US010473286B2

(12) United States Patent
Nishimura et al.

(10) Patent No.: US 10,473,286 B2
(45) Date of Patent: Nov. 12, 2019

(54) VEHICLE LAMP

(71) Applicant: Stanley Electric Co., Ltd., Tokyo (JP)

(72) Inventors: Shota Nishimura, Tokyo (JP); Yoshihiro Fujiyama, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 187 days.

(21) Appl. No.: 15/415,224

(22) Filed: Jan. 25, 2017

(65) Prior Publication Data

US 2017/0130923 A1 May 11, 2017

Related U.S. Application Data

(63) Continuation of application No. PCT/JP2015/068005, filed on Jun. 23, 2015.

(30) Foreign Application Priority Data

Jul. 25, 2014 (JP) ..... 2014-151694
Jul. 25, 2014 (JP) ..... 2014-151695
(Continued)

(51) Int. Cl.
*F21S 41/24* (2018.01)
*F21S 41/27* (2018.01)
(Continued)

(52) U.S. Cl.
CPC ..... *F21S 41/27* (2018.01); *F21S 41/141* (2018.01); *F21S 41/143* (2018.01); *F21S 41/24* (2018.01);
(Continued)

(58) Field of Classification Search
CPC ..... F21S 41/27; F21S 41/26; F21S 41/143; F21S 41/24; F21S 41/43; F21S 41/141;
(Continued)

(56) References Cited

U.S. PATENT DOCUMENTS 8,616,742 B2 12/2013 Sekiguchi
9,611,997 B2 4/2017 Bauer et al.
(Continued)

FOREIGN PATENT DOCUMENTS

CN 103946626 A 7/2014
JP 2004-241349 A 8/2004
(Continued)

OTHER PUBLICATIONS

International Search Report for PCT/JP2015/068005 dated Sep. 15, 2015.
(Continued)

*Primary Examiner* — Y M. Lee
(74) *Attorney, Agent, or Firm* — Kenealy Vaidya LLP

(57) ABSTRACT

The present invention is characterized by a lens body in which a first lens unit configured to form a first light distribution pattern which includes a first cut-off line; and a second lens unit configured to form a second light distribution pattern which includes a second cut-off line, wherein the first lens unit forms the first light distribution pattern when light from a first light source which entered the first lens unit is emitted from the first lens unit, the second lens unit forms the second light distribution pattern when light from a second light source which entered the second lens unit is emitted from the second lens unit, and the first lens unit and the second lens unit are integrally molded.

14 Claims, 113 Drawing Sheets

(30) Foreign Application Priority Data

| | | |
|---|---|---|
| Aug. 1, 2014 | (JP) | 2014-158182 |
| Aug. 1, 2014 | (JP) | 2014-158183 |
| Aug. 22, 2014 | (JP) | 2014-169270 |
| Aug. 25, 2014 | (JP) | 2014-170377 |
| Sep. 9, 2014 | (JP) | 2014-183479 |

(51) Int. Cl.

| | |
|---|---|
| ***F21S 41/32*** | (2018.01) |
| ***F21S 41/43*** | (2018.01) |
| ***F21S 41/141*** | (2018.01) |
| ***F21S 41/265*** | (2018.01) |
| ***F21S 41/663*** | (2018.01) |
| ***F21S 41/143*** | (2018.01) |
| ***F21V 5/04*** | (2006.01) |
| ***F21V 7/00*** | (2006.01) |
| ***F21V 13/04*** | (2006.01) |
| ***F21S 41/26*** | (2018.01) |

(52) U.S. Cl.
CPC ..... *F21S 41/26* (2018.01); *F21S 41/265* (2018.01); *F21S 41/322* (2018.01); *F21S 41/43* (2018.01); *F21S 41/663* (2018.01); *F21V 5/04* (2013.01); *F21V 7/0091* (2013.01); *F21V 13/04* (2013.01)

(58) Field of Classification Search
CPC ..... F21S 41/322; F21S 41/663; F21S 41/265; F21S 43/235; F21S 43/236; F21S 43/241; F21S 43/243; F21S 43/245; F21S 43/249; F21S 43/251; F21V 7/0091; F21V 5/04; F21V 13/04; F21Y 2215/10; F21Y 2115/30
See application file for complete search history.

(56) References Cited

U.S. PATENT DOCUMENTS

| | | | | |
|---|---|---|---|---|
| 2003/0214815 | A1 | 11/2003 | Ishida et al. | |
| 2004/0156209 | A1 | 8/2004 | Ishida | |
| 2005/0018443 | A1 | 1/2005 | Tsukamoto | |
| 2007/0183168 | A1 | 8/2007 | Naganawa et al. | |
| 2008/0151567 | A1 | 6/2008 | Albou | |
| 2012/0140508 | A1 | 6/2012 | Owada | |
| 2016/0265732 | A1* | 9/2016 | Jacquemin | G02B 6/00 |

FOREIGN PATENT DOCUMENTS

| | | | |
|---|---|---|---|
| JP | 2005-44683 | A | 2/2005 |
| JP | 2007-213877 | A | 8/2007 |
| JP | 2010-67417 | A | 3/2010 |
| JP | 2010-108639 | A | 5/2010 |
| JP | 2010-218964 | A | 9/2010 |
| JP | 2013-016327 | A | 1/2013 |
| JP | 2014-107112 | A | 6/2014 |
| WO | 2014/084004 | A1 | 6/2014 |

OTHER PUBLICATIONS

International Preliminary Report on Patentability and English language Written Opinion of the International Search Report for PCT/JP2015/068005 dated Sep. 15, 2015.
The extended European Search Report for the related European Patent Application No. 15823949.1 dated Dec. 15, 2017.
Japanese Office Action (Notice of Reasons for Refusal) for the related Japanese Patent Application No. 2018-129676 dated Jun. 4, 2019.

* cited by examiner

LEFT AND RIGHT 0°
UPPER AND LOWER 0°

LEFT AND RIGHT 0°
UPPER 25°

RIGHT 15°
UPPER 25°

LEFT AND RIGHT 0°
UPPER AND LOWER 0°

LEFT AND RIGHT 0°
UPPER 25°

RIGHT 15°
UPPER 25°

FIG. 63A
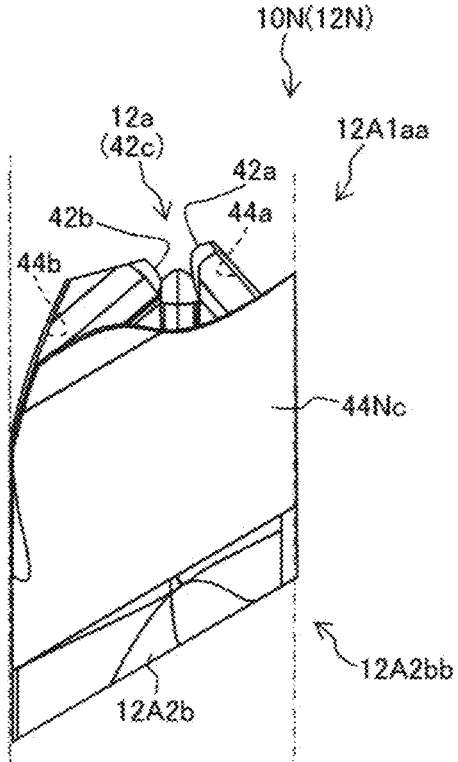
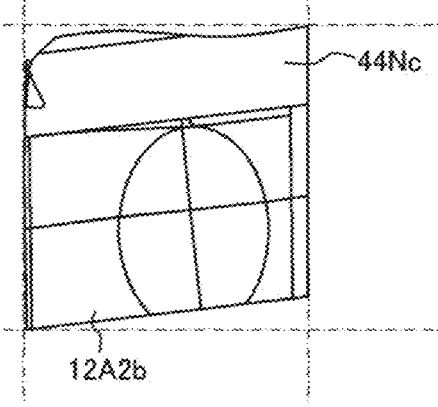
FIG. 63B
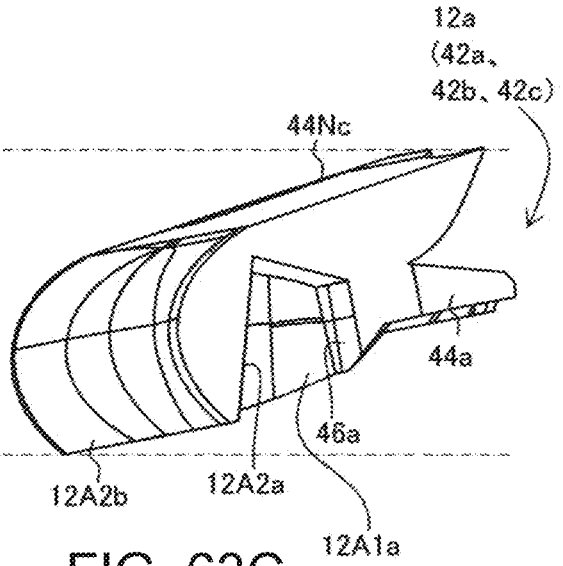
FIG. 63C

FIG. 82A
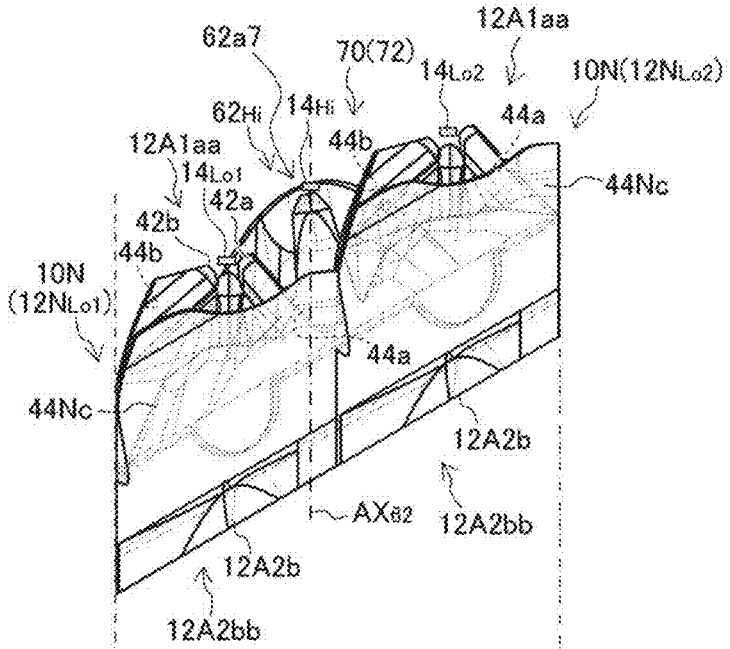
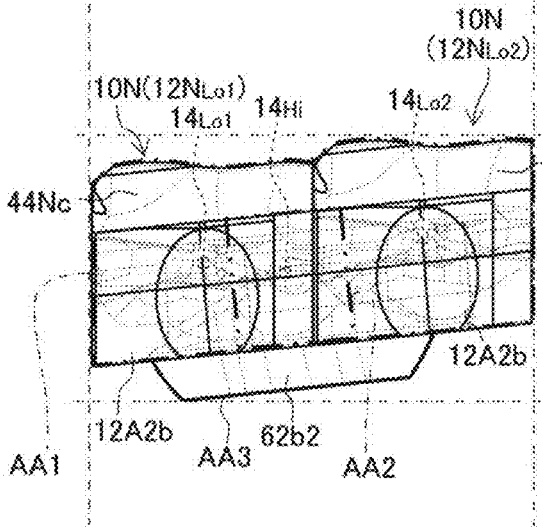
FIG. 82B
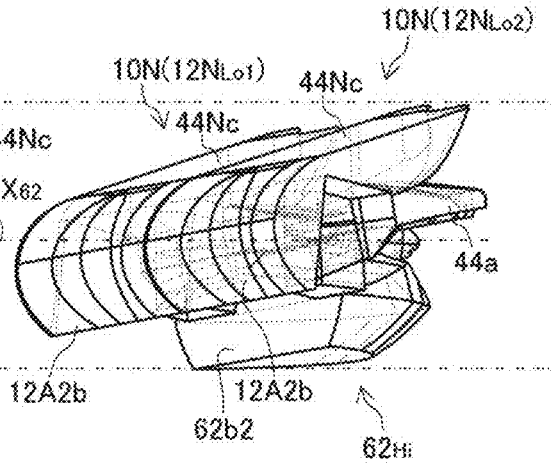
FIG. 82C

FIG. 97A
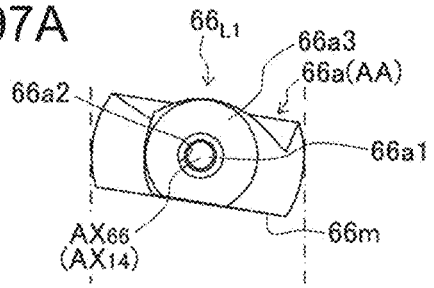
FIG. 97B
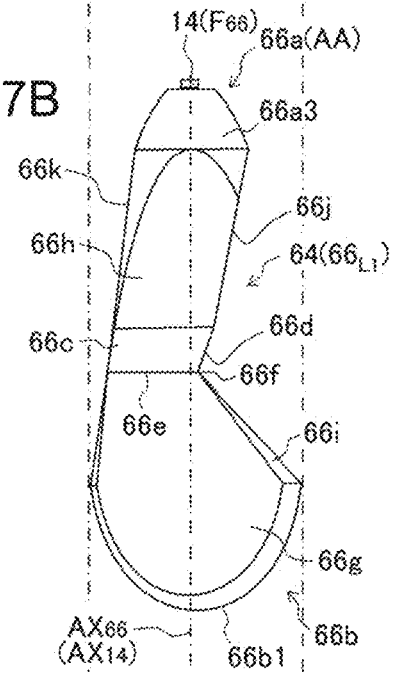
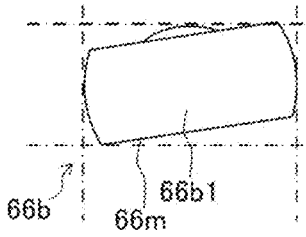
FIG. 97C
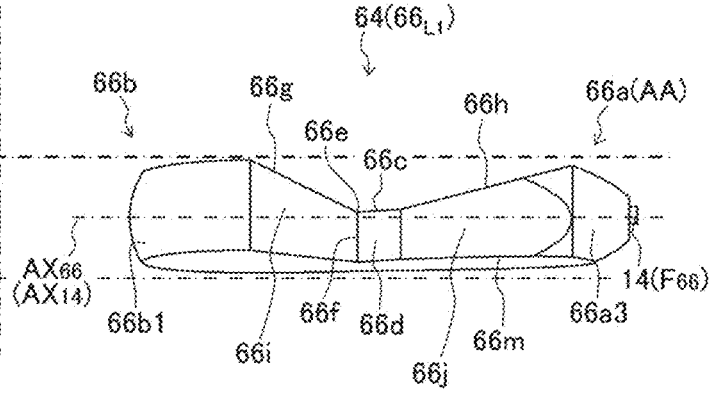
FIG. 97D FIG. 103A
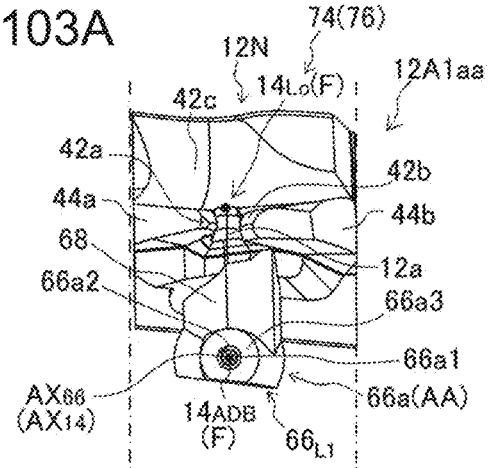
FIG. 103B
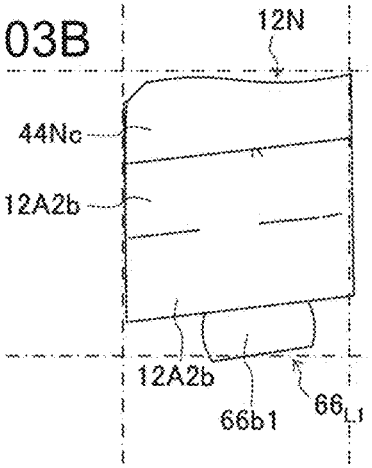
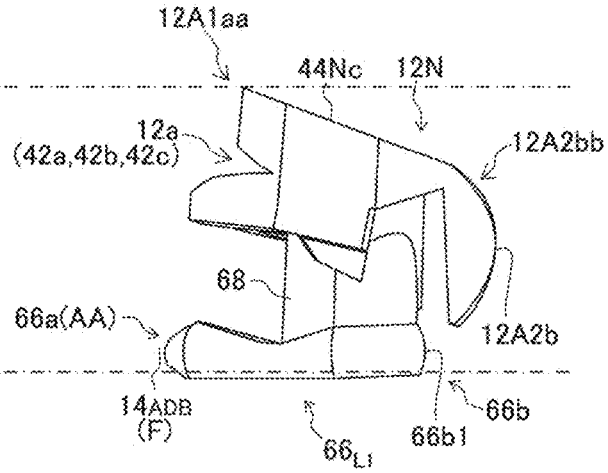
FIG. 103D
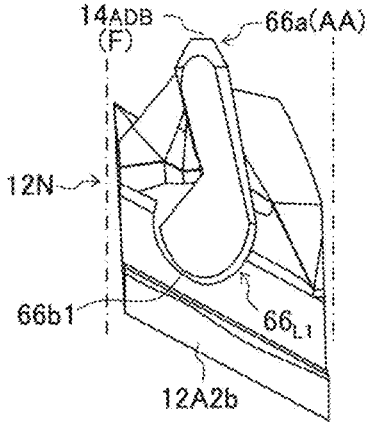
FIG. 103C

VEHICLE LAMP

CROSS-REFERENCE TO RELATED APPLICATIONS

This application is a continuation of International Application No. PCT/JP2015/068005, filed on Jun. 23, 2015, now pending, herein incorporated by reference. Further, this application is based upon and claims the benefit of priority from the prior Japanese Patent Application No. 2014-151694, filed on Jul. 25, 2014, the prior Japanese Patent Application No. 2014-151695, filed on Jul. 25, 2014, the prior Japanese Patent Application No. 2014-158182, filed on Aug. 1, 2014, the prior Japanese Patent Application No. 2014-158183, filed on Aug. 1, 2014, the prior Japanese Patent Application No. 2014-169270, filed on Aug. 22, 2014, the prior Japanese Patent Application No. 2014-170377, filed on Aug. 25, 2014 and the prior Japanese Patent Application No. 2014-183479, filed on Sep. 9, 2014, entire contents of which are incorporated herein by reference.

FIELD

The present invention relates to a vehicle lamp, in particular, it relates to a vehicular lamp having a light source and a lens member placed in front of the light source.

BACKGROUND

Conventionally, vehicle lighting device for configured low beam to form a light distribution pattern for low beam has been proposed (e.g., see Patent Document 1). FIG. 130 A is a longitudinal sectional view of the vehicular lamp 200 for low beam.

Vehicle lamp 200 described in Patent Document 1, in a vehicle lamp which forms a low-beam light distribution pattern including a cutoff line to the upper edge, as shown in FIG. 130 A, the rear side having a convex front surface surface plane of the projection lens 210 (plano-convex lens), the light blocking member 220 disposed on the rear side focal position of the projection lens 210, including the light source 230 disposed behind the vicinity of the light shielding member 220 (light emitting diode) or the like is configured as a vehicle lamp of a direct projection type (also direct type referred to).

Conventionally, a vehicle lamp for high beam, which is configured to form a light distribution pattern for high beam has been proposed (e.g., see Patent Document 2). FIG. 130 B is a longitudinal sectional view of a vehicular lamp 300 for this high beam.

The vehicular lamp 300 described in Patent Document 2, in the vehicle lamp which forms a high-beam light distribution pattern, as shown in FIG. 130 B, a convex front surface and the rear surface of the planar projection lens 310 (plano-convex lens), is configured as a vehicle lamp of a light source 320 disposed near the rear focal point of the projection lens 310 (light emitting diode) or the like direct projection type having the (also direct type referred).

Conventionally, a lamp unit for a low beam with a constructed lens body so as to form a light distribution pattern for low beam has been proposed (e.g., see Patent Document 3). Longitudinal sectional view of FIG. 132 A is a lamp unit 200 for the low beam (lens body 220), FIG. 132 B is formed by light irradiated forward from the lamp unit 200 for the low beam (lens body 220) it is an example of a light distribution pattern for low beam PLo being.

Further, conventionally, it comprises a lens body, the upper portion of the light distribution pattern for low beam, is configured lamp unit for ADB to form a plurality of light distribution patterns for ADB arranged horizontally has been proposed (For example, see Patent Document 4). FIG. 132 C is a schematic structural view of a lamp unit 300 for ADB provided with the lens body 310, the light irradiated forward from FIG. 132 (d-) is a lamp unit 300 for the ADB (lens body 310) it is a plurality of examples of light distribution patterns PA1~PA8 for the ADB to be formed.

According to the lamp unit 200 (the lens body 220) and lamp unit 300 for the ADB for the low beam (lens body 310), in the light distribution pattern PLo and its upper part for the low beam, light distribution for multiple ADB which are arranged in a horizontal direction it is possible to form a pattern PA1~PA8.

Conventionally, a vehicular lamp having a structure in which combination of a light source and a lens member has been proposed (e.g., see Patent Document 3).

FIG. 128 is a longitudinal sectional view of the vehicular lamp 200 described in Patent Document 3, FIG. 129 is a top view showing a state of arranging a plurality of the vehicle lamp 200 (s lens body 220) in a row.

As shown in FIG. 128, the vehicle lamp 200 described in Patent Document 1 includes a light source 210 having a semiconductor light emitting element includes a lens body 220, the lens body 220 surface, the posture in which the light emitting surface facing upward incident surface 221 of the hemispherical covering the light source 210 from above, the first reflecting surface 222 which is disposed in the traveling direction of the light from the light source 210 which is incident from the incident surface 221 to the inner lens member 220 (the reflecting surfaces by the metal vapor deposition), the the second reflecting surface 223 from the lower end edge of the first reflecting surface 222 extending toward the front (reflection surface by metal vapor deposition), etc. convex lens surface 224 is formed.

Further, as shown in FIG. 128, the vehicle lamp 200 described in Patent Document 3, a light source 210 having a semiconductor light emitting element includes a lens body 220, the lens body 220 surface was a light-emitting side up the first reflective surface 222 which is disposed a light source 210 of the posture incident surface 221 of the hemispherical covering from above, in the traveling direction of the light from the light source 210 which is incident from the incident surface 221 to the inner lens member 220 (the reflecting surface by metal deposition), (reflecting surface by metal vapor deposition) second reflecting surface 223 extending forward from the lower edge of the first reflecting surface 222, such as a convex lens surface 224 is formed.

Further, as shown in FIG. 130. B, the vehicle lighting device 300 disclosed in Patent Document 2, a projection lens 310 (plano-convex lens) of the plane rear surface having a convex front surface, the rear of the projection lens 310 It is configured as a vehicle lamp of a light source 320 disposed at the back focal position direct projection type having a (light emitting diode) or the like (also direct type referred).

FIG. 131 is a side view of the vehicular lamp 200 described in Patent Document 1.

Vehicle lamp 200 described in Patent Document 1, in a vehicle lamp which forms a low-beam light distribution pattern including a cutoff line to the upper edge, as shown in FIG. 131, the rear surface having a convex front surface and a plane of the projection lens 210 (plano-convex lens), the light blocking member 220 disposed on the rear side focal position of the projection lens 210, a vehicle lamp having a light source 230 disposed behind the vicinity of the light shielding member 220 (light emitting diode) or the like It is configured as a.

A low beam lighting fixture unit using a lens body configured to form a low beam light distribution pattern has been proposed (e.g. Patent Literature 3). FIG. 132A is a longitudinal cross-sectional view depicting this low beam lighting fixture unit 200 (lens body 220), and FIG. 132B illustrates a low beam light distribution pattern $P_{Lo}$, which is formed by the light irradiated forward from the low beam lighting fixture unit 200 (lens body 220).

Further, an ADB lighting fixture unit configured to form a plurality of ADB light distribution patterns, which are disposed in the horizontal direction so that the respective lower end portions are superimposed on the upper end portion of the low beam light distribution pattern, has been proposed (e.g. see Patent Literature 4). FIG. 132C is a schematic block diagram of the ADB lighting fixture unit 300 including a lens body 310, and FIG. 132D is an example of the plurality of ADB light distribution patterns PA1 to PA8, which are formed by light irradiated forward from the ADB lighting fixture unit 300 (lens body 310).

According to the low beam lighting fixture unit 200 (lens body 220) and the ADB lighting fixture unit 300 (lens body 310), the lighting fixture units 200 and 300 (lens bodies 220 and 310) are disposed in parallel when viewed from the front, thereby the low beam light distribution pattern $P_{Lo}$ and the plurality of ADB light distribution patterns PA1 to PA8, the respective lower end portions of which are disposed in the horizontal direction in the state of being superimposed on the upper end portion of the low beam light distribution pattern $P_{Lo}$, can be formed.

CITATION LIST

Patent Literature

Patent document 1: Japanese Laid-open Patent Publication No. 2005-44683

Patent document 2: Japanese Laid-open Patent Publication No. 2007-213877

Patent document 3: Japanese Laid-open Patent Publication No. 2004-241349

Patent document 4: Japanese Laid-open Patent Publication No. 2010-67417

Respect Patent Documents 1 and 2 (FIG. 130), by using the vehicle lamp 200 and 300 of the above construction, although it is possible to form a light distribution pattern or a high beam light distribution pattern for low beam, the vehicle lamp 200, 300 (lens 210, 310) are, for example, because it is used in parallel arranged as shown in FIG. 130. C, a lens 210, 310 (and thus the vehicle lamp 200, 300) a problem that further miniaturization of hard there is. FIG. 130. C are diagrams showing a state in which juxtaposed the vehicle lamp 200 and 300 (the lens 210, 310) (top view). In addition, the vehicle lamp 200 and 300 (the lens 210, 310) for example, and arranged in parallel as shown in FIG. 130 C, becomes the appearance that point is continuous, the appearance with a sense of unity that extends in a line in a predetermined direction it is not possible to configure the vehicle lamp (design flexibility poor).

The present invention has been made in view of such circumstances, the first and second lens portion and the lens member third lens unit are integrally formed of the high beam and the vehicle lighting device having the same for low beam It is to realize the miniaturization of the first purpose. In the first and second lens portion and the lens member third lens unit are integrally formed of the high beam and the vehicle lighting device having the same for low beam, the appearance with a sense of unity, which extends linearly in a predetermined direction that to achieve the second object of the present invention.

In the case of Patent Literature 3 and 4 (FIG. 132), a problem occurs when a plurality of ADB light distribution patterns PA1 to PA8, disposed in the horizontal direction, are formed on and above the low beam light distribution pattern $P_{Lo}$. In other words, the low beam lighting fixture unit 200 (lens body 220) and the ADB lighting fixture unit 300 (lens body 310) are configured as physically separate and independent lighting fixture units (lens bodies), and the relative positional relationship between the low beam light distribution pattern $P_{Lo}$ and the plurality of ADB light distribution patterns PA1 to PA8 shifts as time elapses due to the influence of vibration or the like while the vehicle is moving, therefore there is a need to dispose an aiming adjustment mechanism to appropriately correct the relative positional relationship between the low beam light distribution pattern $P_{Lo}$ and the plurality of ADB light distribution patterns PA1 to PA8.

With the foregoing in view, it is a third object of this invention to provide: a lens body, which has a first lens unit configured to form a first light distribution pattern including a first cut-off line (e.g. low beam light distribution pattern), and a second lens unit configured to form a second light distribution pattern including a second cut-off line (e.g. ADB light distribution pattern), and in which the relative positional relationship between the first light distribution pattern (first cut-off line) and the second light distribution pattern (second cut-off line) does not shift as time elapses (as a result, an aiming adjustment mechanism and correction using this aiming adjustment mechanism are not needed); and a vehicular lighting fixture equipped with this lens body.

In the case of Patent Literature 3 (FIG. 128 and FIG. 129), in the vehicular lighting fixture 200 having the above mentioned configuration, a convex lens surface 224, which is the final emission surface of the lens body 220, is configured as a hemispherical lens surface, hence even if a plurality of vehicular lighting fixtures 200 (a plurality of lens bodies 220) are disposed in a line as illustrated in FIG. 129, the fixtures appear as if dots lined up, and the lens bodies having an integrated appearance which linearly extends in a predetermined direction, and a vehicular lighting fixture equipped with the lens bodies are not able to be constructed (design flexibility is poor).

With the foregoing in view, it is a fourth object of this invention to provide lens bodies having an integrated appearance which linearly extends in a predetermined direction, and a vehicular lighting fixture equipped with the lens bodies.

In the case of Patent Literature 3 (FIG. 128 and FIG. 129), in the vehicular lighting fixture 200 having the above mentioned configuration, a convex lens surface 224, which is the final emission surface of the lens body 220, is configured as a hemispherical lens surface, hence even if a plurality of vehicular lighting fixtures 200 (a plurality of lens bodies 220) are disposed in a line as illustrated in FIG. 129, the fixtures appear as if dots lined up, and the vehicular lighting fixtures having an integrated appearance which linearly extends in a predetermined direction are not able to be constructed. Another problem of the vehicular lighting fixture 200 having the above mentioned configuration is that one lens body 200 is able to form only one light distribution pattern.

With the foregoing in view, it is a fifth object of this invention to provide a lens body that is able to implement an integrated appearance which linearly extends in a predetermined direction, and that is able to form a plurality of light distribution patterns as a single lens body, and a vehicular lighting fixture equipped with the lens body.

Further, with respect to Patent Document 2 (FIG. 130), in the vehicle lamp 300 having the above configuration, can not be only one light distribution pattern for high beam in one lens body 310 formed, for example, the light converging pattern and the diffusion pattern is superimposed the case of forming a light distribution pattern for high beam, to be prepared for converging light pattern vehicle lamp configured for 300 (lens body 310) and the diffusion pattern vehicle lamp configured for 300 (lens body 310) there is a problem that does not.

The present invention has been made in view of such circumstances, for a vehicle having a lens body and it is possible to form one in the light converging pattern and a light distribution pattern for high beam spread pattern is superimposed to provide a lamp to a sixth object of.

Further, with respect to Patent Document 1 (FIG. 131), in the vehicle lamp 200 having the above structure, part of the light (see RayOUT in example FIG. 131) of the light from the light source 230 does not enter the projection lens 210, a low beam because use is not used in formation of the light distribution pattern, light utilization efficiency is lowered.

The present invention has been made in view of these circumstances, with a light source and a lens member disposed in front of the light source, the light distribution pattern including a cutoff line on an upper edge (e.g., low-beam light distribution pattern) in the fabricated vehicle lamp so as to form a light utilization efficiency is a seventh object of that suppressed.

As for Patent Document 3 and 4 (FIG. 132), according to the lamp unit 300 for lighting unit 200 and ADB for low beam having the above structure, a light distribution pattern for light and ADB to form a light distribution pattern for low beam is formed because light will be emitted from separate lamp units 200 and 300 which are arranged in parallel in a front view (lens body 220,310), the installation space of the lamp unit 200, 300 is increased, the vehicle lamp is large to there is a problem that the reduction.

The present invention has been made in view of such circumstances, the first light distribution pattern (e.g., a light distribution pattern for low beam) and its lower end is arranged in a form overlapping the upper end portion of the first light distribution pattern the second light distribution pattern (e.g., light distribution pattern or a light distribution pattern for high beam ADB) that the downsizing of the configured vehicle lamp so as to form an eighth object of.

SUMMARY

To achieve the above first object, the first embodiment, the low beam is disposed a first lens unit for a low-beam disposed in front of the first light source for low beam, in front of the second light source for low beam a second lens unit of use, and, in the third lens unit is a lens body that is integrally formed for a high-beam disposed in front of the third light source for a high beam, the first lens unit, a rear end and a front end portion wherein the said light from said first light source first lens unit enters therein, by being irradiated forward emitted from the front end of the first lens unit, a low beam including a cutoff line on an upper edge is configured as a lens portion that forms a light distribution pattern, the second lens unit includes a rear end and a forward end, said light from said second light source the second lens unit enters therein, said first by being irradiated forward emitted from the front end of the second lens unit is constructed as a lens portion that forms a light distribution pattern for low beam, including a cut-off line on an upper edge, a rear end portion of the first lens unit comprises a first cone portion narrowed cone shape toward the front end side of the rear end portion from the front end side of the first lens portion, the rear end portion of the second lens unit, the second lens unit direction and a second cone portion which narrows pyramidal shaped, the first lens unit and said second lens unit, which is inclined relative to the horizontal direction or the horizontal toward the front end portion side to the distal side of the rear end portion arranged in parallel, and wherein the first conical portion is connected to each other in a state where a space is formed between the second conical portion, said third lens unit, at least a part thereof in a state of being positioned in the space between the second conical portion and the first conical section is coupled to the rear end portion of the rear end portion and the second lens portion of the first lens unit, a rear end portion of the third lens unit, the front end portion of the front end portion of the first lens unit and said second lens unit, the second from the rear end portion of the third lens unit has entered the interior of the third lens unit light from 3 light sources, in that the front end portion of the first lens unit and emitted from the front end of said second lens unit, and an optical system which forms a high beam light distribution pattern is illuminated toward the forward direction and features.

According to a first embodiment, may be the third lens unit for the first and second lens portion and the high beam of the low beam is to reduce the size of the integral molded lens body. This is the first, the third lens unit is at least partially in a state of being arranged in the space between the second conical portion of the first cone portion and the second lens portion of the first lens unit is connected to the rear end portion of the rear end portion and the second lens of the first lens unit (not the parallel arrangement, be connected are in the form of a series arrangement) that, in the second, third for low beam 1 and the front end portion of the second lens unit (exit surface), as well as the front end portion of the third lens unit for high beam (exit surface) is formed as a separate front end which is physically separated (exit surface) rather, that the first and the front end portion of the second lens portion of the low-beam is part of the (emission surface) constitutes a front end portion of the third lens unit for high beam (the exit surface) (i.e., the low-beam some of the exit surface is due to) which is also the exit surface for high beam.

The second embodiment, in the first embodiment, the rear end portion of the third lens unit, the incident surface of the diffusion patterns, and enters the interior of the third lens unit from the incident surface for the diffusion pattern was includes a reflection surface of the diffusion pattern of internal reflection light from the third light source, the incident surface for the diffusion pattern, the reflecting surface for the diffusion pattern, the front end portion and the second lens of the first lens unit the front end parts are light from the third light source incident on the interior of the third lens unit from the incident surface for the diffusion pattern, from the front end of the front end portion and the second lens portion of the first lens unit the emitted, characterized in that it constitutes a first optical system for forming a diffusion pattern for high beam is emitted forward.

According to a second embodiment, it is possible to form the diffusion pattern for high beam.

The third embodiment, in the second embodiment, the incident surface for the diffusion pattern has a first incident surface, and extends rearward from the outer peripheral edge of said first entrance surface, the third light source and comprises a second entrance surface cylindrical surrounding the space between the first entrance surface, reflecting surfaces for diffused pattern is disposed outside of said second entrance surface, said from said second entrance surface wherein the light from the third light source incident on the internal third lens unit is a reflective surface for internal reflection.

According to a third embodiment, the light from the third light source which is incident from the first incident surface inside the third lens unit, and the reflection of the diffusion pattern is incident from the second incident surface inside the third lens unit the light from the third light source which is internally reflected at the surface, it is possible to form a diffusion pattern for high beam.

A fourth embodiment, in the second embodiment or the third embodiment, the rear end portion of the third lens unit, the entrance surface of the converging light pattern, and, from the incident surface for the light converging pattern comprising a reflective surface for converging light pattern to the inner surface reflecting light from said third light source third lens unit enters the interior, the front end portion of the third lens unit includes an emission surface for converging light pattern, incident surface for the light converging pattern, reflecting surface for the light converging pattern, and the exit surface for the light converging pattern, the incident inside the third lens unit from the incident surface for the light converging pattern light from the third light source is internally reflected by the reflecting surface for light collecting pattern is emitted from the exit surface for the light converging pattern, a second optical forming the light converging pattern for high beam is emitted forward constitute a system, the distance between the reflecting surface for the light converging pattern and the third light source, compared to the distance between the third light source and the reflecting surface for the diffusion pattern, is set to be longer and wherein the are.

According to the fourth embodiment, it is possible to provide a lens which is capable of forming one in the light converging pattern and high beam light distribution pattern spreading pattern is superimposed.

This is one of the lens body is by that it comprises a second optical system for forming a first optical system and the light converging pattern to form a diffusion pattern.

Further, according to the fourth embodiment, as a result of the luminous intensity of the light converging pattern is higher than the diffusion patterns, the light converging pattern and high beam light distribution pattern spreading pattern is formed by being superimposed (synthesized light distribution pattern) the high center luminosity can be made excellent in long-distance visibility.

The luminous intensity of the light converging pattern is higher than the diffusion pattern, the distance between the light source and the reflecting surface for light converging pattern, as compared the light source and the distance between the reflective surface of the diffusion pattern, is set longer because you are, in the second optical system for forming a converging light pattern, compared to the first optical system for forming a diffusion pattern, the light source image of the light source becomes relatively small, light collection in this relatively small light source image it is due to the fact that the pattern is formed.

The fifth embodiment, in the fourth embodiment, the incident surface for the diffusion pattern has a first incident surface, and extends rearward from the outer peripheral edge of said first entrance surface, the third light source and among the space between the first entrance surface includes a second entrance surface cylindrical surrounding the range other than the cutout portion through which light passes from the third light source, the reflecting surface for the diffusion pattern the second is located outside of the entrance surface, a reflecting surface for internal reflection of light from the said incident inside the third lens unit from the second entrance surface third light source, the incident for the light converging pattern plane is a plane of incidence of light from said third light source which has passed through the notch is incident, reflecting surface for the light converging pattern is disposed outside of the entrance surface for light collecting pattern, wherein It characterized in that the incident surface of the converging light pattern is a reflective surface for internal reflection light from the third light source which enters the interior of the lens body.

According to the fifth embodiment, it is possible to achieve the same effect as the fourth embodiment.

In order to achieve the second object, an embodiment of the sixth, in the fifth embodiment, the front end portion of the front end portion of the first lens unit and said second lens unit, the cylindrical axis extending in a horizontal direction emitting surface of the semi-cylindrical, or comprises a slant angle and/or exit surface of semicylindrical the camber angle is applied, the first entrance surface, the interior of the third lens unit from the first incident surface light from the incident third light source relates to the vertical direction, is focused on the focal line near the exit surface of the semi-cylindrical, and relates to a horizontal direction, so as to diffuse, the surface shape is constituted the reflecting surface for the diffusion pattern, the light from the second and the third light source is internally reflected by the reflecting surface for the diffusion pattern incident on the interior of the third lens unit from the incident surface, relates vertical direction, condensed at the focal line near the exit surface of the semi-cylindrical, and relates to a horizontal direction, so as to diffuse, characterized in that the surface shape is formed.

According to the sixth embodiment, in the first and second lens unit and the third lens unit is a lens body that is integrally formed for high beam low beam, realized appearance with a sense of unity, which extends linearly in a predetermined direction can do. Semicircle which, the front end portion of the front end portion and the second lens portion of the first lens unit, the exit surface of the semicircular columnar cylinder axis extends in the horizontal direction, or, the slant angle and/or camber angle is applied it is due to contain columnar exit surface.

Further, according to the sixth embodiment, it is possible to the front end of the front end portion of the first lens unit and the second lens portion provides a lens body of a novel appearance, including the semi-cylindrical surface (cylindrical surface).

Embodiments of the seventh, the fifth embodiment, the front end portion and the front end portion of the second lens portion of the first lens unit includes a emitting surface of the planar shape, the first entrance surface, the first light from the third light source from one entrance surface enters the interior of the third lens unit is emitted from the exit surface of the planar shape relates to the vertical direction is collimated, and relates to a horizontal direction, so as to diffuse, the surface and shape is configured, the reflecting surface for the diffusion pattern, the second incident surface incident on the interior of the third lens unit is internally reflected by the reflecting surface for the diffusion pattern, the planar shape light from the third light source emitting from the exit surface relates to the vertical direction is collimated, and relates to a horizontal direction, so as to diffuse, characterized in that the surface shape is formed.

According to the seventh embodiment, in the first and second lens unit and the third lens unit is a lens body that is integrally formed for high beam low beam, realized appearance with a sense of unity, which extends linearly in a predetermined direction can do. This front end portion of the front end portion of the first lens unit and the second lens unit is by that it contains the exit surface of the planar shape.

Further, according to the seventh embodiment, it is possible to the front end of the front end portion of the first lens unit and the second lens portion provides a lens body of a novel appearance, including the face of the planar shape.

Eighth embodiment, in any one of the seventh embodiment from the fourth embodiment, the exit surface for the light converging pattern is configured as a surface of a planar shape, reflection for the light converging pattern the surface is internally reflected incident inside the third lens element from the incident surface for the light converging pattern by the reflecting surface for the light collecting pattern, the third light source emitting from the emission surface for the light converging pattern light from the relates vertical and horizontal directions, as is collimated, characterized in that the surface shape is formed.

According to the eighth embodiment, it is possible to output surface for converging light pattern to provide a lens having a novel appearance which is a surface of a planar shape.

Embodiment of the ninth, in any one of the eighth embodiment from the fourth embodiment, the incident surface for the light converging pattern is configured as a surface of a spherical shape centered on said third light source it features a.

According to the ninth embodiment, it is possible to light from the third light source to suppress the Fresnel reflection loss at the time of entering the interior third lens unit from the incident surface for the light converging pattern.

The present invention may also be specified as follows: (a tenth embodiment of).

And one of the lens of the ninth embodiment from the first embodiment, and the first light source, and the second light source, the vehicle lighting device provided with a third light source.

To achieve the third object, an embodiment of the eleventh form a second light distribution pattern including a first lens unit and the second cutoff line forming the first light distribution pattern including a first cutoff line in the lens body having a second lens portion, the first lens unit is a lens unit which is disposed in front of the first light source includes a rear end and a front end portion, enters inside the first lens unit light from the first light sources is, by being irradiated forward emitted from the front end of the first lens unit, is configured as a lens portion that forms a first light distribution pattern including a first cutoff line cage, wherein the second lens unit is a lens unit which is disposed in front of the second light source includes a rear end and a front end portion, the light from the second light source incident on inside the second lens unit, by being irradiated forward emitted from the front end of the second lens unit is constructed as a lens unit for forming a second light distribution pattern including a second cutoff line, said first lens portion and said the second lens unit, so that the positional relationship relative positional relationship is predetermined between the first light distribution pattern and the second light distribution pattern, characterized in that it is integrally molded.

According to an eleventh embodiment of the first light distribution pattern including a first cutoff line (e.g., a light distribution pattern for low beam) the second light distribution pattern including a first lens unit and the second cutoff line form (e.g., relative between the lens body having a second lens portion which forms a light distribution pattern) ADB, and the first light distribution pattern (first cut-off line) second light distribution pattern (second cutoff line) Do positional relationship can provide lens body never deviate over time. As a result, aiming adjustment mechanism, and, according to the aiming adjustment mechanism, the correction of relative positional relationship between the first light distribution pattern (first cutoff line) and the second light distribution pattern (second cutoff line) It becomes unnecessary.

This is so that the positional relationship relative positional relationship is predetermined between the first light distribution pattern (first cutoff line) and the second light distribution pattern (second cutoff line), a first lens parts and second lens portions is by being integrally molded.

Twelfth embodiment is characterized in that in the eleventh embodiment of the first light distribution pattern is a light distribution pattern for low beam including the first cutoff line on an upper end edge, the second light distribution pattern, the first characterized in that it is a light distribution pattern for ADB containing 2 cut-off line.

According to the twelfth embodiment, a lens having a second lens portion which forms a light distribution pattern for ADB comprising a first lens portion and the second cutoff line forming a light distribution pattern for low beam including a first cutoff line in the body, to provide a relative positional relationship never deviate over time lens body between the light distribution pattern for low beam (the first cutoff line) and ADB light distribution pattern (second cutoff line) it can.

This light distribution pattern for low beam so that the positional relationship relative positional relationship is predetermined between the (first cutoff line) and ADB light distribution pattern (second cutoff line), a first lens parts and second lens portions is by being integrally molded.

Embodiment of the first 13, the twelfth embodiment of the second lens unit is provided with an upper reflective surface and the longitudinal reflecting surface disposed between the rear end and the front end portion, said second lens the rear end parts includes an incident portion which light from said second light source is incident on the interior of the second lens portion, the distal end portion of the tip and the longitudinal reflecting surface of the upper reflective surface, respectively, the shade wherein said entrance portion, the upper reflection surface, a front end portion of the longitudinal reflecting surface and said second lens unit, the upper of the light from the second light source incident on the interior of the second lens portion from the entrance part shade and light internally reflected by the partial blocking light and the upper reflective surface and the longitudinal reflecting surface by the shade of the longitudinal reflecting surface of reflecting surface, the forward emitted from the front end of the second lens unit by being irradiated, the optical system for forming a light distribution pattern for the ADB including the second cutoff line defined by the lower edge and the upper shade reflecting surface and the shade of the longitudinal reflecting surface on one side edge characterized in that it constitutes.

According to a thirteenth embodiment of the, by the action of the upper reflective surface and the longitudinal reflecting surface, it is possible to achieve the following effects.

The first, to form a light distribution pattern for the ADB, including the second cut-off line (below the cut-off line and the vertical cut-off line), which is defined by the shade of the shade and the longitudinal reflecting surface of the upper reflective surface to the lower edge and one side edge be able to.

Second, it is possible to make the vertical cutoff line as clear formed below the cutoff line and one side edge is formed on the lower edge of the light distribution pattern for ADB.

Thirdly, unnecessary extent as a light distribution pattern for ADB, i.e., it is possible to prevent the light from the second light source is a light distribution below the lower cut-off line. Similarly, it is possible to light from the second light source can be inhibited from being light distribution from the vertical cutoff line on the vertical line side. As a result, the vehicle front of the irradiation-prohibited object (e.g., preceding vehicle or oncoming vehicle) can effectively suppress the generation of glare for.

Fourth, due to influence of assembly error, as the relative positional relationship of the second lens unit with respect to the second light source is deviating from the design value, the lower cutoff line and the vertical cutoff line of a light distribution pattern for ADB that deviated it can be suppressed.

Embodiment of the first 14, in any one of the thirteenth embodiment from the eleventh embodiment, the first lens unit is provided with a lower reflective surface disposed between the rear end and a front end portion the rear end portion of the first lens unit includes an incident surface, the distal end portion of the lower reflection surface includes a shade, the incident surface, a front end portion of the lower reflective surface and said first lens portion, said light is internally reflected by the partial blocking light and the lower reflection surface by the shade of the lower reflection surface of the light from the first light source incident on the inside of the first lens unit from the incident surface, said first by being irradiated forward emitted from the front end of the lens unit, an optical system for forming the first light distribution pattern including the first cutoff line which is defined by the shade of the lower reflecting surface the upper edge characterized in that it.

According to the fourteenth embodiment, the first light distribution pattern (e.g., a light distribution pattern for low beam) including the first cutoff line which is defined by the shade of the lower reflecting surface the upper edge to form a and a light distribution pattern for ADB be able to.

Fifteenth embodiment of the, in any one of the thirteenth embodiment from the eleventh embodiment, the first lens unit is provided with a lower reflective surface disposed between the rear end and a front end portion the rear end portion of the first lens unit includes an incident surface, the distal end portion of the lower reflection surface includes a shade, the front end portion of the first lens unit, the intermediate exit face, the front of the intermediate exit face includes a final exit plane disposed in front of the arrangement intermediate the entrance surface and the intermediate incidence surface, said intermediate exit face, the face of the first semicircular columnar cylinder axis extending in the vertical direction or substantially vertical direction wherein the said final exit surface, the second semi-cylindrical surface which cylindrical axis is extending in a horizontal direction, or is configured as a second semicylindrical surface slant angle and/or camber angle is applied and the incident surface, the lower reflecting surface, said first semi-cylindrical surface, said intermediate incident surface and the final exit surface, said first light source incident on the inside of the first lens unit from the incident surface light is internally reflected by the partial blocking light and the lower reflection surface by the shade of the lower reflection surface of the light from is emitted to the first lens unit outside from the first semi-cylindrical surface further, said incident from the intermediate incident surface inside the first lens portion is emitted from said final exit surface, by being irradiated forward, the first defined by the shade of the lower reflecting surface the upper edge characterized in that it constitutes an optical system for forming the first light distribution pattern including a cutoff line.

According to a fifteenth embodiment, it is possible to provide a lens body which can realize appearance with a sense of unity, which extends linearly in a predetermined direction. This is due to the final exit surface of the first lens unit is constructed as a semi-cylindrical surface (refracting surface of the semi-cylindrical).

Embodiment of the first 16, in any one of the thirteenth embodiment from the eleventh embodiment, the first lens unit includes a first lower reflecting surface disposed between the rear end and a front end portion and, a rear end portion of the first lens unit includes a first entrance surface, the distal end portion of the first lower reflection surface includes a shade, the front end portion of the first lens unit, the intermediate exit face, wherein the intermediate medium entrance face disposed in front of the exit surface and the intermediate incident surface final exit plane disposed in front of the intermediate exit face, the cylinder axis extending in the vertical direction or substantially vertical direction 1 semicylindrical surface of and includes the pair of left and right intermediate exit surface which is disposed on the left and right sides of the first semi-cylindrical surface, the final exit surface, the second the cylinder axis extending in the horizontal direction semicylindrical surface of, or is constructed as a second surface of the semicylindrical the slant angle and/or camber angle is applied, the first incident surface, wherein the first lower reflection surface, said first semicylindrical surface of said intermediate incident surface and the final exit surface, the shade of the first lower reflection surface of the light from the first light source first enters from the incident surface inside the first lens unit partial blocking light and the first light is internally reflected by the lower reflecting surface, and emitted to the first lens unit outside from the first semicylindrical surface by, further wherein from said intermediate incident surface enters the inside the first lens portion is emitted from said final exit surface, by being irradiated forward, the first part including the first cutoff line which is defined by the first shade of the lower reflecting surface the upper edge constitute a first optical system for forming a partitioned light pattern, further, the first lens unit is provided with a disposed pair of left and right sides between the rear end and the front end portion, said first the rear end of the lens portion, the right and left sides of the first incident surface, wherein the disposed pair of the entrance surface so as to surround the space from the left and right sides between the first light source and the first incident surface, between the front end portion of the rear end portion and the first lens portion of the first lens unit, and includes a second lower reflecting surface arranged in pair on the left and right sides of the first lower reflection surface, the tip portions of the left and right pair of second lower reflecting surface includes a shade, the pair of left and right entrance surface, said pair of right and left side surface, the second lower reflecting surface of the pair, the pair of left and right intermediate exit face, It said intermediate entrance surface and the final exit surface, said pair of the light from the pair of the first light source is internally reflected by the pair of right and left side enters the inside of the first lens unit from the incident surface the second light that is internally reflected by the partial blocking light and said left-right pair of second lower reflecting surface by the shade of the lower reflecting surface, and emitted to the first lens unit outside from the pair of left and right middle exit surface of, further defined, said incident from the intermediate incident surface inside the first lens portion is emitted from said final exit surface, by being irradiated forward, by the pair of right and left second shade lower reflecting surface the upper edge characterized in that it constitutes a second optical system pair to form a second partial light distribution pattern including the first cutoff line to be.

According to a sixteenth embodiment, it is possible to provide a lens body which can realize appearance with a sense of unity, which extends linearly in a predetermined direction. This is due to the final exit surface of the first lens unit is constructed as a semi-cylindrical surface (refracting surface of the semi-cylindrical).

In addition, according to a sixteenth embodiment, the upper end edges are being left and right pair of first partial light distribution pattern and the upper edge includes a first cutoff line of the second lower reflecting surface defined by the shade of the first lower reflection surface it is possible to form the second partial light distribution pattern is a light distribution pattern for low beam superimposed including a first cutoff line which is defined by the shade.

Embodiment of the first 17, in the sixteenth embodiment, the rear end portion of the first lens unit, the upper side of the first entrance surface, the space between the first light source wherein the first incident surface characterized in that it comprises an upper incident surface which is disposed so as to surround the upper side.

According to an embodiment of the seventeenth, it is possible to provide a light use efficiency higher vehicle lamp in which light is directly incident from the upper incident surface inside the first lens portion of the light source extending upward.

The present invention may also be specified as follows (18th embodiment) of.

Vehicle lamp that includes a second light source and the first light source and a lens body according to any one of the seventeenth embodiment from the eleventh embodiment.

Embodiment of the first 19, the eleventh embodiment of the first light distribution pattern is a light distribution pattern for a first low beam including the first cutoff line on an upper end edge, the second light distribution pattern, characterized in that it is a second light distribution pattern for low beam comprising said second cutoff line on an upper edge.

According to a nineteenth embodiment, the second lens portion forming the first lens unit and the light distribution pattern for a second low beam including a second cutoff line forming a light distribution pattern for a first low beam including a first cutoff line in the lens body provided with a, that the relative positional relationship between the light distribution pattern for a first low beam (the first cutoff line) and a second low-beam distribution pattern (second cutoff line) is over time shifts it is possible to provide a no lens body.

This is so that the positional relationship relative positional relationship is predetermined between the light distribution pattern for a first low beam (the first cutoff line) and a second low-beam distribution pattern (first cutoff line) the first lens unit and the second lens unit is by being integrally molded.

Twentieth embodiment provides a lens body disposed in front of the light source includes a rear end and a front end, light from the light source incident on inside the lens body, and emitted from the front end by being emitted forward, in the lens body forming a light distribution pattern for ADB comprising a cut-off line provided with an upper reflective surface and the longitudinal reflecting surface disposed between said rear end and said front end portion It said rear end portion includes an incident portion which light from the light source is incident on the interior of the lens body, the front end portion of the tip and the longitudinal reflecting surface of the upper reflective surface, respectively, includes a shade, the incident parts, the upper reflection surface, the longitudinal reflecting surface and the front end is, by the shade of the shade and the longitudinal reflecting surface of the upper reflecting surface of the light from the light source incident on the interior of the lens body from said entrance portion one part shielding light and light is internally reflected by the upper reflective surface and the longitudinal reflecting surface, by being irradiated forward emitted from the front end, the upper reflection surface to the lower edge and one side edge characterized in that it constitutes a shade and an optical system for forming the ADB light distribution pattern including the cut-off line defined by the shade of the longitudinal reflecting surface.

According to a twentieth embodiment, by the action of the upper reflective surface and the longitudinal reflecting surface, it is possible to achieve the following effects.

First, to form a light distribution pattern for ADB comprising a cut-off line (the lower cutoff line and the vertical cutoff line) defined by the shade of the shade and the longitudinal reflecting surface of the upper reflecting surface to the lower edge and one side edge it can.

Second, it is possible to make the vertical cutoff line as clear formed below the cutoff line and one side edge is formed on the lower edge of the light distribution pattern for ADB.

Thirdly, unnecessary extent as a light distribution pattern for ADB, i.e., it is possible to prevent the light from the light source below the lower cut-off line is light distribution. Similarly, it is possible to light from the light source than the longitudinal cut-off line on the vertical line side can be inhibited from being light distribution. As a result, the vehicle front of the irradiation-prohibited object (e.g., preceding vehicle or oncoming vehicle) can effectively suppress the generation of glare for.

Fourth, assembly due to the influence of errors such as, as a relative positional relationship between the lens body relative to the light source was shifted from the design value, possible to prevent the deviation is below the cutoff line and the vertical cutoff line of a light distribution pattern for ADB can.

The present invention may also be specified as follows: (a twenty-first embodiment).

Vehicle lamp that includes a light source and lens body according to the twentieth embodiment.

To achieve the above fourth object, an embodiment of the 22 includes a first lens unit disposed in front of the light source, and a second lens unit which is disposed in front of said first lens portion, light from the light source, by being irradiated forward transmitted through the first lens unit and the second lens unit in this order, are arranged to form a predetermined light distribution pattern including a cutoff line on an upper edge in the lens body, said comprises a first lower reflective surface disposed between the rear end and the front end portion of the first lens portion, the distal end portion of the first lower reflection surface includes a shade, the the rear end portion of the first lens unit includes a first entrance surface, a front end portion of the first lens unit includes a first intermediate output surface, a rear end portion of the second lens unit, an intermediate incident surface wherein the front end portion of the second lens unit includes a final exit surface, said first incidence surface, said first lower reflecting surface, said first intermediate output surface, said intermediate incident surface and the final exit surface, said light is internally reflected by the partial blocking light and the first lower reflection surface by the shade of the first lower reflection surface of the light from the light source incident on the inside of the first lens unit from the first incident surface, emitted from the first intermediate output surface in the first lens unit outside, further, the incident from the intermediate incident surface inside the second lens portion is emitted from said final exit surface, by being emitted forward constitute a first optical system for forming a first light distribution pattern including a cutoff line that is defined by the shade of the upper edge first lower reflecting surface, said final exit surface, configured as a surface of a planar shape being, at least one of the first intermediate output surface and the intermediate plane of incidence, the light from the light source emerging from the final exit surface relates to the vertical direction, such that the collimated light, the surface shape There is configured, the predetermined light distribution pattern, characterized by being formed by the first light distribution pattern.

According to the 22 embodiment, it is possible to first, provides a lens body of looking with a sense of unity, which extends linearly in a predetermined direction. This final exit surface is by being configured as a surface of a planar shape.

Second, even though the final exit surface is flat shape, to provide a lens body which can form a predetermined light distribution pattern focused in the horizontal direction and the vertical direction (e.g., a light distribution pattern for low beam) be able to. This is because the first output surface of the first lens unit is responsible for horizontal condensing primarily, at least one of the vertical direction of the first intermediate output surface of the light collecting predominantly and intermediate incidence plane is responsible it is intended.

Embodiment of the first 23, in an embodiment of the 22, provided with a disposed pair of left and right sides between the rear end and the front end portion of said first lens portion, after said first lens unit end, wherein the left and right sides of the first entrance surface includes a second entrance surface of the deployed pair so as to surround the space from the left and right sides between said light source and said first entrance surface, the first the front end of the lens unit includes a second intermediate output surface arranged in pair on both left and right sides of the first intermediate output surface, the second incident surface of the right and left, the right and left pair of side, the pair of left and right the second intermediate output surface, said intermediate incident surface and the final exit surface, from said pair of second light source which is internally reflected by the pair of right and left side enters the inside of the first lens unit from the incident surface light, said emitted from the left and right pair of second intermediate output surface in the first lens unit outside, further from said intermediate incident surface incident within said second lens portion is emitted from said final output surface, the front by being irradiated, constitute a second optical system pair to form a second light distribution pattern, at least one of said second intermediate output surface of the left-right pair and the intermediate plane of incidence, the final outgoing light from the light source emitting from the surface is relates to the vertical direction, so that the collimated light is composed its surface shape, the predetermined light distribution pattern, the first light distribution pattern and the second wherein the light distribution pattern is formed as a synthesized light distribution pattern is superimposed.

According to a twenty-third embodiment, in the second optical system, the same effect as the 22 embodiment, i.e., even though the final exit surface is a flat shape, a second arrangement which is focused in the vertical direction light pattern (e.g., a light distribution pattern for mid) can provide a lens body that may be formed. This is due to at least one of representative of the vertical direction of the first intermediate output surface of the light collecting and intermediate the plane of incidence.

24th embodiments, in embodiments of the 22, a pair of right and left side surfaces disposed between the rear end portion and the front end portion of said first lens portion, and the rear end portion of the first lens unit between the front end and the pair of left and right second lower reflecting surface arranged on the left and right sides of the first lower reflection surface includes a leading end portion of the pair of right and left second lower reflective surface includes a shade, the rear end portion of the first lens unit, the both left and right sides of the first entrance surface, left and right spaces are arranged so as to surround the left and right sides between the light source and the first incident surface includes a pair of second entrance surface, a front end portion of the first lens unit, said first and a second intermediate output surface arranged in pair on the left and right sides of the intermediate exit surface, the second incidence of the right and left surface, the right and left pair of side, the second lower reflecting surface of the right and left, the right and left pair of second intermediate output surface, said intermediate incident surface and the final exit surface, wherein the pair of left and right second entrance surface and the 1 lens inner surface reflected second light and said left-right pair of the light-shielding portion by the pair of right and left second shade below the reflecting surface of the light from the light source by the pair of right and left side enters the interior is light internally reflected under the reflection surface, the emitted from the pair of second intermediate output surface in the first lens unit outside, further, enters from the intermediate incident surface inside the second lens portion and the final and emitted from the emission surface, by being irradiated forward, the second optical pair of left and right to form a second light distribution pattern including a cutoff line that is defined by the pair of right and left second shade lower reflecting surface the upper edge constitute a system, the right and left at least one of the pair of second intermediate output surface and the intermediate plane of incidence, the light from the light source emerging from the final exit surface relates to the vertical direction, the collimated light so that is configured its surface shape, the predetermined light distribution pattern, wherein the first light distribution pattern and the second light distribution pattern is formed as a synthesized light distribution pattern is superimposed.

According to a twenty-fourth aspect, in the second optical system, the same effect as the 22 embodiment, i.e., even though the final exit surface is a flat shape, a second arrangement which is focused in the vertical direction light pattern (e.g., a light distribution pattern for mid) can provide a lens body that may be formed. This is due to at least one of representative of the vertical direction of the first intermediate output surface of the light collecting and intermediate the plane of incidence.

25th embodiment, in embodiments or the twenty fourth aspect of the first 23, the rear end portion of the first lens unit, the upper side of the first incident surface, the light source and the first incident surface characterized in that it comprises an upper incident surface which space is arranged to surround the upper side between.

According to a twenty-fifth aspect, it is possible to provide a highly lens body light utilization efficiency of light from a light source extending upward is incident directly on the lens inside from the upper incident surface.

Embodiment of the first 26, in any one of the twenty-fifth embodiment from the first 22 embodiment, said final exit surface, the slant angle and/or camber angle is formed as a surface of a planar shape which is imparted the features.

According to the 26th embodiment, may be the last exit surface provides a lens body of a novel appearance which is configured as a surface of a planar shape slant angle and/or camber angle is applied.

Embodiment of the first 27, in any one of the 26th embodiment from the first 22 embodiment, said final exit surface, so that the lower edge is located forward with respect to the upper edge, inclined rearward obliquely upward characterized in that the are arranged in a posture.

According to the 27th embodiment, the final exit surface, that the lower edge is to be located forward with respect to the upper edge, to provide a lens having a novel appearance which is arranged in a posture which is inclined rearwardly obliquely upward can.

The present invention may also be specified as follows.

Vehicular lamp comprising: a lens body according, to, and the light source into any of the first 22 embodiment from the 27th embodiment.

To achieve the above fifth object of the invention of the 28 embodiment provides a lens body disposed in front of the light source, between the rear end portion, a front end, the rear end and the front end portion comprise disposed a pair of left and right side surfaces and upper surface, light from the light source incident on the interior of the lens body, by being irradiated forward emitted from the front end, the light converging pattern and a first diffusion pattern There are superimposed, in the fabricated lens body so as to form a light distribution pattern for low beam, including a cut-off line at an upper end edge, a first lower reflective surface disposed between the rear end and the front end portion, between the front end and the rear end portion, and said pair of left and right second lower reflecting surface first placed on the left and right sides of the lower reflecting surface, provided with a tip end of the first lower reflection surface parts, the front end portion of the pair of right and left second lower reflective surface, respectively, includes a shade, the rear end portion has a first incident surface, and, on the left and right sides of the first incident surface, wherein the light source first 1 includes a pair of left and right entrance face the space disposed so as to surround the left and right sides between the entrance surface, said front end portion, an intermediate exit surface, intermediate the entrance surface and the placed in front of the intermediate exit face includes a final exit plane disposed in front of the middle entrance surface, said intermediate exit surface, a first semi-cylindrical surface which cylindrical axis is extending in the vertical direction or substantially vertical direction and, said first semicircle comprising a pair of left and right intermediate exit surface which is disposed on the left and right sides of the columnar surface, said final output surface, a second semicylindrical surface cylinder axis extends in the horizontal direction, or slant angle and/or camber corners is configured as a surface of a semi-cylindrical granted, the first incident surface, wherein the first lower reflection surface, wherein the first semi-cylindrical surface, said intermediate incident surface and the final exit surface, the light is internally reflected by the partial blocking light and the first lower reflection surface by the shade of the first lower reflection surface of the light from the light source incident on the interior of the lens body from a first entrance surface, It said first emitted from semi-cylindrical surface on the lens body outside, further from said intermediate incident surface enters the interior of the lens body and emitted from the final exit surface, by being irradiated forward, the upper end constitute a first optical system which forms the light collecting pattern including the cut-off line defined by the shade of the first lower reflection surface to the edge, the pair of left and right entrance surface, said pair of right and left sides, the right and left second lower reflection surfaces of the pair, the pair of left and right intermediate exit surface, said intermediate incident surface and the final exit surface, internal reflection in the right and left pair of side from the pair of left and right entrance surface enters the interior of the lens body light which is internally reflected by the partial blocking light and said left-right pair of second lower reflecting surface by the shade of the pair of right and left second lower reflecting surface of the light from the light source, the right and left pair of intermediate and emitted from the emission surface to the lens body outside, further from said intermediate incident surface enters the interior of the lens body and emitted from the final exit surface, by being irradiated forward, the right and left upper edge the characterized in that it constitutes a second optical system of pair of forming the first diffusion pattern comprising a cut line defined by the shade of the second lower reflective surface.

According to the invention of a 28 embodiment, it can be realized appearance with a sense of unity, which extends linearly in a predetermined direction, yet, to form one in a plurality of light distribution patterns (the light converging pattern and a first diffusion pattern) it is possible to provide a lens body which can.

Can be realized appearance with a sense of unity, which extends linearly in a predetermined direction is by final exit surface is formed as a semicylindrical surface (refracting surface of the semi-cylindrical).

Be able to form one in a plurality of light distribution patterns (the light converging pattern and a first diffusion pattern) forms a first optical system and the first diffusion patterns one lens member forms a light converging pattern it is by and a second optical system.

Further, according to the invention of a 28 embodiment, the influence of assembly error, as the relative positional relationship of the lens body is deviating from the design value with respect to the light source, that the glare to the first diffusion pattern is generated it can be suppressed. This is due to the second optical system for forming a first diffusion pattern and a second lower reflecting surface of the pair (and shades).

Invention of a 29 embodiment, the Aspect 28 of the embodiment, the rear end portion, on the upper side of the first incident surface, surrounding a space between the light source and the first entrance surface from the upper side comprise disposed on the entrance surface, as the upper surface is disposed in an inclined posture obliquely upward from the front end side toward the rear end side, the upper incident surface and said top surface, said light from the light source from the upper incident surface is incident on the interior of the lens body, by being irradiated forward emitted from the top surface, the second diffusion pattern which is superimposed on the light converging pattern and the first diffusion pattern constitute a third optical system for forming an, the upper incident surface and/or the upper surface, as near the center of the top edge thereof and the second diffusion pattern shape including the concave portion recessed downwardly is formed, characterized in that the surface shape is formed.

According to the invention of the twenty-ninth embodiment, the influence of assembly error, the relative positional relationship of the lens body with respect to the light source is deviated from the design value, even if the second diffusion pattern is moved vertically upward, glare it can be suppressed. This second diffusion patterns is by the central vicinity of the upper edge is formed as a light distribution pattern having a shape comprising a recess recessed downward.

Invention of a 30 embodiment, the Aspect 28 of the embodiment, the rear end portion, on the upper side of the first incident surface, surrounding a space between the light source and the first entrance surface from the upper side in comprise disposed on the entrance surface as the upper surface is disposed in an inclined posture obliquely upward from the rear end portion side toward the front end side, the final exit surface, the final exit plane includes extension regions that extend upward obliquely rearward from the upper edge of the upper incident surface, said upper surface, and, the extension area is internally reflected by the upper surface of the upper incident surface enters the interior of the lens body light from the light source is, by being irradiated forward emitted from the extension area, constituting the third optical system for forming a second diffusion pattern which is superimposed on the light converging pattern and the first diffusion pattern and it is, the upper incident surface and/or the upper surface, as near the center of the top edge thereof and the second diffusion pattern shape including the concave portion recessed downwardly is formed, the surface shape is formed it features a.

According to the invention of the thirtieth embodiment, the influence of assembly error, the relative positional relationship of the lens body with respect to the light source is deviated from the design value, even if the second diffusion pattern is moved vertically upward, glare it can be suppressed. This second diffusion patterns is by the central vicinity of the upper edge is formed as a light distribution pattern having a shape comprising a recess recessed downward.

Invention of a 31 embodiment provides a lens body disposed in front of the light source includes a rear end and a front end, light from the light source incident on the interior of the lens body is emitted from the front end by being irradiated forward, and wherein the central portion of the upper edge is configured lens body so as to form a predetermined light distribution pattern shape including a recess recessed downward.

According to the invention of the 31 embodiment, the influence of assembly error, the relative positional relationship of the lens body with respect to the light source is deviated from the design value, as the predetermined light distribution pattern is moved vertically upward, glare it can be suppressed. This is due to the predetermined light distribution pattern is formed as a light distribution pattern having a shape near the center of the upper edge includes a recessed portion recessed downwardly.

Invention of a 32 embodiment, the Aspect 31 of the embodiment, the rear end portion includes at least one entrance surface, the lens body is disposed between the rear end and the front end portion includes top surfaces, said top surface, said has from the front end side is arranged in an inclined posture obliquely upward toward the rear end side, the incident surface and the upper surface, the lens body from the incident surface light from the light source incident on the inside, by being irradiated forward emitted from the upper surface, the optical system near the center of the top edge to form a predetermined light distribution pattern shape including a recess recessed downward constitute a, the incident surface and/or the upper surface, as described above near the center of the upper end edge a predetermined light distribution pattern shape including a recess recessed downward is formed, the surface shape is configured and features that you are.

According to the invention of a 32 embodiment, it is possible to achieve the same effect as the 31 embodiment.

Invention of a 33 embodiment, the Aspect 31 of the embodiment, the rear end portion includes at least one entrance surface, the lens body is disposed between the rear end and the front end portion includes top surfaces, said top surface is arranged in an inclined posture obliquely upward from the rear end portion side toward the front end side, the front end includes an exit surface, the incident surface, wherein top surface, and said exit surface, light from the light source is internally reflected by the top surface enters the inside of the lens body from the incident surface, by being irradiated forward emitted from the exit surface, constitute an optical system for forming a predetermined light distribution pattern having a shape near the center of the upper edge comprises a recess recessed downward, the incident surface and/or the upper surface, near the center of the top edge downward as the predetermined light distribution pattern shape including a recess recessed is formed, the surface shape is formed.

According to the invention of a 33 embodiment, it is possible to achieve the same effect as the 31 embodiment.

The present invention may also be specified as follows.

Vehicle lamp having the one of the lens body, and a light source of the first 33 embodiment from the 28th embodiment.

To achieve the above sixth object of the invention of the 34 embodiment provides a lens body disposed in front of the light source, the rear end portion includes a front end, said light source incident on the interior of the lens body light from the by being irradiated forward emitted from the front end, in the fabricated lens body so as to form a light distribution pattern for high beam light converging pattern and a diffusion pattern is superimposed, the rear end parts are incident surface of the diffusion pattern, the reflecting surface of the diffusion pattern of the inner surface reflecting light from said light source incident on the interior of the lens body from the incident surface for the diffusion pattern, the entrance surface for light collection pattern, and includes a reflective surface for the light converging pattern to internal reflection light from the light source incident on the inside of the lens body from the incident surface for the light collecting pattern, the front end portion, the exit surface of the diffusion pattern and the condenser wherein the emission surface of the pattern, the incident surface for the diffusion pattern, the reflecting surface for the diffusion pattern, and the exit surface for the diffusion pattern is made incident on the inside of the lens body from the incident surface for the diffusion pattern light from the light source, emitted from the emission surface for diffused pattern, constitute a first optical system for forming the diffusion pattern is emitted forward, an incident surface for the light converging pattern, the collection the reflecting surface for the light pattern, and the exit surface for the light converging pattern is incident on the inside of the lens body from the incident surface for the light converging pattern is internally reflected by the reflecting surface for the light converging pattern wherein light from the light source, emitted from the exit surface for the light converging pattern, constitute a second optical system for forming the light converging pattern is emitted forward, reflection for the light collecting pattern to the light source the distance between the surfaces as compared to the distance between the light source and the reflecting surface for the diffusion pattern, characterized in that it is set longer.

According to the invention of a 34 embodiment, it is possible to provide a lens which is capable of forming one in the light converging pattern and high beam light distribution pattern spreading pattern is superimposed.

This is one of the lens body is by that it comprises a second optical system for forming a first optical system and the light converging pattern to form a diffusion pattern.

Further, according to the invention of a 34 embodiment, as a result of the luminous intensity of the light converging pattern is higher than the diffusion pattern, high beam distribution pattern formed by light converging pattern and the diffusion pattern is superimposed (synthesized light distribution the pattern), high center luminosity can be made excellent in long-distance visibility.

The luminous intensity of the light converging pattern is higher than the diffusion pattern, the distance between the light source and the exit surface for light converging pattern, as compared the light source and the distance between the exit surface of the diffusion pattern, it is set longer because you are, in the second optical system for forming a converging light pattern, compared to the first optical system for forming a diffusion pattern, the light source image of the light source becomes relatively small, light collection in this relatively small light source image it is due to the fact that the pattern is formed.

Invention of a 35 embodiment, the Aspect 34 of the embodiment, the incident surface for the diffusion pattern has a first incident surface, and extends rearward from the outer peripheral edge of said first entrance surface, of the space between the light source and the first incident surface, and a second entrance surface cylindrical surrounding the range other than the cutout portion through which light passes from the light source, the reflecting surface for the diffusion pattern the second is located outside of the entrance surface, a reflecting surface for internal reflection of light from said light source second incident from the incident surface to the interior of the lens body, the incident surface for the light converging pattern, the incident surface on which light is incident from the light source which has passed through the cutout portion, the reflecting surface for the light converging pattern is disposed outside of the entrance surface for the light converging pattern, incident for the light converging pattern wherein the light from the light source incident on the interior of the lens body from the surface is a reflective surface for internal reflection.

According to the invention of the 35th embodiment, it is possible to achieve the same effect as the 34 embodiment.

Invention of a 36 embodiment, the Aspect 35 of the embodiment, the exit surface for the diffusion pattern is semicylindrical surface cylinder axis extends in the horizontal direction, or slant angle and/or camber angle There is configured as a surface of a semi-cylindrical granted, the first incident surface, the light from said light source from said first entrance surface is incident on the interior of the lens body, relates to a vertical direction, for diffused pattern condensed at the focal line near the exit surface of, and relates to a horizontal direction, so as to diffuse, it is constituted its surface shape, the reflecting surface for the diffusion pattern, the lens body from said second entrance surface light from said light source incident on the inside has been internally reflected by the reflecting surface for the diffusion pattern relates a vertical direction, it is focused on the focal line near the exit surface for the diffusion pattern, and relates to a horizontal direction, to diffuse, characterized in that the surface shape is formed.

According to the invention of a 36 embodiment, it is possible to exit surface of the diffusion pattern is to provide a lens having a novel appearance which is semicylindrical surface (cylindrical surface).

Invention of a 37 embodiment, the Aspect 35 of the embodiment, the exit surface for the diffusion pattern is formed as a surface of a planar shape, said first entrance surface, from said first entrance surface light from the light source emitted from the emitting surface for the diffusion pattern incident on the interior of the lens body, relates to vertical, collimated, and relates to a horizontal direction, so as to diffuse, the surface shape is configured cage, reflective surface for the diffusion pattern is internally reflected by the reflecting surface of the second for the diffusion pattern enters within said lens body from the incident surface, from the light source emitted from the emitting surface for the diffusion pattern the optical relates vertical direction is collimated, and relates to a horizontal direction, so as to diffuse, characterized in that the surface shape is formed.

According to the invention of the 37th embodiment, the exit surface of the diffusion patterns may provide a lens body of the new appearance is the surface of a planar shape.

Invention of a 38 embodiment, in any one of the 37th embodiment from 35th embodiment, the exit surface for the light converging pattern is configured as a surface of a planar shape, said condensing the reflecting surface of the pattern is incident on the inside of the lens body from the incident surface for the light converging pattern is internally reflected by the reflecting surface for the light collecting pattern, the light source emitted from the emitting surface for the light converging pattern light from the relates vertical and horizontal directions, as is collimated, characterized in that the surface shape is formed.

According to the invention of a 38 embodiment, it is possible to output surface for converging light pattern to provide a lens having a novel appearance which is a surface of a planar shape.

Invention of a 39 embodiment, in any one of the 37th embodiment from 35th embodiment, the exit surface for the light converging pattern is continuous to the lower edge of the exit surface for the diffusion pattern is configured as a surface of a planar shape, the reflecting surface for the light converging pattern is incident on the inside of the lens body from the incident surface for the light converging pattern is internally reflected by the reflecting surface for the light collecting pattern, light from the light source emitted from the emitting surface for the light converging pattern relates vertical and horizontal directions, as is collimated, characterized in that the surface shape is formed.

According to the invention of a 39 embodiment, it is possible to provide a lens having a novel appearance to the exit surface of the converging light pattern is continuous with the lower edge of the exit surface of the diffusion pattern.

Invention of a 40 embodiment, in any one of the 39th embodiment from 35th embodiment, the incident surface for the light converging pattern is formed as a surface of a spherical shape centered on the light source and wherein the are.

According to the invention of the fortieth embodiment, light from the light source can be suppressed Fresnel reflection loss at the time of entering the inner lens body from the incident surface for the light converging pattern.

The present invention may also be specified as follows.

Vehicle lamp having the one of the lens body, and a light source of the first 40 embodiment from the first 34 embodiment.

To achieve the above seventh object of the invention of the 41 embodiment includes a light source, a lens body disposed in front of said light source comprises a rear end and a front end portion, within said lens body light from the light source incident is, by being irradiated forward emitted from the front end, provided with a lens and a body that is configured to form a first light distribution pattern including a cutoff line on an upper edge in the vehicle lamp, and further comprising a reflective surface for entering the inside of the lens body from said rear end portion to reflect light other than light entering directly into the lens body of the light from the light source to.

According to the invention of the 41st embodiment, and a light source and a lens member disposed in front of the light source, the light distribution pattern including a cutoff line on an upper edge (e.g., a light distribution pattern for low beam) to form a in the fabricated vehicle lamp, light use efficiency can be suppressed. This is due to having a reflective surface for incident inside the lens body from the rear end of the lens body and reflects the light other than the light directly incident on the inner lens body of the light from the light source.

Invention of a 42 embodiment, the Aspect 41 of the embodiment has a lower reflecting surface disposed between said rear end and said front end, said rear end, an incident surface wherein the distal end portion of the lower reflection surface includes a shade, the incident surface, the lower reflective surface and the front end portion, the lower reflection of the light from the light source incident on the interior of the lens body from the incident surface light is internally reflected by the partial blocking light and the lower reflection surface by the shade of the face, by being irradiated forward emitted from the front end portion is defined by the shade of the lower reflecting surface the upper edge characterized in that it constitutes an optical system for forming the first light distribution pattern including a cutoff line that.

According to the invention of a 42 embodiment, due to the reflected light from the reflecting surface is incident on the inner lens member, glare occurs in the first light distribution pattern (e.g. a light distribution pattern for a spot of the low beam) it can be suppressed. This reflected light from the reflecting surface is incident to the inner lens body, the lower reflective surface (and shade), is due to be controlled below the cutoff line.

Invention of a 43 embodiment, the Aspect 41 of the embodiment has a lower reflecting surface disposed between said rear end and said front end, said rear end, an incident surface wherein the distal end portion of the lower reflection surface includes a shade, the front end portion, an intermediate exit face, the final outgoing disposed in front of the middle entrance surface disposed in front of the intermediate exit face and said intermediate incidence plane includes a surface, said intermediate exit surface includes a first semi-cylindrical surface cylinder axis extending in the vertical direction or substantially vertical direction, said final exit surface, the second the cylinder axis extending in the horizontal direction semi-cylindrical surface, or is constructed as a second surface of the semicylindrical the slant angle and/or camber angle is applied, the incident surface, the lower reflecting surface, said first semi-cylindrical surface, said intermediate incident surface and the final exit surface is a light shielding light and the lower reflective surface portion by the shade of the lower reflection surface of the light from the light source incident on the interior of the lens body from the incident surface internally reflected light is emitted from the first semi-cylindrical surface on the lens body outside, further, it enters from the intermediate incident surface inside the lens body and emitted from the final exit surface, forward by being irradiated, it is characterized by constituting an optical system for forming the first light distribution pattern including a cutoff line that is defined by the shade of the lower reflecting surface the upper edge.

According to the invention of a 43 embodiment, it is possible to provide a vehicular lamp that can realize appearance with a sense of unity, which extends linearly in a predetermined direction. This is due to the final exit surface of the lens body is configured as a semi-cylindrical surface (refracting surface of the semi-cylindrical).

Invention of a 44 embodiment, the Aspect 42 embodiment or the 43 embodiment, the reflective surface being disposed so as to surround the space between the light source and the incident surface and features.

According to the invention of the 44th embodiment can be incident outside light entering directly into the lens body light (light from a light source extending in the vertical and horizontal directions) inside the lens body. As a result, it is possible to light use efficiency can be suppressed.

Invention of a 45 embodiment, the Aspect 41 of the embodiment comprises a first lower reflective surface disposed between the rear end and the front end, the rear end, the comprising a first entrance surface, the distal end portion of the lower reflection surface includes a shade, the front end portion, an intermediate exit face, in front of the middle entrance surface disposed in front of the intermediate exit face and said intermediate incidence surface disposed It includes a final exit surface that is, the intermediate exit face, a first semi-cylindrical surface which cylindrical axis is extending in the vertical direction or substantially vertical direction, and, on the left and right sides of the first semi-cylindrical surface comprise disposed right and left pair of intermediate exit surface, said final output surface, a second semicylindrical surface cylinder axis extends in the horizontal direction, or the second to slant angle and/or camber angle is applied is configured as a semi-cylindrical surface and said first incidence surface, the first lower reflection surface, wherein the first semi-cylindrical surface, said intermediate incident surface and the final exit surface, said first incidence light is internally reflected by the partial blocking light and the first lower reflection surface by the shade of the first lower reflection surface of the light from said light source from the surface incident on the interior of the lens body, said first emitted from the surface of the semi-cylindrical in the lens body outside, further from said intermediate incident surface enters the interior of the lens body and emitted from the final exit surface, by being irradiated forward, the upper edge the constitute a first optical system for forming the first light distribution pattern including a cutoff line that is defined by the shade of the first lower reflection surface, further, disposed between said front end and said rear end portion includes a pair of left and right sides, the rear end portion, the both left and right sides of the first entrance surface, pair the space is arranged to surround the right and left sides between said light source and said first entrance surface of including an incident surface, between said rear end and said front end portion, and includes a second lower reflecting surface arranged in pair on the left and right sides of the first lower reflection surface, said pair of right and left distal end of the second lower reflecting surface includes a shade, the pair of left and right entrance surface, said pair of right and left side surface, the second lower reflecting surface of the pair, the pair of left and right intermediate exit surface, said intermediate incident surface and said final exit face, by the pair of right and left second shade below the reflecting surface of the light from said pair of said light source is internally reflected by the pair of right and left side enters the inside of the lens body from the incident surface partial blocking light and said left-right pair of second light internally reflected under the reflection surface is emitted to the lens body outside from said pair of left and right intermediate exit face, further, the lens body from the intermediate incident surface incident on the inside and emitted from the final exit surface, by being irradiated forward, forming a second light distribution pattern including a cutoff line that is defined by the pair of right and left second shade lower reflecting surface the upper edge characterized in that it constitutes a left and right pair of the second optical system.

According to the invention of the 45th embodiment, it is possible to provide a vehicular lamp that can realize appearance with a sense of unity, which extends linearly in a predetermined direction. This is due to the final exit surface of the lens body is configured as a semi-cylindrical surface (refracting surface of the semi-cylindrical).

Further, according to the invention of a 45 embodiment, due to the reflected light from the reflecting surface is incident on the inner lens member, glare to the second light distribution pattern (e.g. mid light distribution pattern for low beam) is generated it can be suppressed to. This reflected light from the reflecting surface is incident to the inner lens body, the second lower reflecting surface of the pair constituting the second optical system (and shade) due to be controlled below the cut-off line is there.

Invention of a 46 embodiment of the present invention, in the 45th embodiment, the reflective surface, the upper and lower space between the light source and the first entrance surface, respectively, the space above and characterized in that it is arranged so as to surround the lower side.

According to the invention of the 46th embodiment, it may be made incident directly incident outside light (light from a light source extending in the vertical direction) inside the lens body inside the lens body. As a result, it is possible to light use efficiency can be suppressed.

Invention of a 47 embodiment of the present invention, in the 45th embodiment, the rear end portion, on the upper side of the first incident surface, surrounding a space between the light source and the first entrance surface from the upper side characterized in that it comprises a disposed on the entrance surface, as.

According to the invention of the 47th embodiment, it is possible to provide a light use efficiency higher vehicle lamp in which light is directly incident on the lens inside from the upper incident surface of the light source extending upward.

48th embodiments, Aspect 47 of the embodiment, the reflective surface, the lower space between the light source and the first entrance surface is disposed so as to surround the space from the lower side and wherein the are.

According to the invention of the 48th embodiment, it may be made incident directly incident outside light (light from a light source extending in the downward direction) on the inner lens body inside the lens body. As a result, it is possible to light use efficiency can be suppressed.

Invention of a 49 embodiment, the Aspect 48 of the embodiment, the reflective surface includes a first caused to enter inside the lens body from said first entrance surface reflects a part of the light from the light source 1 reflective region, the second reflective region to be incident from one of the entrance surface to the interior of the lens body out of the right and left of the entrance surface and reflecting another part of the light from the light source, and, the light from the light source It reflects the other part, characterized in that it comprises a third reflective region to be incident inside the lens body from the other incident surface out of the pair of left and right entrance surface.

According to the invention of the 49th embodiment, by adjusting each of the reflective regions separately, it is possible to individually control the light reflected from each of the reflective regions which enters from each of the incident surface inside the lens body.

To achieve the above eighth object of the invention of the 50th embodiment, the second light distribution first light distribution pattern and its lower end is arranged in a form overlapping the upper end portion of the first light distribution pattern Pattern in the fabricated vehicle lamp so as to form a, a first light source, a first lens element which is disposed in front of said first light source, the first and the second light source, arranged in front of said second light source a second lens element, and wherein the first lens body, the front end of the rear end portion and the first lower reflection surface and the first lower reflection surface disposed between the front end portion of the first lens body parts comprises an extension entrance face which is extended downward from the rear end of said first lens member comprises a first entrance surface, the distal end portion of the first lower reflection surface includes a shade, the second 1 entrance surface, the front end portion of the first lower reflection surface and said first lens body, said first lower reflection of the light from the first light source first enters from the incident surface inside the first lens body by light is internally reflected by the partial blocking light and the first lower reflection surface by the shade of the surface is irradiated forward emitted from the front end of the first lens body, the upper edge the constitute a first optical system for forming the first light distribution pattern including a cutoff line that is defined by the shade of the first lower reflection surface, the rear end portion of the second lens body, from the second light source wherein an incident portion through which light enters the interior of the second lens body, the front end portion of the second lens body comprises exit surface, the incident portion, the exit surface of the second lens body, the extension incident surface, and the front end portion of the first lens body, light from the second light source incident on the interior of the second lens element from said entrance portion, and emitted from the exit surface of the second lens body, furthermore, the from the extension incident surface incident inside the first lens body is emitted from the front end of the first lens body, by being irradiated forward, to constitute a second optical system for forming the second light distribution pattern and we, the exit surface of the second lens body, light from the second light source for emitting from the said exit surface of the second lens body, said one of the extension incidence surface and the first lower reflection surface and the from 1 of the shade near the lower reflection surface area is incident inside the first lens body, characterized in that it is disposed near the extension plane of incidence.

According to the invention of a 50 embodiment, the first light distribution pattern (e.g., a light distribution pattern for low beam) second light distribution and its lower end is arranged in a form overlapping the upper end portion of the first light distribution pattern Pattern (e.g., light distribution pattern or a light distribution pattern for high beam ADB) miniaturization of the constructed vehicle lamp so as to form a can be performed.

This is the first light distribution pattern (e.g., a light distribution pattern for low beam) light forming the (light from the first light source) and a second light distribution pattern (e.g., a light distribution pattern or a light distribution pattern for high beam ADB) the light forming (light from the second light source) is caused to emit from the front end of instead of exiting from separate lens body which are arranged in parallel in a front view, a first lens which is a single lens body it is intended.

Further, according to the invention of a 50 embodiment, the second light from the light source, the shade of the first lower reflection surface of the extension incidence surface and the first lower reflection surface for emitted from the emission surface of the second lens body as incident from the vicinity of the region within the first lens body, by arranging the exit surface of the second lens body in the extended entrance surface near its lower end a first light distribution pattern (e.g., low-beam light distribution pattern) the second light distribution pattern (e.g. arranged in a form overlapping the upper end portion of the light distribution pattern or a light distribution pattern for high beam ADB) may be formed.

Invention of a 51 embodiment, the Aspect 50 of the embodiment, the first light distribution pattern is a light distribution pattern for low beam, the second light distribution pattern, the respective lower ends for low beam at least one light distribution pattern for ADB among the plurality of light distribution patterns for ADB arranged horizontally in a form overlapping the upper end portion of the light distribution pattern, the second lens body, after the second lens body includes an upper reflective surface and the longitudinal reflecting surface disposed between the end and the front end portion, the distal end portion of the tip and the longitudinal reflecting surface of the upper reflective surface, respectively, includes a shade, the entrance portion, wherein the reflective surface, the longitudinal reflecting surface, the exit surface of the second lens body, the extension incident surface, and the front end portion of the first lens body, instead of the second optical system, the entrance portion in the upper light blocking light and said upper reflective surface portion by the shade and the shade of the longitudinal reflecting surface of the reflecting surface and the longitudinal reflecting surface of the light from said second light source incident on the interior of the second lens body from internally reflected light is emitted from the exit surface of the second lens body, further, enters from the extension incident surface inside the first lens body is emitted from the front end of the first lens body, front by being irradiated to a second optical system for forming a light distribution pattern for the ADB comprising a cut-off line defined by the lower edge and the upper shade reflecting surface and the shade of the longitudinal reflecting surface on one side edge characterized in that it constitutes.

According to the invention of a 51 embodiment, the vehicle light distribution pattern and the lower end thereof for a low beam is configured to form a ADB light distribution pattern arranged in a form overlapping the upper end portion of the light distribution pattern for low beam miniaturization of use lamp becomes possible.

This is a separate lens light forming the or a light distribution pattern for ADB (light from the first light source) light forming the light distribution pattern for low beam (light from the second light source) are arranged in parallel in a front view instead of exiting from the body, it is by exiting from the front end of the first lens which is a single lens body.

Further, according to the invention of a 51 embodiment, the second light from the light source, the shade of the first lower reflection surface of the extension incidence surface and the first lower reflection surface for emitted from the emission surface of the second lens body as incident from the vicinity of the region within the first lens body, by arranging the exit surface of the second lens body in the extended incident surface vicinity, arranged in the form in which the lower end overlaps the upper portion of the light distribution pattern for low beam it is possible to form a light distribution pattern for ADB to be.

Further, according to the invention of a 51 embodiment, by the action of the upper reflective surface and the longitudinal reflecting surface, it is possible to achieve the following effects.

First, it is possible to form a light distribution pattern for ADB including the lower cutoff line and the vertical cutoff line that is defined by the shade of the shade and the longitudinal reflecting surface of the upper reflecting surface to the lower edge and one side edge.

Second, it is possible to make the vertical cutoff line as clear formed below the cutoff line and one side edge is formed on the lower edge of the light distribution pattern for ADB.

Thirdly, unnecessary extent as a light distribution pattern for ADB, i.e., it is possible to prevent the light from the second light source is a light distribution below the lower cut-off line. Similarly, it is possible to light from the second light source can be inhibited from being light distribution from the vertical cutoff line on the vertical line side. As a result, the vehicle front of the irradiation-prohibited object (e.g., preceding vehicle or oncoming vehicle) can effectively suppress the generation of glare for.

Fourth, due to influence of assembly error, as the relative positional relationship of the second lens element relative to the second light source is deviating from the design value, the lower cutoff line and the vertical cutoff line of a light distribution pattern for ADB that deviated it can be suppressed.

Invention of a 52 embodiment, the Aspect 51 of the embodiment includes a plurality of combination of the second lens element and the second light source, the emitting surfaces of the plurality of the second lens body, said plurality the light from a plurality of said second light source for emitting from the emission surface of the second lens body, the extension incident surface and from said region of the shade vicinity of the first lower reflection surface of said first lower reflection surface of so as to enter inside the first lens body, characterized in that arranged in parallel in a horizontal direction in the vicinity the extension plane of incidence.

According to a 52nd embodiment, the combination of the second light source and the second lens body relative to the first lens body of one By preparing a plurality, it is possible to form a light distribution pattern for a plurality of ADB.

Invention of a 53 embodiment, the Aspect 50 of the embodiment, the first light distribution pattern is a light distribution pattern for low beam, the second light distribution pattern, the lower end distribution for the low beam a light distribution pattern for high beam, which is arranged in a form overlapping the upper end portion of the light pattern, the incident portion, the exit surface of the second lens body, the extension incident surface, and the front end portion of the first lens body, instead of the second optical system, light from the second light source incident on the interior of the second lens element from said entrance portion, and emitted from the exit surface of the second lens body, and further, the extension incident enters the inside of the first lens body from the surface is emitted from the front end of said first lens body, by being irradiated forward, constitute a second optical system for forming a light distribution pattern for the high beam it features a.

According to the invention of a 53 embodiment, the vehicle light distribution pattern and the lower end thereof for a low beam is configured to form a high beam light distribution pattern which is arranged in a form overlapping the upper end portion of the light distribution pattern for low beam miniaturization of use lamp becomes possible.

This is a separate lens light forming the or a light distribution pattern for high beam (light from the first light source) light forming the light distribution pattern for low beam (light from the second light source) are arranged in parallel in a front view instead of exiting from the body, it is by exiting from the front end of the first lens which is a single lens body.

Further, according to the invention of a 53 embodiment, the second light from the light source, the shade of the first lower reflection surface of the extension incidence surface and the first lower reflection surface for emitted from the emission surface of the second lens body as incident from the vicinity of the region within the first lens body, by arranging the exit surface of the second lens body in the extended incident surface vicinity, arranged in the form in which the lower end overlaps the upper portion of the light distribution pattern for low beam it is possible to form a high beam light distribution pattern.

Invention of a 54 embodiment, the Aspect 53 of the embodiment, the second lens body, provided with an upper reflective surface disposed between the rear end and the front end portion of the second lens body cage, the front end portion of the upper reflection surface includes a shade, the incident portion, wherein the reflecting surface, the exit surface of the second lens body, the extension incident surface, and the front end portion of the first lens body the second place of the optical system, the upper light and the upper reflecting surface is shielded in part by the shade reflecting surface of the light from said second light source incident on the interior of the second lens element from said entrance portion in the inner surface reflected light, emitted from the exit surface of the second lens body, further, enters from the extension incident surface inside the first lens body is emitted from the front end of the first lens body, by being irradiated forward, characterized in that it constitutes a second optical system for forming a light distribution pattern for the high beam, including a cut-off line defined by the shade of the upper reflecting surface to the lower edge.

According to the invention of the 54th embodiment, by the action of the upper reflecting surface can achieve the following effects.

First, it is possible to form a light distribution pattern for high beam including the lower cut-off line defined by the shade of the upper reflecting surface to the lower edge.

Second, it is possible to make the lower cut-off line formed in the lower edge of the light distribution pattern for high beam as clear.

Thirdly, unnecessary extent as a light distribution pattern for high beam, i.e., it is possible to prevent the light from the second light source is a light distribution below the lower cut-off line.

Fourth, assembly due to the influence of errors such as, as a relative positional relationship of the second lens element relative to the second light source is deviating from the design value, possible to prevent the deviation is below the cutoff line of the light distribution pattern for high beam can.

Invention of a 55 embodiment, the embodiment of the first 51, in any one of the 52nd embodiment or the 54th embodiment, the shade of the upper reflecting surface of said emission surface of said second lens body region near, as light from the second light source for emitting the second lens body outside from the region is diffused, characterized in that the surface shape is formed.

According to the invention of the 55th embodiment, by adjusting the surface shape of a region of the shade near the out on the reflective surface of the exit surface of the second lens body, the first light distribution pattern (e.g., a light distribution pattern for low beam) and the second light distribution pattern (e.g., a light distribution pattern or a light distribution pattern for high beam) ADB without discomfort (naturally) can be visually recognized as being connected.

Invention of a 56 embodiment, in any one of the 55th embodiment from the first 50 embodiment, the second lens body, between the rear end and the front end portion of the second lens body includes a bent portion, the bent portion includes an intermediate reflecting surface, light from the second light source incident on the interior of the second lens element from said entrance portion, after being internally reflected by the intermediate reflective surface, wherein characterized by emitted from the exit surface of the second lens body.

According to the invention of the 56th embodiment, it is possible to a second light source disposed at a desired position. In other words, the layout is improved.

Invention of a 57 embodiment, in any one of the 56th embodiment from the first 50 embodiment, the front end portion of the first lens body, an intermediate exit surface, is disposed in front of the intermediate exit face and wherein an intermediate incident surface and the final exit plane disposed in front of the intermediate entrance surface, said intermediate exit surface includes a first semicylindrical surface cylinder axis extending in the vertical direction or substantially vertical direction, said final exit surface, the second surface of the semi-cylindrical extending in the cylindrical axis in the horizontal direction, or is constructed as a second surface of the semi-cylindrical granted the slant angle and/or camber angle, the first entrance surface, the front end portion of the first lower reflection surface and said first lens body, instead of the first optical system, the first incident on the interior of the first lens element from said first entrance surface light is internally reflected by the light shielding light and the first lower reflection surface part by the shade of the first lower reflection surface of the light from the light source, said first lens from said first semi-cylindrical surface emitted in Karadagaibu, further from said intermediate incident surface incident inside the first lens body is emitted from the final exit surface, by being irradiated forward, the shade of the first lower reflection surface on an upper edge characterized in that it constitutes a first optical system for forming the first light distribution pattern including a cutoff line defined by.

According to the invention of the 57th embodiment, it is possible to provide a vehicle lamp having a lens body which can realize appearance with a sense of unity, which extends linearly in a predetermined direction. This is due to the final exit surface of the first lens body is configured as a semi-cylindrical surface (refracting surface of the semi-cylindrical).

Invention of a 58 embodiment, in any one of the 56th embodiment from the first 50 embodiment, the front end portion of the first lens body, an intermediate exit surface, is disposed in front of the intermediate exit face and wherein an intermediate incident surface and the final exit plane disposed in front of the intermediate entrance surface, said intermediate exit surface, a first semi-cylindrical surface which cylindrical axis is extending in the vertical direction or substantially vertical direction and, wherein the pair of left and right intermediate exit surface which is disposed on the left and right sides of the first semi-cylindrical surface, the final exit surface, the second semi-cylindrical surface which cylindrical axis is extending in a horizontal direction, or, is configured as a second semicylindrical surface slant angle and/or camber angle is applied, the first incident surface, the front end portion of the first lower reflection surface and said first lens body, said first 1 instead of the optical system, the light and the first which is shielded in part by the shade of the first lower reflection surface of the light from said first light source incident on the inside of the first lens body from the first incident surface is light internally reflected under the reflection surface, said first emitted from semi-cylindrical surface in said first lens body outside, further, the final incident inside the first lens element from said intermediate incident surface and emitted from the emission surface, by being irradiated forward, to constitute a first optical system for forming a first partial light distribution pattern including a cutoff line that is defined by the shade of the upper edge first lower reflection surface cage further, the first lens member is provided with a disposed pair of left and right sides between the rear end and the front end, the rear end portion of the first lens body, said first entrance surface the right and left sides, wherein the disposed pair of the entrance surface so as to surround the space from the left and right sides between the first light source and the first entrance surface, the rear end portion and the first of said first lens body between the front end portion of the lens body, and includes a second lower reflecting surface arranged in pair on the left and right sides of the first lower reflection surface, the distal end portion of the pair of right and left second lower reflective surface includes a shade, the pair of left and right entrance surface, said pair of right and left sides, the second lower reflecting surface of the right and left, the right and left pair of intermediate exit surface, said intermediate incident surface and the final exit surface, said pair protected from light in part by said pair of right and left second shade below the reflecting surface of the light from said first lens body said internal is internally reflected by the pair of right and left sides and incident on the first light source from the incident surface of the light and light that is internally reflected by the pair of right and left second lower reflecting surface, and emitted to the first lens body outside from said pair of left and right intermediate exit face, further, the inside of the first lens element from said intermediate incident surface incident emitted from said final output surface in, by being irradiated forward, forming a second partial light distribution pattern including a cutoff line that is defined by the pair of right and left second shade lower reflecting surface the upper edge constitute a pair of right and left third optical system for the first light distribution pattern, said first partial light distribution pattern and the second partial light distribution pattern is formed as a synthesized light distribution pattern superimposed the features.

According to the invention of the 58th embodiment, it is possible to provide a vehicle lamp having a lens body which can realize appearance with a sense of unity, which extends linearly in a predetermined direction. This is due to the final exit surface of the first lens body is configured as a semi-cylindrical surface (refracting surface of the semi-cylindrical).

Further, according to the invention of a 58 embodiment, the first partial light distribution pattern and the second lower reflecting surface to the upper edge of the pair comprising a cut-off line defined by the shade of the first lower reflection surface on an upper edge it can be a second partial light distribution pattern including a cutoff line that is defined by the shade to form a first light distribution pattern superimposed.

Invention of a 59 embodiment, the Aspect 58 of the embodiment, the rear end portion of the first lens body, the upper side of the first incident surface, and the first light source and the first incident surface characterized in that it comprises an upper incident surface which space is arranged to surround the upper side between.

According to the invention of the 59th embodiment, it is possible to provide a vehicle lamp having high light utilization efficiency which light enters directly into the first lens body from the upper incident surface of the light source extending upward.

According to the present invention, the first light distribution pattern (e.g., a light distribution pattern for low beam) the second light distribution pattern and its lower end is arranged in a form overlapping the upper end portion of the first light distribution pattern (e.g., for ADB miniaturization of the constructed vehicle lamp so as to form a light distribution pattern or a light distribution pattern for high beam) can be achieved.

BRIEF DESCRIPTION OF DRAWINGS

FIG. 28D is a side view (of major optical surfaces only) of the vehicular lamp fitting 10A of Embodiment 2 to which the camber angle is not added, FIG. 28E is a top view (of major optical surfaces only) thereof, and FIG. 28F is an example of a low beam light distribution pattern formed by the vehicular lamp fitting 10A of Embodiment 2.

FIG. 63A is a top view of the vehicular lighting fixture 10N (lens body 12N), FIG. 63B is a front view, and FIG. 63C is a side view thereof.

FIG. 82A is a top view of the vehicular lighting fixture 70 (lens body 72), FIG. 82B is a front view, and FIG. 82C is a side view thereof.

FIG. 97A is a rear view of the lens body $\mathbf{66}_{L1}$, and FIG. 97B is a top view, FIG. 97C is a front view, and FIG. 97D is a left side view thereof.

FIG. 102 is a perspective view of the vehicular lighting fixture 74 (lens body 76).

FIG. 103A is a rear view of the vehicular lighting fixture 74 (lens body 76), FIG. 103B is a front view, FIG. 103C is a bottom view, and FIG. 103D is a right side view thereof.

FIG. 104 is an example of the low beam light distribution pattern $P_{Lo}$ formed by the first lens unit 12N and the ADB light distribution patterns $P_{L1}$ to $P_{L3}$ and $P_{R1}$ to $P_{R3}$ formed by the second lens unit 66.

FIG. 105 is a perspective view (only major optical surfaces) of the vehicular lighting fixture 10Q (lens body 12Q).

FIG. 106A is a side view (only major optical surfaces) of the vehicular lighting fixture 10Q (lens body 12Q), and FIG. 106B is a top view (only major optical surfaces) thereof.

FIG. 107A is a front view (only major optical surfaces) of the vehicular lighting fixture 10Q (lens body 12Q), and FIG. 107B is a rear view (only major optical surfaces) thereof.

FIG. 108 is a diagram depicting a state when the light emitted from the focal point $F_{12A4}$ (or a reference point corresponding to the focal point $F_{12A4}$) is collimated by the first intermediate emission surface 12A1*a* and the intermediate entrance surface 12A2*a*.

Figure 109A:
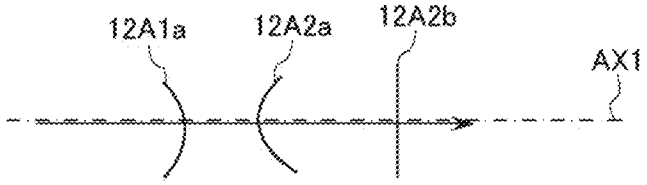
Figure 109B:
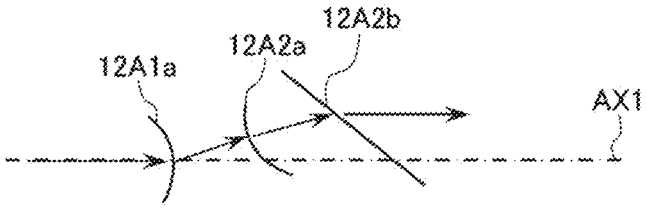
Figure 109C:
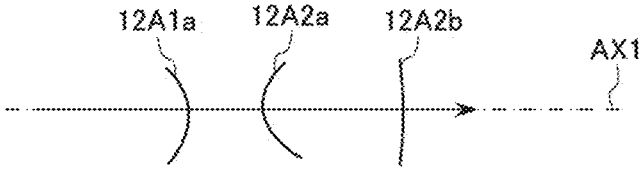

FIG. 109A is an example of the final emission surface 12A2*b* configured as a plane surface which is perpendicular to the first reference axis AX1 and extends in the horizontal direction (e.g. a plane, the external shape of which is a rectangle), FIG. 109B is an example of the final emission surface 12A2*b* disposed to be inclined diagonally upper backward direction so that the lower end edge is located forward with respect to the upper end edge, and FIG. 109C is an example of the final emission surface 12A2*b* configured as a slightly curved surface which extends forward (see FIG. 103D).

Figure 110A:
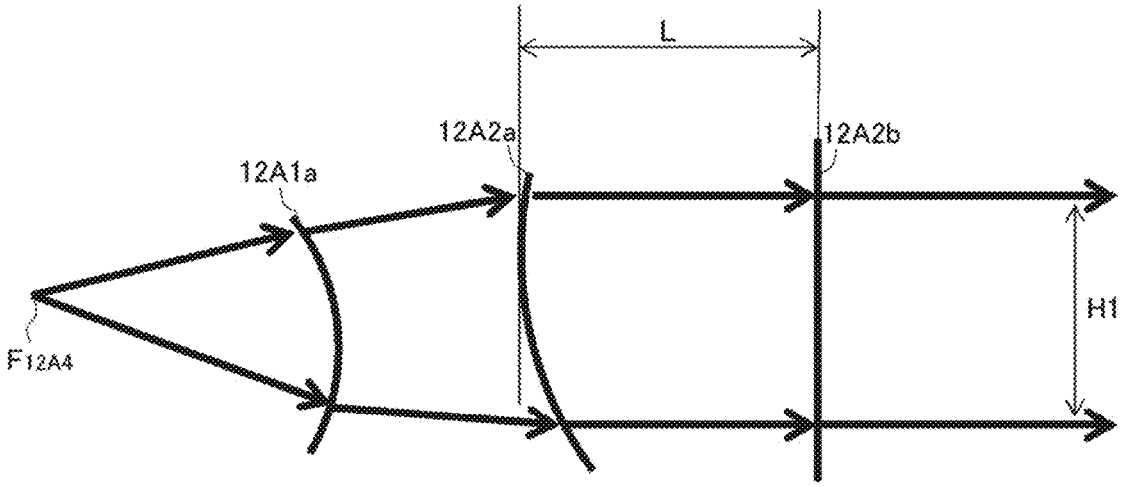

FIG. 110A is a diagram depicting a state when the light emitted from the focal point $F_{12A4}$ (or a reference point corresponding to the focal point $F_{12A4}$) is collimated by the first intermediate emission surface 12A1*a* and the intermediate entrance surface 12A2*a* in Embodiment 12, and FIG. 11013 is a diagram depicting a state when the light emitted from the focal point $F_{12A4}$ (or a reference point corresponding to the focal point $F_{12A4}$) is collimated by the first intermediate emission surface 12A1*a* and the intermediate entrance surface 12A2*a* in Embodiment 2.

Figure 111:
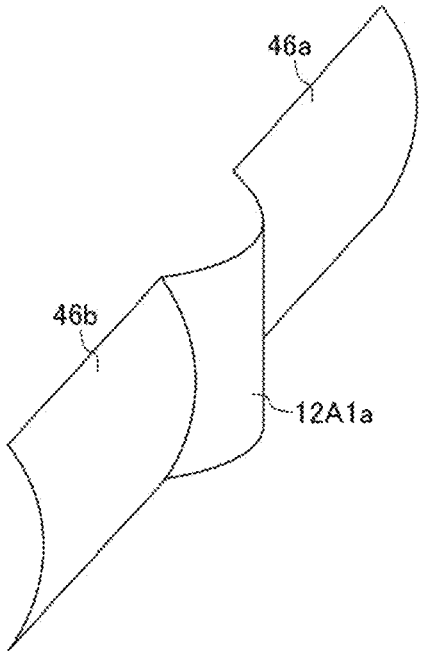

FIG. 111 is a perspective view of a left-right pair of the second intermediate emission surfaces 46*a* and 46*b* (modification).

Figure 62:
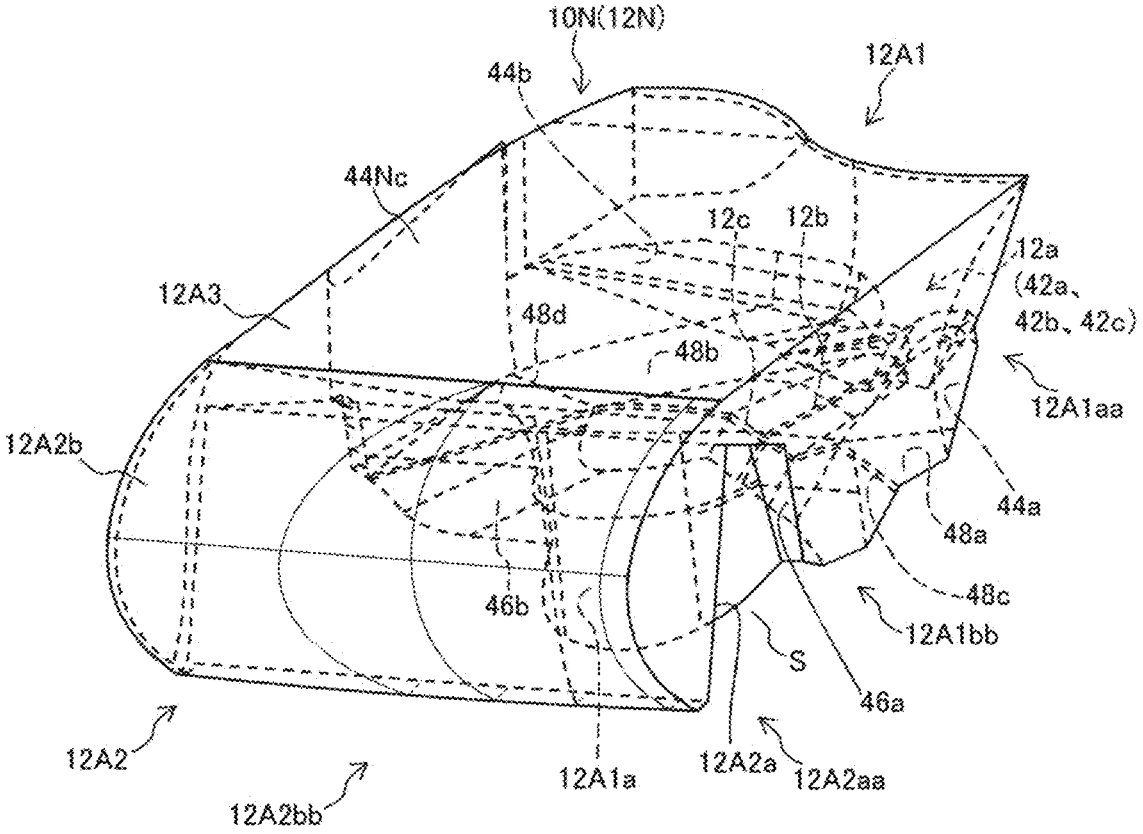
FIG. 62 is a perspective view of the vehicular lighting fixture 10N (lens body 12N).
Figure 64A:
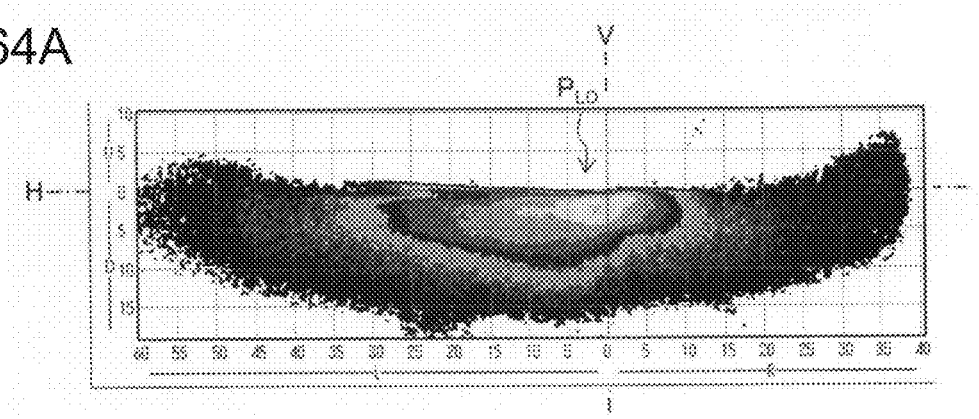
FIG. 64A is an example of a low beam light distribution pattern $P_{Lo}$ (composite light distribution pattern) formed by the vehicular lighting fixture 10N (lens body 12N)
Figure 64B:
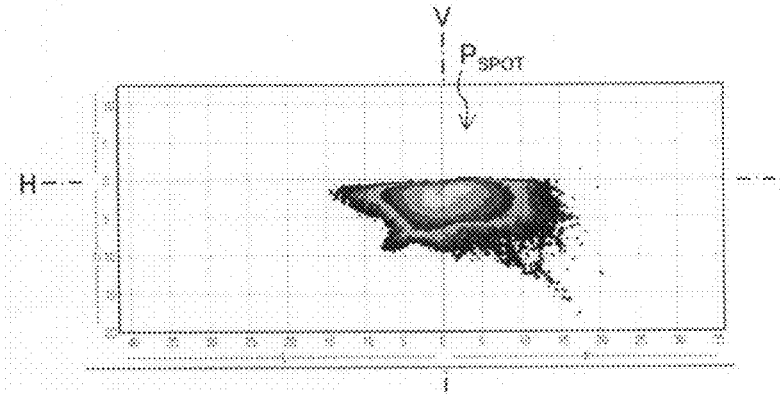
FIG. 64B is an example of a spot light distribution pattern $P_{SPOT}$.
Figure 64C:
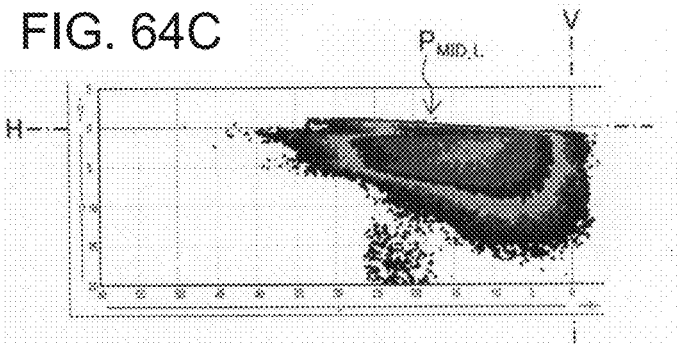
FIG. 64C is an example of as intermediate light distribution pattern $P_{MID\ L}$.
Figure 64D:
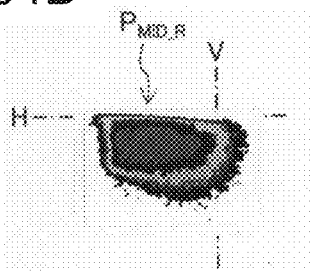
FIG. 64D is an example of as intermediate light distribution pattern $P_{MID\ R}$.
Figure 64E:
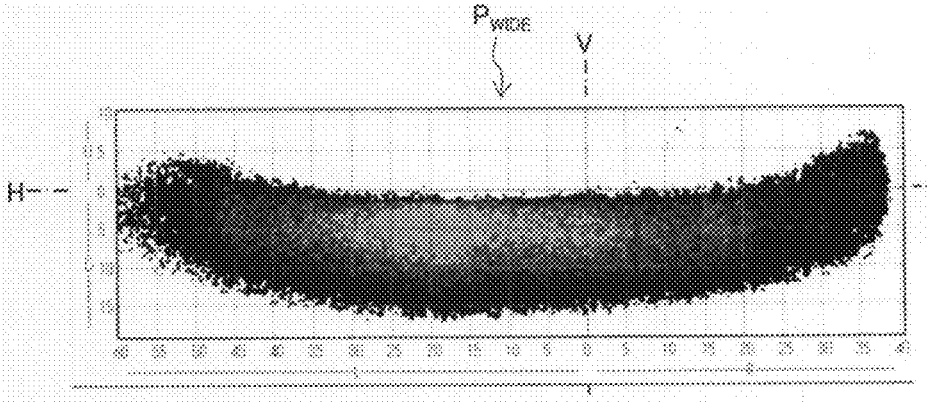
FIG. 64E is an example of a wide light distribution pattern $P_{WIDE}$.
Figure 112A:
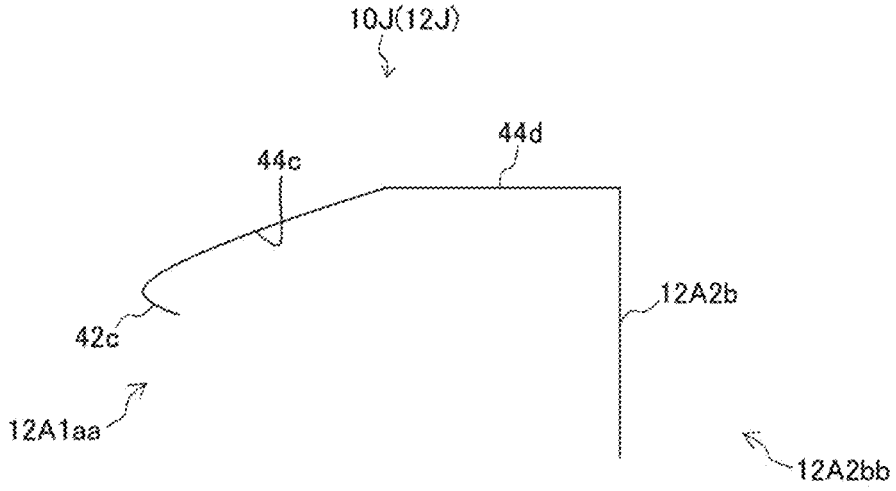
Figure 112B:
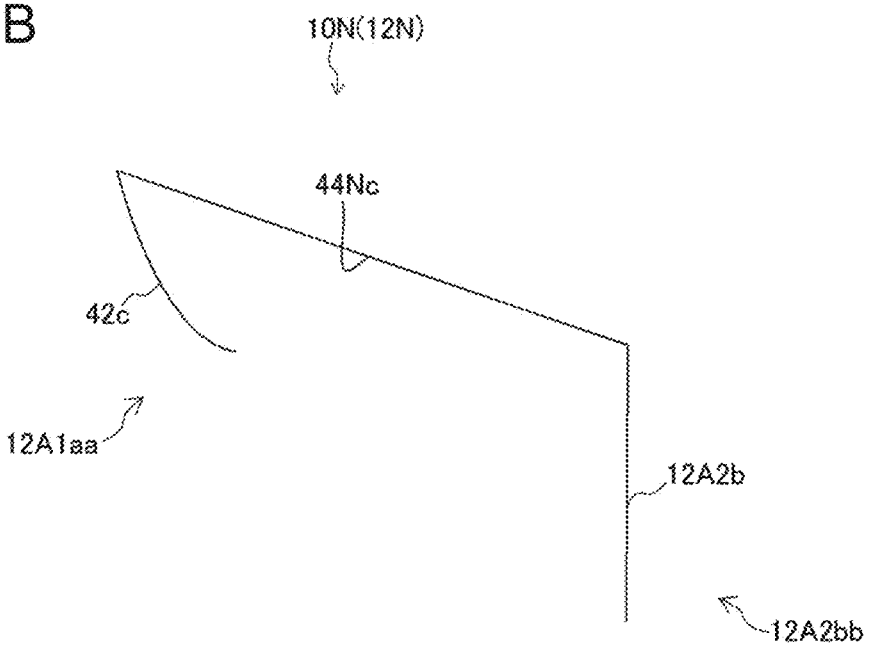

FIG. 112A is a schematic longitudinal cross-sectional view of the vehicular lighting fixture 10J (lens body 12J) of Embodiment 6, to which the concept "final emission surface (second emission surface 12A2*b*) is configured as a plane surface", is applied, and FIG. 112B is a schematic longitudinal cross-sectional view of the vehicular lighting fixture 10N (lens body 12 N) of Embodiment 12 illustrated in FIG. 62, to which the concept "final emission surface (second emission surface 12A2*b*) is configured as a plane surface" is applied.

Figure 113:
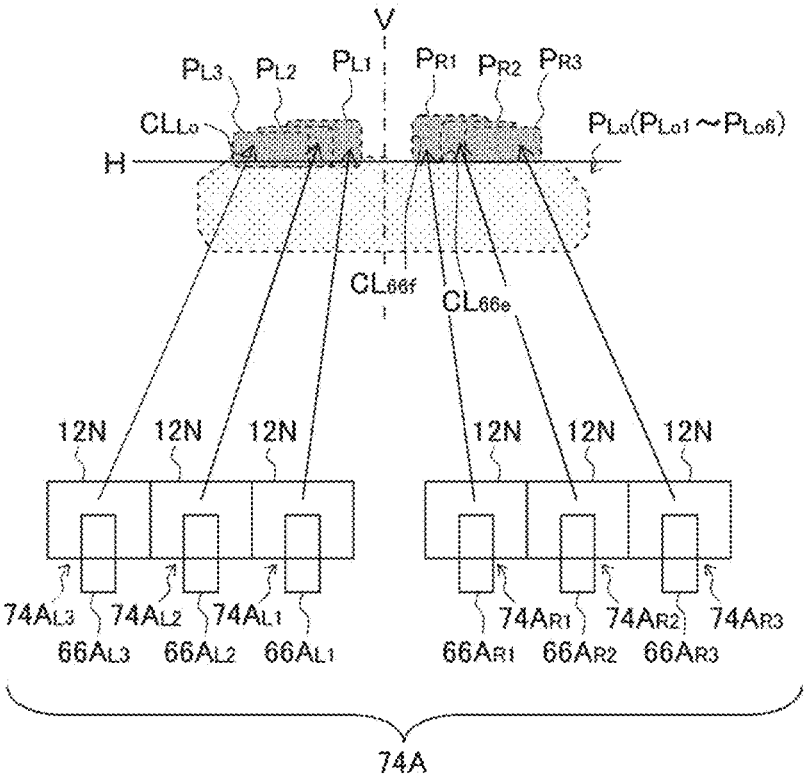

FIG. 113 is a schematic block diagram of the vehicular lighting fixture 74A of Embodiment 15.

Figure 114:
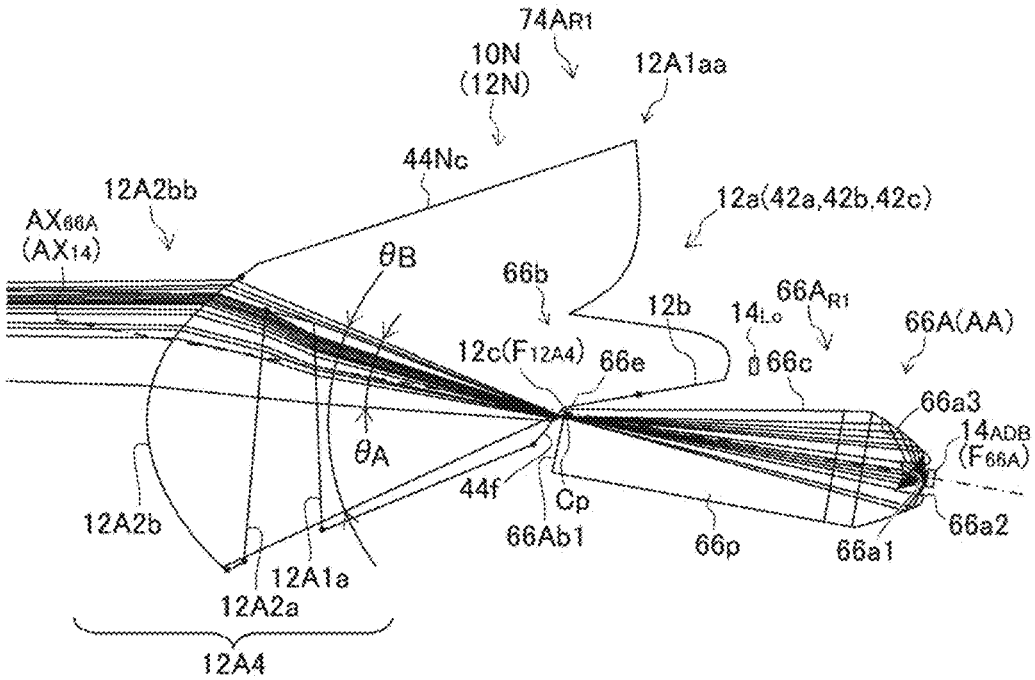

FIG. 114 is a longitudinal cross-sectional view (schematic diagram) of the vehicular lighting fixture 74$A_{R1}$.

Figure 115:
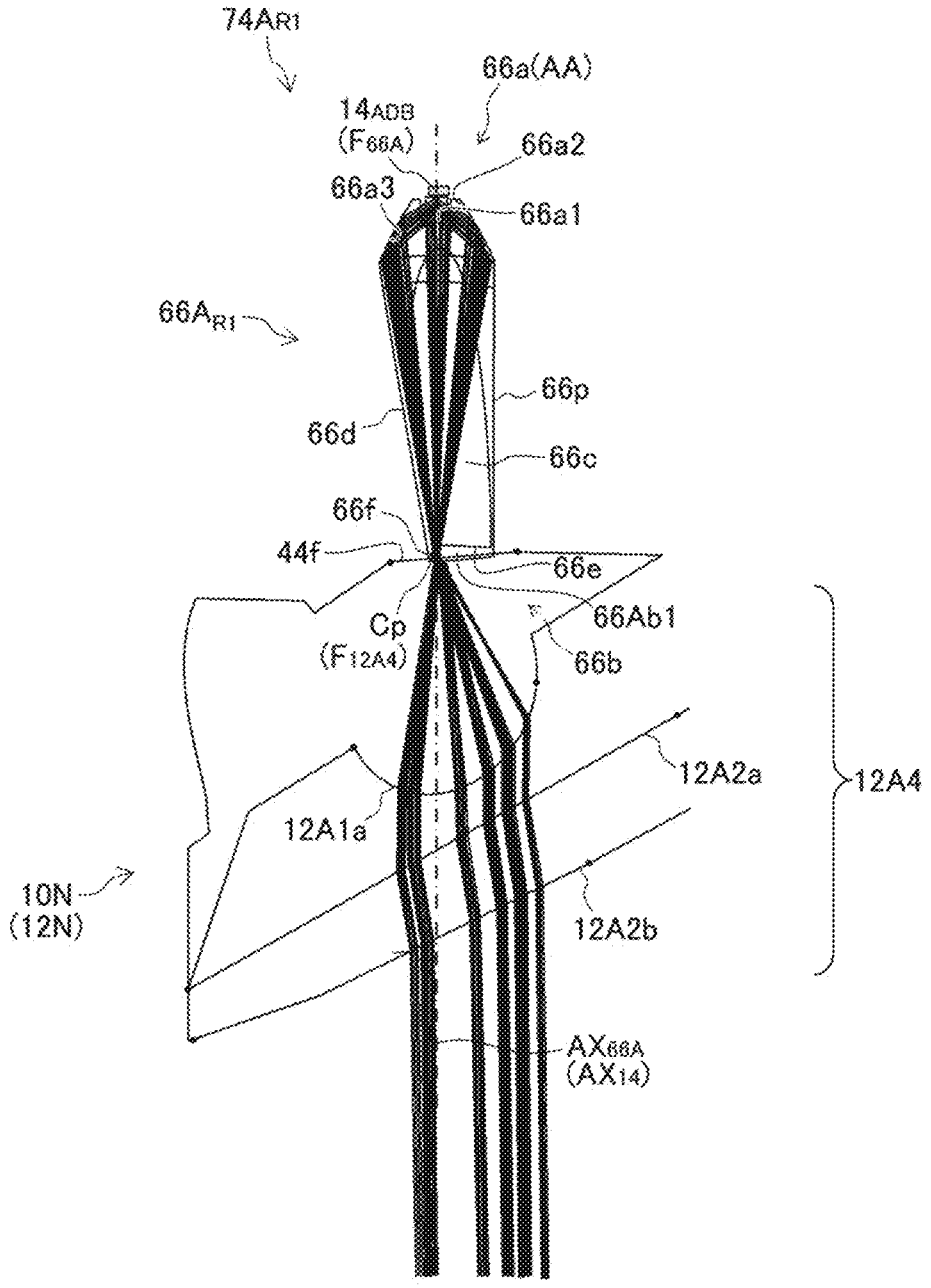

FIG. 115 is a top view (schematic diagram) of the vehicular lighting fixture 74$A_{R1}$.

Figure 116:
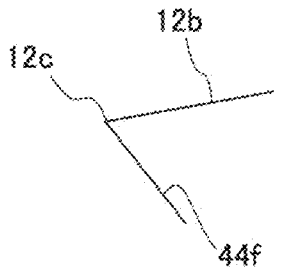

FIG. 116 is a modification of the extended entrance surface 44*f*.

Figure 117:
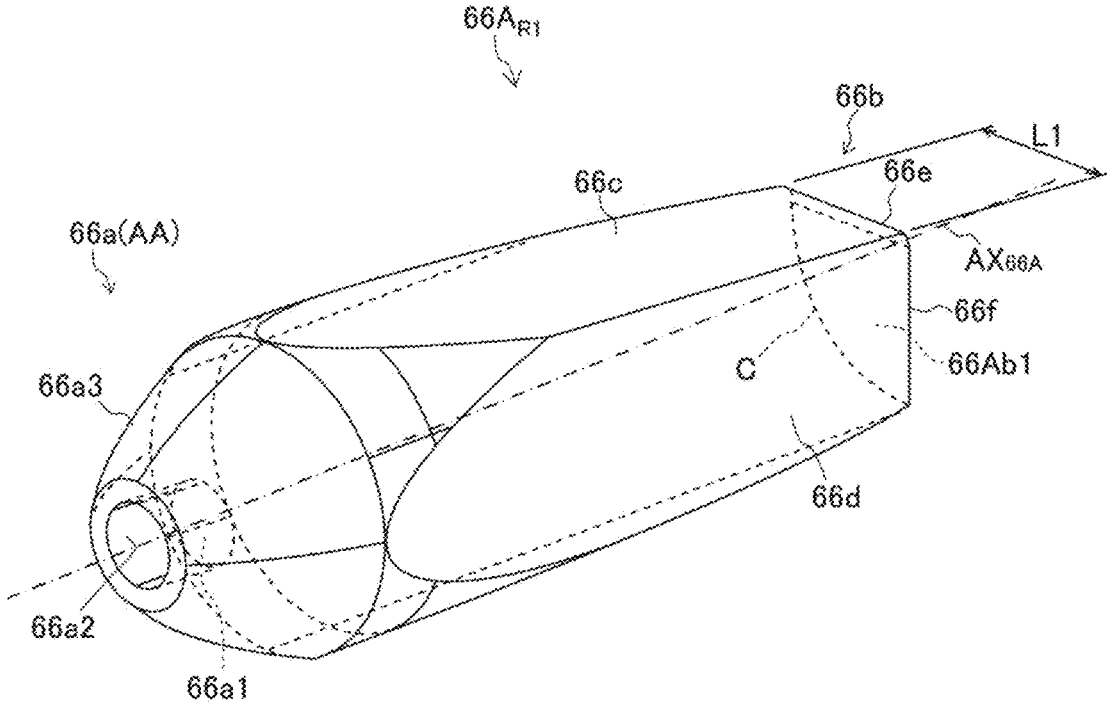

FIG. 117 is a perspective view of the second lens body 66$A_{R1}$.

Figure 118:
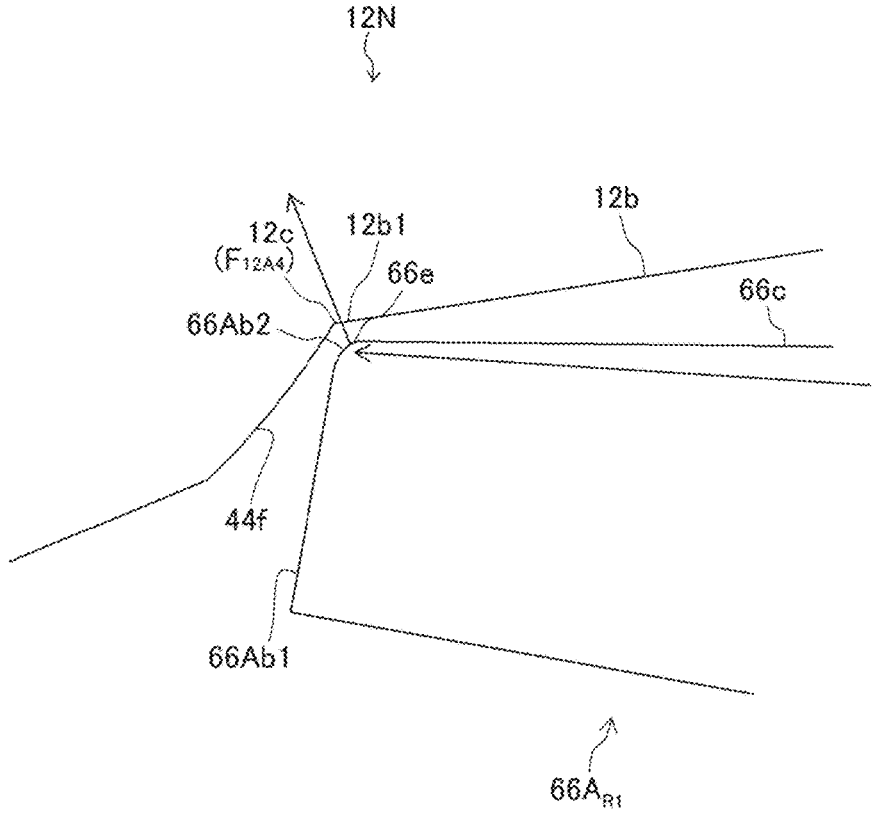

FIG. 118 is an enlarged longitudinal cross-sectional view of an area around the extended entrance surface 44*f* of the first lens body 12N and the emission surface 66Ab1 of the second lens body 66$A_{R1}$.

Figure 119:
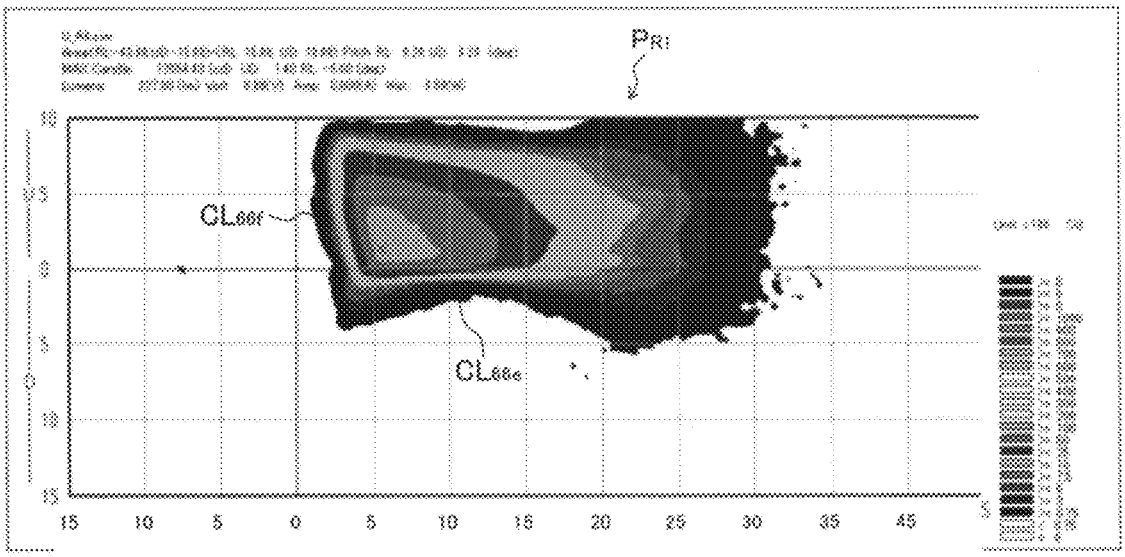

FIG. 119 is a simulation result of the ADB light distribution pattern $P_{R1}$ formed on the virtual vertical screen.

Figure 120A:
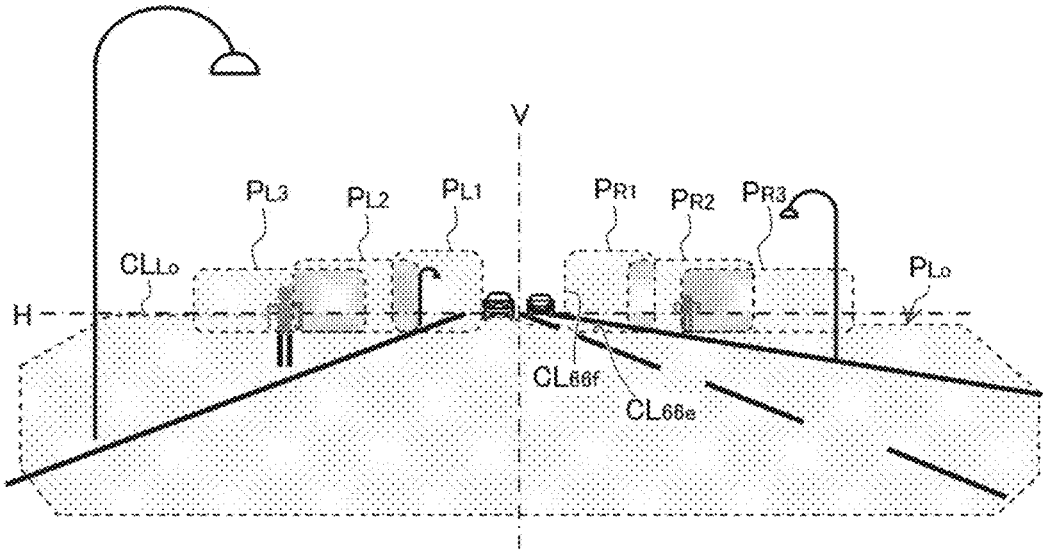
Figure 120B:
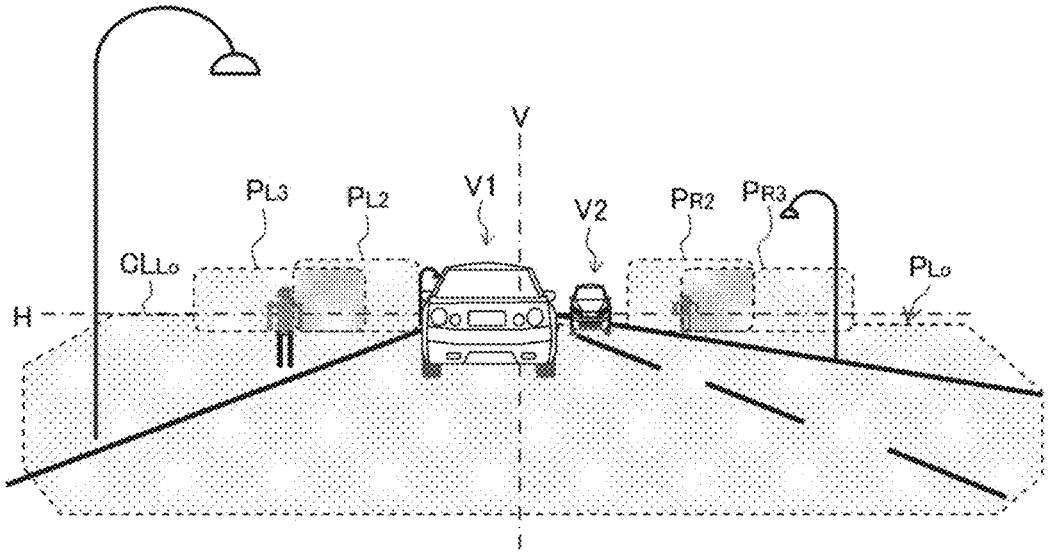

FIG. 120A is an example of the ADB light distribution pattern which is formed when it is determined that an irradiation prohibited target (e.g. preceding vehicle or oncoming vehicle) does not exist in front of this vehicle, and FIG. 120B is an example of the ADB light distribution pattern which is formed when it is determined that an irradiation-prohibited object (e.g. preceding vehicle V1 or oncoming vehicle V2) exists in front of this vehicle.

Figure 121:
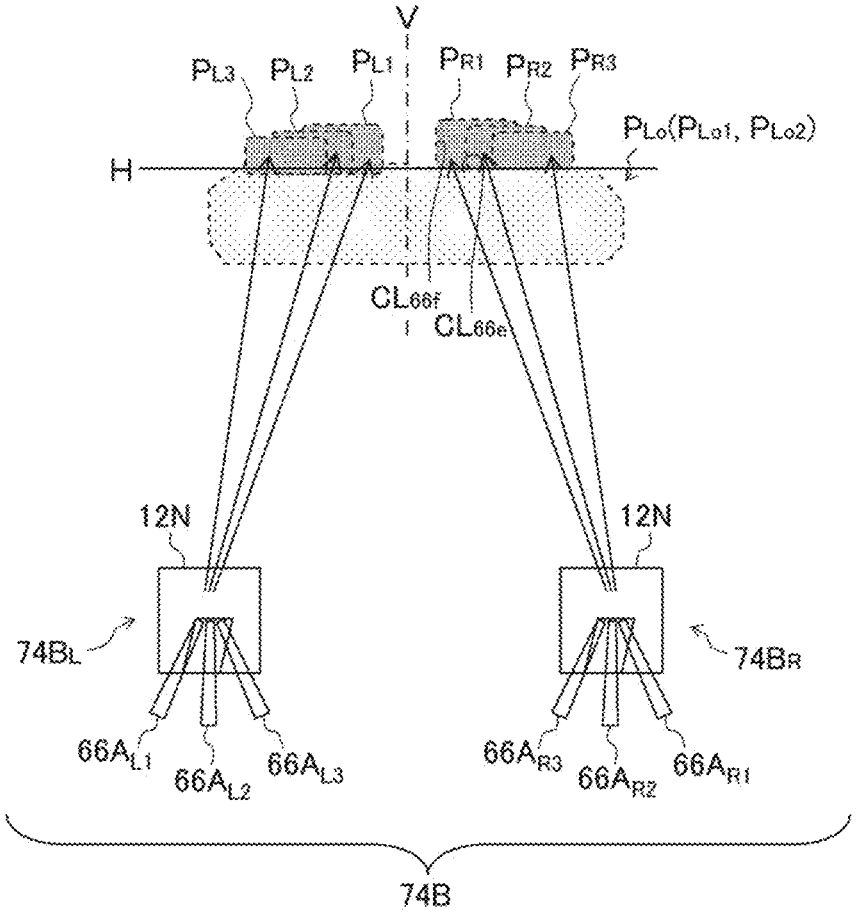

FIG. 121 is a schematic block diagram of the vehicular lighting fixture 74B of Embodiment 16.

Figure 122:
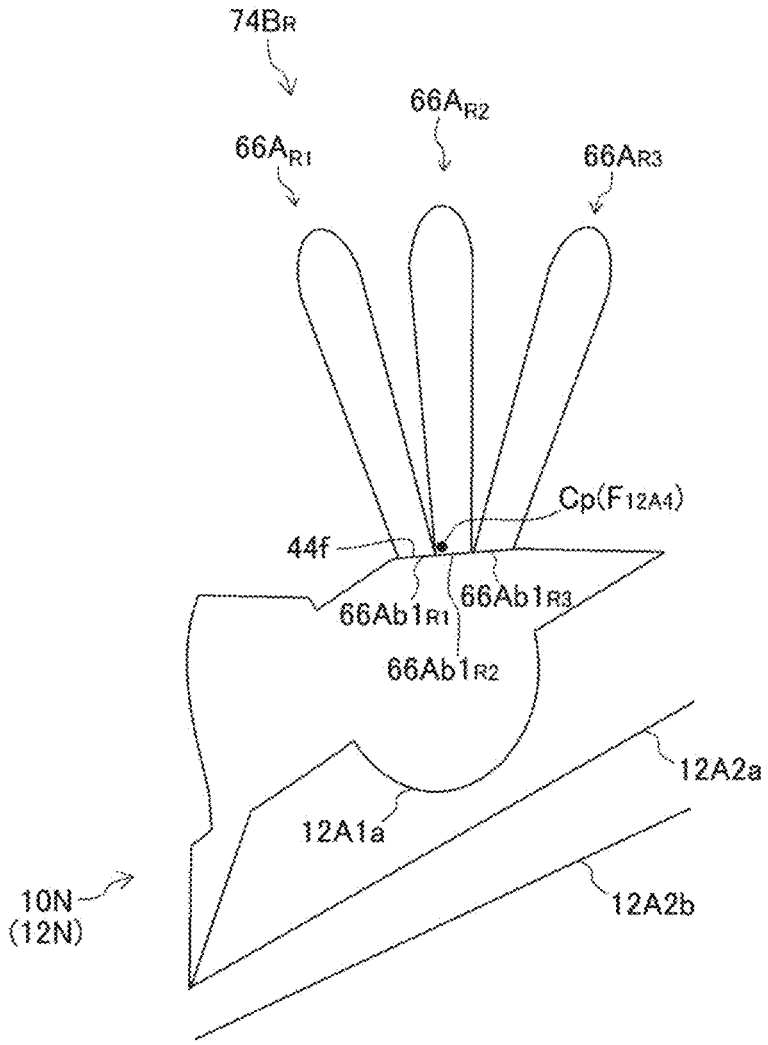

FIG. 122 is a top view (schematic diagram) of the vehicular lighting fixture 74$B_R$.

Figure 123:
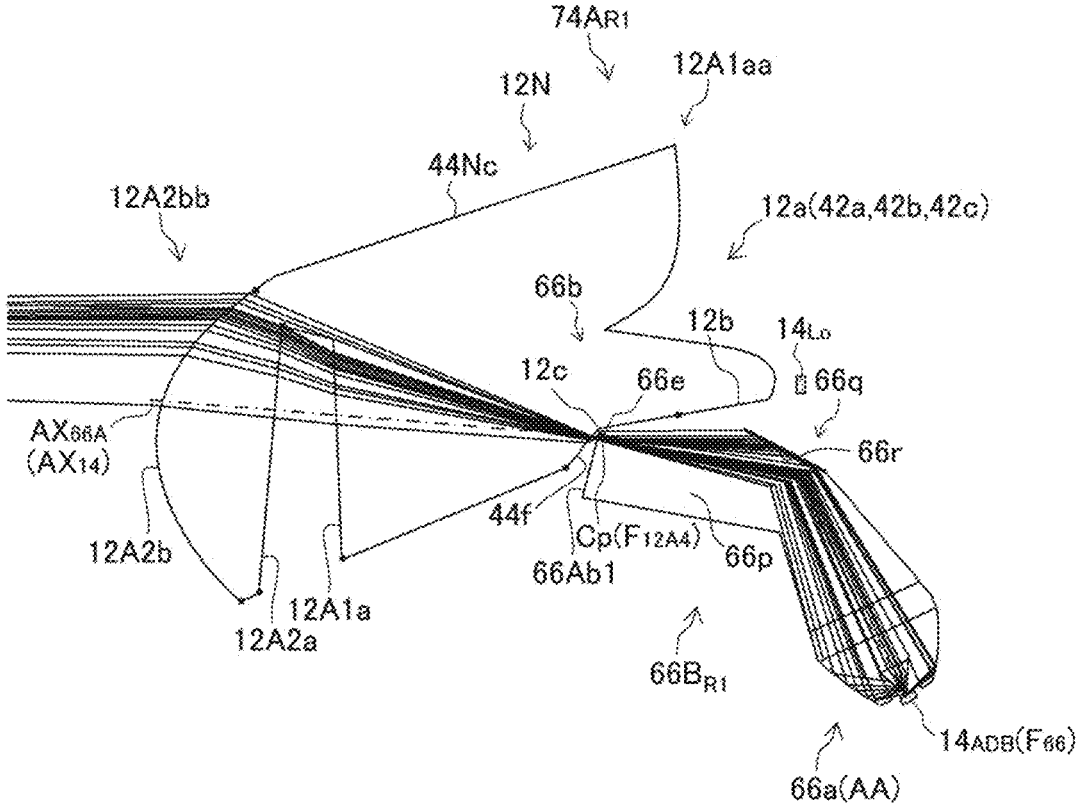

FIG. 123 is a longitudinal cross-sectional view of the vehicular lighting fixture 74$A_{R1}$ using the second lens body 66$B_{R1}$ which is a modification of the second lens body 66$A_{R1}$.

Figure 124:
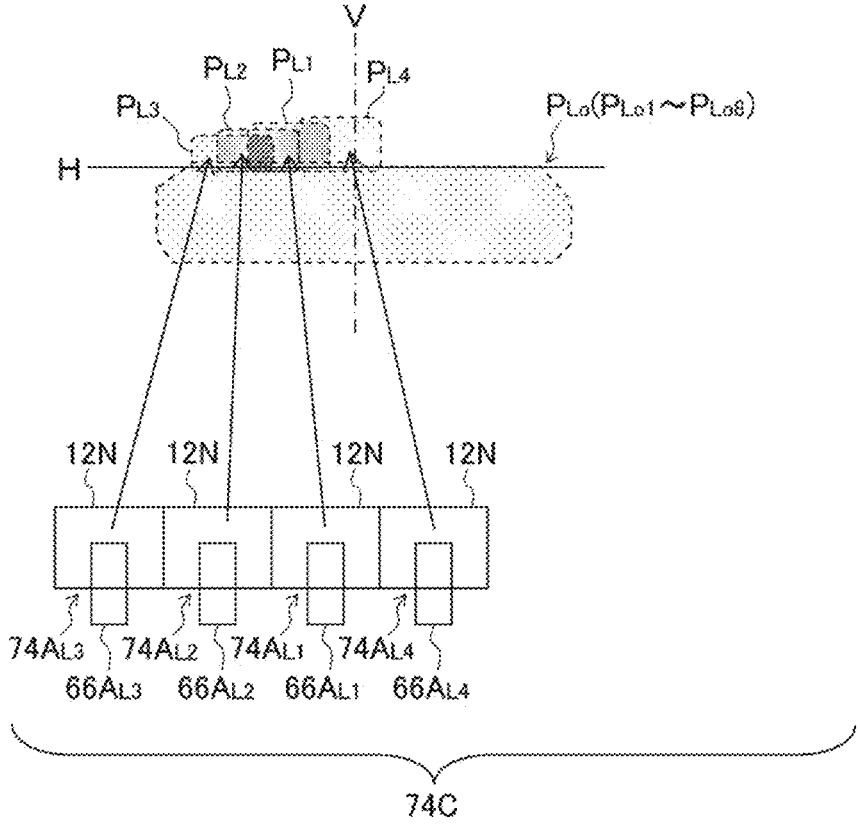

FIG. 124 is a schematic block diagram of the vehicular lighting fixture 74C of Embodiment 17.

Figure 125:
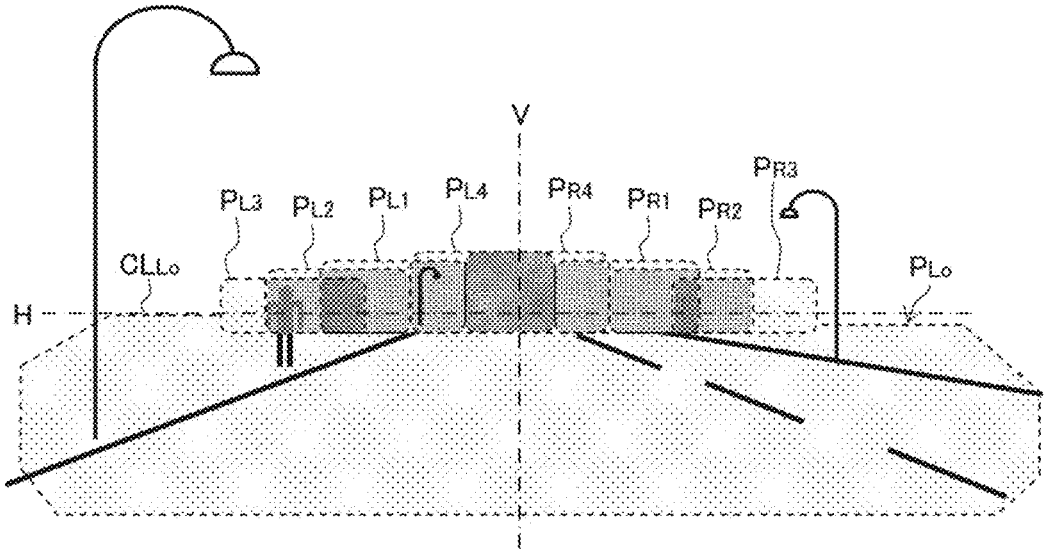

FIG. 125 is an example of the high beam light distribution pattern (composite light distribution pattern) on which the low beam light distribution pattern $P_{Lo}$ ($P_{Lo1}$ to $P_{Lo8}$) and the plurality of ADB light distribution patterns $P_{L1}$ to $P_{L4}$ and $P_{R1}$ to $P_{R4}$ are superimposed.

Figure 126:
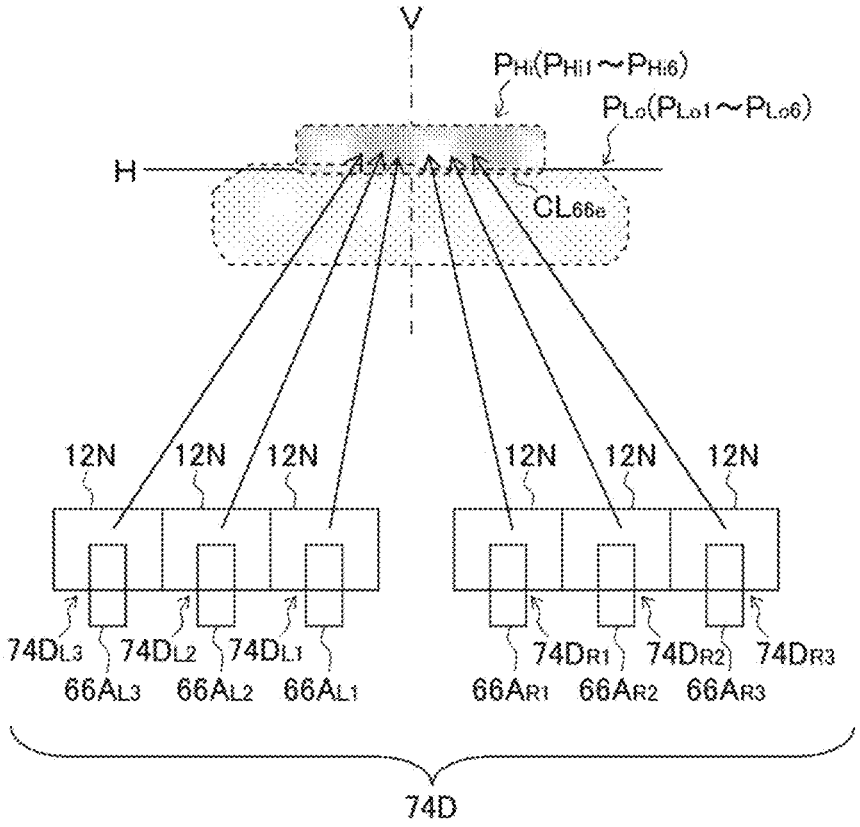

FIG. 126 is a schematic block diagram of the vehicular lighting fixture 74D of Embodiment 18.

Figure 127A:
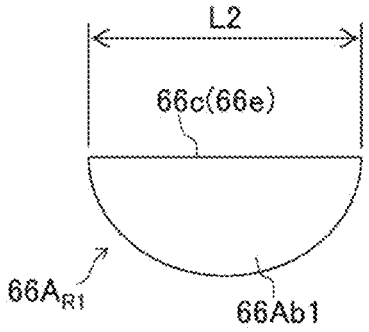
Figure 127B:
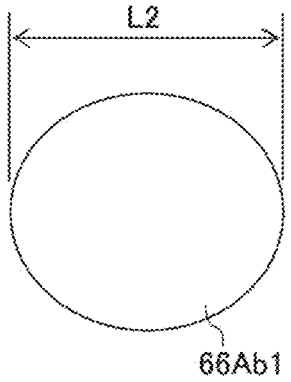
Figure 127C:
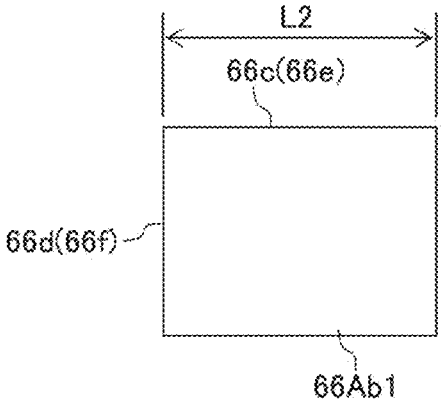

FIG. 127A to FIG. 127C are front views of the emission surface 66Ab1 of the second lens body 66$A_{R1}$ constituting the vehicular lighting fixture 74$D_{R1}$.

Figure 128:
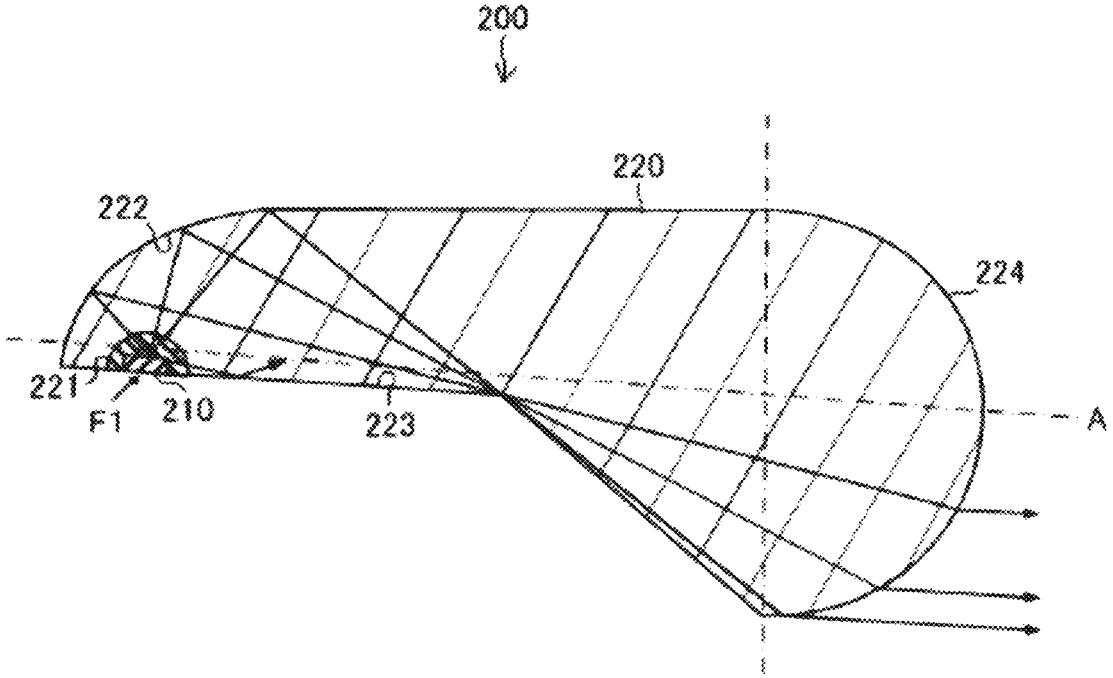
FIG. 128 CONVENTIONAL ART

FIG. 128 is a longitudinal cross-sectional view of the vehicular lighting fixture 200 according to Patent Literature 1.

Figure 129:
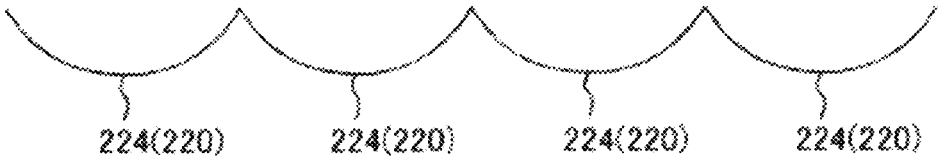
FIG. 129 CONVENTIONAL ART

FIG. 129 is a top view depicting a state when a plurality of vehicular lighting fixtures 200 (a plurality of lens bodies 220) are disposed in a line.

Figure 130A:
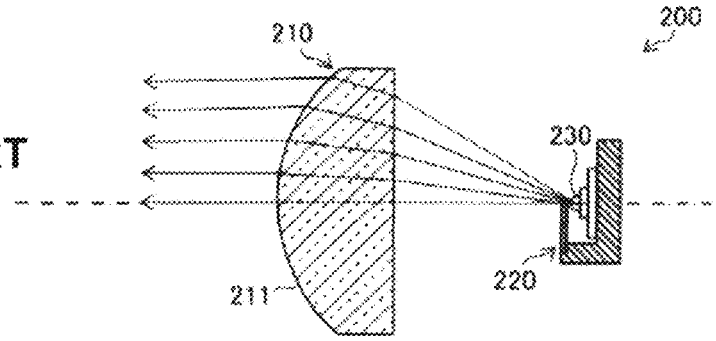
FIG. 130A CONVENTIONAL ART
Figure 130B:
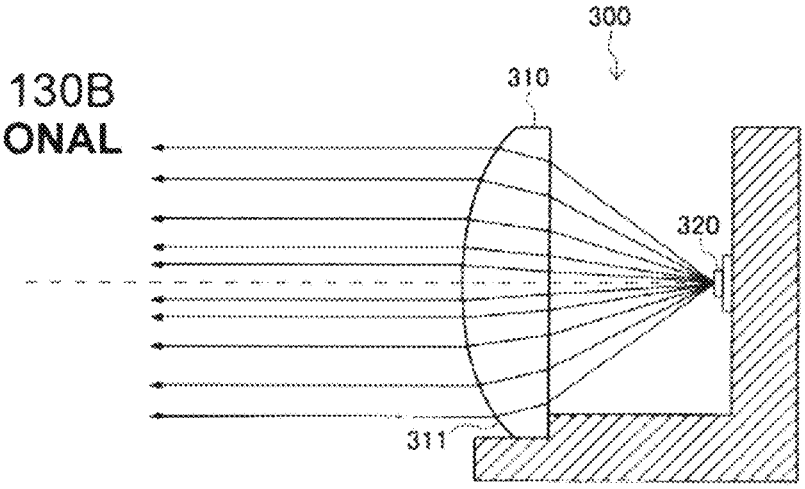
FIG. 130B CONVENTIONAL ART
Figure 130C:
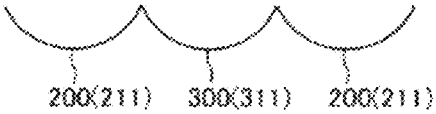
FIG. 130C CONVENTIONAL ART

FIG. 130A is a longitudinal cross-sectional view of the low beam vehicular lighting fixture 200, FIG. 130B is a longitudinal cross-sectional view of the high beam vehicular lighting fixture 300, and FIG. 130C is a diagram (top view) depicting the state when the vehicular lighting fixtures 200 and 300 (lenses 210 and 310) are arranged in parallel.

Figure 131:
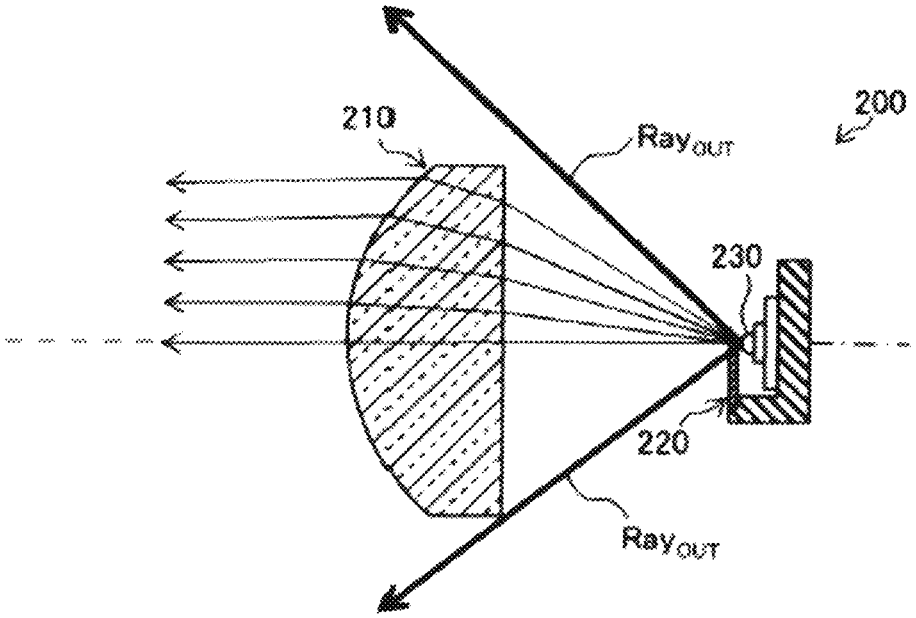
FIG. 131 CONVENTIONAL ART

FIG. 131 is a side view of the vehicular lighting fixture 200 according to Patent Literature 1.

Figure 132A:
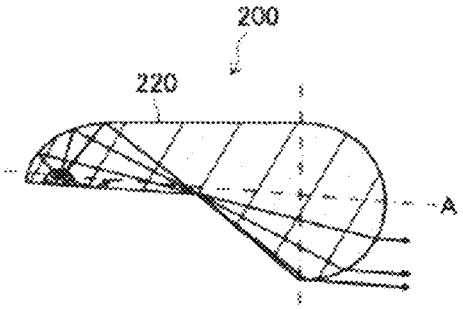
CONVENTIONAL ART FIG. 132A
Figure 132B:
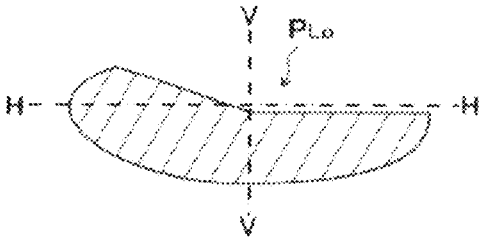
FIG. 132B CONVENTIONAL ART
Figure 132C:
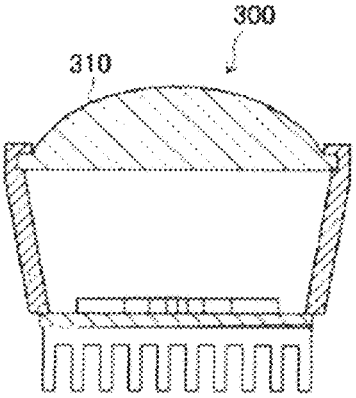
FIG. 132C CONVENTIONAL ART
Figure 132D:
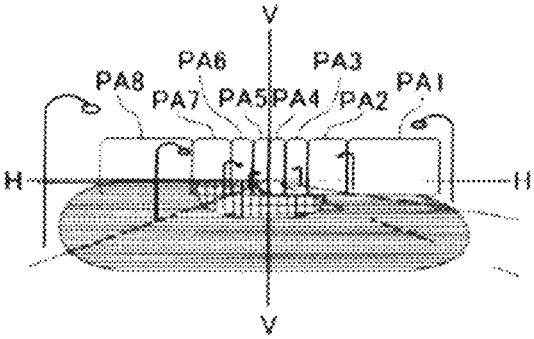
FIG. 132D CONVENTIONAL ART

FIG. 132A is a longitudinal cross-sectional view of the low beam lighting fixture unit 200 (lens body 220), FIG. 132B is an example of the low beam light distribution pattern $P_{Lo}$ formed by light irradiated forward from the low beam lighting fixture unit 200 (lens body 220), FIG. 132C is a schematic block diagram view of the ADB lighting fixture unit 300 equipped with the lens body 310, and FIG. 132D is an example of a plurality of ADB light distribution patterns PA1 to PA8 formed by the light irradiated forward from the ADB lighting fixture unit 300 (lens body 310).

DESCRIPTION OF EMBODIMENTS

A vehicular lamp fitting according to Embodiment 1 of the present invention will be described with reference to the drawings.

Figure 1:
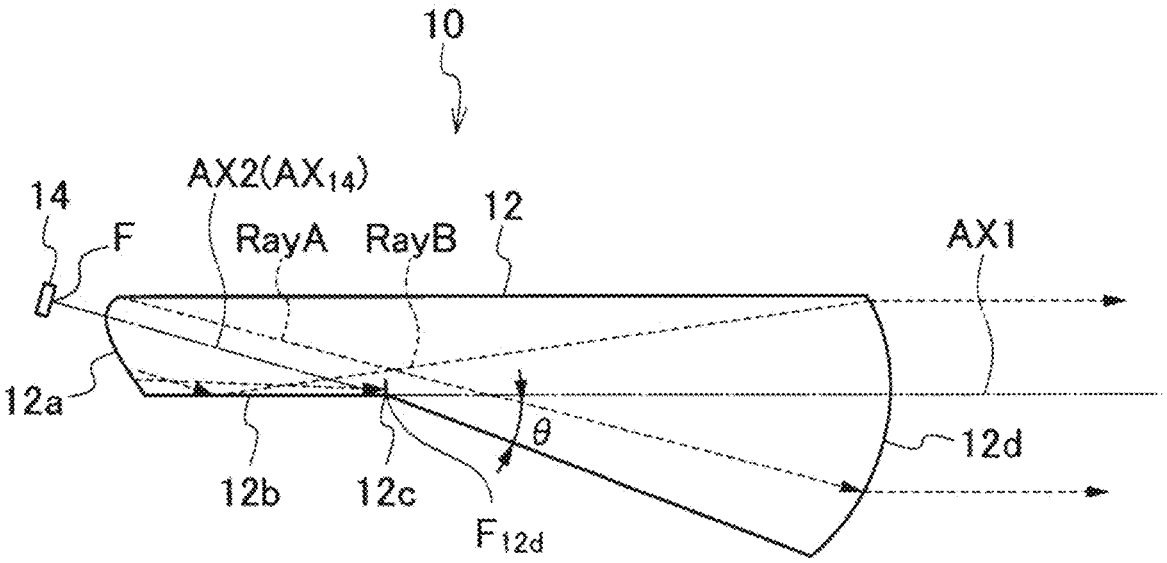
FIG. 1 is a longitudinal cross-sectional view of the vehicular lamp fitting 10 according to Embodiment 1 of the present invention.

FIG. 1 is a longitudinal cross-sectional view of the vehicular lamp fitting 10 according to Embodiment 1 of the present invention.

Figure 11A:
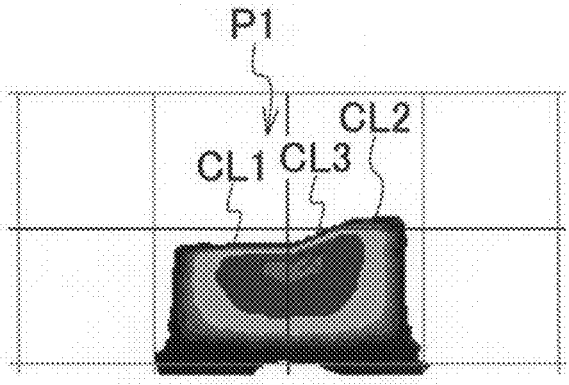
FIG. 11A illustrates the low beam light distribution pattern P1 on virtual vertical screen which faces the front face of the vehicle (disposed at about 25 m in front of the front face of the vehicle)

As illustrated in FIG. 1, the vehicular lamp fitting 10 according to Embodiment 1 includes a lens body 12, and a light source 14 which is disposed in the vicinity of an entry surface 12*a* of the lens body 12, and is configured as a vehicular head light which forms a low beam light distribution pattern P1, which includes cut-off lines CL1 to CL3 on an upper edge illustrated in FIG. 11A on a virtual vertical screen which faces the front face of the vehicle (disposed at about 25 m in front of the front face of the vehicle).

Figure 2A:
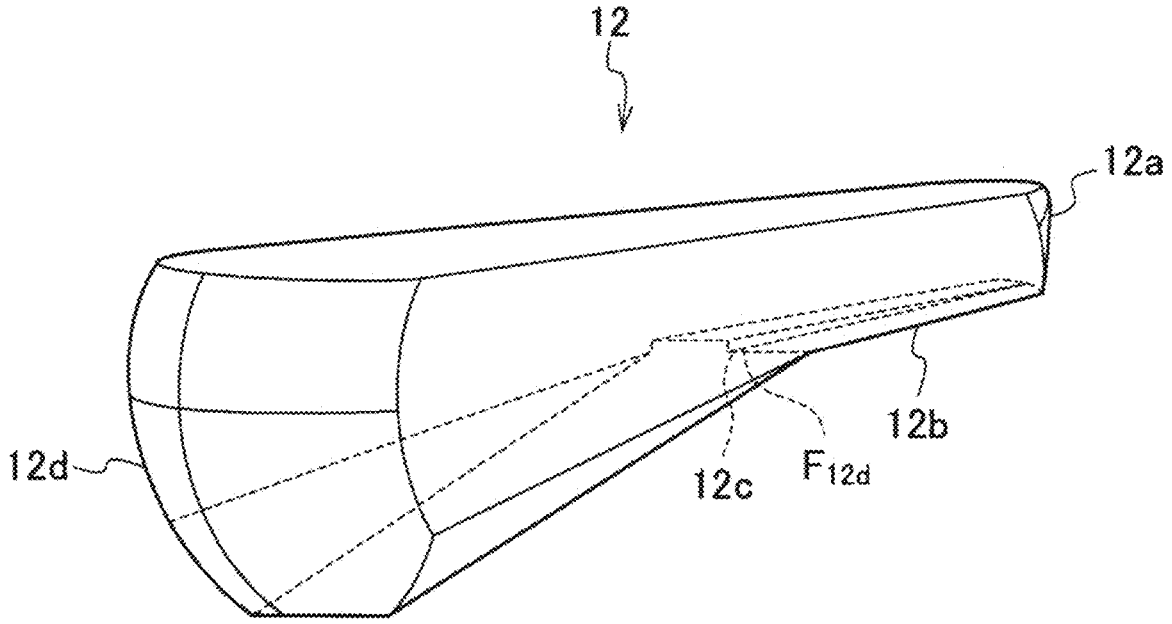
FIG. 2A is a perspective view of the lens body 12 when viewed from the front.
Figure 2B:
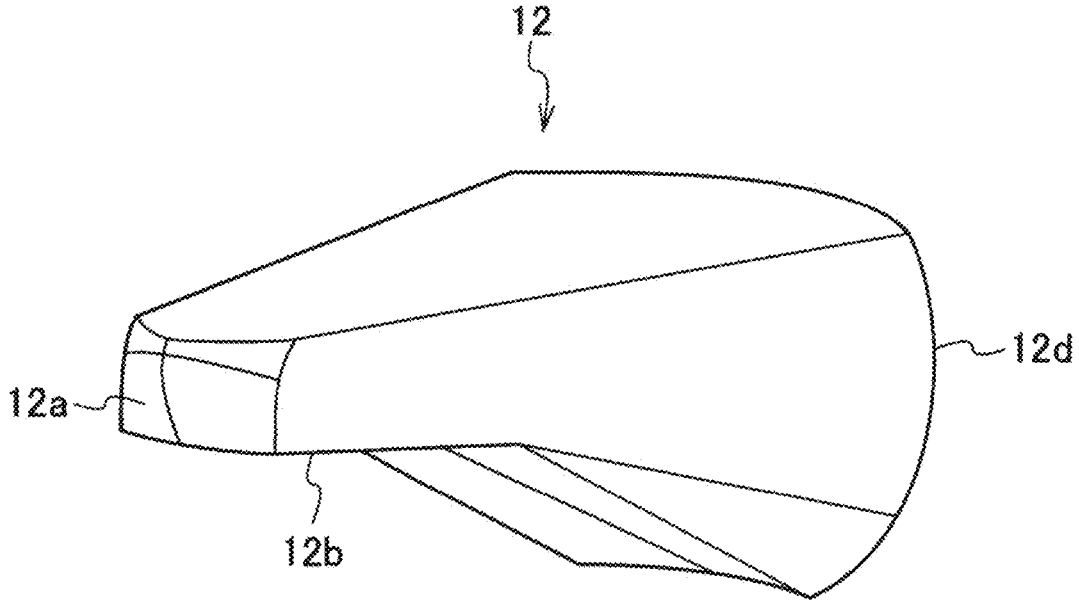
FIG. 2B is a perspective view of the lens body 12 when viewed from the back.
Figure 3A:
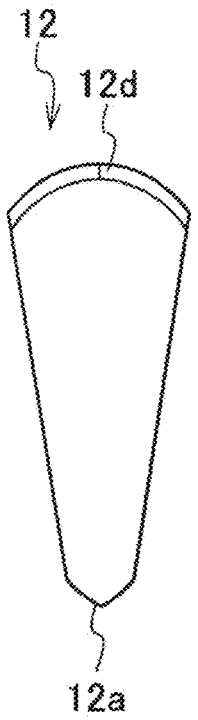
FIG. 3A is a top view.
Figure 3C:
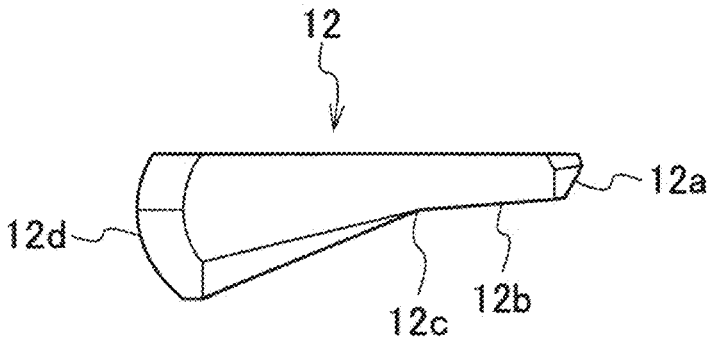
FIG. 3C is a side view of the lens body 12.
Figure 3B:
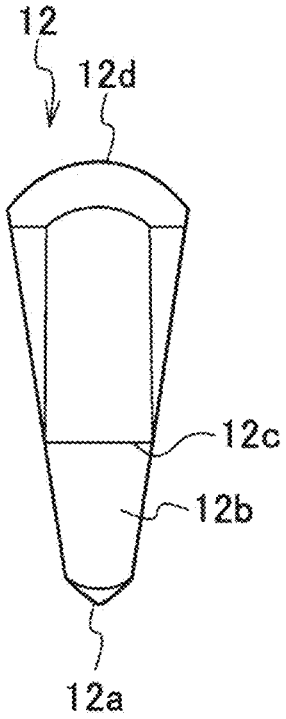
FIG. 3B is a bottom view.

FIG. 2A is a perspective view of the lens body 12 when viewed from the front, FIG. 2B is a perspective view of the lens body 12 when viewed from the back, FIG. 3A is a top view, FIG. 3B is a bottom view, and FIG. 3C is a side view of the lens body 12.

As illustrated in FIG. 1, the lens body 12 is a lens body having a shape along a first reference axis AX1 extending in the horizontal direction, and includes the entry surface 12*a*, a reflection surface 12*b*, a shade 12*c*, an exit surface 12*d*, and a reference point F which is disposed in the vicinity of the entry surface 12*a* in the optical design. The entry surface 12*a*, the reflection surface 12*b*, the shade 12*c* and the exit surface 12*d* are disposed in this order along the first reference axis AX1. The material of the lens body 12 may be polycarbonate, or other transparent resins, such as acrylic or glass.

In FIG. 1, a dotted line with an arrow at the end indicates an optical path of light from the light source 14 (to be more precise, the reference point F) which entered the lens body 12.

The major functions of the lens body 12 are primarily capturing light from the light source 14 in the lens body 12, and secondly forming a low beam light distribution pattern which includes a cut-off line on an upper edge, by inverting and projecting a luminous intensity distribution (light source image) which is formed in the vicinity of a focal point $F_{12d}$ of the exit surface 12*d* (lens unit) by direct light RayA, which travels toward the exit surface 12*d* and reflected light RayB, which is internally reflected on the reflection surface 12*b*, out of the light captured in the lens body 12.

Figure 4A:
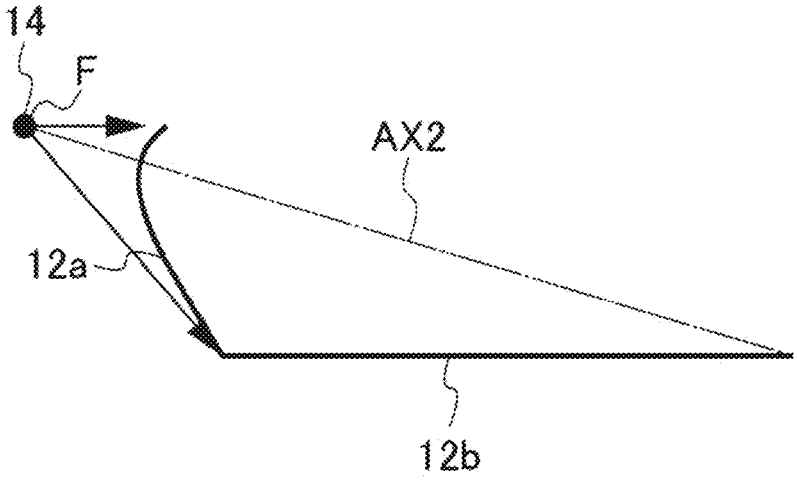
FIG. 4A is a diagram depicting a state when the light from the light source 14 (to be more precise, the reference point F) enters the entry surface 12*a*.
Figure 4B:
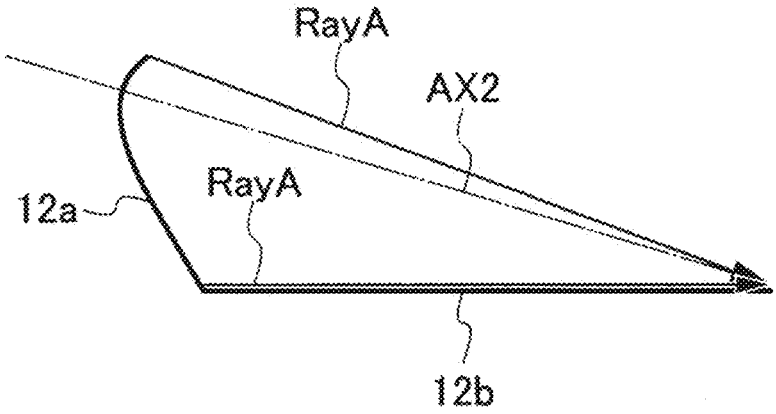
FIG. 4B is a diagram depicting a state when the light from the light source 14, which entered the lens body 12 (direct light RayA), is condensed.

FIG. 4A is a diagram depicting a state when the light from the light source 14 (to be more precise, the reference point F) enters the entry surface 12*a*, and FIG. 4B is a diagram depicting a state when the light from the light source 14, which entered the lens body 12 (direct light RayA), is condensed.

The entry surface 12*a* is formed in the rear end of the lens body 12, and is a surface through which the light from the light source 14 (to be more precise, the reference point F in the optical design), which is disposed in the vicinity of the entry surface 12*a* (see FIG. 4A), is refracted and enters the lens body 12 (e.g. free-form surface that is convex toward the light source 14), and the surface shape thereof is configured such that the light from the light source 14 (direct light RayA), which entered the lens body 12, is condensed toward the shade 12*c* in a direction closer to a second reference axis AX2 with respect to at least the vertical direction (see FIG. 4B). The second reference axis AX2 passes through the center of the light source 14 (to be more precise, reference point F) and a point in the vicinity of the shade 12*c*, and is inclined forward and diagonally downward with respect to the first reference axis AX1 (see FIG. 1).

The light source 14 includes, for example, a metal substrate (not illustrated), and a semiconductor light emitting element (not illustrated), such as a white LED light source (or white LD light source) mounted on the surface of the substrate. A number of the semiconductor light emitting elements is 1 or more. The light source 14 may be a light source other than the semiconductor light emitting element, such as a white LED light source (or white LD light source). The light source 14 is disposed in the vicinity of the entry surface 12*a* of the lens body 12 (in the vicinity of the reference point F) in an attitude such that the light emitting surface (not illustrated) thereof faces forward and diagonally downward, in other words, in an attitude such that the optical axis $AX_{14}$ of the light source 14 matches the second reference axis AX2. The light source 14 may be disposed in the vicinity of the entry surface 12*a* of the lens body 12 (in the vicinity of the reference point F) in an attitude such that the optical axis $AX_{14}$ of the light source 14 does not match the second reference axis AX2 (e.g. in the attitude such that the optical axis $AX_{14}$ of the light source 14 is disposed in the horizontal direction).

If the light source 14 is a semiconductor light emitting element (e.g. white LED light source), the directional characteristic of the light emitted from the light source 14 (light emitting surface) has Lambertian light distribution, and can be expressed by $I(\theta)=I0\times\cos\theta$. This expresses the diffusion of the light emitted from the light source 14. Here $I(\theta)$ denotes the luminous intensity of the light in the direction that is inclined from the optical axis $AX_{14}$ of the light source 14 by angle $\theta$, and I0 denotes the luminous intensity on the optical axis $AX_{14}$. In the light source 14, the luminous intensity is the maximum on the optical axis $AX_{14}$ ($\theta=0$).

Figure 5:
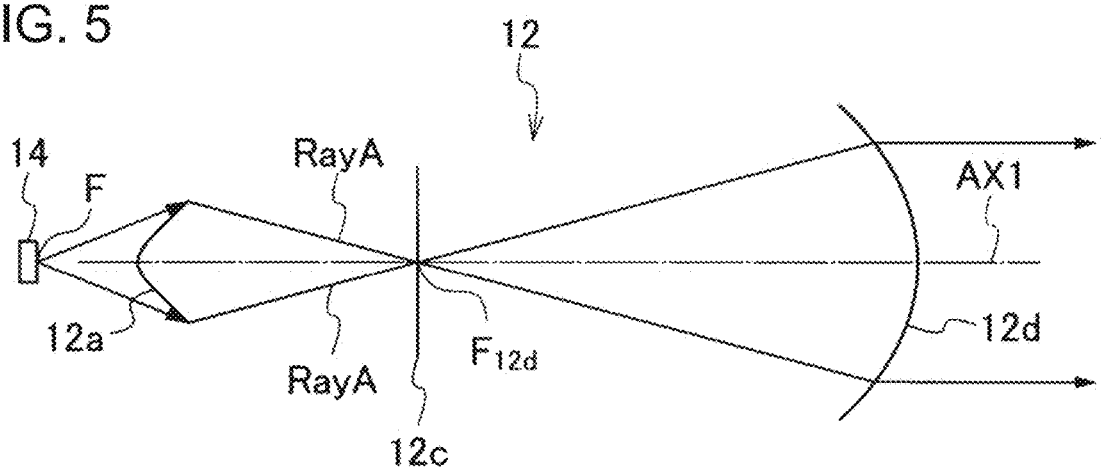
FIG. 5 is an example of the entry surface 12*a* (cross-sectional view).
Figure 6:
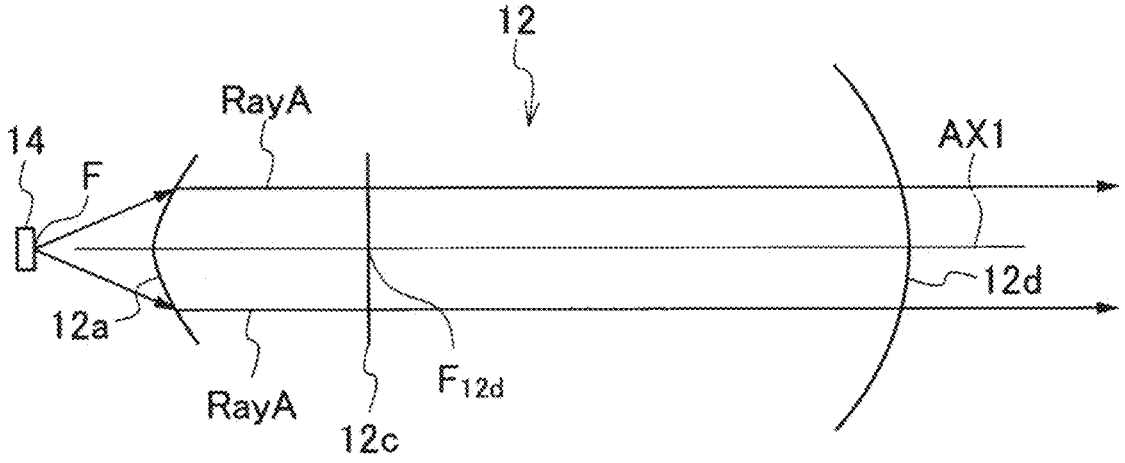
FIG. 6 is another example of the entry surface 12*a* (cross-sectional view).

FIG. 5 is an example of the entry surface 12*a* (cross-sectional view), and FIG. 6 is another example of the entry surface 12*a* (cross-sectional view).

As illustrated in FIG. 5, the surface shape of the entry surface 12*a* is configured such that the light from the light source 14 which entered the lens body 12 (direct light RayA), is condensed toward the shade 12*c* in a direction closer to the first reference axis AX1 with respect to the horizontal direction. The surface shape of the entry surface 12*a* may be configured such that the light from the light source 14 which entered the lens body 12 (direct light RayA), becomes parallel with the reference axis AX1 with respect to the horizontal direction.

The degree of diffusion of the low beam light distribution pattern in the horizontal direction can be freely adjusted by adjusting the surface shape of the entry surface 12*a* (e.g. curvature of the entry surface 12*a* in the horizontal direction).

Figure 7A:
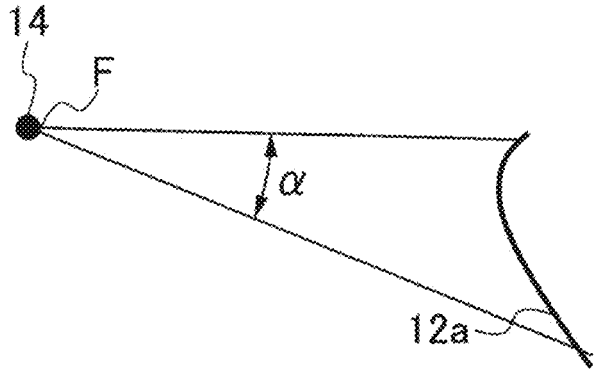
FIG. 7A and FIG. 7B are diagrams depicting the distance between the entry surface 12*a* and the light source 14.
Figure 7B:
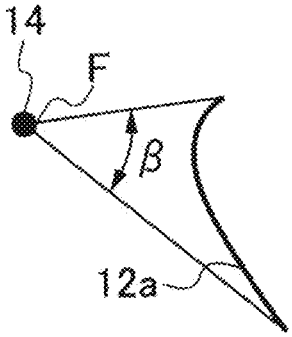

FIG. 7A and FIG. 7B are diagrams depicting the distance between the entry surface 12*a* and the light source 14.

By decreasing the distance between the entry surface 12*a* and the light source 14 (see FIG. 7B), the light source image becomes smaller compared with the case of increasing the distance between the entry surface 12*a* and the light source 14 (see FIG. 7A). As a result, the maximum luminous intensity of the luminous intensity distribution (and the low beam light distribution pattern) that is formed in the vicinity of the focal point $F_{12d}$ of the exit surface 12*d* (lens unit) can be increased even more.

Further, by decreasing the distance between the entry surface 12*a* and the light source 14 (see FIG. 7B), the light from the light source 14 that is captured in the lens body 12 increases, compared with the case of increasing the distance between the entry surface 12*a* and the light source 14 (see FIG. 7A) ($\beta>\alpha$). As a result, the efficiency of the lens body improves.

The reflection surface 12*b* is a plane-shaped reflection surface extending forward in the horizontal direction from the lower edge of the entry surface 12*a*. The reflection surface 12*b* is a reflection surface that totally reflects the light emitted onto the reflection surface 12*b*, out of the light from the light source 14 which entered the lens body 12, and metal deposition is not performed on the reflection surface 12*b*. The light emitted onto the reflection surface 12*b*, out of the light from the light source 14 which entered the lens body 12, is internally reflected by the reflection surface 12*b* and is directed to the exit surface 12*d*, is then refracted by the exit surface 12*d*, and finally directed to the road surface. In other words, the reflected light RayB, internally reflected by the reflection surface 12*b*, is returned at the cut-off line, and is superposed onto the light distribution pattern after the cut-off line. As a result, the cut-off line is formed on the upper edge of the low beam light distribution pattern.

Figure 14A:
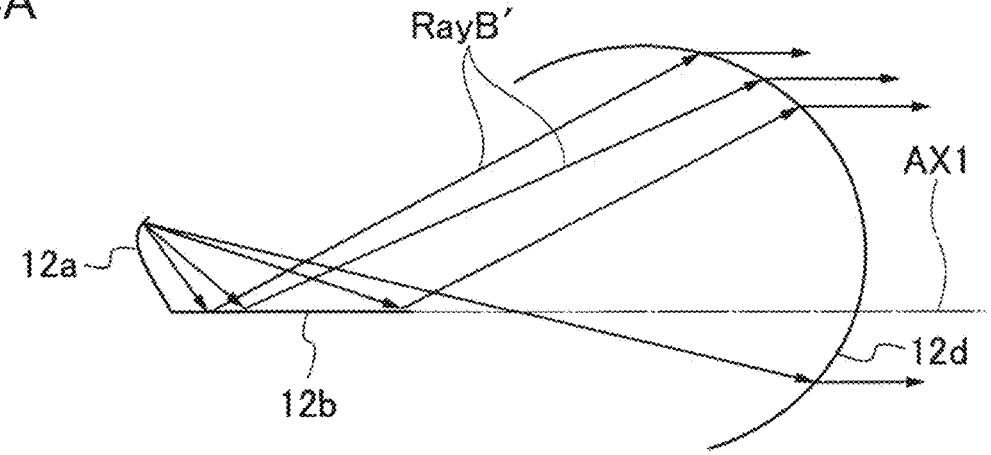
FIG. 14A is a view depicting how the reflected light RayB' traveling in a direction that does not enter the outgoing surface 12 *d* can be captured by extending the reflecting surface 12 *b* upward when the reflecting surface 12 *b* is arranged in the horizontal direction is there.
Figure 14B:
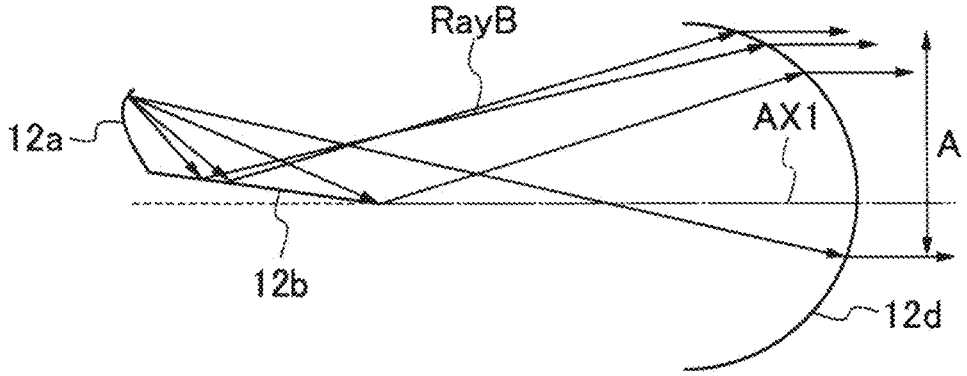
FIG. 14B is a view illustrating a manner in which more light (reflected light RayB internally reflected by the reflecting surface 12 *b*) can be captured without extending the reflecting surface 12 *b* upward, in the case where the reflecting surface 12 *b* is tilted with respect to the first reference axis AX 1.

The reflection surface 12*b* may be a plane-shaped reflection surface inclined forward and diagonally downward from the lower edge of the entry surface 12*a* with respect to the first reference axis AX1 (see FIG. 14B). The advantage of disposing the reflection surface 12*b* to be inclined with respect to the first reference axis AX1 will be described later.

The shade 12*c* extending in the crosswise direction is formed on the front end of the reflection surface 12*b*.

Figure 8:
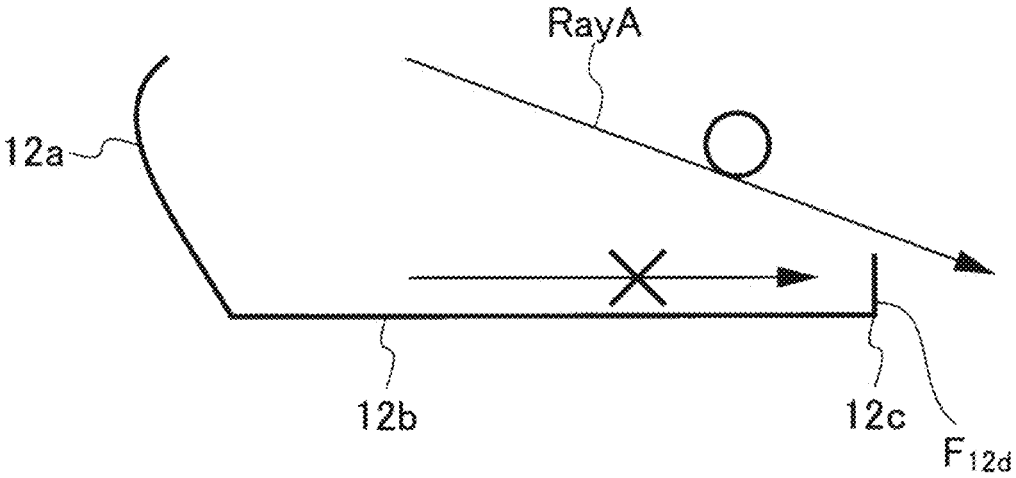
FIG. 8 is a diagram depicting functions of the shade 12*c*.

FIG. 8 is a diagram depicting functions of the shade 12*c*.

As illustrated in FIG. 8, a main function of the shade 12*c* is to shield a part of the light from the light source 14 which entered the lens body 12, and to form a luminous intensity distribution (light source image), that includes an edge corresponding to the cut-off line defined on the lower edge by the shade 12*c*, in the vicinity of the focal point $F_{12d}$ of the exit surface 12*d* (lens unit).

Figure 9A:
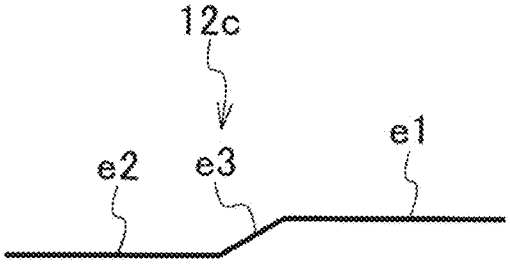
FIG. 9A is a schematic diagram depicting the shade 12*c* when viewed from the light source 14 position.
Figure 9B:
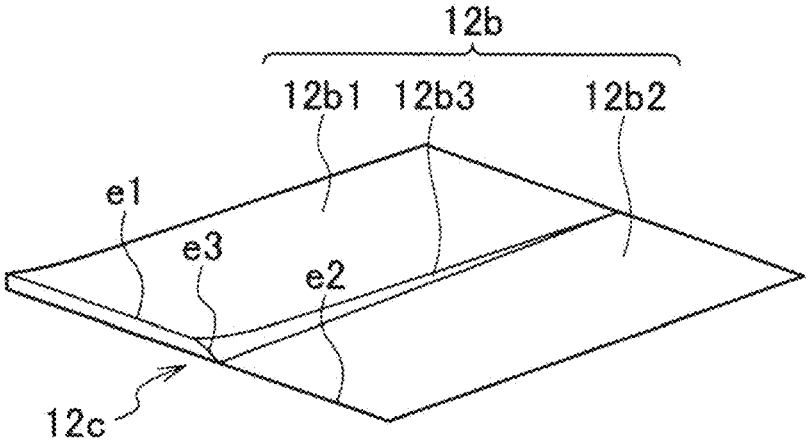
FIG. 9B is an enlarged perspective view of the reflection surface 12*b* (including the shade 12*c*) illustrated in FIG. 2A.
Figure 9C:
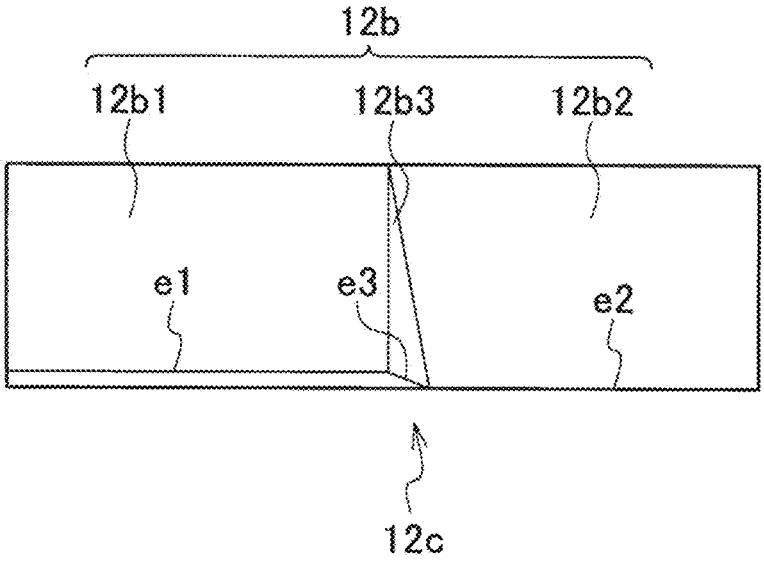
FIG. 9C is a top view of the reflection surface 12*b* (including the shade 12*c*) illustrated in FIG. 2A.

FIG. 9A is a schematic diagram depicting the shade 12*c* when viewed from the light source 14 position, FIG. 9B is an enlarged perspective view of the reflection surface 12*b* (including the shade 12*c*) illustrated in FIG. 2A, and FIG. 9C is a top view of the reflection surface 12*b* (including the shade 12*c*) illustrated in FIG. 2A.

As illustrated in FIG. 2A and FIG. 9A to FIG. 9C, the shade 12*c* includes an edge e1 corresponding to a left horizontal cut-off line, an edge e2 corresponding to a right horizontal cut-off line, and an edge e3 corresponding to a diagonal cut-off line connecting the left horizontal cut-off line and the right horizontal cut-off line.

The reflection surface 12*b* includes: a first reflection region 12*b*1 between the lower edge of the entry surface 12*a* and the edge e1 corresponding to the left horizontal cut-off line; a second reflection region 12*b*2 between the lower edge of the entry surface 12*a* and the edge e2 corresponding to the right horizontal cut-off line; and a third reflection region 12*b*3 between the first reflection region 12*b*1 and the second reflection region 12*b*2.

The first reflection region 12*b*1 gradually curves up from the lower edge of the entry surface 12*a* approaching the edge e1 corresponding to the left horizontal cut-off line, and the second reflection region 12*b*2, on the other hand, extends forward from the lower edge of the entry surface 12*a* in the horizontal direction.

As a result, the edge e1 corresponding to the left horizontal cut-off line is disposed in a position that is one step higher in the vertical direction than the edge e2 corresponding to the right horizontal cut-off line (in the case of driving on the right-hand side). For certain, the edge e1 corresponding to the left horizontal cut-offline may be disposed in a position that is one step lower in the vertical direction than the edge e2 corresponding to the right horizontal cut-off line (in the case of driving on the left hand side).

The shade 12*c* may also be created by forming grooves on the front end of the reflection surface 12*b*, including: a groove corresponding to the left horizontal cut-off line, a groove corresponding to the right horizontal cut-off line, and a groove corresponding to the diagonal cut-off line connecting the left horizontal cut-off line and the right horizontal cut-off line.

Figure 10A:
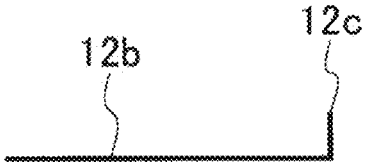
FIG. 10A to FIG. 10C illustrate modifications (side views) of the shade 12*c*.
Figure 10B:
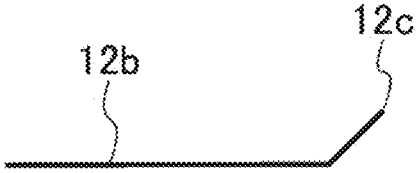
Figure 10C:
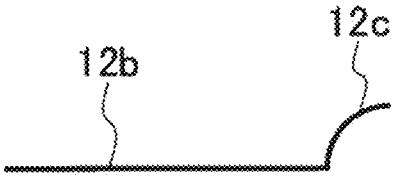

In FIG. 10A to FIG. 10C, modifications (side views) of the shade 12*c* are depicted. The shade 12*c* may be extended upward from the front end of the reflection surface 12*b* (see FIG. 10A), may be extended forward and diagonally upward in a curved state (see FIG. 10B), or may be extended forward and diagonally upward (see FIG. 10C). The shade 12*c* is not limited to these, but may have any shape as long as a part of the light from the light source 14 that enters the lens body 12 is shielded so that this light does not travel toward the exit surface 12*d*. The shielded light may be used for other light distributions or optical guidings.

As illustrated in FIG. 1, the exit surface 12*d* is a surface (e.g. convex surface which protrudes forward) through which the direct light RayA, which is traveling toward the exit surface 12*d*, and the reflected light RayB, which is internally reflected by the reflection surface 12*b* and traveling toward the exit surface 12*d*, out of the light from the light source 14 which entered the lens body 12, exit, and is configured as a lens unit of which focal point $F_{12d}$ is set in the vicinity of the shade 12*c* (e.g. in the vicinity of the center of the shade 12*c* in the crosswise direction). The exit surface 12*d* reversely projects a luminous intensity distribution (light source image) formed in the vicinity of the focal point $F_{12d}$ of the exit surface 12*d* (lens unit) by the direct light RayA and the reflected light RayB traveling toward the exit surface 12*d*, and forms a low beam light distribution pattern which includes the cut-off line on the upper edge.

By increasing the distance between the shade 12*c* and the exit surface 12*d* (focal length), the light source image becomes smaller compared with a case of decreasing the distance between the shade 12*c* and the exit surface 12*d* (focal length). As a result, the maximum luminous intensity of the luminous intensity distribution (and low beam light distribution pattern), which is formed in the vicinity of the focal point $F_{12d}$ of the exit surface 12*d* (lens unit), can be further increased.

Further, by decreasing the distance between the exit surface 12*d* and the light source 14 (or the shade 12*c*), the direct light RayA and the reflected light RayB captured in the exit surface increases compared with a case of increasing the distance between the exit surface 12*d* and the light source 14 (or the shade 12*c*). As a result, efficiency improves.

The degree of diffusion of the low beam light distribution pattern in the horizontal direction and vertical direction can be freely adjusted by adjusting the surface shape of the exit surface 12*d*.

The surface connecting the front edge of the reflection surface 12*b* and the lower edge of the exit surface 12*d* is an inclined surface extending forward and diagonally downward from the front edge of the reflection surface 12*b*. The surface connecting the front edge of the reflection surface 12*b* and the lower edge of the exit surface 12*d* is not limited to this, but may be any surface as long as the surface does not shield the direct light RayA and the reflected light RayB travelling toward the exit surface 12*d*. In the same manner, the surface connecting the upper edge of the entry surface 12*a* and the upper edge of the exit surface 12*d* is a plane surface extending in the horizontal direction between the upper edge of the entry surface 12*a* and the upper edge of the exit surface 12*d*. However, the surface connecting the upper edge of the entry surface 12*a* and the upper edge of the exit surface 12*d* is not limited to this, but may be any surface as long as the surface does not shield the direct light RayA and the reflected light RayB travelling toward the exit surface 12*d*.

In the lens body 12 having the above configuration, light which entered the lens body 12 through the entry surface 12*a* is condensed toward the shade 12*c* in a direction closer to the second reference axis AX2 with respect to the vertical direction (e.g. condensed to the center of the shade 12*c*). If the surface shape of the entry surface 12*a* is configured as illustrated in FIG. 5, the light which entered the lens body through the entry surface 12*a* is condensed toward the shade 12*c* in a direction closer to the first reference axis AX1 with respect to the horizontal direction (e.g. condensed to the center of the shade 12*c*).

As described above, the direct light RayA condensed in the vertical direction and the horizontal direction and the reflected light RayB internally reflected by the reflection surface 12*b* travel toward the exit surface 12*d*, and exit through the exit surface 12*d*. At this time, by the direct light RayA and the reflected light RayB travelling toward the exit surface 12*d*, the luminous intensity distribution (light source image), which includes the edge corresponding to the cut-off line defined on the lower edge by the shade 12*c*, is formed in the vicinity of the focal point $F_{12d}$ of the exit surface 12*d* (lens unit). The exit surface 12*d* reversely projects this luminous intensity distribution and forms the low beam light distribution pattern P1, which includes the cut-off line on the upper edge, as illustrated in FIG. 11A on a virtual vertical screen.

This low beam light distribution pattern P1 has a central luminous intensity that is relatively high and excels in long range visibility. This is because the light source 14 is disposed in the vicinity of the entry surface 12*a* (vicinity of the reference point F) of the lens body 12 in the attitude with which the optical axis $AX_{14}$ of the light source 14 matches with the second reference axis AX2, and because the light on the optical axis $AX_{14}$ having relatively high intensity (luminous intensity) (direct light) is condensed toward the shade 12*c* in a direction closer to the second reference axis AX2 (e.g. condensed to the center of the shade 12*c*).

Figure 11B:
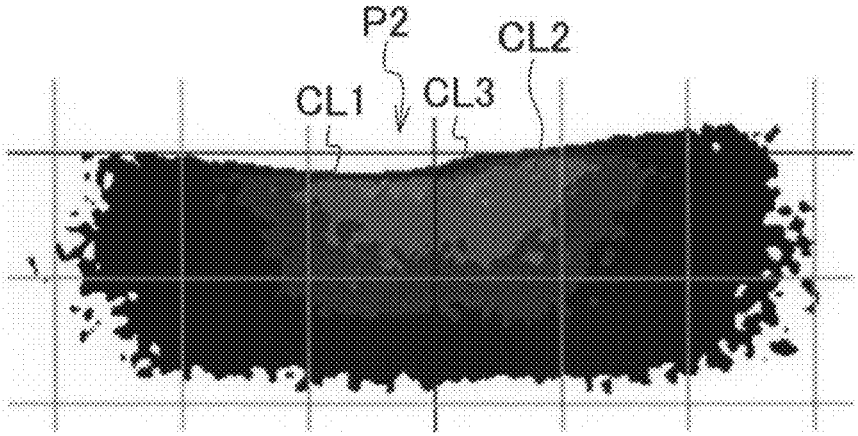
FIG. 11B illustrates a low beam light distribution pattern P2.

A low beam light distribution pattern P2, diffused in the horizontal direction, as illustrated in FIG. 11B, can be formed by adjusting the surface shape (e.g. curvature) of the entry surface 12*a* and/or the exit surface 12*d*.

Further, the lower edge of the low beam light distribution pattern P1 or P2 can be extended downward by increasing the inclination of the second reference axis AX2 with respect to the first reference axis AX1 (see angle θ indicated in FIG. 1).

If the surface shape of the entry surface 12*a* is configured as illustrated in FIG. 6, on the other hand, the light which entered the lens body 12 through the entry surface 12*a* becomes a light parallel with the first reference axis AX1 in the horizontal direction, as illustrated in FIG. 6.

Figure 11C:
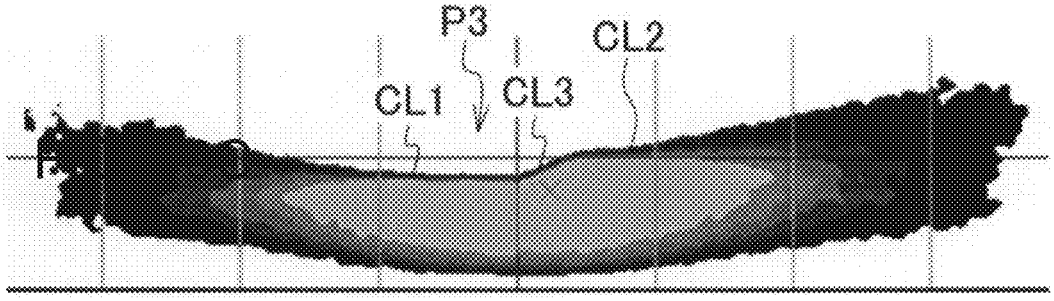
FIG. 11C illustrates a low beam light distribution pattern P3.

As described above, the direct light Ray A which condensed in the vertical direction and becomes parallel in the horizontal direction, and the reflected light RayB which is internally reflected by the reflection surface 12*b*, travel toward the exit surface 12*d* and exit through the exit surface 12*d*. At this time, by the direct light RayA and the reflected light RayB, travelling toward the exit surface 12*d*, the luminous intensity distribution (light source image), which includes the edges corresponding to the cut-off lines CL1 to CL3, defined on the lower edge of the shade 12*c*, is formed in the vicinity of the focal point $F_{12d}$ of the exit surface 12*d* (lens unit). The exit surface 12*d* reversely projects this luminous intensity distribution and forms a low beam light distribution pattern P3, which includes the cut-off lines CL1 to CL3 on the upper edge illustrated in FIG. 11C, on the virtual vertical screen. The low beam light distribution pattern P3 illustrated in FIG. 11C is not condensed in the horizontal direction, therefore the pattern is more diffused in the horizontal direction than the low beam light distribution pattern P1 illustrated in FIG. 11A.

Next, the relationship between the light source image formed by the light from the light source 14, which entered the lens body 12, and the low beam distribution light distribution pattern, will be described.

Figure 12:
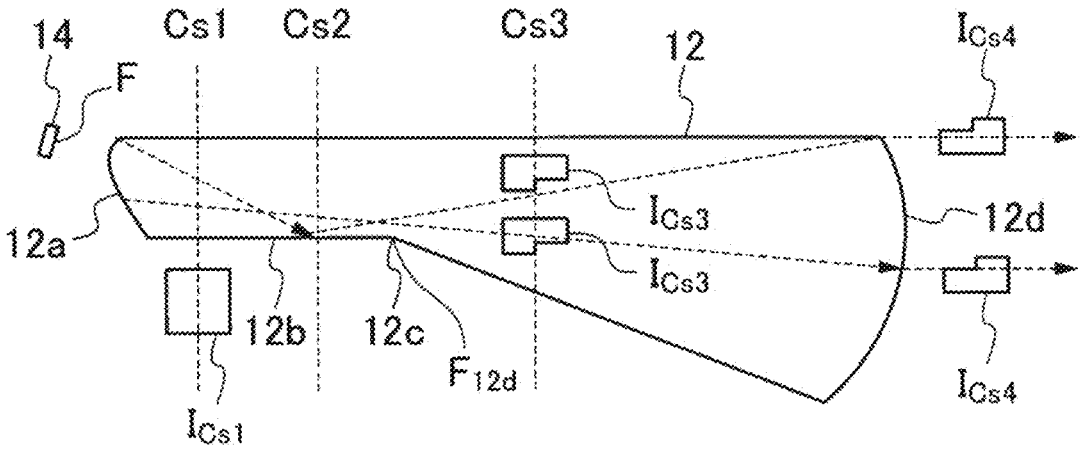
FIG. 12 is a diagram depicting the light source images formed by the light from the light source 14 on each cross-section Cs1 to Cs4.

FIG. 12 is a diagram depicting the light source images formed by the light from the light source 14 on each cross-section Cs1 to Cs3.

As illustrated in FIG. 12, the external shapes of the light source images $I_{Cs1}$ and $I_{Cs2}$ on the cross-sections Cs1 and Cs2 are the same as the external shape of the light source (the external shapes of the light source images are similar to and larger than the external shape of the light source 14).

The external shape of the light source image $I_{Cs3}$ on the cross-section CS3, after passing through the reflection surface 12*b* and the shade 12*c*, includes the edges e1, e2 and e3 corresponding to the cut-off lines CL1 to CL3 defined on the lower edge by the shade 12*c*. This light source image $I_{Cs3}$ is inverted by the function of the exit surface 12*d* (lens unit), and includes the edges e1, e2 and e3 corresponding to the cut-off lines CL1 to CL3 defined by an upper edge by the shade 12*c*.

The low beam light distribution patterns P1 to P3, illustrated in FIG. 11A to FIG. 11C, are formed based on this light source image which includes the edges e1, e2 and e3 corresponding to the cut-off lines CL1 to CL3 defined on the upper edge by the shade 12*c*, hence the low beam light distribution patterns P1 to P3 include the clear cut-off lines CL1, CL2 and CL3 on the upper edges.

Next, the advantages of disposing the reflection surface 12*b* so as to be inclined with respect to the first reference axis AX1 will be described in comparison with the case of disposing the reflection surface 12*b* in the horizontal direction.

The first advantage is that stray light decreases and efficiency improves compared with the case of disposing the reflection surface 12*b* in the horizontal direction.

Figure 13A:
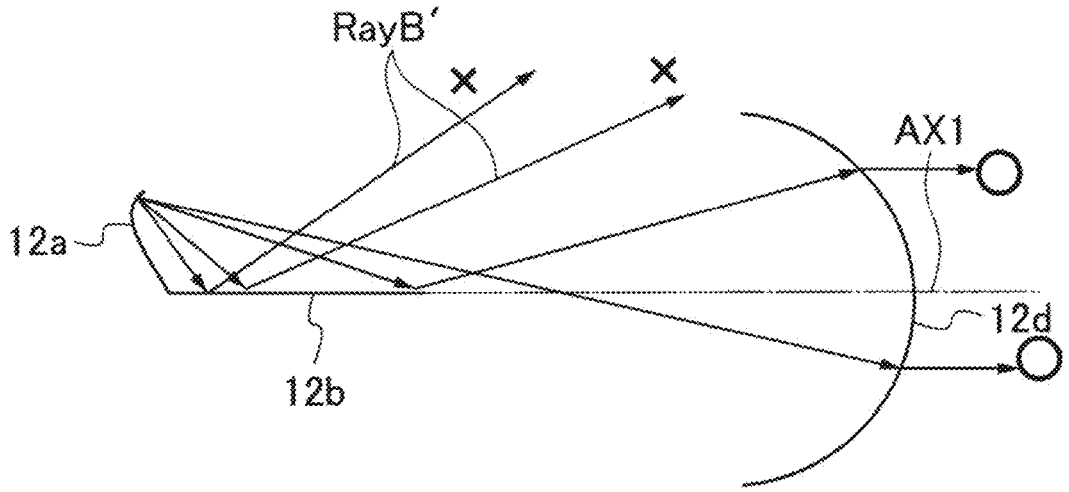
FIG. 13A is a view illustrating how the reflected light Ray B 'reflected internally by the reflecting surface 12 *b* advances in a direction in which the reflected light Ray B' does not enter the emitting surface 12 *d* when the reflecting surface 12 *b* is arranged in the horizontal direction.

In other words, in the case of disposing the reflection surface 12*b* in the horizontal direction, as illustrated in FIG. 13A, the reflected light RayB', which was internally reflected by the reflection surface 12*b*, becomes a stray light RayB' which travels in a direction that does not enter the exit surface 12*d*. As a result, the efficiency drops.

Figure 13B:
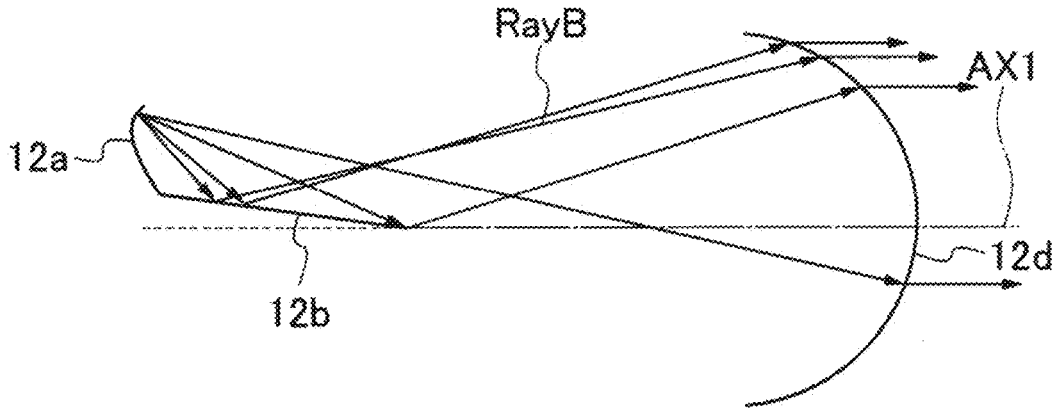
FIG. 13B is a view depicting how the reflected light Ray B, which is internally reflected by the reflecting surface 12 *b*, travels in a direction in which it is incident on the exit surface 12 *d* when the reflecting surface 12 *b* is disposed so as to be inclined with respect to the first reference axis AX 1 is there.

On the other hand, in the case of disposing the reflection surface 12*b* so as to be inclined with respect to the first reference axis AX1, as illustrated in FIG. 13B, the reflected light RayB, which was internally reflected by the reflection surface 12*b* and travels toward the exit surface 12*d*, increases, and light captured in the exit surface 12*d* (reflected light which was internally reflected by the reflection surface 12*b*) increases. As a result, the stray light decreases and the efficiency improves compared with the case of disposing the reflection surface 12*b* in the horizontal direction.

According to the simulation performed by the inventors of the present invention, in the case of disposing the reflection surface 12*b* so as to be inclined with respect to the first reference axis AX1 by 5°, the efficiency increases 33.8%, and in the case of disposing the reflection surface 12*b* so as to be inclined with respect to the first reference axis AX1 by 10°, the efficiency increases 60%.

The second advantage is that the lens body 12 can be downsized compared with the case of disposing the reflection surface 12*b* in the horizontal direction.

In other words, in the case of disposing the reflection surface 12*b* in the horizontal direction, as illustrated in FIG. 13A, the reflected light RayB', which was internally reflected by the reflection surface 12*b*, becomes a stray light RayB' which travels in a direction that does not enter the exit surface 12*d*. By extending the exit surface 12*d* upward, as illustrated in FIG. 14A, the stray light RayB' can be captured, but the size of the exit surface 12*d* increases because of the upward extension.

On the other hand, in the case of disposing the reflection surface 12*b* so as to be inclined with respect to the first reference axis AX1, as illustrated in FIG. 14B, the exit surface 12*d* can capture more light (reflected light RayB internally reflected by the reflection surface 12*b*) without extending the exit surface 12*d* upward. As a result, the exit surface 12*d* (and therefore the lens body 12) can be downsized compared with the case of disposing the reflection surface 12*b* in the horizontal direction.

According to the simulation performed by the inventors of the present application, in the case of disposing the reflection surface 12*b* so as to be inclined with respect to the first reference axis AX1 by 5°, the height A (height in the vertical direction of the light which exits through the exit surface 12*d*) indicated in FIG. 14B, decreases 8% compared with the case illustrated in FIG. 14A, and if the reflection surface 12*b* is disposed so as to be inclined with respect to the first reference axis AX1 by 10°, the height A indicated in FIG. 14B decreases 18.1% compared with the case illustrated in FIG. 14A.

Now an advantage of disposing the second reference axis AX2 so as to be inclined with respect to the first reference axis AX1, and condensing the light from the light source 14 which entered the lens body 12 toward the shade 12*c* in a direction closer to the second reference axis AX2 at least with respect to the vertical direction, will be described in comparison with the case of disposing the second reference axis AX2 in the horizontal direction and condensing the light from the light source 14 which entered the lens body 12 toward the shade 12*c* in a direction closer to the second reference axis AX2, at least with respect to the vertical direction.

The advantage is that stray light decreases and efficiency improves compared with the case of disposing the second reference axis AX2 in the horizontal direction and condensing the light from the light source 14 which entered the lens body 12 toward the shade 12*c* in a direction closer to the second reference axis AX2, at least with respect to the vertical direction.

Figure 15A:
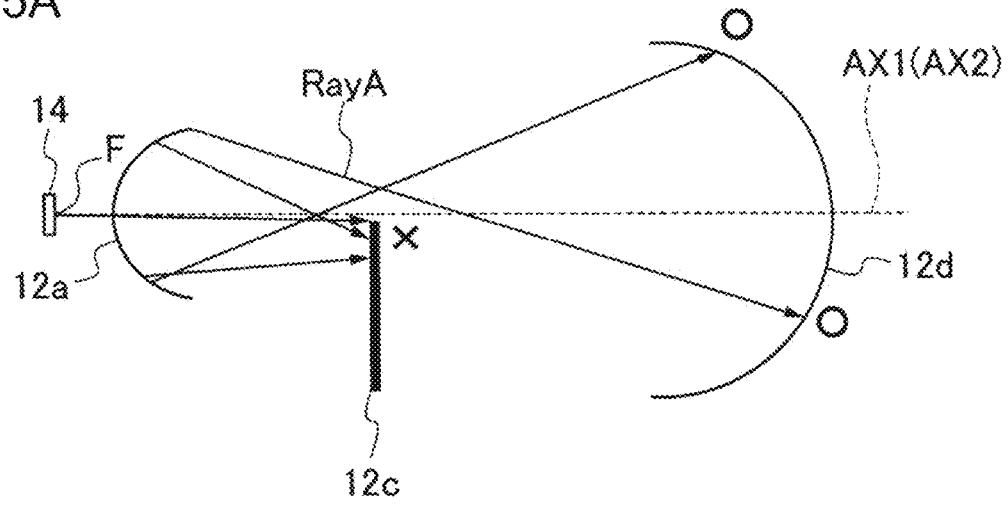
FIG. 15A illustrates most of the light from the light source 14 which entered the lens body 12 is shielded by the shade 12*c*, in the case of disposing the second reference axis AX2 in the horizontal direction and condensing the light from the light source 14 which entered the lens body 12 toward the shade 12*c* in a direction closer to the second reference axis AX2 at least with respect to the vertical direction.

In other words, in the case of disposing the second reference axis AX2 in the horizontal direction and condensing the light from the light source 14 which entered the lens body 12 toward the shade 12*c* in a direction closer to the second reference axis AX2 at least with respect to the vertical direction, as illustrated in FIG. 15A, most of the light from the light source 14 which entered the lens body 12 is shielded by the shade 12*c*. As a result, the efficiency drops considerably. Even if a reflection surface corresponding to the reflection surface 12*b* is added in FIG. 15A, the reflected light internally reflected by this reflection surface becomes stray light which travels in a direction that does not enter the exit surface 12*d*.

Figure 15B:
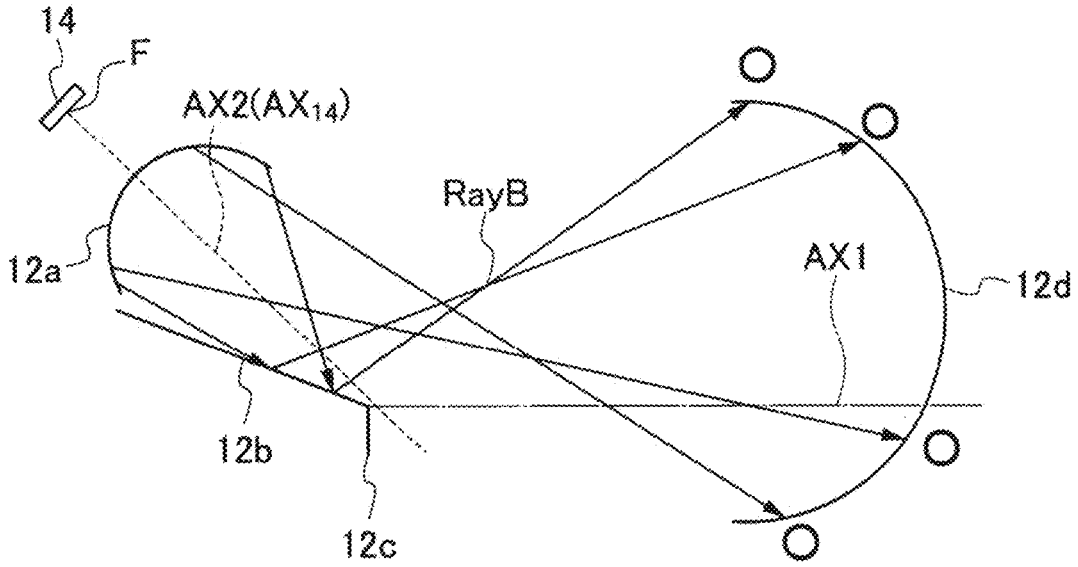
FIG. 15B illustrates the light captured in the exit surface 12*d* (reflected light RayB internally reflected by the reflection surface 12*b*) increases, in the case of disposing the second reference axis AX2 so as to be inclined with respect to the first reference axis AX1 and condensing the light from the light source 14 which entered the lens body 12 toward the shade 12*c* in a direction closer to the second reference axis AX2 at least with respect to the vertical direction.

On the other hand, in the case of disposing the second reference axis AX2 so as to be inclined with respect to the first reference axis AX1 and condensing the light from the light source 14 which entered the lens body 12 toward the shade 12*c* in a direction closer to the second reference axis AX2 at least with respect to the vertical direction, as illustrated in FIG. 15B, the light captured in the exit surface 12*d* (reflected light RayB internally reflected by the reflection surface 12*b*) increases. As a result, the stray light decreases and the efficiency improves compared with the case of disposing the second reference axis AX2 in the horizontal direction and condensing the light from the light source 14 which entered the lens body 12 toward the shade 12*c* in a direction closer to the second reference axis AX2, at least with respect to the vertical direction.

As described above, according to this embodiment, a lens body 12, without including a reflection surface formed by metal deposition, which is a factor that increases cost, and a vehicular lamp fitting 10 equipped with this lens body 12, can be provided. Secondly, a lens body 12 that can suppress melting of the lens body 12 and a drop in the output of the light source 14, caused by the heat generated in the light source 14, and a vehicular lamp fitting 10 equipped with this lens body 12, can be provided.

The reflection surface formed by metal deposition, which is a factor that increases cost, can be omitted, because the light from the light source 14 is controlled not by the reflection surface formed by metal deposition, but by refraction on the entry surface 12*a* and internal reflection on the reflection surface 12*b*.

Melting of the lens body 12 or a drop in the output of the light source 14, caused by the heat generated in the light source 14, can be suppressed, because the entry surface 12*a* is formed on the rear end of the lens body 12, and the light source 14 is disposed outside the lens body 12 (that is, in a position distant from the entry surface 12*a* of the lens body 12).

Next, a vehicular lamp fitting according to Embodiment 2 of the present invention will be described with reference to the drawings.

Figure 16:
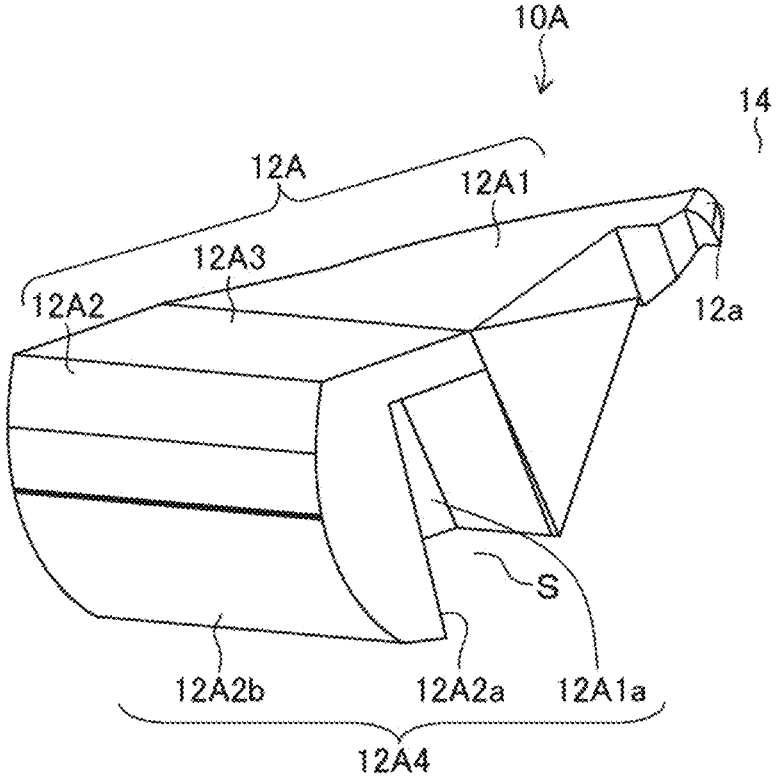
FIG. 16 is a perspective view of the vehicular lamp fitting 10A according to Embodiment 2 of the present invention/
Figure 17A:
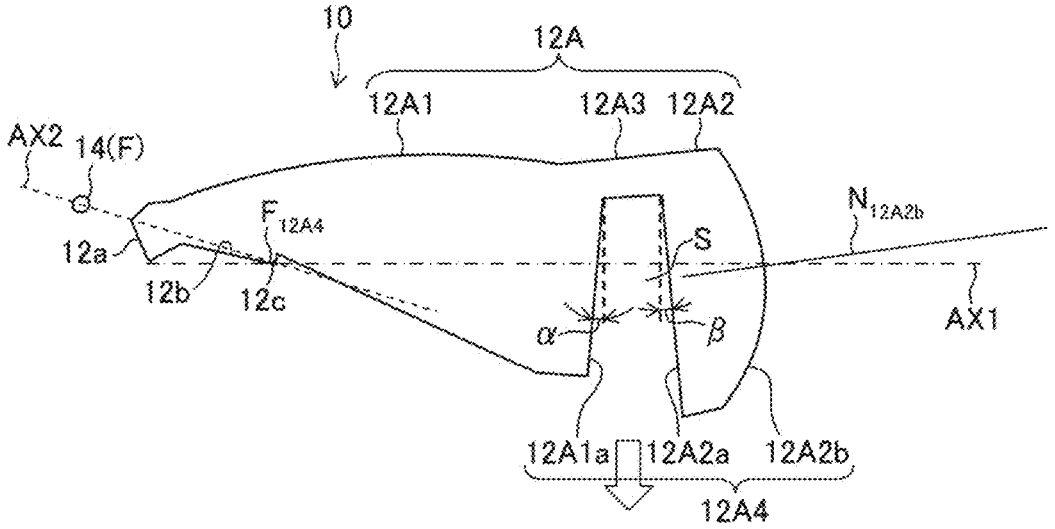
FIG. 17A is a longitudinal cross-sectional view thereof.
Figure 17B:
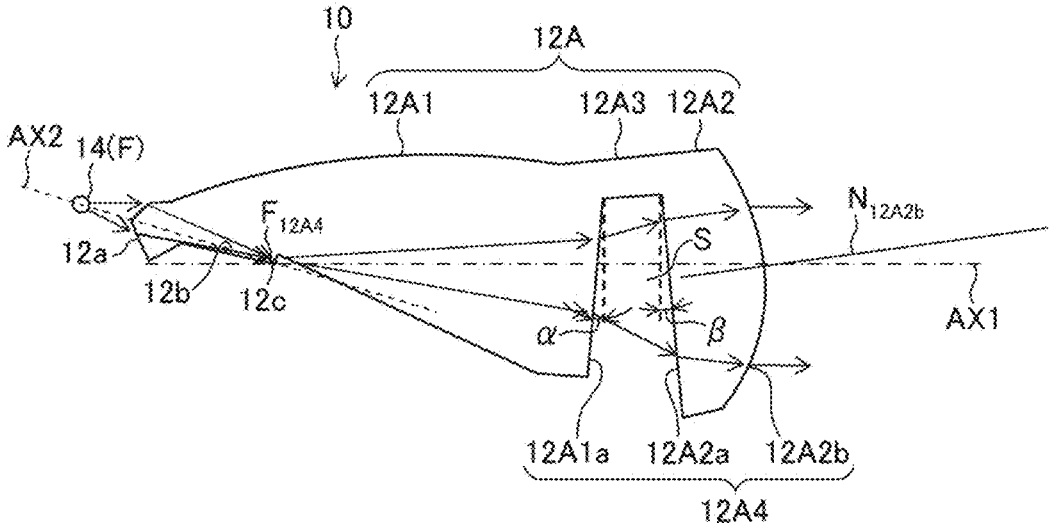
FIG. 17B is a diagram depicting the state of the light from the light source 14 that travels inside a lens body 12A.

FIG. 16 is a perspective view of the vehicular lamp fitting 10A according to Embodiment 2 of the present invention, FIG. 17A is a longitudinal cross-sectional view thereof, and FIG. 17B is a diagram depicting the state of the light from the light source 14 that travels inside a lens body 12A.

The vehicular lamp fitting 10A of Embodiment 2 and the above mentioned vehicular lamp fitting 10 of Embodiment 1 are different mainly in the following aspects.

Firstly, in the vehicular lamp fitting 10 of Embodiment 1, condensing in the horizontal direction and condensing in the vertical direction are mainly performed by the exit surface 12*d*, which is the final exit surface, of the lens body 12, but in the vehicular lamp fitting 10A of Embodiment 2, condensing in the horizontal direction is mainly performed by a first exit surface 12A1*a* of a first lens unit 12A1, and condensing in the vertical direction is mainly performed by a second exit surface 12A2*b* of a second lens unit 12A2, which is the final exit surface of the lens body 12A. In other words, in the vehicular lamp fitting 10A of Embodiment 2, the concept "condensing functions are separated" is applied.

Secondly, in the vehicular lamp fitting 10 of Embodiment 1, the exit surface 12*d*, which is the final exit surface of the lens body 12, is configured as a hemispherical surface (hemispherical refractive surface) in order to perform condensing in the horizontal direction and condensing in the vertical direction (see FIG. 2A), but in the vehicular lamp fitting 10A of Embodiment 2, the first exit surface 12A1*a* of the first lens unit 12A1 is configured as a semicircular cylindrical surface (semicircular cylindrical refractive surface) which extends in the vertical direction (see FIG. 23) in order to perform condensing in the horizontal direction, and the second exit surface 12A2*b* of the second lens unit 12A2, which is the final exit surface of the lens body 12A, is configured as a semicircular cylindrical surface (semicircular cylindrical refractive surface) which extends in the horizontal direction (see FIG. 23) in order to perform condensing in the vertical direction.

Figure 18:
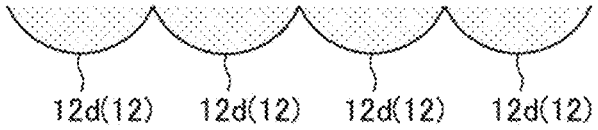
FIG. 18 is a top view depicting a state where a plurality of vehicular lamp fittings 10 (plurality of lens bodies 12) of Embodiment 1 are disposed on a line.

Thirdly, in the vehicular lamp fitting 10 of Embodiment 1, the exit surface 12*d*, which is the final exit surface of the lens body 12, is configured as a hemispherical surface (hemispherical refractive surface), hence when a plurality of vehicular lamp fittings 10 (plurality of lens bodies 12) are disposed on a line (see FIG. 18), dots appear as if lined up, and a vehicular lamp fitting (combined lens body) having an integral appearance linearly extending in a predetermined direction is not able to be implemented, while in the vehicular lamp fitting 10A of Embodiment 2, the second exit surface 12A2*b*, which is the final exit surface of the lens body 12A, is configured as a semicircular cylindrical surface (semicircular cylindrical refractive surface) extending in the horizontal direction, hence by disposing a plurality of vehicular lamp fittings 10A (plurality of lens bodies 12A) on a line (see FIG. 19A and FIG. 19B), a vehicular lamp fitting (combined lens bodies 16), having an integral appearance linearly extending in the horizontal direction, can be configured. FIG. 18 is a top view depicting a state where a plurality of vehicular lamp fittings 10 (plurality of lens bodies 12) of Embodiment 1 are disposed on a line.

The other configuration is the same as the vehicular lamp fitting 10 of Embodiment 1. The vehicular lamp fitting 10A of Embodiment 2 will now be described focusing on the differences from the vehicular lamp fitting 10 of Embodiment 1, and a composing element the same as the vehicular lamp fitting 10 of Embodiment 1 will be denoted with a same reference symbol, and description thereof is omitted.

Figure 20A:
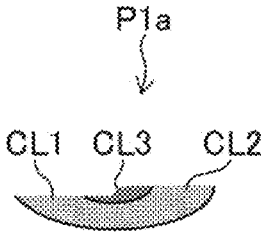
FIG. 20A illustrates the low beam light distribution pattern P1*a* on virtual vertical screen which faces the front face of the vehicle (disposed at about 25 m in front of the front face of the vehicle)

As illustrated in FIG. 16 and FIG. 17B, the vehicular lamp fitting 10A according to Embodiment 2 includes the light source 14, the first lens unit 12A1, and the second lens unit 12A2, and is configured as a vehicular head light equipped with the lens body 12A, such that light from the light source 14 enters the first lens unit 12A1 through a first entry surface 12*a* of the first lens unit 12A1, exits through the first exit surface 12A1*a* of the first lens unit 12A1 after being partially shielded by the shade 12*c* of the first lens unit 12A1, further enters the second lens unit 12A2 through a second entry surface 12A2*a* of the second lens unit 12A2, then exits through a second exit surface 12A2*b* of the second lens unit 12A2, and is irradiated forward, so as to form a low beam light distribution pattern P1*a* or the like (corresponding to the predetermined light distribution pattern of the present invention), which includes cut-off lines CL1 to CL3 defined on an upper edge by the shade 12*c* illustrated in FIG. 20A.

Figure 21A:
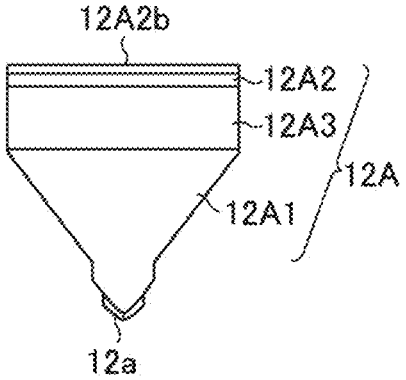
FIG. 21A is a top view.
Figure 21C:
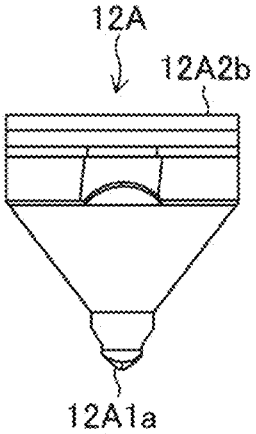
FIG. 21C is a bottom view of the lens body 12A of Embodiment 2.
Figure 21B:
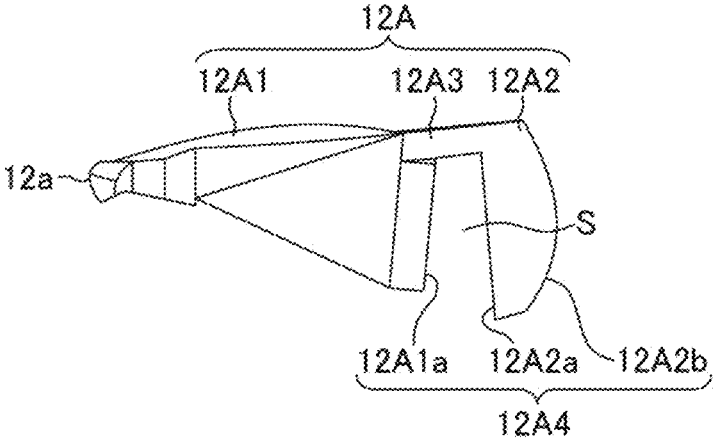
FIG. 21B is a side view.
Figure 22:
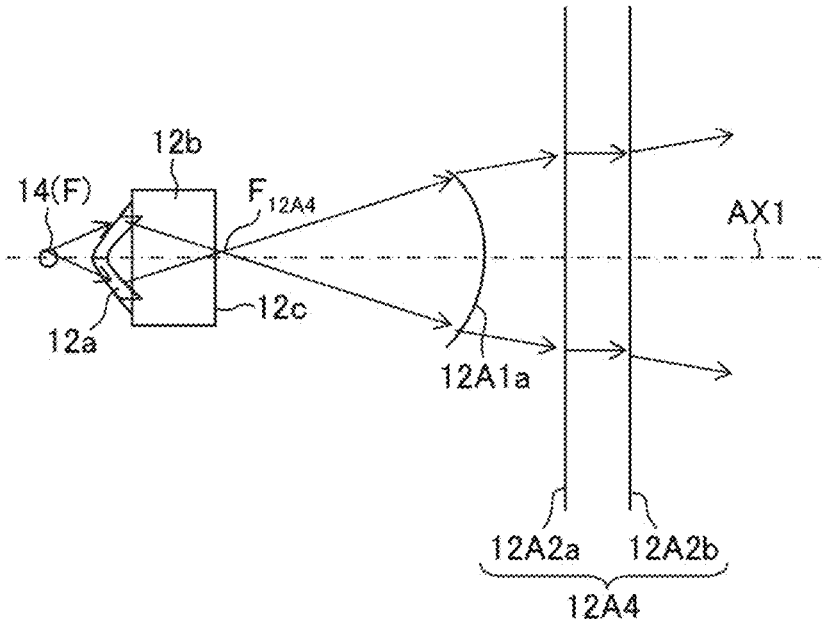
FIG. 22 illustrates an example of the first entry surface 12*a* (cross-sectional view).
Figure 23:
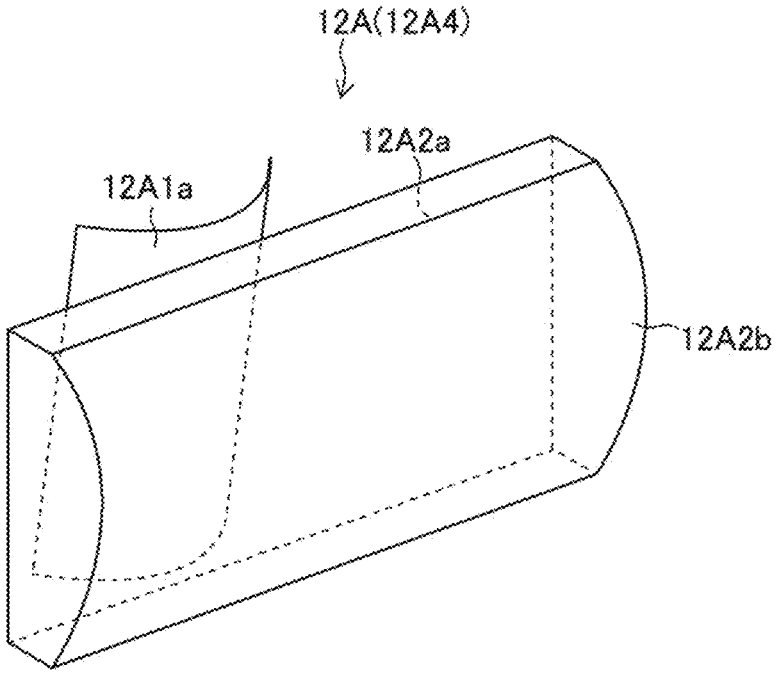
FIG. 23 is a perspective view depicting the lens body 12A (first exit surface 12A1*a*, second entry surface 12A2*a* and second exit surface 12A2*b*) of Embodiment 2.

FIG. 21A is a top view, FIG. 21B is a side view, and FIG. 21C is a bottom view of the lens body 12A of Embodiment 2. FIG. 22 illustrates an example of the first entry surface 12*a* (cross-sectional view), and FIG. 23 is a perspective view depicting the lens body 12A (first exit surface 12A1*a*, second entry surface 12A2*a* and second exit surface 12A2*b*) of Embodiment 2.

As illustrated in FIG. 17A and FIG. 21A to FIG. 21C, the lens body 12A is a lens body having a shape along the first reference axis AX extending in the horizontal direction, and includes the first lens unit 12A1, the second lens unit 12A2, and a connecting unit 12A3 which connects the first lens unit 12A1 and the second lens unit 12A2.

The first lens unit 12A1 includes the first entry surface 12*a*, the reflection surface 12*b*, the shade 12*c*, the first exit surface 12A1*a* and a reference point F that is disposed in the vicinity of the first entry surface 12*a* in the optical design. The second lens unit 12A2 includes the second entry surface 12A2*a* and the second exit surface 12A2*b*. The first entry surface 12*a*, the reflection surface 12*b*, the shade 12*c*, the first exit surface 12A1*a*, the second entry surface 12A2*a*, and the second exit surface 12A2*b* are disposed in this order along the first reference axis AX1.

The first lens unit 12A1 and the second lens unit 12A2 are connected by the connecting unit 12A3.

The connecting unit 12A3 connects the first lens unit 12A1 and the second lens unit 12A2 at the upper portions thereof such that a space S (open area), surrounded by the first exit surface 12A1*a*, the second entry surface 12A2*a* and the connecting unit 12A3, is formed.

The lens body 12A is integrally molded by injecting such transparent resin as polycarbonate and acrylic into a die, and cooling and solidifying the resin (injection molding).

The space S is formed by a die of which the extracting direction is the opposite from the connecting unit 12A3 (see the arrow mark in FIG. 17A). To smoothly extracting the die, extracting angles $\alpha$ and $\beta$ (also called "drafts", which are preferably 2° or more) are set for the first exit surface 12A1*a* and the second entry surface 12A2*a* respectively. Thereby the die can be vertically extracted during molding, and the lens body 12 (and the later mentioned combined lens body 16) can be manufactured by one extraction operation (without using a slide) at low cost. The material of the lens body 12A may be glass, other than such transparent resins as polycarbonate and acrylic.

The first entry surface 12*a* is a surface which is formed in the rear end of the first lens unit 12A1 (e.g. free-form surface protruding toward the light source 14), and through which the light from the light source 14 (to be more precise, the reference point F in the optical design), disposed in the vicinity of the first entry surface 12*a*, is refracted and enters the first lens unit 12A1, and the surface shape of the first entry surface 12*a* is configured such that the light from the light source 14, which entered the first lens unit 12A1, is condensed toward the shade 12*c* in a direction closer to the second reference axis AX2 with respect to the vertical direction (see FIG. 17B), and the light from the light source 14 is condensed toward the shade 12*c* in a direction closer to the first reference axis AX1 with reference to the horizontal direction (see FIG. 22). The first reference axis AX passes through a point (e.g. focal point $F_{12A4}$) in the vicinity of the shade 12*c*, and extends in the longitudinal direction of the vehicle. The second reference axis AX2 passes through the center (to be more precise, the reference point F) of the light source 14 and a point (e.g. focal point $F_{12A4}$) in the vicinity of the shade 12*c*, and is inclined forward and diagonally downward with respect to the first reference axis AX1. The surface shape of the first entry surface 12*a* may be configured such that the light from the light source 14, which entered the first lens unit 12A1, becomes parallel with the reference axis AX1 (see FIG. 6) with respect to the horizontal direction.

The first exit surface 12A1*a* is a surface configured to condense the light beams from the light source 14 which exited through the first exit surface 12A1*a* (in other words, the direct light which travels toward the first exit surface 12A1*a* and the reflected light which is internally reflected by the reflection surface 12*b* and travels toward the first exit surface 12A1*a*, out of the light beams from the light source 14 which entered the first lens unit 12A1) in the horizontal direction (corresponding to the first direction of the present invention). In concrete terms, the first exit surface 12A1*a* is configured as a semicircular cylindrical surface of which cylindrical axis extends in the vertical direction, as illustrated in FIG. 23. The focal line of the first exit surface 12A1*a* extends in the vicinity of the shade 12*c* in the vertical direction.

The second entry surface 12A2*a* is a surface which is formed on the rear end of the second lens unit 12A2, and through which the light from the light source 14, which exited through the first exit surface 12A1*a*, enters the second lens unit 12A2, and is configured as a plane surface, for example. The surface shape of the second entry surface 12A2*a* is not limited to this, but may be configured as a curved surface.

The second exit surface 12A2*b* is a surface configured to condense the light from the light source 14, which exited through the second exit surface 12A2*b*, in the vertical direction (corresponding to the second direction of the present invention). In concrete terms, the second exit surface 12A2*b* is configured as a semicircular cylindrical surface of which cylindrical axis extends in the horizontal direction, as illustrated in FIG. 23. The focal line of the second exit surface 12A2*b* extends in the vicinity of the shade 12*c* in the horizontal direction.

Similarly to the focal point $F_{12d}$ of the exit surface 12*d* of Embodiment 1, the focal point $F_{12A4}$ of the lens 12A4, constituted by the first exit surface 12A1*a* and the second lens unit 12A2 (the second entry surface 12A2*a* and the second exit surface 12A2*b*) is set in the vicinity of the shade 12*c* (e.g. in the vicinity of the center of the crosswise direction of the shade 12*c*). Similarly to the exit surface 12*d* of Embodiment 1, this lens 12A4 is configured such that light reversely projects the luminous intensity distribution (light source image), which is formed in the vicinity of the focal point $F_{12A4}$ of the lens 12A4 by the light beams from the light source 14 which entered the first lens unit 12A1, (in other words, the direct light which travels toward the first exit surface 12A1*a* and the reflected light which was internally reflected by the reflection surface 12*b* and travels toward the first exit surface 12A1*a*, out of the light beams from the light source 14 which entered the first lens unit 12A1), and forms the low beam light distribution pattern P1*a*, including the cut-off lines CL1 to CL3 defined on an upper edge as illustrated in FIG. 20A on the virtual vertical screen.

The basic surface shape of the second exit surface 12A2*b* is as described above, but is actually adjusted as follows, since the extracting angles α and β are set for the first exit surface 12A1*a* and the second entry surface 12A2*a*.

Figure 24:
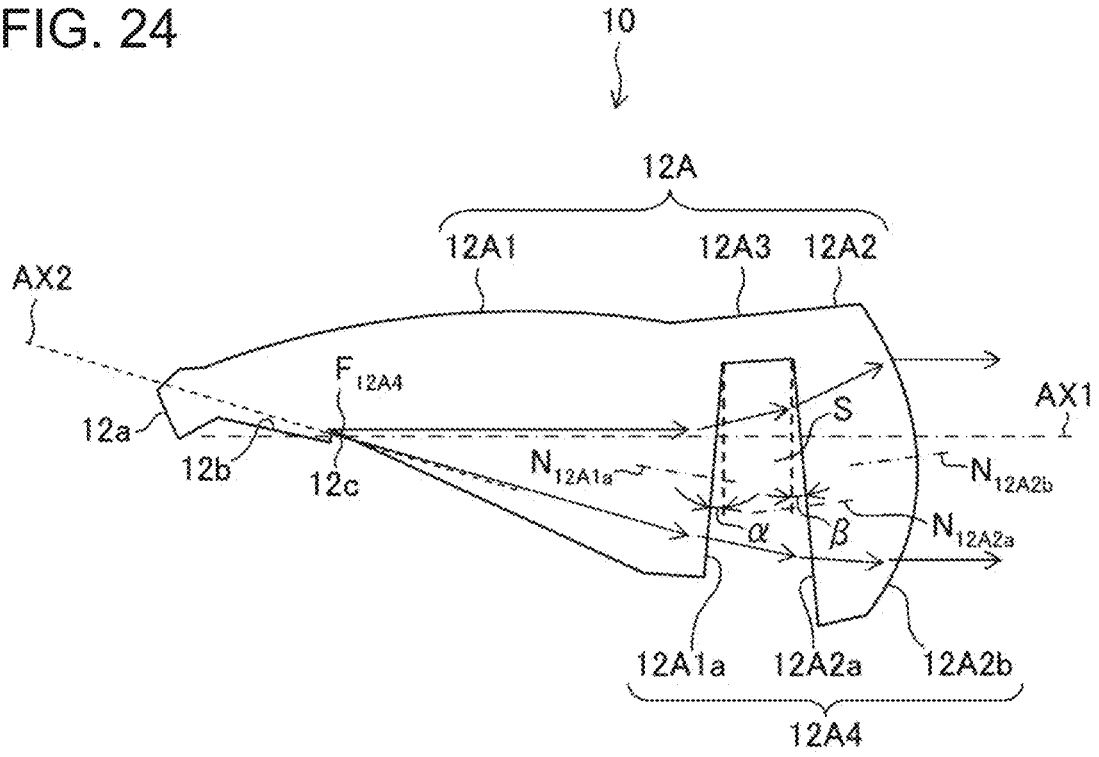
FIG. 24 is a diagram depicting the normal lines of the first exit surface 12A1*a*, the second entry surface 12A2*a*, and the second exit surface 12A2*b* respectively.

FIG. 24 is a diagram depicting the normal lines of the first exit surface 12A1*a*, the second entry surface 12A2*a*, and the second exit surface 12A2*b* respectively.

In other words, in the case when the extracting angles α and β are set for the first exit surface 12A1*a* and the second entry surface 12A2*a*, the normal lines $N_{12A1a}$ and $N_{12A2a}$, which pass through the centers of the first exit surface 12A1*a* and the second entry surface 12A2*a*, incline with respect to the horizontal line respectively, as illustrated in FIG. 24. In this case, if the normal line $N_{12A2b}$, passing through the center of the second exit surface 12A2*b*, extends in the horizontal direction, the light from the light source 14, which exits through the second exit surface 12A2*b*, becomes light traveling diagonally upward with respect to the horizontal line, which may cause glare.

To suppress this, the surface shape of the second exit surface 12A2*b* is adjusted so that the light from the light source 14, which exits through the second exit surface 12A2*b*, becomes parallel light with respect to the first reference axis AX1. For example, the second exit surface 12A2*b* is adjusted to the surface shape of which the normal line $N_{12A2b}$ thereof is inclined forward and diagonally upward, so that the light from the light source 14, which exits through the second exit surface 12A2*b*, becomes parallel light with respect to the first reference axis AX1. This adjustment is performed for matching the focal point $F_{12A4}$ of the lens 12A4 constituted by the first exit surface 12A1*a* and the second lens unit 12A2 (second entry surface 12A2*a* and second exit surface 12A2*b*) to a position in the vicinity of the shade 12*c*. The line with an arrow at the end in FIG. 24 indicates the optical path of the light from the light source 14 (to be more precise, the reference point F) which entered the lens body 12A.

The surface connecting the front edge of the reflection surface 12*b* and the bottom edge of the first exit surface 12A1*a* is an inclined surface extending forward and diagonally downward from the front edge of the reflection surface 12*b*, but the surface is not limited to this, and may be any surface as long as the light from the light source 14 traveling toward the second exit surface 12A2*b* is not shielded. In the same manner, the top surface of the lens body 12A, that is the surface connecting the upper edge of the first entry surface 12*a* and the upper edge of the second exit surface 12A2*b*, is a surface extending approximately in the horizontal direction, but the surface is not limited to this, and may be any surface as long as the light from the light source 14 traveling toward the second exit surface 12A2*b* is not shielded. In the same manner, both side surfaces of the lens body 12A, which are surfaces connecting the left and right edges of the first entry surface 12*a* and the left and right edges of the second exit surface 12A2*b*, are inclined surfaces that are tapered toward the first entry surface 12*a* (see FIG. 21A), but the surfaces are not limited to this, and may be any surfaces as long as the light from the light source 14 traveling toward the second exit surface 12A2*b* is not shielded.

In the vehicular lamp fitting 10A (lens body 12A) having the above mentioned configuration, the light from the light source 14 enters the first lens unit 12A1 through the first entry surface 12*a* of the first lens unit 12A1, and exits through the first exit surface 12A1*a* of the first lens unit 12A1 after being partially shielded by the shade 12*c* of the first lens unit 12A1. At this time, the light from the light source 14, which exits through the first exit surface 12A1*a*, is condensed in the horizontal direction by a function of the first exit surface 12A1*a* (see FIG. 22. The light is not condensed or hardly condensed in the vertical direction). Then the light from the light source 14, which exited through the first exit surface 12A1*a*, passes through the space S, further enters the second lens unit 12A2 through the second entry surface 12A2*a* of the second lens unit 12A2, exits through the second exit surface 12A2*b* of the second lens unit 12A2, and is irradiated forward. At this time, the light from the light source 14, which exits through the second exit surface 12A2*b*, is condensed in the vertical direction by a function of the second exit surface 12A2*b* (see FIG. 17B. The light is not condensed, or hardly condensed in the horizontal direction). Thereby the low beam light distribution pattern P1*a* or the like (corresponding to the predetermined light distribution pattern of the present invention) including the cut-off lines CL1 to CL3 defined on an upper edge by the shade 12*c* as illustrated in FIG. 20A, is formed on the virtual vertical screen.

This low beam light distribution pattern P1*a* or the like has a relatively high central luminous intensity and excellent long range visibility. This is because the light source 14 is disposed in the vicinity of the entry surface 12*a* (in the vicinity of the reference point F) of the lens body 12A in an attitude such that the optical axis $AX_{14}$ of the light source 14 matches the second reference axis AX2, and that light on the optical axis $AX_{14}$ (direct light) having a relatively high intensity (luminous intensity) is condensed toward the shade 12*c* in a direction closer to the second reference axis AX2 (e.g. condensed to the center of the shade 12*c*).

Figure 20B:
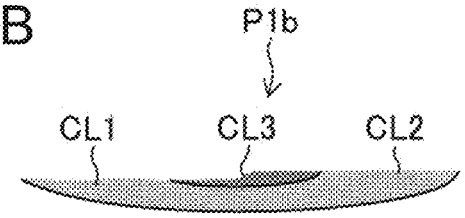
FIG. 20B illustrates a low beam light distribution pattern P1*b*.
Figure 20C:
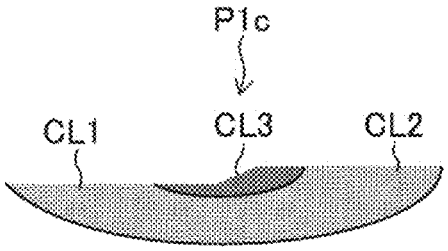
FIG. 20C illustrates a low beam light distribution pattern P1*c*.

The degree of diffusion of the low beam light distribution pattern in the horizontal direction and/or the vertical direction can be freely adjusted as illustrated in FIG. 20A to FIG. 20C by adjusting the surface shape (e.g. curvature) of the first exit surface 12A1*a* and/or the second exit surface 12A2*b*. For example, a degree of the diffusion of the low beam light distribution pattern in the horizontal direction can be freely adjusted by adjusting the surface shape (e.g. curvature) of the first exit surface 12A1*a*. In the same manner, a degree of diffusion of the low beam light distribution pattern in the vertical direction can be freely adjusted by adjusting the surface shape (e.g. curvature) of the second exit surface 12A2*b*.

Figure 19A:
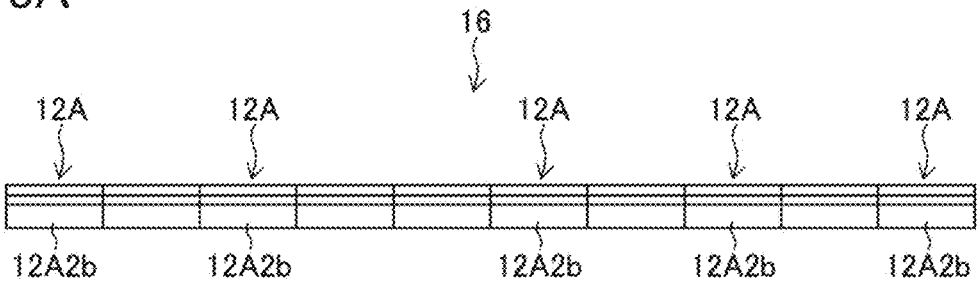
FIG. 19A is a front view depicting the state where a plurality of the vehicular lamp fittings 10A (a plurality of the lens bodies 12A) according to Embodiment 2 are disposed on a line in the horizontal direction.
Figure 19B:
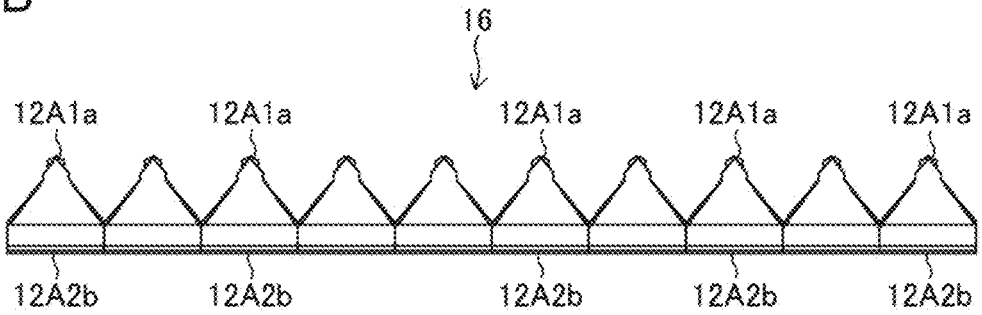
FIG. 19B is a top view thereof.

FIG. 19A is a front view depicting the state where a plurality of the vehicular lamp fittings 10A (a plurality of the lens bodies 12A) according to Embodiment 2 are disposed on a line in the horizontal direction, and FIG. 19B is a top view thereof.

As illustrated in FIG. 19A and FIG. 19B, the combined lens body 16 includes a plurality of the lens bodies 12A. The combined lens body 16 (a plurality of the lens bodies 12A) is integrally molded by injecting such transparent resins as polycarbonate and acrylic into a die, and cooling and solidifying the resin (injection molding). The second exit surface 12A2*b* of each of the plurality of lens bodies 12A is disposed on a line in the horizontal direction so as to be adjacent to each other, and constitutes a semicircular cylindrical exit surface group having an integral appearance linearly extending in the horizontal direction.

By using the combined lens body 16 having the above mentioned configuration, a vehicular lamp fitting having an integral appearance, linearly extending in the horizontal direction, can be configured. The combined lens body 16 may be configured by molding a plurality of lens bodies 12 in a physically separated state, and connecting (holding) the lens bodies 12 using a holding member (not illustrated), such as a lens holder.

As described above, according to Embodiment 2, the following effects can be implemented in addition to the above mentioned effects of Embodiment 1.

Firstly, a lens body 12A (combined lens body 16) having an integral appearance linearly extending in the horizontal direction, and a vehicular lamp fitting 10A equipped with this lens body 12A (combined lens body 16), can be provided. Secondly, a lens body 12A (combined lens body 16) that can form a low beam light distribution pattern P1*a* or the like, condensed in the horizontal direction and the vertical direction, even though the second exit surface 12A2*b*, which is the final exit surface, is a semicircular cylindrical surface (semicircular cylindrical refractive surface extending in the horizontal direction), and a vehicular lamp fitting 10A equipped with this lens body 12A (combined lens body 16), can be provided.

The integral appearance linearly extending in the horizontal direction can be implemented because the second exit surface 12A2*b*, which is the final exit surface, is configured as a semicircular cylindrical surface (semicircular cylindrical refractive surface extending in the horizontal direction).

The low beam light distribution pattern P1*a* or the like, condensed in the horizontal direction and the vertical direction, can be formed even though the second exit surface 12A2*b*, which is the final exit surface, is a semicircular cylindrical surface (semicircular cylindrical refractive surface extending in the horizontal direction), because condensing light in the horizontal direction is mainly performed by the first exit surface 12A1*a* (semicircular cylindrical refractive surface extending in the vertical direction) of the first lens unit 12A1, and condensing light in the vertical direction is mainly performed by the second exit surface 12A2*b* (semicircular cylindrical refractive surface extending in the horizontal direction) of the second lens unit 12A2, which is the final exit surface of the lens body 12A. In other words, the condensing functions are separated.

Further, according to Embodiment 2, a lens body 12A (combined lens body 16) suitable for a vehicular lamp fitting, and a vehicular lamp fitting 10A equipped with the lens body 12A (combined lens body 16), are provided, whereby the light from the light source 14 exited from the second exit surface 12A2*b*, which is the final exit surface, becomes light parallel with the first reference axis AX1, even though the extracting angles α and β are set for the first exit surface 12A1*a* and the second entry surface 12A2*a* respectively.

Next modifications will be described.

Figure 25:
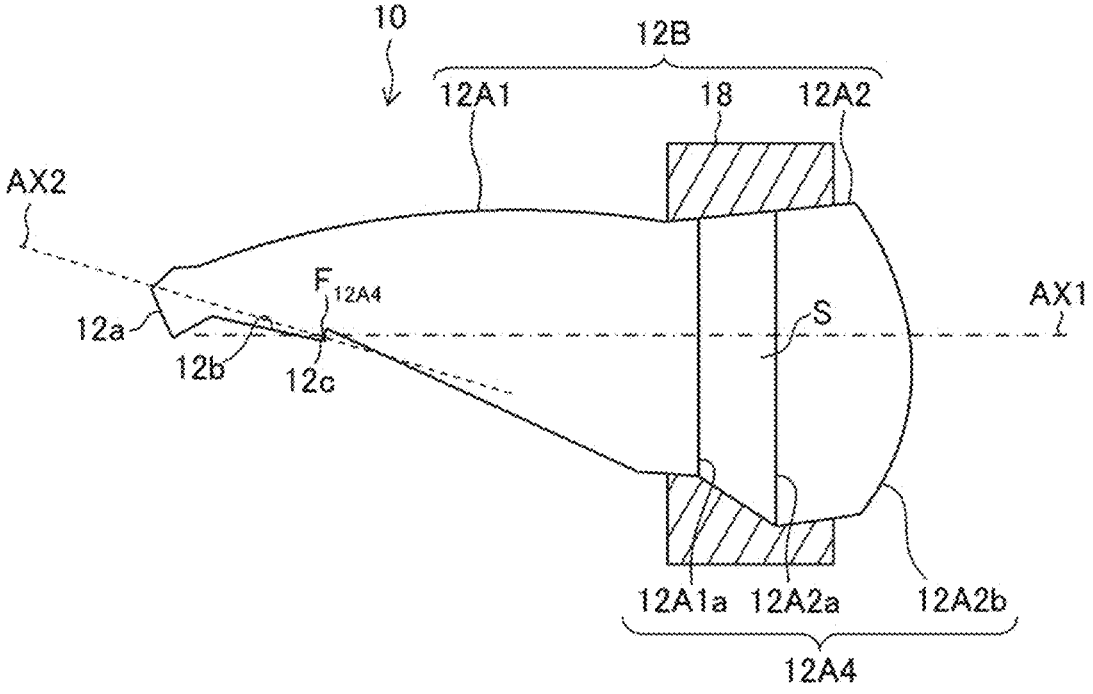
FIG. 25 is a diagram depicting a lens body 12B, which is a first modification of the lens body 12A of Embodiment 2.

FIG. 25 is a diagram depicting a lens body 12B, which is a first modification of the lens body 12A of Embodiment 2.

As illustrated in FIG. 25, the lens body 12B of this modification is configured by molding the first lens unit 12A1 and the second lens unit 12A2 in a physically separated state, and connecting (holding) these lens units by the holding member 18, such as a lens holder. The extracting angles α and β are not set for the first exit surface 12A1*a* and the second entry surface 12A2*a*, and are formed as a plane surface (or curved surface) orthogonal to the reference axis AX1.

According to this modification, the extracting angles α and β are unnecessary, therefore the adjustment of the second exit surface 12A2*b* can be omitted.

Figure 26:
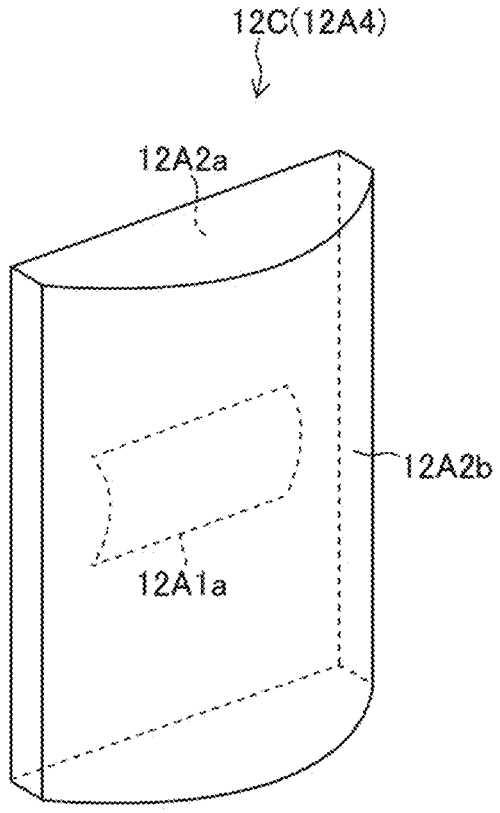
FIG. 26 is a perspective view depicting a lens body 12C (first exit surface 12A1*a*, second entry surface 12A2*a*, second exit surface 12A2*b*), which is a second modification of the lens body 12A of Embodiment 2.

FIG. 26 is a perspective view depicting a lens body 12C (first exit surface 12A1*a*, second entry surface 12A2*a*, second exit surface 12A2*b*), which is a second modification of the lens body 12A of Embodiment 2.

The lens body 12C of this modification corresponds to Embodiment 2, where the first exit surface 12A1*a* and the second exit surface 12A2*b* are reversed.

In other words, the first exit surface 12A1*a* of the lens body 12C of this modification is a surface configured to condense the light from the light source 14 which exits through the first exit surface 12A1*a* in the vertical direction (corresponding to the first direction of the present invention). In concrete terms, as illustrated in FIG. 26, the first exit surface 12A1*a* is a semicircular cylindrical surface of which cylindrical axis extends in the horizontal direction. In this case, the focal line of the first exit surface 12A1*a* extends in the horizontal direction in the vicinity of the shade 12*c*. The second exit surface 12A2*b* of the lens body 12C of this modification is a surface configured to condense the light from the light source 14 which exits through the second exit surface 12A2*b* in the horizontal direction (corresponding to the second direction of the present invention). In concrete terms, as illustrated in FIG. 26, the second exit surface 12A2*b* is a semicircular cylindrical surface of which cylindrical axis extends in the horizontal direction. In this case, the focal line of the second exit surface 12A2*b* extends in the vertical direction in the vicinity of the shade 12*c*.

The focal point $F_{12A4}$ of the lens 12A4, constituted by the first exit surface 12A1*a* and the second lens unit 12A2 (second entry surface 12A2*a* and second exit surface 12A2*b*) of the lens body 12C of this modification, is set in the vicinity of the shade 12*c* (e.g. in the vicinity of the center of the shade 12*c* in the crosswise direction), similarly to Embodiment 2.

Figure 27:
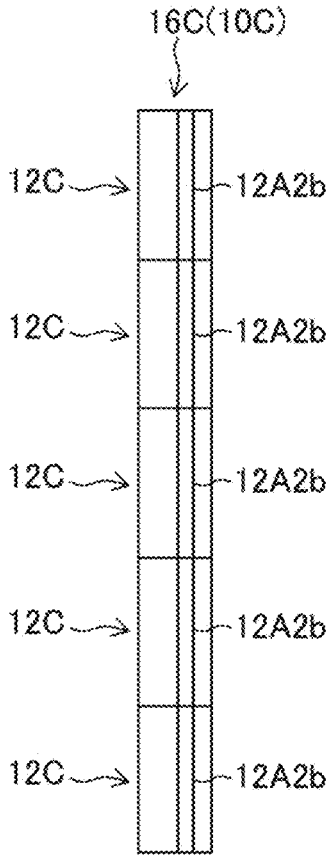
FIG. 27 is a front view depicting a state where a plurality of vehicular lamp fittings 10C (a plurality of lens bodies 12C) are disposed on a line in the vertical direction.

FIG. 27 is a front view depicting a state where a plurality of vehicular lamp fittings 10C (a plurality of lens bodies 12C) are disposed on a line in the vertical direction.

As illustrated in FIG. 27, the combined lens body 16C includes a plurality of lens bodies 12C. The combined lens body 16C (plurality of lens bodies 12C) is integrally molded by injecting such transparent resins as polycarbonate and acrylic into a die, and cooling and solidifying the resin (injection molding). The second exit surface 12A2*b* of the plurality of lens bodies 12C is disposed on a line in the vertical direction so as to be adjacent to each other, and constitutes a semicircular cylindrical exit surface group having an integral appearance linearly extending in the vertical direction.

By using the combined lens body 16C having the above mentioned configuration, a vehicular lamp fitting 10C, having an integral appearance linearly extending in the virtual direction, can be configured. The combined lens body 16C may be configured by molding the plurality of lens bodies 12C in a physically separated state, and connecting (holding) the lens bodies 12C using a holding member (not illustrated), such as a lens holder.

According to this modification, a lens body 12C (combined lens body 16C) having an integral appearance linearly extending in the vertical direction, and a vehicular lamp fitting 10C equipped with this lens body 12C (combined lens body 16C), can be provided. Secondly, a lens body 12C (combined lens body 16C) that can form a low beam light distribution pattern P1*a* or the like condensed in the horizontal direction and the vertical direction, even though the second exit surface 12A2*b*, which is the final exit surface, is a semicircular cylindrical surface (semicircular cylindrical refractive surface extending in the vertical direction), and a vehicular lamp fitting 10C equipped with this lens body 12C (combined lens body 16C), can be provided.

The integral appearance linearly extending in the vertical direction can be implemented because the second exit surface 12A2*b*, which is the final exit surface, is configured as a semicircular cylindrical surface (semicircular cylindrical refractive surface extending in the vertical direction).

The low beam light distribution pattern P1*a* or the like, condensed in the horizontal direction and the vertical direction, can be formed even though the second exit surface 12A2*b*, which is the final exit surface, is a semicircular cylindrical surface (semicircular cylindrical refractive surface extending in the vertical direction), because condensing light in the vertical direction is mainly performed by the first exit surface 12A1*a* (semicircular cylindrical refractive surface extending in the horizontal direction) of the first lens unit 12A1, and condensing light in the horizontal direction is mainly performed by the second exit surface 12A2*b* (semicircular cylindrical refractive surface extending in the vertical direction) of the second lens unit 12A2, which is the final exit surface of the lens body 12A. In other words, the condensing functions are separated.

The concept of "the condensing functions are separated" described in Embodiment 2 is not limited to the vehicular lamp fitting 10 of Embodiment 1, but can be applied to various vehicular lamp fittings (e.g. vehicular lamp fitting according to Japanese Patent Application Laid-Open No. 2005-228502 described in BACKGROUND ART), of which the final exit surface is a hemispherical surface (hemispherical refractive surface). This aspect will be described next in Embodiment 3 and Embodiment 4.

Next a vehicular lamp fitting 10D, in which a camber angle is added, will be described as Embodiment 3 with reference to the drawings.

Figure 28A:
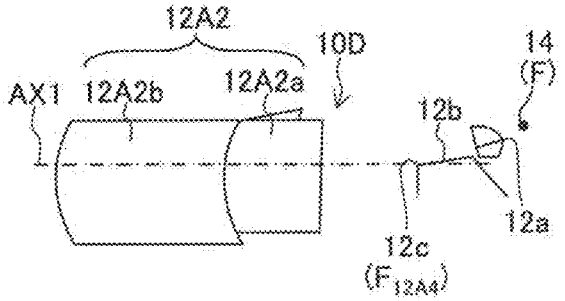
FIG. 28A is a side view (of major optical surfaces only) of the vehicular lamp fitting 10D in which a camber angle is added.
Figure 28D:
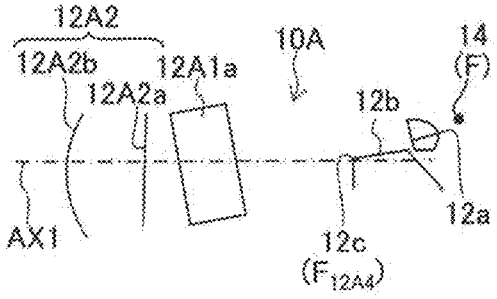
FIG. 28D to FIG. 28F depicting comparative examples, where
Figure 28B:
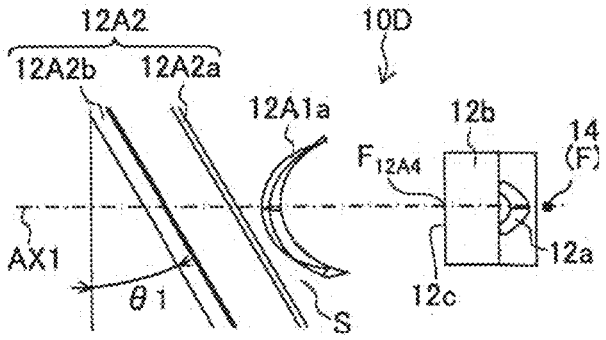
FIG. 28B is a top view (of major optical surfaces only) thereof.
Figure 28E:
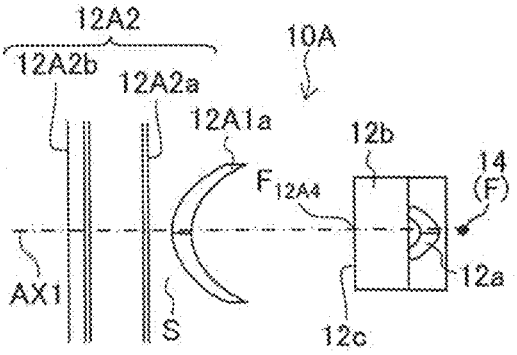
Figure 28C:
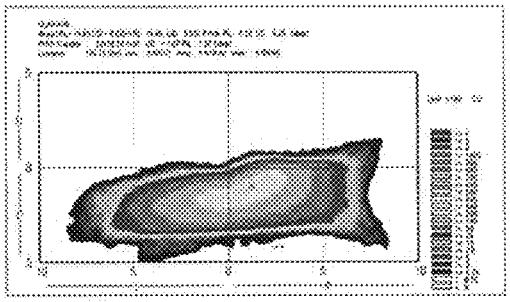
FIG. 28C is an example of a low beam light distribution pattern formed by the vehicular lamp fitting 10D.
Figure 28F:
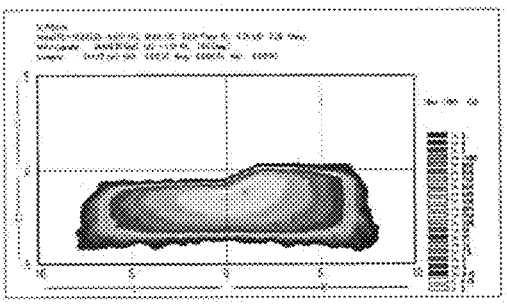
Figure 29:
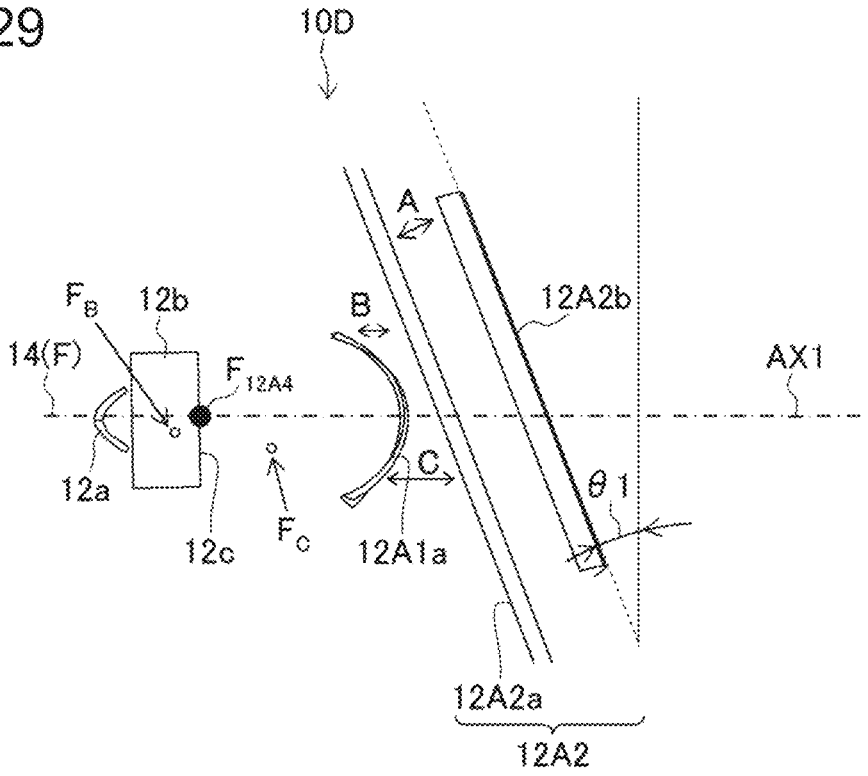
FIG. 29 is a top view (of major optical surfaces only) depicting a problem of the case of adding a comber angle.

FIG. 28A is a side view (of major optical surfaces only) of the vehicular lamp fitting 10D in which a camber angle is added, FIG. 28B is a top view (of major optical surfaces only) thereof, and FIG. 28C is an example of a low beam light distribution pattern formed by the vehicular lamp fitting 10D. FIG. 28D to FIG. 28F depicting comparative examples, where FIG. 28D is a side view (of major optical surfaces only) of the vehicular lamp fitting 10A of Embodiment 2 to which the camber angle is not added, FIG. 28E is a top view (of major optical surfaces only) thereof, and FIG. 28F is an example of a low beam light distribution pattern formed by the vehicular lamp fitting 10A of Embodiment 2. FIG. 29 is a top view (of major optical surfaces only) depicting a problem of the case of adding a comber angle.

As illustrated in FIG. 28B, the vehicular lamp fitting 10D of Embodiment 5 corresponds to the vehicular lamp fitting 10A of Embodiment 2, in which the second lens unit 12A2 is inclined with respect to the first reference axis AX1 when viewed from the top, in other words, the vehicular lamp fitting 10D of Embodiment 5 corresponds to the vehicular lamp fitting 10A of Embodiment 2, in which the second exit surface 12A2*b* is configured as a semicircular cylindrical surface extending in a direction which is inclined with respect to the first reference axis AX1 by a predetermined angle (that is, a camber angle θ1 (e.g. θ1=30°) is added) when viewed from the top.

Figure 30:
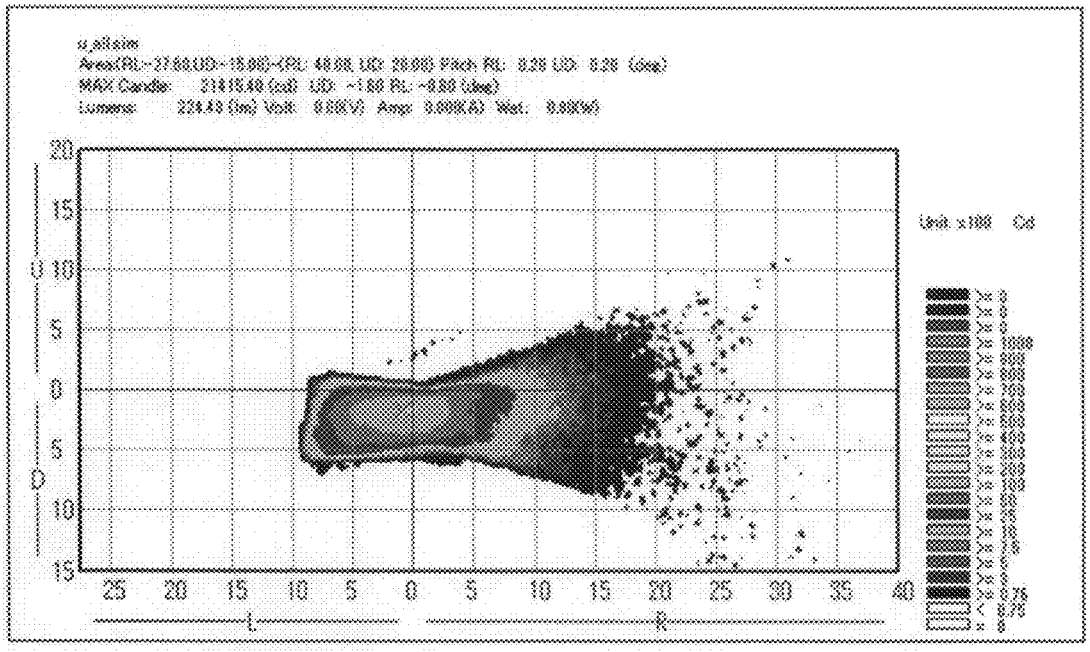
FIG. 30 is a drawing depicting a problem that appears in the low beam light distribution pattern when a comber angle is added.

According to the simulation performed by the inventors of the present invention, if only the camber angle θ1 is added, the distance between the first exit surface 12A1*a* and the second entry surface 12A2*a* is different between each side of the first reference axis AX1 as illustrated in FIG. 29 (see arrow B and arrow C in FIG. 29), and a focal position $F_B$ of the light which exits through a position B of the first exit surface 12A1*a* and a focal position $F_C$ of the light which exits through a position C of the first exit surface 12A1*a* deviate considerably from each other, and as a result, as illustrated in FIG. 30, the light is not condensed on the side where the distance between the first exit surface 12A1*a* and the second entry surface 12A2*a* is wider (right side in FIG. 30), in the low beam light distribution pattern formed on the virtual vertical screen, and the light distribution pattern blurs.

The cause of generating this blur will be described with reference to the drawings.

Figure 31A:
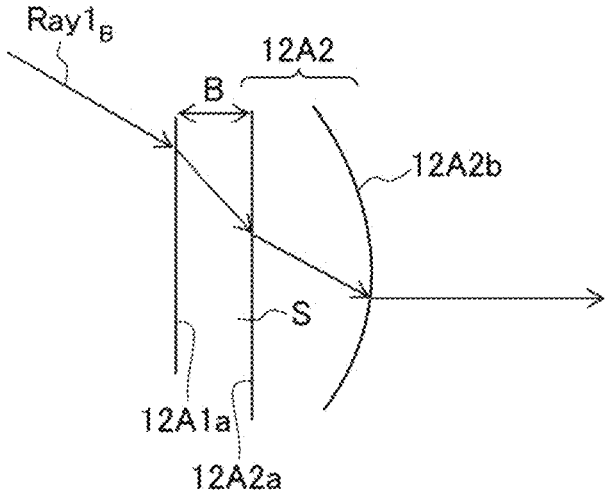
FIG. 31A is a cross-sectional view (of major optical surfaces only) at the position B in FIG. 29.

FIG. 31A is a cross-sectional view (of major optical surfaces only) at the position B in FIG. 29, and a line with an arrow at the end in FIG. 31A indicates an optical path of the light Ray1B, which enters the first exit surface 12A1*a*

Figure 31B:
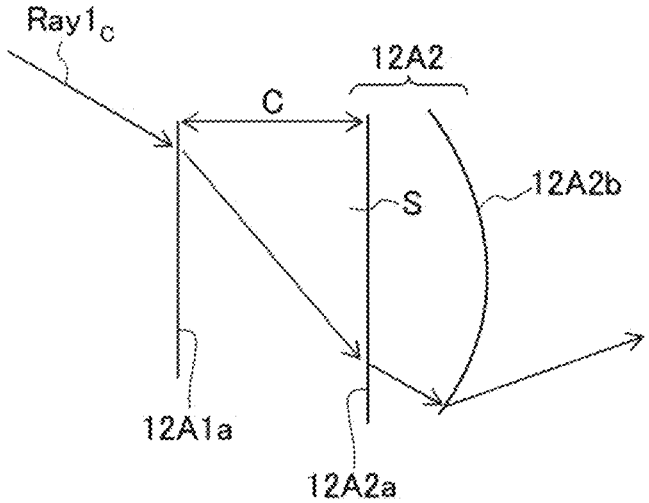
FIG. 31B is a cross-sectional view (of major optical surfaces only) at the position C in FIG. 29

(position B) at a predetermined entry angle. FIG. 31B is a cross-sectional view (of major optical surfaces only) at the position C in FIG. 29, and a line with an arrow at the end in FIG. 31B indicates an optical path of the light Ray1C, which enters the first exit surface 12A1*a* (position C) at a same entry angle as FIG. 31A. To simplify description, the first exit surface 12A1*a* and the second entry surface 12A2*a* are illustrated without setting the extracting angles in FIG. 31A and FIG. 31B, but FIG. 31A and FIG. 31B are applicable to a case of setting the extracting angles.

As illustrated in FIG. 31B, the distance between the first exit surface 12A1*a* and the second entry surface 12A2*a* is wider at the position C, compared with the position B (see FIG. 31A). Therefore the entry position of the light Ray1C to the second entry surface 12A2*a* becomes lower than the entry position of the light Ray1B to the second entry surface 12A2*a* illustrated in FIG. 31A, and the light Ray1C that enters through this lower entry position travels upward, with respect to the horizontal direction, as illustrated in FIG. 31B. As a result, the above mentioned blur is generated.

As a result of keen examination to suppress this blur, the present inventors discovered that this blur is suppressed and the low beam light distribution pattern is generally condensed by adjusting the surface shape of the first exit surface 12A1*a* (see FIG. 28C).

Figure 32A:
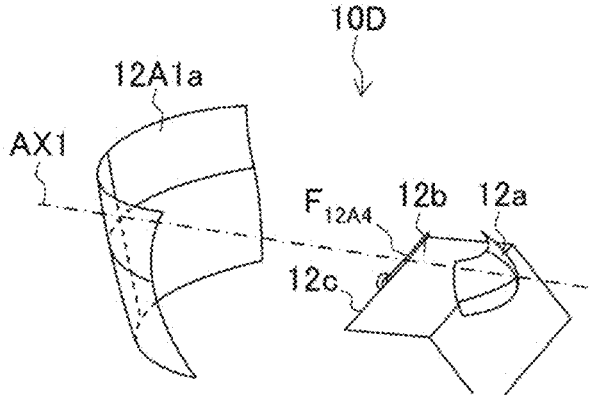
FIG. 32A is a perspective view (of major optical surfaces only) of the vehicular lamp fitting 10D of Embodiment 5.
Figure 32B:
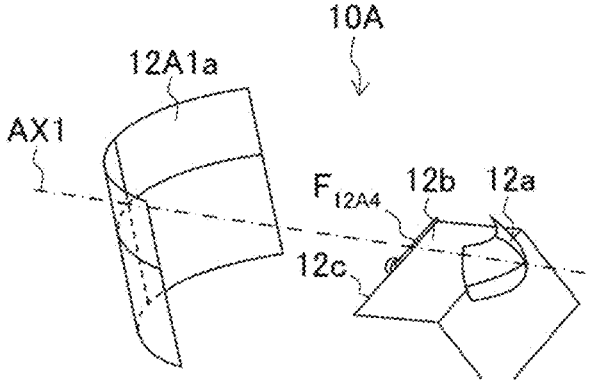
FIG. 32B is a comparative example, that is, a perspective view (of major optical surfaces only) of the vehicular lamp fitting 10A of Embodiment 2.

Based on this knowledge, the first exit surface 12A1*a* of Embodiment 5 is a semicircular cylindrical surface extending in the vertical direction, and the surface shape thereof is adjusted such that the low beam light distribution pattern is generally condensed (see FIG. 28C). This adjustment is for matching the shifted-focal position FB, FC and the like with a position in the vicinity of the shade 12*c*, and is performed using a predetermined simulation software. FIG. 32A is a perspective view (of major optical surfaces only) of the vehicular lamp fitting 10D of Embodiment 3, FIG. 32B is a comparative example, that is, a perspective view (of major optical surfaces only) of the vehicular lamp fitting 10A of Embodiment 2. As illustrated in FIG. 32A, the first exit surface 12A1*a* of Embodiment 5, adjusted as mentioned above, becomes non-symmetric-shaped with respect to the reference axis AX1.

The vehicular lamp fitting 10D of Embodiment 5 is the same as the vehicular lamp fitting 10A of Embodiment 2, except for the above mentioned aspects.

According to Embodiment 5, the following effects can be implemented in addition to the effects of Embodiment 2.

Firstly, a lens body (combined lens body) having a new appearance in which a camber angle is added, and a vehicular lamp fitting equipped with this lend body (combined lens body), can be provided. In other words, a lens body (combined lens body) having an integral appearance linearly extending in a direction inclined with respect to the first reference axis AX1 by a predetermined angle when viewed from the top, and a vehicular lamp fitting equipped with this lens body (combined lens body), can be provided. Secondly, a lens body (combined lens body), which can form a low beam light distribution pattern condensed in the horizontal direction and the vertical direction, even though the second exit surface 12A2*b*, which is the final exit surface, is a semicircular cylindrical surface (semicircular cylindrical refractive surface), and a vehicular lamp fitting equipped with this lens body (combined lens body), can be provided. Thirdly, a lens body (combined lens body) that can generally condense the low beam light distribution pattern, even though a camber angle is added, and a vehicular lamp fitting equipped with this lens body (combined lens body) can be provided.

The integral appearance linearly extending in a direction inclined with respect to the first reference axis AX1 by a predetermined angle can be implemented, because the second exit surface 12A2*b*, which is the final exit surface, is configured as a semicircular cylindrical surface (semicircular cylindrical refractive surface), and this second exit surface 12A2*b* extends in a direction inclined with respect to the first reference axis AX1 when viewed from the top.

The low beam light distribution pattern condensed in the horizontal direction and the vertical direction can be formed even though the second exit surface 12A2*b*, which is the final exit surface, is a semicircular cylindrical surface (semicircular cylindrical refractive surface), because condensing light in the horizontal direction is mainly performed by the first exit surface 12A1*a* (semicircular cylindrical refractive surface) of the first lens unit 12A1, and condensing light in the vertical direction is mainly performed by the second exit surface 12A2*b* (semicircular cylindrical refractive surface) of the second lens unit 12A2, which is the final exit surface of the lens body 12A. In other words, the condensing functions are separated.

The low beam light distribution pattern is generally condensed even though the camber angle is added, because the first exit surface 12A1*a* is a semicircular cylindrical surface extending in the vertical direction, and the surface shape is adjusted such that the low beam light distribution pattern is generally condensed.

The concept "the camber angle is added" described in Embodiment 5 and the concept of suppressing the blur, which is generated by adding the camber angle, as described above, are not limited to the vehicular lamp fitting 10A (lens body 12A) of Embodiment 2, but can be applied to each modification thereof and the like. These concepts can also be applied to the vehicular lamp fitting 10J (lens body 12J) of Embodiment 6, which will be described later.

Next, a vehicular lamp fitting 10E, in which a slant angle is added, will be described as Embodiment 4 with reference to the drawings.

Figure 33:
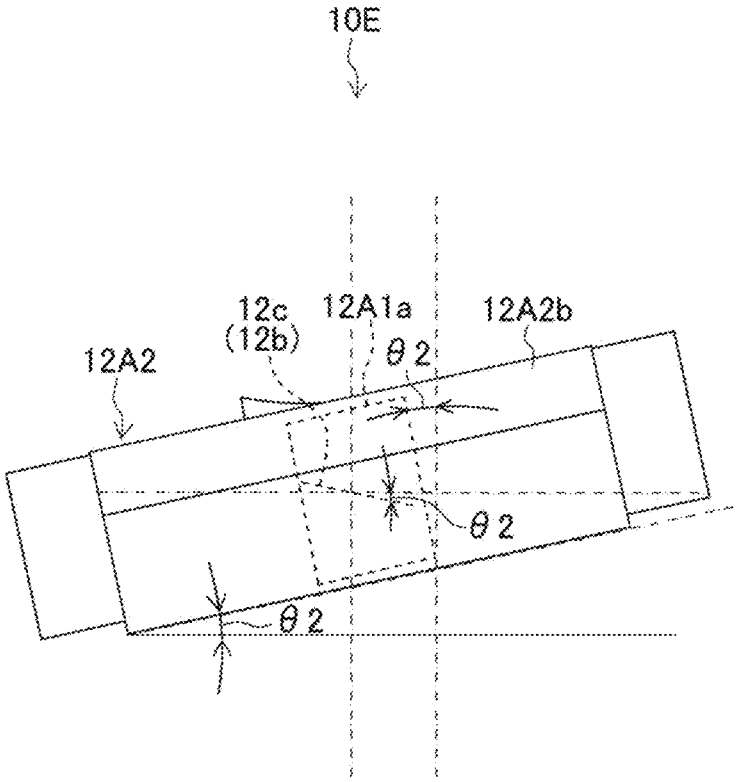
FIG. 33 is a front view of the vehicular lamp fitting 10E in which a slant angle is added.

FIG. 33 is a front view of the vehicular lamp fitting 10E in which a slant angle is added.

As illustrated in FIG. 33, the vehicular lamp fitting 10E of Embodiment 6 corresponds to the vehicular lamp fitting 10A of Embodiment 2, in which the second lens unit 12A2 is inclined with respect to the horizontal direction when viewed from the front, in other words, corresponds to the vehicular lamp fitting 10A of Embodiment 2, in which the second exit surface 12A2*b* is configured as a semicircular cylindrical surface extending in a direction which is inclined with respect to the horizontal direction by a predetermined angle θ2 when viewed from the front (that is, a slant angle θ2 (e.g. θ2=12°) is added). In concrete terms, the second lens unit 12A2 (second exit surface 12A2*b*) of Embodiment 6 corresponds to the second lens unit 12A2 (second exit surface 12A2*b*) of Embodiment 2, which is rotated around the first reference axis AX1 by a predetermined angle θ2.

Figure 34A:
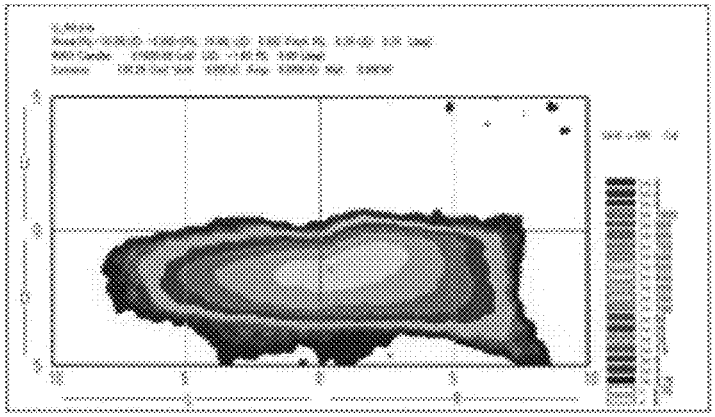
FIG. 34A is a drawing depicting a problem that appears in the low beam light distribution pattern when a slant angle is added.
Figure 34B:
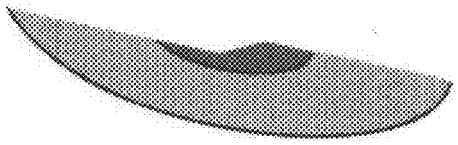
FIG. 34B is a schematic diagram of FIG. 34A.

According to the simulation performed by the inventors of the present invention, if only the slant angle θ2 is added, the focal line of the second lens unit 12A2 inclines with respect to the shade 12*c*, and as a result, the low beam light distribution pattern formed on the virtual vertical screen is rotated (or blurred state), as illustrated in FIG. 34A and FIG. 34B. FIG. 34A is a drawing depicting a problem that appears in the low beam light distribution pattern when a slant angle is added, and FIG. 34B is a schematic diagram of FIG. 34A.

Figure 35A:
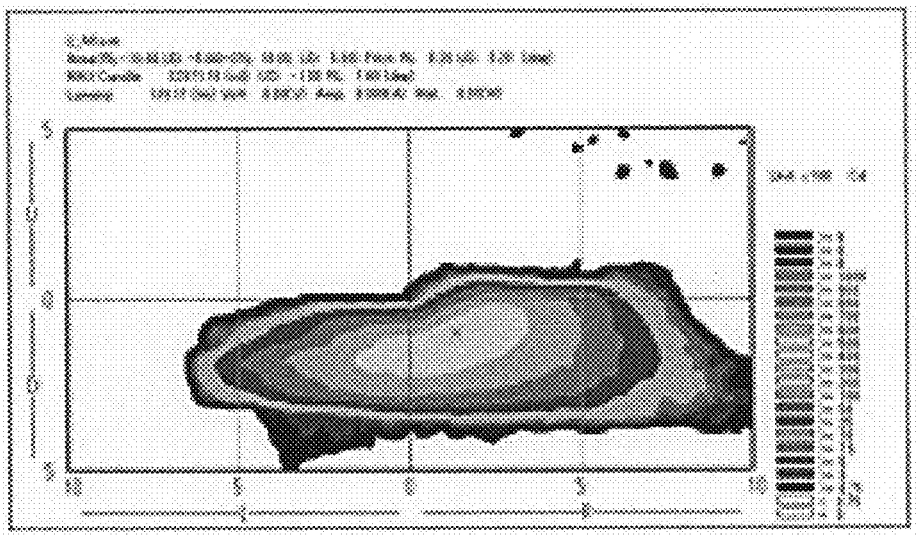
FIG. 35A is a drawing depicting a state when the problem (rotation) which appears in the low beam light distribution pattern was suppressed.
Figure 35B:
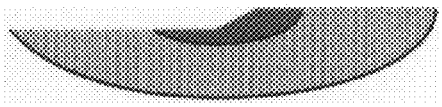
FIG. 35B is a schematic diagram of FIG. 35A.

As a result of keen examination to suppress this rotation (or blurred state), the present inventors discovered that the above mentioned rotation is suppressed (see FIG. 35A and FIG. 35B) by configuring the first exit surface 12A1*a* as a semicircular cylindrical surface extending in a direction which is inclined with respect to the vertical direction by a predetermined angle θ2 when viewed from the front, and disposing the reflection surface 12*b* and the shade 12*c* in an attitude inclined with respect to the horizontal direction by the predetermined angle θ2 in the opposite direction of the second exit surface 12A2*b* and the first exit surface 12A1*a*, as illustrated in FIG. 33. FIG. 35A is a drawing depicting a state when the problem (rotation) which appears in the low beam light distribution pattern was suppressed, and FIG. 35B is a schematic diagram of FIG. 35A.

The reason why the rotation (or blurred state) is suppressed will be described with reference to the drawings.

Figure 45A:
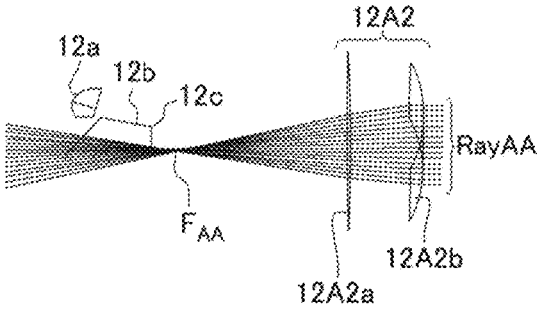
FIG. 45A is first side view of a sixth embodiment of a vehicular lamp 10E (lens body 12A) (primary optical surface is omitted first output surface 12A1*a* only)
Figure 45C:
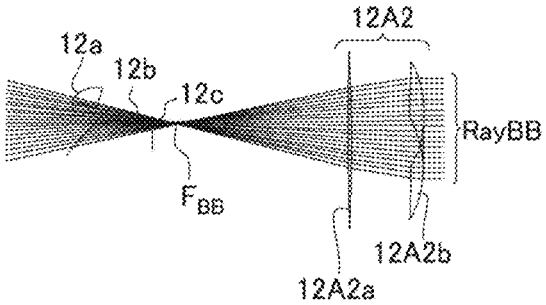
FIG. 45C is side view (main optical surfaces only omitting the first output surface 12A1*a*)
Figure 45B:
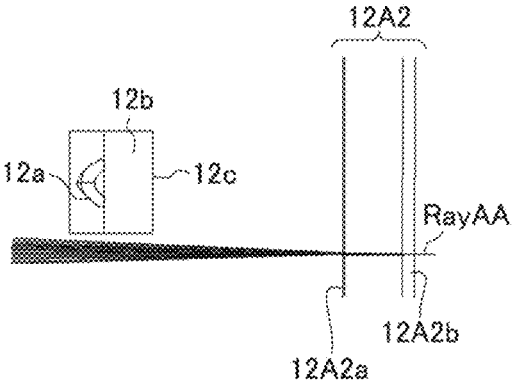
FIG. 45B is top view (first output surface 12A1*a* major omit optical surface only)

FIG. 45A is a side view of the vehicular lamp fitting 10E (lens body 12A) of Embodiment 6 (of only major optical surfaces with omitting the first exit surface 12A1*a*) and FIG. 45B is a top view thereof (of only major optical surfaces with omitting the first exit surface 12A1*a*), and both indicate the optical path of parallel light RayAA, which entered the lens body 12A through the second exit surface 12A2*b* (that is, the result of reverse ray tracing).

Figure 45D:
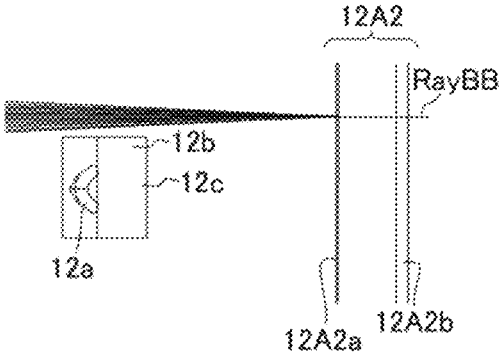
FIG. 45D is a top view (main optical surfaces only omitting the first output surface 12A1*a*).

FIG. 45C is a side view of the vehicular lamp fitting 10E (lens body 12A) of Embodiment 6 (of only major optical surfaces with omitting the first exit surface 12A1*a*), and FIG. 45D is a top view thereof (of only major optical surfaces with omitting the first exit surface 12A1*a*), and both indicate the optical path of parallel light RayBB, which entered the lens body 12A through the second exit surface 12A2*b* (that is, the result of reverse ray tracing).

In FIG. 45A to FIG. 45D, the slant angle θ2 (=10°) is added to the second lens unit 12A2, and the focal line of the second lens unit 12A2 is inclined with respect to the horizontal line by the slant angle θ2. As a result, the focal point FBB in FIG. 45C is positioned higher than the focal point FAA in FIG. 45A.

Figure 46A:
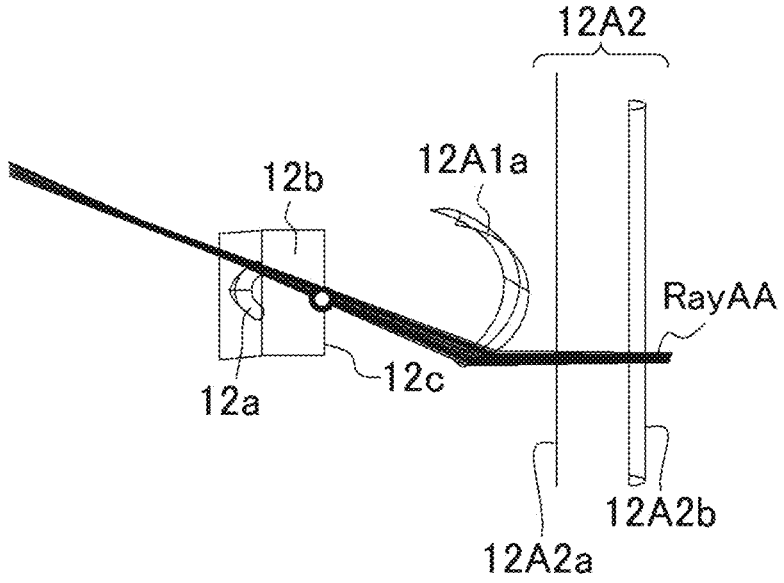
FIG. 46A is top view obtained by adding a first output surface 12A1*a* in FIG. 45B.
Figure 46B:
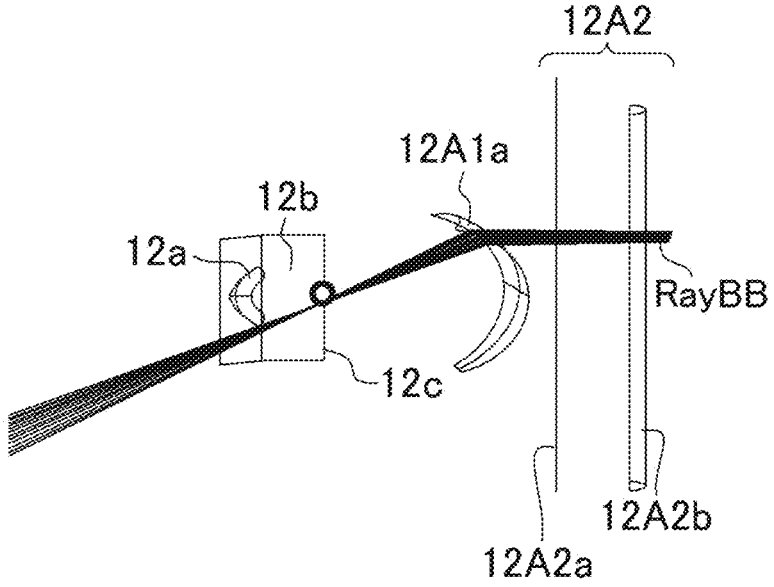
FIG. 46B is top view obtained by adding a first output surface 12A1*a* in FIG. 45D.

The optical paths of the parallel light RayAA and RayBB in the case of disposing the first exit surface 12A1*a*, on the other hand, are illustrated in FIG. 46A and FIG. 46B.

FIG. 46A is a top view when the first exit surface 12A1*a* is added to FIG. 45B, and indicates the optical path of the parallel light RayAA which entered the lens body 12A through the second exit surface 12A2*b* (that is, the result of reverse ray tracing). FIG. 46B is a top view when the first exit surface 12A1*a* is added to FIG. 45D, and indicates the optical path of the parallel light RayBB which entered the lens body 12A through the second exit surface 12A2*b* (that is, the result of reverse ray tracing).

In the case of adding the slant angle θ2 (=10°) to the first exit surface 12A1*a* (that is, the case when the first exit surface 12A1*a* is configured as a semicircular cylindrical surface extending in a direction inclined with respect to the vertical direction by the predetermined angle θ2), the components having a low focal point $F_{AA}$ (that is, RayAA) are refracted because of the function of the first exit surface 12A1*a*, travel in the reverse direction, and are focused, as illustrated in FIG. 46A. The components having a high focal point $F_{BB}$ (that is, RayBB), on the other hand, are refracted because of the function of the first exit surface 12A1*a*, travel in the reverse direction, and are focused, as illustrated in FIG. 46B. As a result, the focal line is inclined in the opposite direction of the slant direction.

In order to match (approximately match) the shade 12*c* with the focal line inclined in the opposite direction of the slant direction, the reflection surface 12*b* and the shade 12*c* are disposed in an attitude inclined with respect to the horizontal line by the predetermined angle θ2 in the opposite direction of the second exit surface 12A2*b* and the first exit surface 12A1*a* when viewed from the front. Thereby, the shade 12*c* matches (approximately matches) with the focal line, which is inclined in the opposite direction of the slant direction, and the above mentioned rotation (or blurred state) can be suppressed.

Based on this knowledge, the first exit surface 12A1*a* of Embodiment 6 is configured as a semicircular cylindrical surface extending in a direction inclined with respect to the vertical direction by the predetermined angle θ2 when viewed from the front. In concrete terms, the first exit surface 12A1*a* of Embodiment 6 corresponds to the first exit surface 12A1*a* of Embodiment 2 that is rotated around the first reference axis AX1 by the predetermined angle θ2 in the same direction as the second exit surface 12A2*b*.

The reflection surface 12*b* and the shade 12*c* are disposed in an attitude inclined with respect to the horizontal direction by the predetermined angle θ2 in the opposite direction of the second exit surface 12A2*b* and the first exit surface 12A1*a* when viewed from the front. In concrete terms, the reflection surface 12*b* and the shade 12*c* of Embodiment 6 correspond to the reflection surface 12*b* and the shade 12*c* of Embodiment 2 that are rotated around the first reference axis AX1 by the predetermined angle θ2 in the opposite direction of the second exit surface 12A2*b* and the first exit surface 12A1*a*.

The vehicular lamp fitting 10E of Embodiment 6 is the same as the vehicular lamp fitting 10A of Embodiment 2, except for the above mentioned aspects.

According to Embodiment 6, the following effects can be implemented in addition to the effects of Embodiment 2.

Firstly, a lens body (combined lens body) having a new appearance in which a slant angle is added, and a vehicular lamp fitting equipped with this lens body (combined lens body), can be provided. In other words, a lens body (combined lens body) having an integral appearance linearly extending in a direction inclined with respect to the horizontal direction by a predetermined angle when viewed from the front, and a vehicular lamp fitting equipped with this lens body (combined lens body), can be provided. Secondly, a lens body (combined lens body) which can form a low beam light distribution pattern condensed in the horizontal direction and the vertical direction, even though the second exit surface 12A2*b*, which is the final exit surface, is a semicircular cylindrical surface (semicircular cylindrical refractive surface), and a vehicular lamp fitting equipped with this lens body (combined lens body), can be provided. Thirdly, a lens body (combined body) that can suppress rotation of the low beam light distribution pattern, even though a slant angle is added, and a vehicular lamp fitting equipped with this lens body (combined lens body), can be provided.

The integral appearance linearly extending in a direction inclined with respect to the horizontal direction by a predetermined angle can be implemented, because the second exit surface 12A2*b*, which is the final exit surface, is configured as a semicircular cylindrical surface (semicircular cylindrical refractive surface), and this second exit surface 12A2*b* extends in a direction inclined with respect to the horizontal direction when viewed from the front.

The low beam light distribution pattern condensed in the horizontal direction and the vertical direction can be formed even though the second exit surface 12A2*b*, which is the final exit surface, is a semicircular cylindrical surface (semicircular cylindrical refractive surface), because condensing light in the horizontal direction is mainly performed by the first exit surface 12A1*a* (semicircular cylindrical refractive surface) of the first lens unit 12A1, and condensing light in the vertical direction is mainly performed by the second exit surface 12A2*b* (semicircular cylindrical refractive surface) of the second lens unit 12A2, which is the final exit surface of the lens body 12A. In other words, the condensing functions are separated.

Rotation of the low beam light distribution pattern is suppressed even though the slant angle is added, because the first exit surface 12A1*a* is a semicircular cylindrical surface extending in a direction inclined with respect to the vertical direction by a predetermined angle, when viewed from the front, and the shade 12*c* (and the reflection surface 12*b*) is disposed in an attitude inclined with respect to the horizontal direction by a predetermined angle in the opposite direction of the second exit surface 12A2*b* and the first exit surface 12A1*a*.

The concept of "the slant angle is added" described in Embodiment 6, and the concept of suppressing the rotation, which is generated by adding the slant angle, as described above, are not limited to the vehicular lamp fitting 10A (lens body 12A) of Embodiment 2, but can be applied to each modification thereof and the like. These concepts can also be applied to the vehicular lamp fitting 10J (lens body 12J) of Embodiment 6, which will be described later.

Next a vehicular lamp fitting 10F, in which a camber angle and a slant angle are added, will be described as Embodiment 5 with reference to the drawings.

Figure 36A:
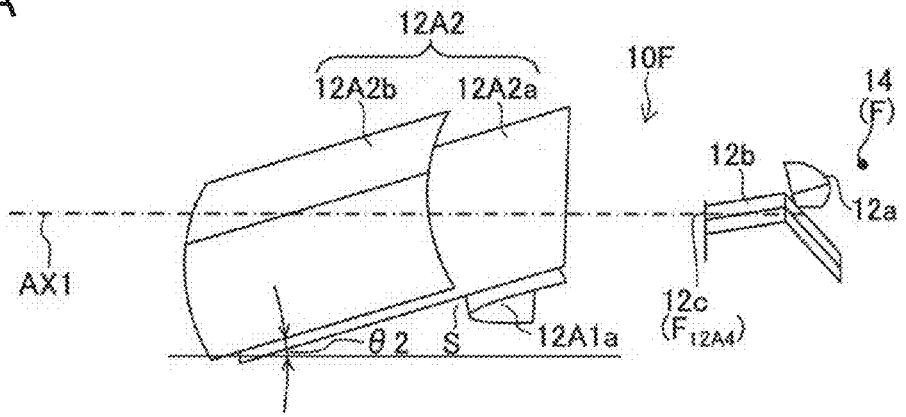
FIG. 36A is a side view (of major optical surfaces only) of the vehicular lamp fitting 10F in which a camber angle and a slant angle are added.
Figure 36B:
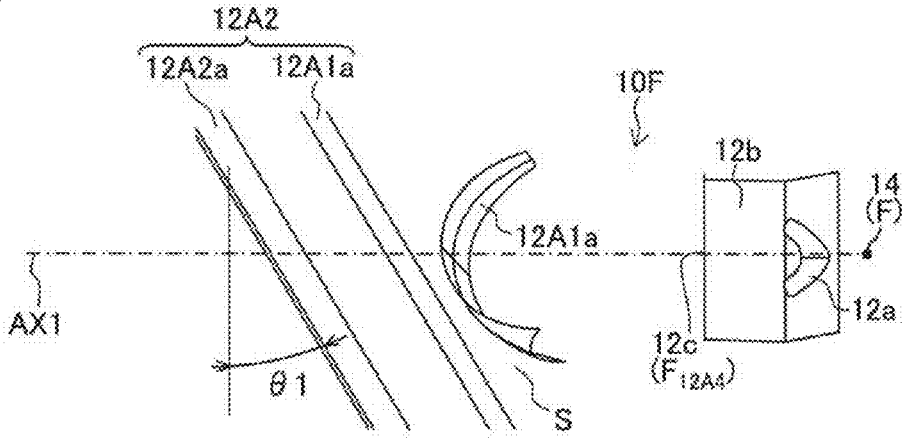
FIG. 36B is a top view (of major optical surfaces only) thereof.
Figure 36C:
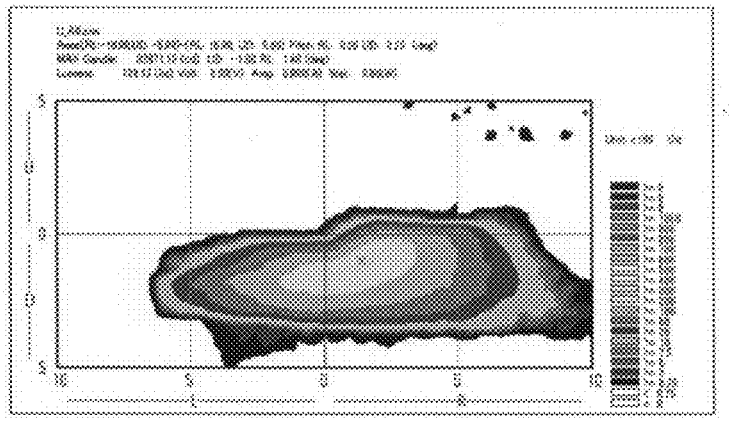
FIG. 36C is an example of a low beam light distribution pattern formed by the vehicular lamp fitting 10F.

FIG. 36A is a side view (of major optical surfaces only) of the vehicular lamp fitting 10F in which a camber angle and a slant angle are added, FIG. 36B is a top view (of major optical surfaces only) thereof, and FIG. 36C is an example of a low beam light distribution pattern formed by the vehicular lamp fitting 10F.

As illustrated in FIG. 36A and FIG. 36B, the vehicular lamp fitting 10F of Embodiment 7 corresponds to the vehicular lamp fitting 10A of Embodiment 2, in which the second lens unit 12A2 is inclined with respect to the first reference axis AX1 (that is, the camber angle θ1 is added) when viewed from the top, and is inclined with respect to the horizontal direction (that is, a slant angle θ2 is added) when viewed from the front, in other words, it corresponds to the combination of Embodiment 3 and Embodiment 4 described above.

In other words, the second exit surface 12A2*b* of Embodiment 7 extends in a direction inclined with respect to the first reference axis AX1 by a predetermined angle when viewed from the top, similarly to Embodiment 3, and is configured as a semicircular cylindrical surface extending in a direction inclined with respect to the horizontal direction by the predetermined angle θ2 when viewed from the front, similarly to Embodiment 4.

Further, the first exit surface 12A1*a* of Embodiment 7 is a semicircular cylindrical surface extending in a direction inclined with respect to the vertical direction by the predetermined angle θ2 when viewed from the front (see FIG. 33), and the surface shape thereof is adjusted so that the low beam light distribution pattern is generally condensed.

Furthermore, the reflection surface 12*b* and the shade 12*c* of Embodiment 7 are disposed in an attitude inclined with respect to the horizontal direction by the predetermined angle θ2 in the opposite direction of the second exit surface 12A2*b* and the first exit surface 12A1*a* when viewed from the front, similarly to Embodiment 4.

According to Embodiment 7, a lens body (combined lens body) having a new appearance in which a camber angle and a slant angle are added, and a vehicular lamp fitting equipped with the lens body (combined lens body), can be provided, and effects the same as Embodiment 3 and Embodiment 4 can be implemented.

The concept "camber angle and the slant angle are added" described in Embodiment 7, and the concept of improving rotation and suppressing blur, which are generated by adding the camber angle and the slant angle, as described above, are not limited to the vehicular lamp fitting 10A (lamp body 12A) of Embodiment 2, but can be applied to each modification thereof and the like. These concepts can also be applied to the vehicular lamp fitting 10J (lens body 12J) of Embodiment 6, which will be described later.

Now a vehicular lamp fitting 10G, according to a first comparative example, will be described with reference to the drawings.

Figure 37A:
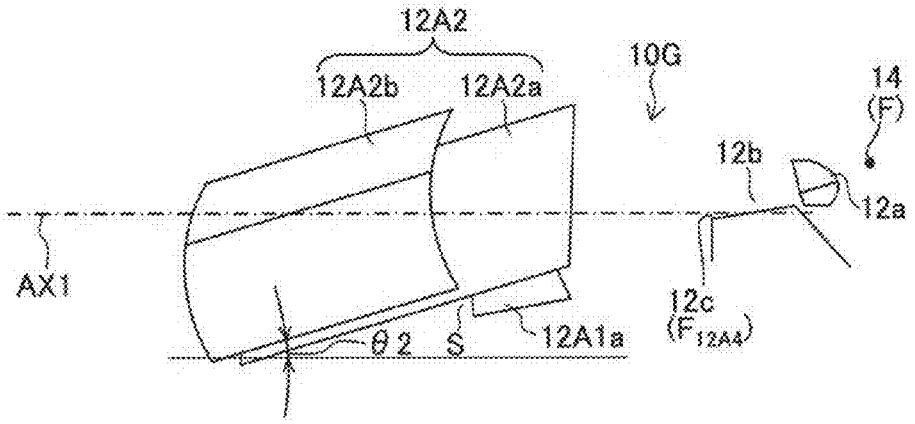
FIG. 37A is a side view (of major optical surfaces only) of the vehicular lamp fitting 10G according to the first comparative example.
Figure 37B:
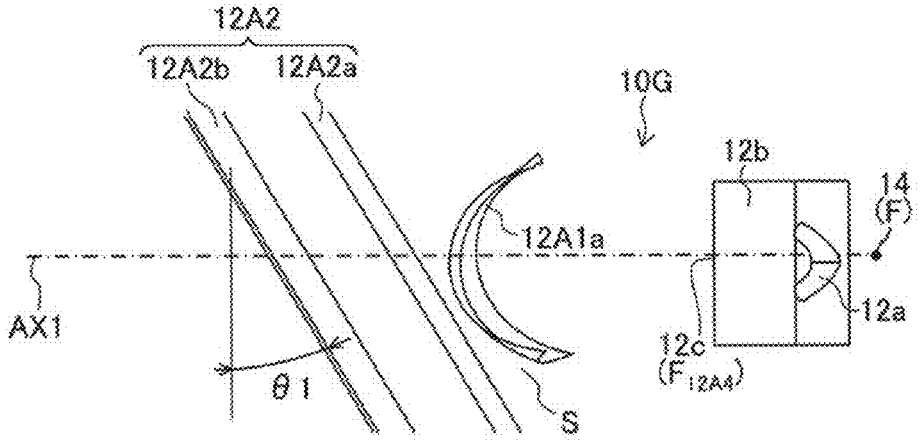
FIG. 37B is a top view (of major optical surfaces only) thereof.
Figure 37C:
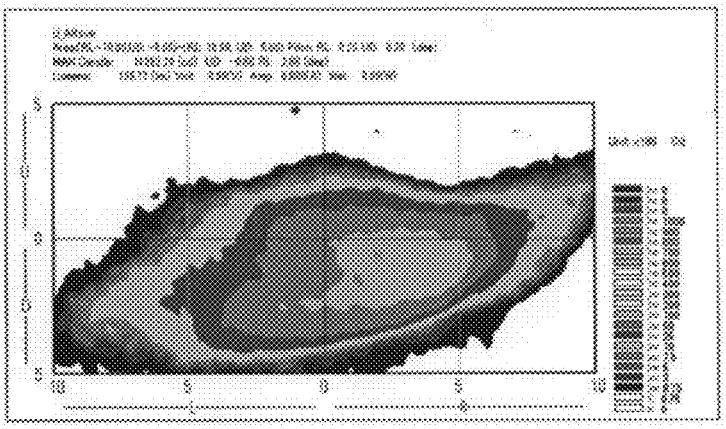
FIG. 37C is an example of a light distribution pattern formed by the vehicular lamp fitting 10G.

FIG. 37A is a side view (of major optical surfaces only) of the vehicular lamp fitting 10G according to the first comparative example, FIG. 37B is a top view (of major optical surfaces only) thereof, and FIG. 37C is an example of a light distribution pattern formed by the vehicular lamp fitting 10G.

As illustrated in FIG. 37A and FIG. 37B, the vehicular lamp fitting 10G according to the first comparative example corresponds to the vehicular lamp fitting 10D of Embodiment 3, in which the second lens unit 12A2 is inclined with respect to the horizontal direction (that is, a slant angle θ2 is added) when viewed from the front.

In other words, the first exit surface 12A1*a* of the first comparative example is configured as a semicircular cylindrical surface extending in the vertical direction when viewed from the front, similarly to Embodiment 3. This means that, unlike Embodiment 4, the first exit surface 12A1*a* of the first comparative example is not configured as a semicircular cylindrical surface extending in a direction inclined with respect to the vertical direction by the predetermined angle θ2 when viewed from the front.

Further, the reflection surface 12*b* and the shade 12*c* of the first comparative example are disposed in a horizontal attitude when viewed from the front, similarly to Embodiment 3. In other words, unlike Embodiment 4, the first exit surface 12A1*a* of the first comparative example is not disposed in an attitude inclined with respect to the horizontal direction by the predetermined angle θ2 in the opposite direction of the second exit surface 12A2*b* and the first exit surface 12A1*a*.

As illustrated in FIG. 37C, the light distribution pattern formed by the vehicular lamp fitting 10G of the first comparative example extends considerably above the horizontal line, which is not suitable for the low beam light distribution pattern.

Now a vehicular lamp fitting 10H according to a second comparative example will be described with reference to the drawings.

Figure 38A:
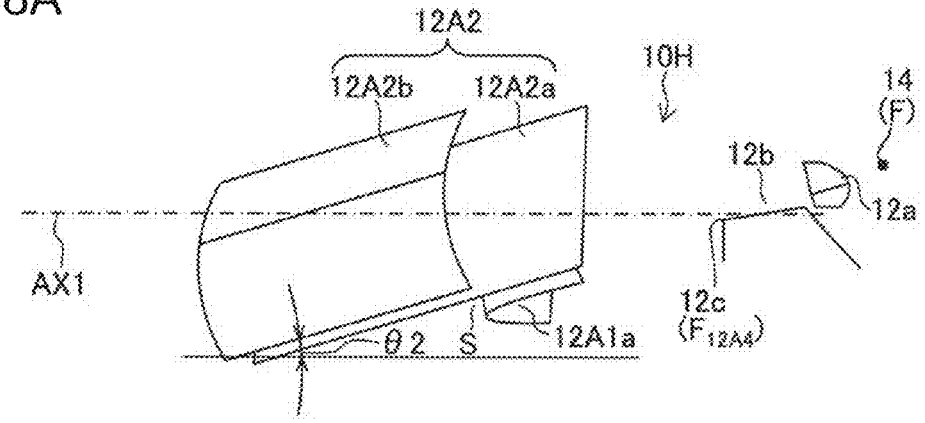
FIG. 38A is a side view (of major optical surfaces only) of the vehicular lamp fitting 10H of a second comparative example.
Figure 38B:
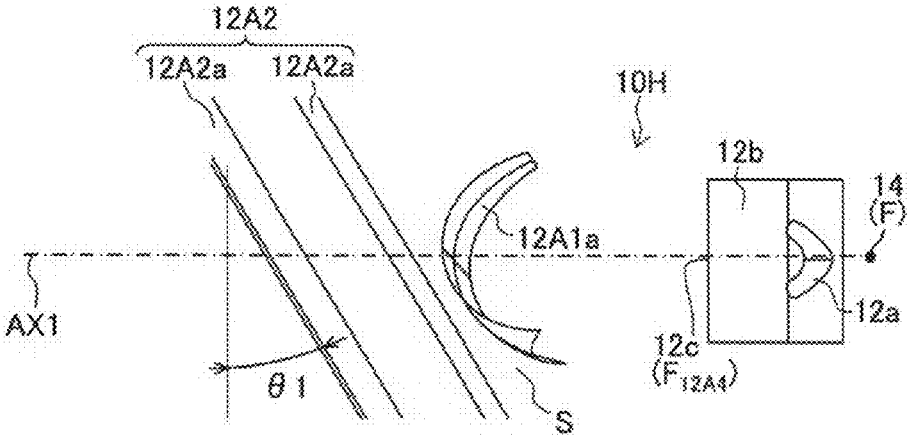
FIG. 38B is a top view (of major optical surfaces only) thereof.
Figure 38C:
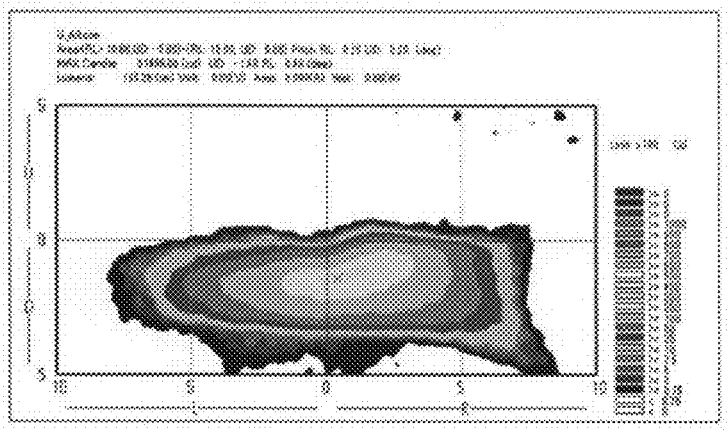
FIG. 38C is an example of a light distribution pattern formed by the vehicular lamp fitting 10H.

FIG. 38A is a side view (of major optical surfaces only) of the vehicular lamp fitting 10H of a second comparative example, FIG. 38B is a top view (of major optical surfaces only) thereof, and FIG. 38C is an example of a light distribution pattern formed by the vehicular lamp fitting 10H.

As illustrated in FIG. 38A and FIG. 38B, the vehicular lamp fitting 10H of the second comparative example corresponds to the vehicular lamp fitting 10G of the first comparative example, in which the first exit surface 12A1*a* is configured as a semicircular cylindrical surface extending in a direction inclined with respect to the vertical direction by a predetermined angle θ2 when viewed from the front, similarly to Embodiment 4.

In other words, the first exit surface 12A1*a* of the second comparative example is configured as a semicircular cylindrical surface extending in a direction inclined with respect to the vertical direction by a predetermined angle θ2 when viewed from the front, similarly to Embodiment 4.

Further, the reflection surface 12*b* and the shade 12*c* of the second comparative example are disposed in a horizontal attitude when viewed from the front, similarly to Embodiment 3. In other words, unlike Embodiment 4, the first exit surface 12A1*a* of the second comparative example is not disposed in an attitude inclined with respect to the horizontal direction by the predetermined angle θ2 in the opposite direction of the second exit surface 12A2*b* and the first exit surface 12A1*a*.

As illustrated in FIG. 38C, the light distribution pattern formed by the vehicular lamp fitting 10H of second comparative example extends considerably above the horizontal line, which is not suitable for the low beam light distribution pattern.

Next, the vehicle lighting device of the sixth embodiment 10 J (lens body 12 J), will be described with reference to the drawings.

Vehicle lamp 10J of the present embodiment (the lens body 12 J) is constructed as follows.

Figure 39:
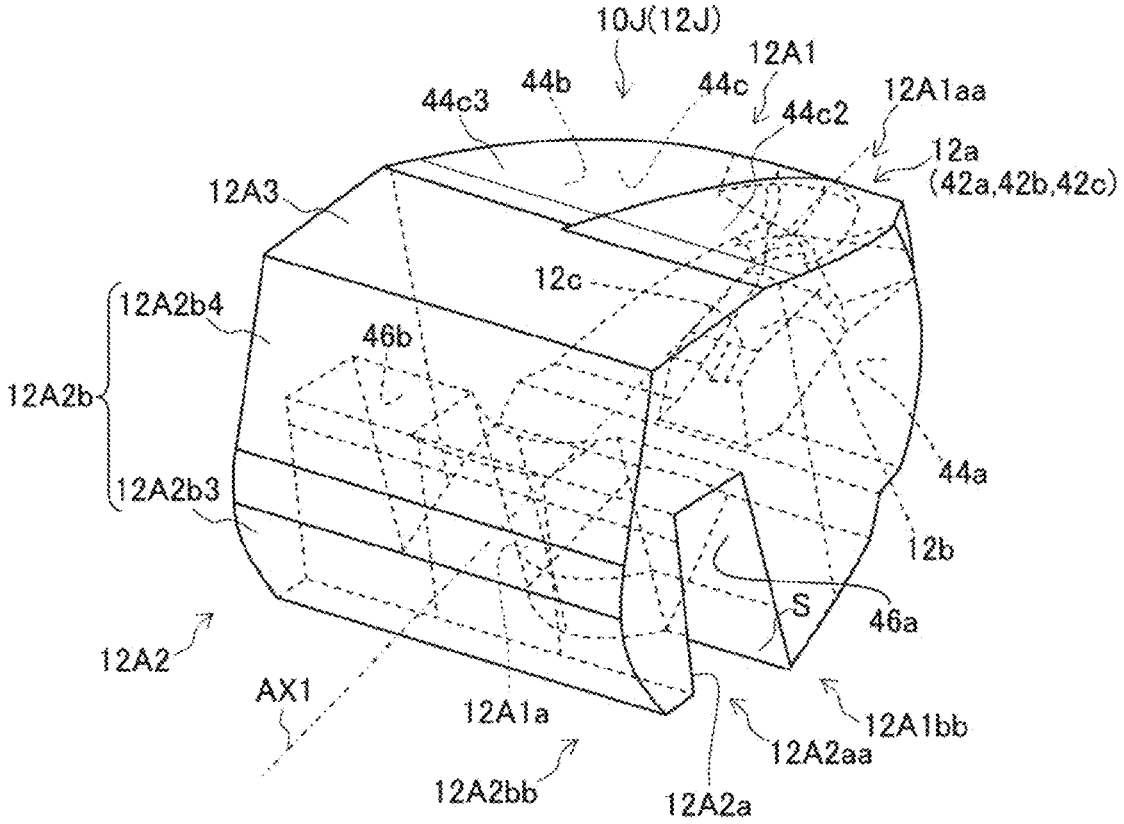
FIG. 39 is a perspective view of the vehicular lamp 10 J (lens body 12 J).
Figure 40A:
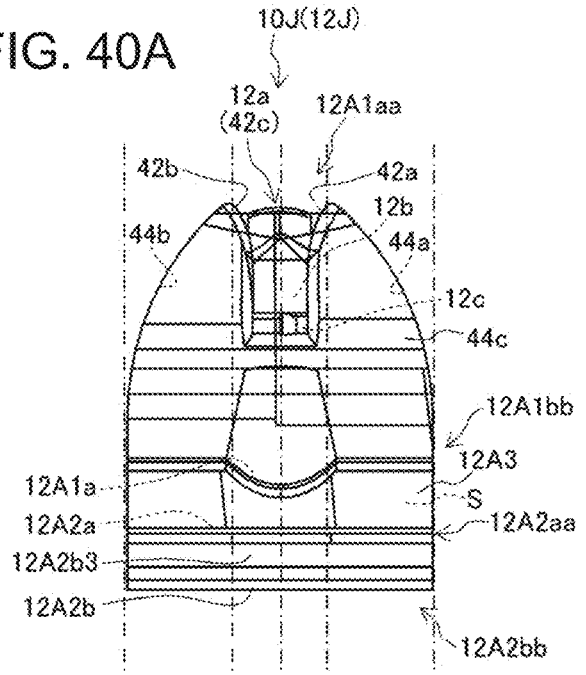
FIG. 40A is a top view of the vehicular lamp 10 J (lens body 12 J)
Figure 40B:
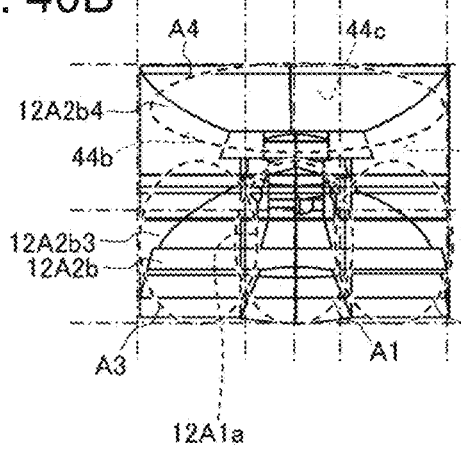
FIG. 40B is a front view.
Figure 40C:
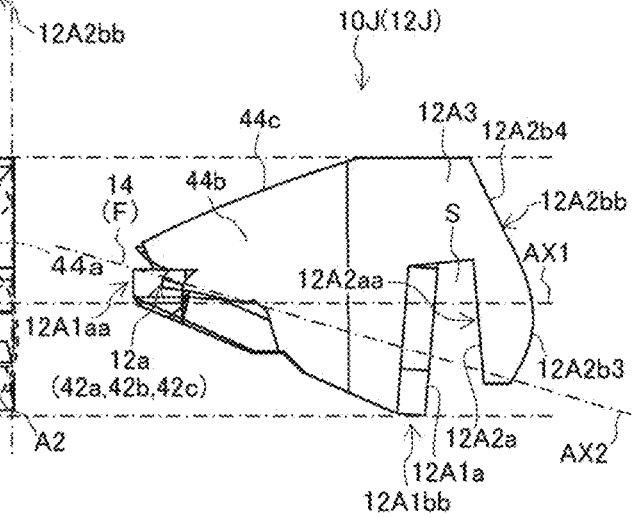
FIG. 40C is a side view.

FIG. 39 is a perspective view of the vehicular lamp 10 J (lens body 12 J), FIG. 40 A is a top view, FIG. 40 B is a front view, FIG. 40 C is a side view. In the example of FIG. 41 A is a light distribution pattern PLO (synthesized light distribution pattern) for a low beam formed by the vehicle lamp 10 J (lens body 12 J), each section partitioned shown in FIG. 41 B~FIG. 41 (d-) light pattern PSPOT, PMID, is formed by PWIDE is superimposed.

Figure 41A:
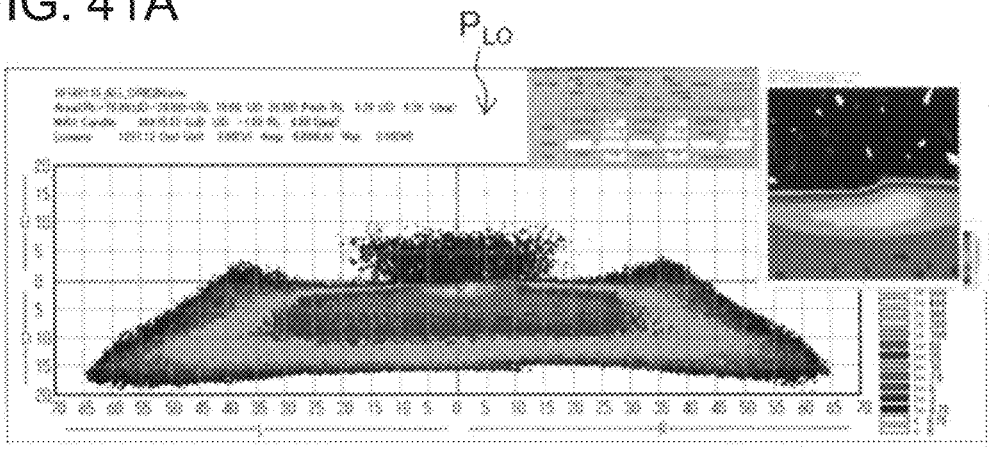
FIG. 41A is an example of the vehicle lamp 10J (lens body 12J) light distribution pattern for low beam is formed by the PLO (synthetic light distribution pattern)
Figure 41B:
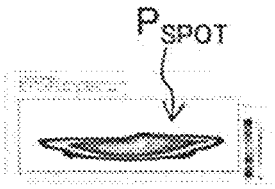
FIGS. 41B to 41D illustrate various parts distribution light pattern PSPOT, PMID, PWIDE.
Figure 41C:
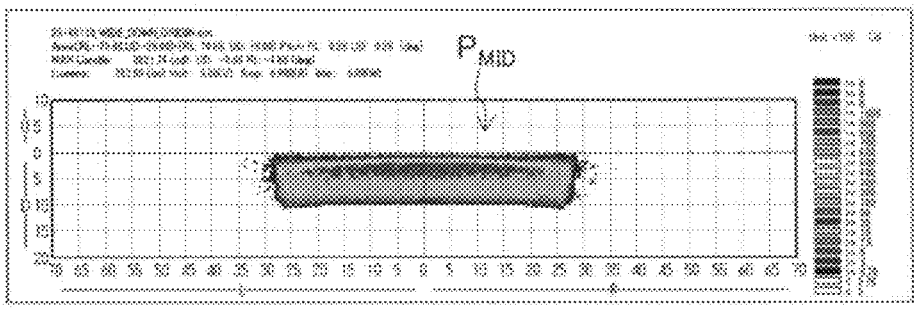
Figure 41D:
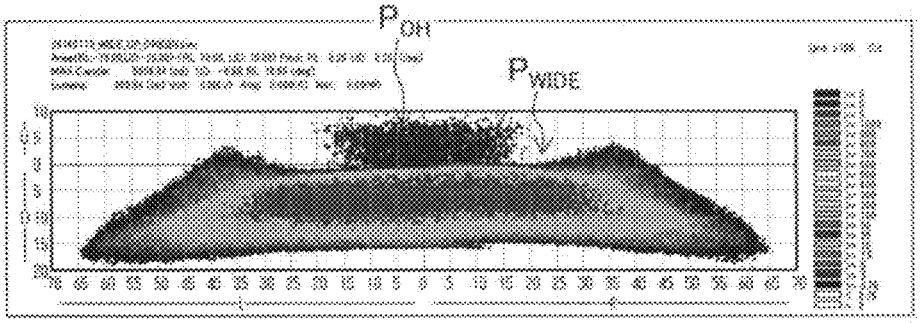
Figure 42A:
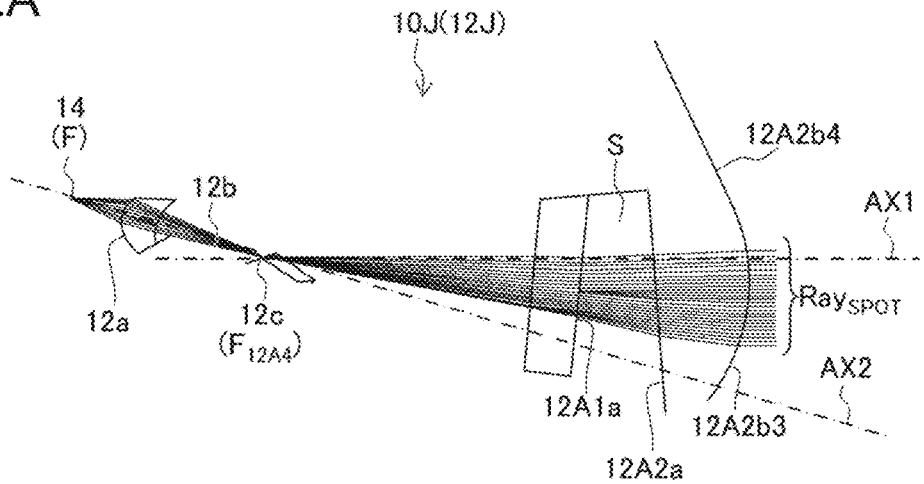
FIG. 42A is a side view of the first optical system (primary optical surfaces only).
Figure 42B:
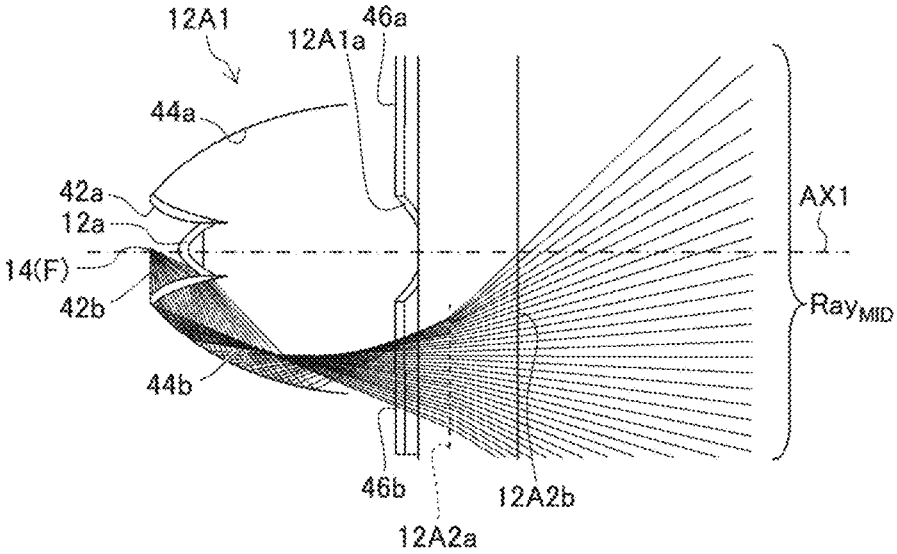
FIG. 42B is a top view of the second optical system (primary optical surfaces only).
Figure 42C:
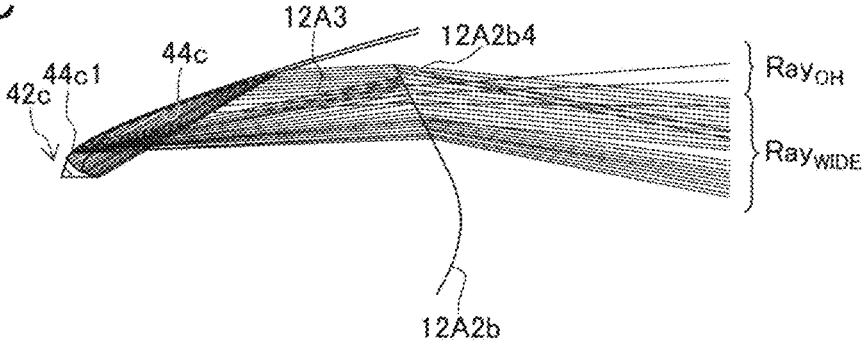
FIG. 42C is a side view of the third optical system (primary optical surfaces only).

Lens body 12J of the present embodiment, to form a spot light distribution pattern PSPOT (see FIG. 41 B), the lens body 12A similar to the first optical system of the second embodiment (see FIG. 42 A) in addition to the further (see FIG. 42 B) mid light distribution pattern PMID diffused from the light distribution pattern PSPOT for spot second optical system for forming (FIG. 41 C refer), and, distribution for mid the third optical system for forming an optical pattern PMID than diffuse wide light distribution pattern PWIDE (see FIG. 41*d* (d-)) and a (FIG. 42 C refer).

Hereinafter, the second focuses on the differences from the vehicle lighting device 10A of embodiment (lens body 12A), the same configuration as the second embodiment of the vehicle lamp 10A (lens body 12A) is the same description thereof is omitted a reference numeral.

FIG. 39, as shown in FIG. 40, the lens body 12J of the present embodiment, the same configuration as the lens body 12A of the second embodiment, the first rear end portion 12A1*aa*, the front end portion 12A1*bb*, first rear end portion 12A1*aa* When placed right and left pair of side 44*a* between the first front end 12A1*bb*, 44*b*, and, the first comprising a first rear end portion 12A1*aa* and the lower reflecting surface 12*b* disposed between the first front end 12A1*bb* a lens portion 12A1, is disposed in front of the first lens portion 12A1, the second rear end portion 12A2*aa*, a second lens portion 12A2 including a second front end 12A2*bb*, a first lens unit 12A1 and a second lens portion 12A2 wherein the connecting portion 12A3 linked, further configured as a lens body comprising a first rear end portion of the first lens portion 12A1 12A1*aa* and the placed top surface 44*c* between the first front end 12A1*bb*.

Lens body 12J of the present embodiment, similarly to the above embodiments, injecting a polycarbonate or a transparent resin such as acrylic, cooling, (by injection molding) by solidifying are integrally formed.

Figure 43A:
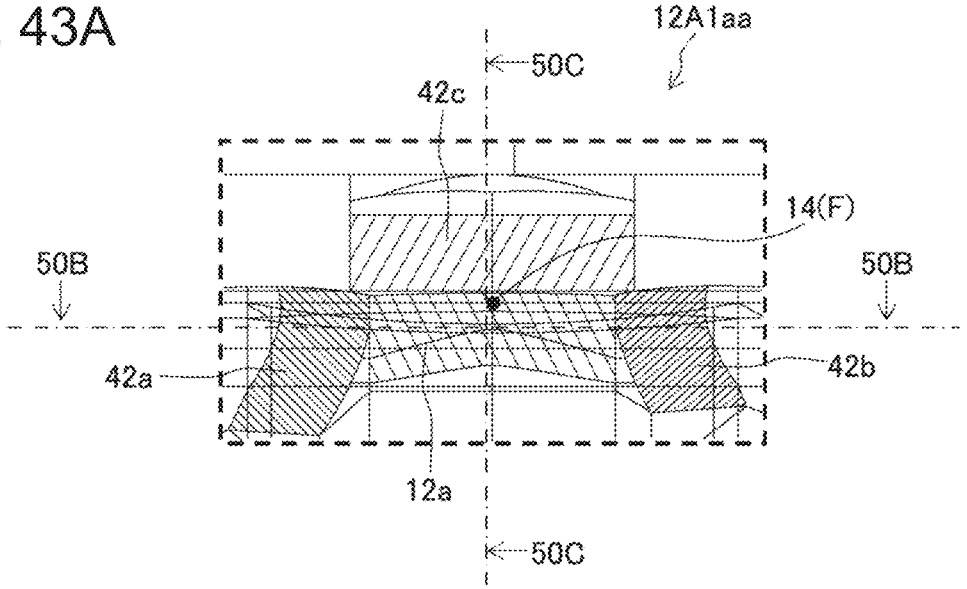
FIG. 43A is a front view of a first rear end portion 12A1*aa* of the first lens unit 12A1.
Figure 43B:
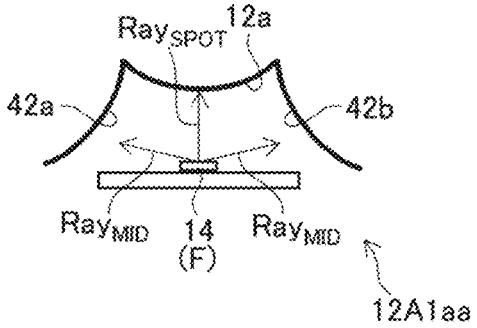
FIG. 43B is B-B sectional view of FIG. 43A (schematic diagram)
Figure 43C:
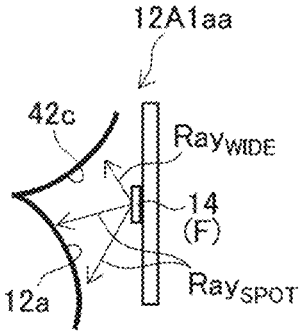
FIG. 43C is C-C sectional view of FIG. 43A (schematic diagrams).

FIG. 43 A is a front view of a first rear end portion 12A1*aa* of the first lens unit 12A1, FIG. 43 B FIG. 43 B-B sectional view of A (schematic view), FIG. 43 C is diagrams 43 C-C sectional view of A (schematic diagram).

FIG. 43 A, as shown in FIG. 43 B, the first rear end portion 12A1*aa* of the first lens unit 12A1 includes a first entrance surface 12*a*, and, on both left and right sides of the first entrance surface 12*a*, the first space disposed so as to surround the left and right sides are pair of left and right entrance surface 42*a* between the light source 14 arranged in the vicinity of the incident surface 12*a* and the first incident face 12*a*, includes 42*b*. The first rear end 12A1*aa*, as shown in FIG. 43 A, FIG. 43 C, further, on the upper side of the first entrance surface 12*a*, the light source 14 and the space between the first entrance surface 12*a* upward It contains on the entrance surface 42*c* disposed so as to surround from.

Tip of the lower reflecting surface 12*b* includes a shade 12*c*.

The first front end 12A1*bb* of the first lens unit 12A1, as shown in FIG. 39, semicylindrical first output surface 12A1*a* extending in the vertical direction, and left and right pair are disposed on both left and right sides of the first output surface 12A1*a* of the emission surface 46*a*, and it includes a 46*b*.

The second rear end portion 12A2*aa* of the second lens unit 12A2 includes a second entrance surface 12A2*a*, the second front end 12A2*bb* of the second lens unit 12A2 includes a second output surface 12A2*b*.

Second output surface 12A2*b* includes a semicylindrical region 12A2*b*3 extending in a horizontal direction, contains, an extension region 12A2*b*4 that extend upward obliquely rearward from the upper edge of the semi-cylindrical region 12A2*b*3.

Connecting portion 12A3 includes a first lens portion 12A1 and the second lens portion 12A2, in each of the upper, first forward end of the first lens unit 12A1 12A1*bb*, second rear end portion of the second lens portion 12A2 12A2*aa* and consolidated are connected in a state enclosed space S is formed in parts 12A3.

FIG. 42 A is a side view of a first optical system (primary optical surfaces only).

As shown in FIG. 42 A, first entrance surface 12*a*, the lower reflection surface 12 *b* (and shade 12*c*), first output surface 12A1*a*, second entrance surface 12A2*a*, and, second output surface 12A2*b* (the semi-cylindrical region 12A2*b*3), the light was shielded in part by the shade 12*c* of the light RaySPOT from the light source 14 incident from the first incident surface 12*a* inside the first lens portion 12A1, and, the light is internally reflected under the reflection surface 12*b* but is emitted from the first emission surface 12A1*a*, further partial region A1 (FIG out from the second incident surface 12A2*a* enters inside the second lens portion 12A2 second output surface 12A2*b* (semicylindrical region 12A2*b*3) by being irradiated forward emitted from the 40 B refer), as shown in FIG. 41 B, the light distribution pattern PSPOT (present invention for spot comprising a cut-off line defined by the shade 12*c* to the upper edge constitute a first optical system for forming an equivalent) to the first light distribution pattern.

FIG. 42 B is a top view of a second optical system (primary optical surfaces only).

As shown in FIG. 42 B, a pair of left and right entrance surface 42*a*, 42*b*, a pair of left and right side faces 44*a*, 44*b*, a pair of left and right exit surface 46*a*, 46*b*, second incident surface 12A2*a*, and, second output surface 12A2*b* (semicylindrical region 12A2*b*3) is a pair of left and right entrance surface 42*a*, the first lens portion 12A1 enters the inside right and left pair of side 44*a* from 42*b*, the light RayMID from the light source 14 which is internally reflected at 44*b*, right and left of the emission surface 46*a*, and emitted from the 46 *b*, further, the partial area A1 of the second incident surface 12A2*a* enters inside the second lens portion 12A2 mainly second output surface 12A2*b* (semicylindrical region 12A2*b*3) by being emitted forward left and right sides of the region A2, A3 and emitted (FIG. 40 B refer), as shown in FIG. 41 C, is superimposed on the spot light distribution pattern PSPOT, for spot constitute a second optical system for forming a mid light distribution pattern PMID diffused from the light distribution pattern PSPOT.

A pair of left and right entrance surface 42*a*, 42*b*, of the light from the light source 14 does not enter the first entrance surface 12*a* of light (mainly, the light RayMID extending in the lateral direction. FIG. 43 B refer) is a plane that is incident inside the first lens portion 12A1 is refracted, as shown in FIG. 43 B, the surface of the curved convex toward the light source 14 (e.g., free-form surface) It is configured as a.

A pair of left and right side faces 44*a*, 44*b*, as shown in FIG. 40 A, when viewed from left and right pair of side accordance from the first front end 12A1*bb* side of the first lens portion 12A1 toward the first rear end portion 12A1*aa* side 44*a*, the spacing between 44*b* is configured as a surface of a convex curved surface shape toward the outside, which narrows in a tapered shape (e.g., free-form surface). Further, a pair of left and right side faces 44*a*, 44*b*, as shown in FIG. 40 C, in side view, on which in accordance with the first front end 12A1*bb* side of the first lens portion 12A1 toward the first rear end portion 12A1*aa* side and lower edges is formed as a surface having a shape narrowing tapered.

Incidentally, a pair of left and right sides 44*a*, 44*b* are a pair of left and right entrance surface 42*a*, the light RayMID pair of left and right exit surface 46*a* of the first lens unit 12A1 light source 14 which enters the inside through 42*b*, internal reflection towards the 46 *b* (in reflecting surface total reflection) to, metal deposition is not used.

A pair of left and right exit surface 46*a*, 46*b* is configured as a surface of a planar shape. Of course, not limited to this, it may be configured as a surface of a curved surface.

The second optical system of the above construction, on the virtual vertical screen, the light distribution pattern PMID for mid shown in FIG. 41 C is formed.

Vertical dimension of the mid-beam light distribution pattern PMID is about 10 degrees in FIG. 41 C, not limited to this, for example, a pair of left and right entrance surface 42*a*, 42*b* of the surface shape (e.g., curvature in the vertical direction) can be freely adjusted by adjusting the.

The position of the upper edge of the mid-beam light distribution pattern PMID is a somewhat of a FIG. 41 C the horizontal line is not limited thereto, a pair of left and right entrance surface 42*a*, 42*b* of the surface shape (e.g., pair it is possible to adjust the incident surface 42*a*, freely by adjusting the 42*b* slope of).

Further, the right end and left end of the mid-beam light distribution pattern PMID is extends to the right to about 30 degrees and the left about 30 degrees FIG. 41 C, not limited to this, for example, a pair of left and right entrance surface 42*a*, 42*b* and/or right and left pair of side 44*a*, 44*b* (for example, each of the horizontal curvature) can be adjusted freely by adjusting the.

FIG. 42 C is a side view of a third optical system (primary optical surfaces only).

As shown in FIG. 42 C, the upper entrance surface 42*c*, the upper surface 44*c*, the coupling portion 12A3, and the second emission surface 12A2*b* (extension regions 12A2*b*4) enters from the upper incident surface 42*c* inside the first lens portion 12A1 the internal reflection at the upper surface 44*c* on, the connecting portion 12A3 light RayWIDE from the light source 14, which travels through the inside, above the area A4 of the second emission surface 12A2*b* (each of the regions A1~A3. That is, by being irradiated forward emitted from the extended area 12A2*b*4), as shown in FIG. 41 D, is superimposed on the light distribution pattern for a spot PSPOT and mid light distribution pattern PMID, mid light distribution constitute a third optical system for forming a light distribution pattern PWIDE for wide diffused than the pattern PMID.

The upper incident surface 42*c*, the light (mainly not enter the first entrance surface 12*a* of the light from the light source 14 extends upward light RayWIDE. FIG. 43 C refer) is a plane that is incident inside the first lens portion 12A1 is refracted, as shown in FIG. 43 C, the surface of the curved convex toward the light source 14 (e.g., free-form surface) It is configured as a.

The upper surface 44*c*, as shown in FIG. 39, FIG. 42 C, outer in side view, inclined from the first front end 12A1*bb* side of the first lens portion 12A1 obliquely downward toward the first rear end portion 12A1*aa* side It is formed as a surface of a curved shape convex toward the. The upper surface 44*c*, as shown in FIG. 40 A, when viewed, has its left edge and right edge according to the first front end 12A1*bb* side of the first lens portion 12A1 toward the first rear end portion 12A1*aa* side It is configured as a surface of a shape that narrows in a tapered shape. Specifically, the upper surface 44*c* is (to be exact, the reference point F) a light source 14 which is incident from the upper incident surface 42*c* inside the first lens portion 12A1 light RayWIDE from the relates vertical direction, so as to be parallel light its surface shape is formed. The upper surface 44*c* is directed to a horizontal direction, in FIG. 42 C, and extends in a direction perpendicular to the paper surface.

It should be noted that the top surface 44*c* is a reflection surface for internal reflection (total internal reflection) towards the light RayWIDE from the light source 14 incident from above the entrance surface 42*c* inside the first lens unit 12A1 the second exit surface 12A2*b* (extension area 12A2*b*4), metal deposition is not used.

Extension region 12A2*b*4 is configured as a surface of the extended planar shape from the upper edge of the second output surface 12A2*b* (semicylindrical region 12A2*b*3) upward obliquely rearward. Of course, not limited to this, it may be configured as a surface of a curved surface. It should be noted that, with the semi-cylindrical area 12A2*b*3 the extension area 12A2*b*4 has been stepped without smoothly connected.

The upper surface 44*c*, as shown in FIG. 42 C, includes a reflecting surface for overhead sign 44*c*1 for forming a light distribution pattern POH for overhead sign irradiating the cutoff line above the road signs or the like. Reflecting surface for overhead sign 44C1 is incident from the upper incident surface 42*c* inside the first lens portion 12A1, is reflected by the reflecting surface for overhead sign 44C1, the light RayOH from the light source 14 travels through internal connection portion 12A3 is, the second by being emitted forward obliquely upward emitted from the exit surface 12A2*b* (extension regions 12A2*b*4), as shown in FIG. 41 D, the surface to form a light distribution pattern POH for overhead sign the cutoff line above shape is formed. It should be noted that, for the overhead sign reflecting surface 44*c*1 can be omitted as appropriate.

As the third optical system, in place of the upper incident surface 42*c*, connecting portion 12A3, and includes a second output surface 12A2*b* (extension regions 12A2*b*4), from the upper incident surface 42*c* inside the first lens portion 12A1 by light RayWIDE from the incident light source 14 travels through connecting portion 12A3 interior without being internally reflected and irradiated forward emitted directly from the second output surface 12A2*b* (extension regions 12A2*b*4), FIG. 41 (d- as shown in), it may be used in an optical system to form a light distribution pattern PWIDE for wide.

The third optical system having the above structure, on a virtual vertical screen, the light distribution pattern PWIDE and overhead sign light distribution pattern POH for wide shown in FIG. 41 D are formed.

Vertical dimension of the light distribution pattern PWIDE for wide is about 15 degrees in FIG. 41 (d-), not limited to this, for example, to adjust the surface shape of the upper incident surface 42*c* (e.g., the vertical curvature) it can be freely adjusted by.

The position of the upper edge of the wide light distribution pattern PWIDE, although along a horizontal line in FIG. 41 D, not limited to this, it is possible to freely adjust by adjusting the inclination of the upper surface 44*c*.

In the present embodiment, the upper surface 44*c*, as shown in FIG. 39, the vertical plane including the reference axis AX1 includes a left upper surface 44*c*2 and the right upper surface 44*c*3, which is divided into right and left, upper left surface 44*c*2 and the right upper surface 44*c*3 of each inclination are different from each other. More specifically, it is inclined to below the right upper surface 44*c*3 the upper left surface 44*c*2. Thus, as shown in FIG. 41 D, the light distribution pattern PWIDE for wide, the upper edge, the upper edge of the left side is intended to include a cut-off line of the lower left and right stepped than the right upper edge against vertical line it is (in the case of right-hand traffic). Of course, on the contrary, it may be inclined to the upper left surface 44*c*2 above the right top surface 44*c*3. Thus, a light distribution pattern PWIDE for wide, upper edge of the left side with respect to the vertical line can be made, including the cutoff line of the higher lateral stepped than the right upper edge (the case of left-hand traffic).

Further, the right end and left end of the wide light distribution pattern PWIDE is extends to the right to about 65 degrees and the left about 65 degrees FIG. 41 D, not limited to this, for example, on the entrance surface 42*c* (e.g., horizontal it can be adjusted freely by adjusting the direction curvature).

According to this embodiment, in addition to the effects of the second embodiment, furthermore, it can achieve the following effects.

That is, the first, it is possible to provide a lens body 12J and the vehicle lighting device 10J having the same can be maintained even linear luminous appearance changes viewpoint position. Second, it is possible to provide a uniform light emission (or substantially uniform light emission) lens body appearance can be realized in 12J and vehicle lamp 10J having the same. Third, the efficiency of capturing light from the light source 14 inside the lens body 12J is dramatically improved. Fourth, it is possible to provide a lens body 12J and the vehicle lighting device 10J having the same of appearance with a sense of unity, which extends linearly in a predetermined direction. Fifth, even though the second emission surface 12A2*b* the ultimate exit surface is a semi-cylindrical surface 12A2*b*3 (refracting surface of the semi-cylindrical), arrangement for spots focused in the horizontal and vertical directions it is possible to provide a lens body 12J and vehicle lamp 10J with this it is possible to form the light pattern PSPOT.

Can be the viewpoint position is maintained also linear luminous appearance change is one of the lens body 12J is, the plurality of light distribution patterns that degree of diffusion are different, i.e., a spot light distribution pattern PSPOT (of the present invention corresponds to a first light distribution pattern), a plurality of forming the second corresponds to the light distribution pattern) and a wide light distribution pattern PWIDE mid light distribution pattern PMID (present invention (corresponding to the third light distribution pattern of the present invention) of the optical system, i.e., a first optical system (see FIG. 42 A), by the second optical system (FIG. 42 B refer) and the third optical system that comprises a (FIG. 42 C refer) it is intended. Note that exhibit this effect, a minimum, a first optical system (FIG. 42 A refer) and a second optical system need only comprise a (FIG. 42 B refer), the third optical system (FIG. Referring 42 C) may be omitted as appropriate.

Figure 44:
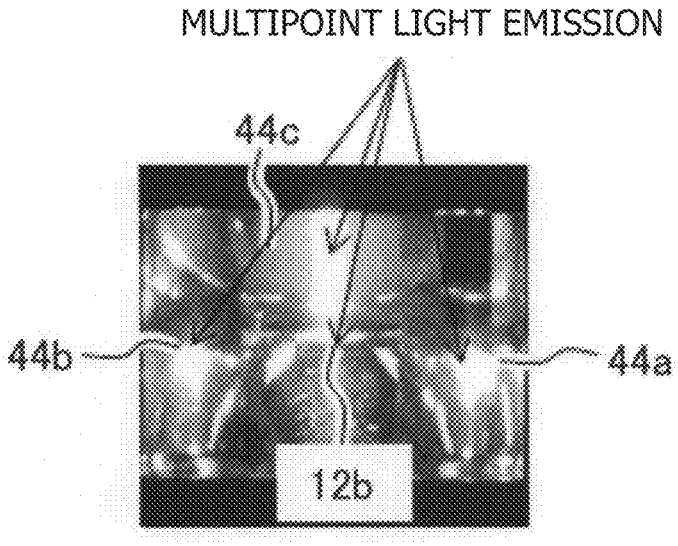
FIG. 44 is a front view (photo) of the vehicle lamp 10J (lens body 12J) emitting multi-point light.

Uniform light emission (or substantially uniform light emission) can be realized the appearance of each of the incident surface, i.e., a first entrance surface 12*a*, a pair of left and right entrance surface 42*a*, the first lens unit from 42*b* and the upper incident surface 42*c* a light reflection surface are each from 12A1 light source 14 incident on the inside, i.e., lower reflection surface 12 *b*, a pair of left and right side faces 44*a*, is reflected by 44*b* and upper surface 44*c* result, the multipoint emission within lens body 12 J (FIG. 44 reference) especially added, each of the reflecting surfaces, i.e., the lower reflection surface 12 *b*, a pair of left and right side faces 44*a*, the reflected light from 44*b* and upper surface 44*c*, substantially the entire area of second output surface 12A2*b* is the final output surface be uniformly emitted from, i.e., partial region of the second output surface 12A2*b* light reflected from the lower reflective surface 12*b* is the final output surface (semicylindrical region 12A2*b*3) A1 (FIG. 40B emitted from the reference), a pair of left and right side faces 44*a*, the reflected light from 44*b*, primarily the left and right partial region A1 of the second output surface 12A2*b* is the final output surface (semicylindrical region 12A2*b*3) both sides of the region A2, A3 emitted (FIG. 40 B refer), the reflected light from the upper surface 44*c* is mainly the region above the final emitting surface and a second output surface 12A2*b* (the regions A1~A3 A4. That is by exiting the extension region 12A2*b*4). Note that exhibit this effect, a minimum, a first optical system (FIG. 42 A refer) and a second optical system need only comprise a (FIG. 42 B refer), the third optical system (FIG. Referring 42 C) may be omitted as appropriate.

The efficiency of capturing light from the light source 14 inside the lens body 12J is dramatically improved, each of the incident surface, i.e., a first entrance surface 12*a*, a pair of left and right entrance surface 42*a*, 42*b* and the upper incident surface 42*c* is a light source it is arranged so as to surround the 14 (see FIG. 43 A~FIG. 43 C) that is due. Note that exhibit this effect, a minimum, the first incident surface 12*a* and the pair of entrance surface 42*a*, it is sufficient comprises a 42*b*, on the entrance surface 42*c* can be omitted suitably.

Vehicle lamp 10J of the present embodiment (the lens body 12 J) is the above concept, but correspond to those applied to the vehicle lamp 10A of the second embodiment includes a first output surface 12A1*a* and second output surface 12A2*b*, not limited to this. That is, the above concept, other than vehicle lighting device 10A of the second embodiment includes a first output surface 12A1*a* and second output surface 12A2*b*, for example, to the vehicle lamp 10 of the first embodiment with one exit surface it is also possible to apply.

Can be an appearance with a sense of unity, which extends linearly in a predetermined direction, the second emission surface 12A2*b* the ultimate exit surface is configured as a semi-cylindrical surface 12A2*b*3 (refracting surface of the semi-cylindrical) it is due to have.

Despite second output surface 12A2*b* the ultimate exit surface is a semicylindrical surface 12A2*b*3 (refracting surface of the semi-cylindrical), the horizontal direction and converging the light distribution pattern PSPOT for spot in the vertical direction can be formed, horizontal direction of the first emission surface of the first lens portion 12A1 12A1*a* (refracting surface of the semi-cylindrical) is in charge of the condenser primarily mainly a vertical condenser lens body 12J the final exit surface at a second output surface of the second lens portion 12A2 12A2*b* (refracting surface of the semi-cylindrical) is by the charge. That is due to decomposed the light collecting function.

Note that the first to fifth embodiments and the concept described in the modified examples, for example, concept of "camber angle" described in the third embodiment, and, generated with the application of the camber angle idea the blur to improve as described above, the fourth concept described in embodiment "imparting slant angle", and, the rotating occurring due to the application of the slant angle in the above idea of suppressing, the idea of a fifth "to grant the camber angle and slant angle" was described in the embodiment, and, above blur and the rotation will occur due to the grant of this camber angle and slant angle, as described above the idea of improving and inhibiting, are of course can be applied to the vehicle lamp 10J of the present embodiment (the lens body 12 J).

Further, in the sixth embodiment, the second optical system (see FIG. 42 B) is configured to form a light distribution pattern PMID for mid, third optical system (see FIG. 42 C) is wide an example is described that is configured to form a use light distribution pattern PWIDE, the present invention is not limited thereto.

For example, on the contrary, the second optical system (FIG. 42 B refer) is configured to form a light distribution pattern PWIDE for wide, for the third optical system (see FIG. 42 C) of Mid it may be configured so as to form a light distribution pattern PMID.

Figure 47A:
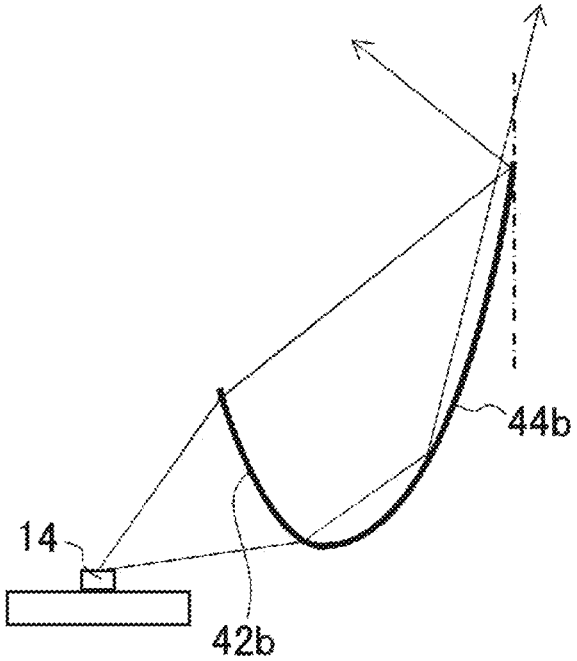
FIG. 47A is pair of the incident surface 42*a* constituting the second optical system, 42*b* and/or the right and left pair of side 44*a*, an adjustment example of a surface shape of 44*b*.
Figure 47B:
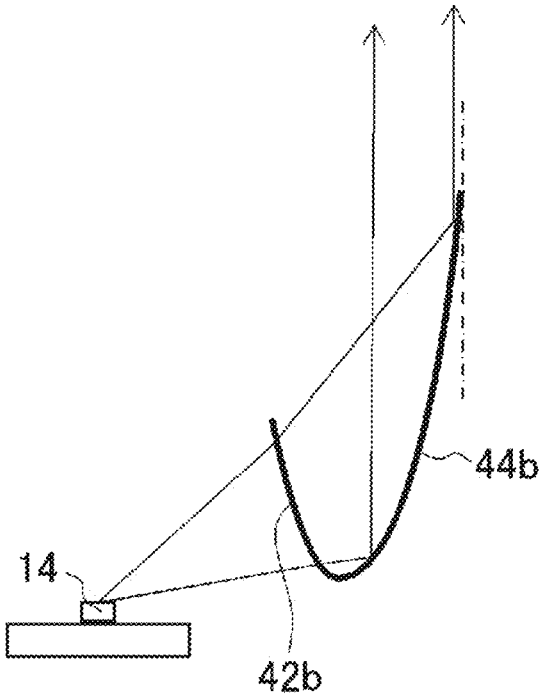
FIG. 47B is pair of the incident surface 42*a* constituting the second optical system, 42*b* and/or the right and left pair of side 44*a*, an adjustment example of a surface shape of 44*b*.

For example, a pair of left and right entrance surface 42*a* constituting the second optical system, 42*b* and/or the right and left pair of side 44*a*, 44*b* of the surface shape (e.g., the horizontal direction of curvature) to adjust, as shown in FIG. 47 A it is, a light distribution pattern (e.g., the horizontal direction) can be expanded, by adjusting, as shown in FIG. 47 B, the light distribution pattern can be (e.g., horizontally) to narrow. Accordingly, the pair of left and right entrance surface 42*a* constituting the second optical system, 42*b* and/or the right and left pair of side 44*a*, 44*b* of the surface shape (e.g., the horizontal direction of curvature) by adjusting the, the light distribution pattern for mid not limited, it is also possible to form a light distribution pattern wide.

Figure 48A:
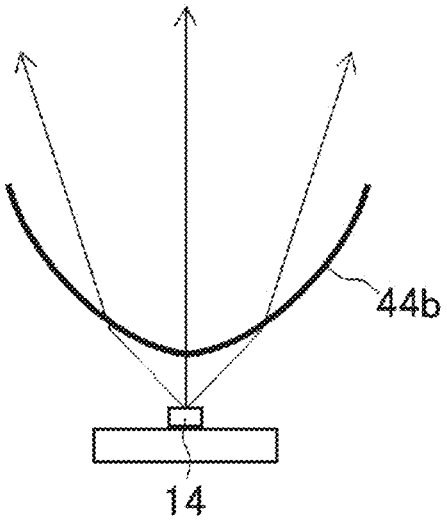
FIG. 48A is an example of adjusting the surface shape of the incident surface 42*c* on which constitute the third optical system.
Figure 48B:
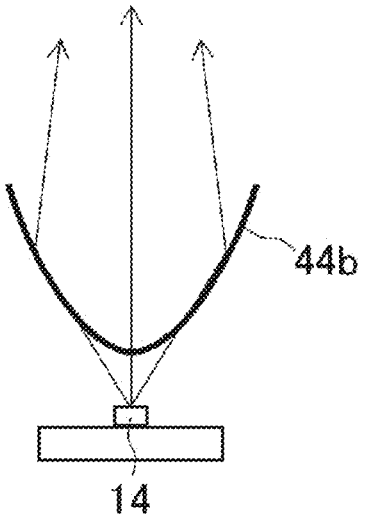
FIG. 48B is an example of adjusting the surface shape of the incident surface 42*c* on which constitute the third optical system.

Similarly, the surface shape of the upper incident surface 42*c* constituting the third optical system (e.g., the horizontal direction of curvature) by adjusting the as shown in FIG. 48 A, a light distribution pattern (e.g., in a horizontal direction) it can be expanded, by adjusting, as shown in FIG. 48 B, a light distribution pattern (e.g., can be horizontally) to narrow. Accordingly, the surface shape of the upper incident surface 42*b* constituting the third optical system (e.g., the horizontal direction of curvature) by adjusting the, not only the light distribution pattern for wide, can be formed a light distribution pattern for mid.

Of course, the second optical system (FIG. 42 B refer) and the third optical system (see FIG. 42 C) are both may be configured so as to form a light distribution pattern PWIDE for wide. Conversely, the second optical system (FIG. 42 B refer) and the third optical system (see FIG. 42 C) are both may be configured so as to form a light distribution pattern PMID for mid.

Next, the vehicle lighting device of the seventh embodiment 10K (lens body 12K), will be described with reference to the drawings.

Vehicle lamp 10K of the present embodiment (the lens body 12K) is constructed as follows.

Figure 49:
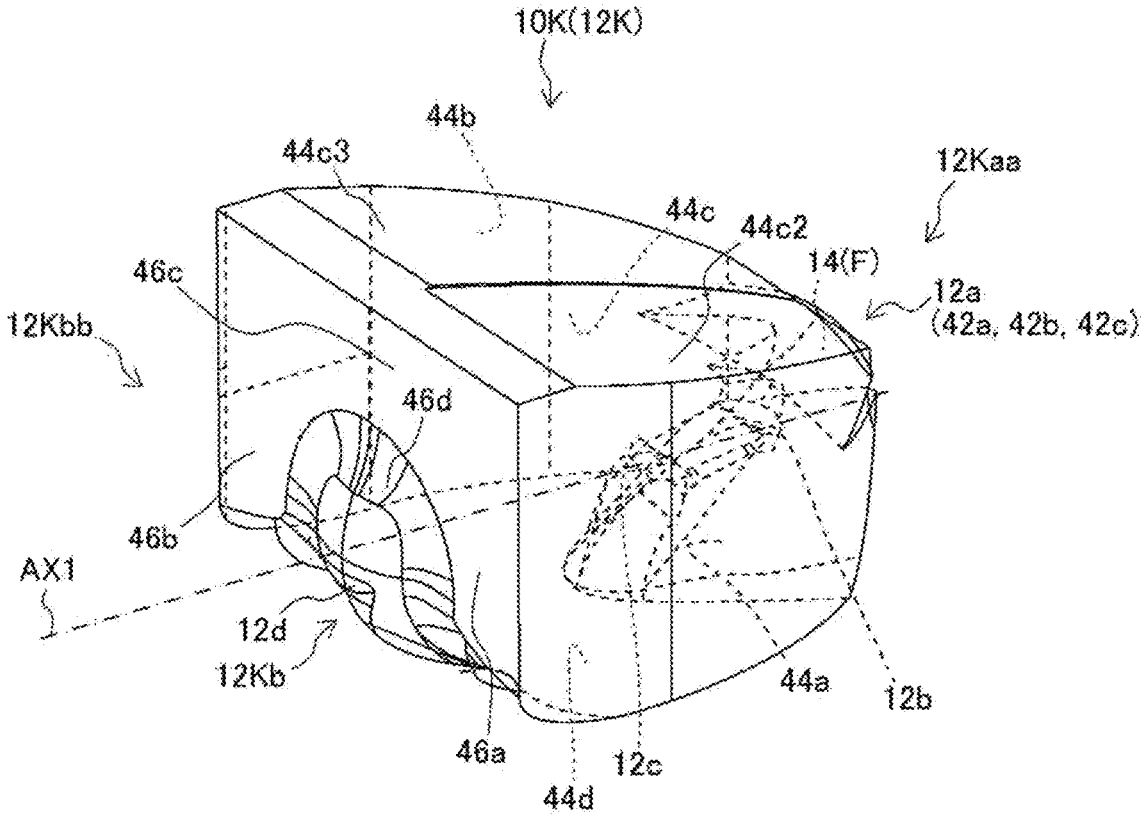
FIG. 49 is a perspective view of the vehicular lamp 10K (lens body 12K) of the eleventh embodiment.
Figure 50A:
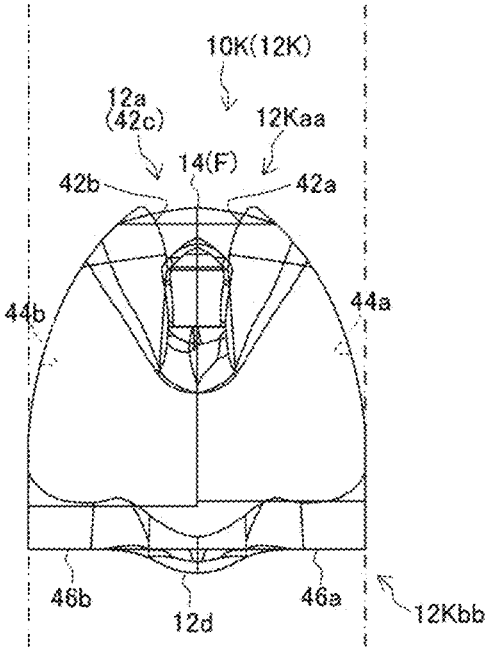
FIG. 50A is a top view of a vehicular lamp 10K (lens body 12K)
Figure 50B:
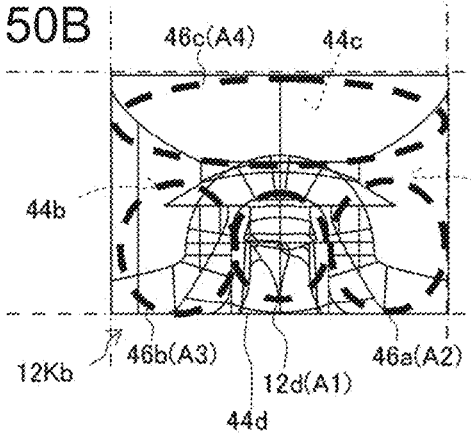
FIG. 50B is a front view.
Figure 50C:
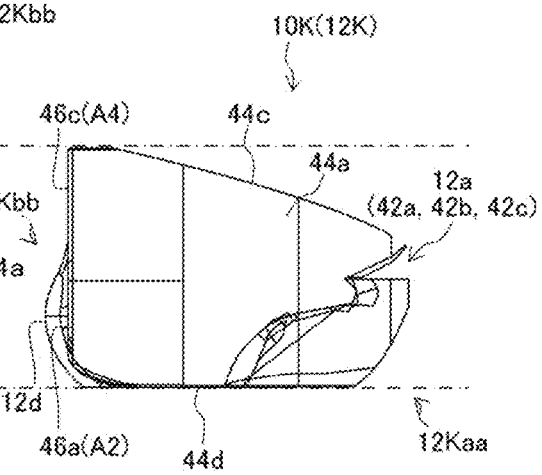
FIG. 50C is a side view.
Figure 51A:
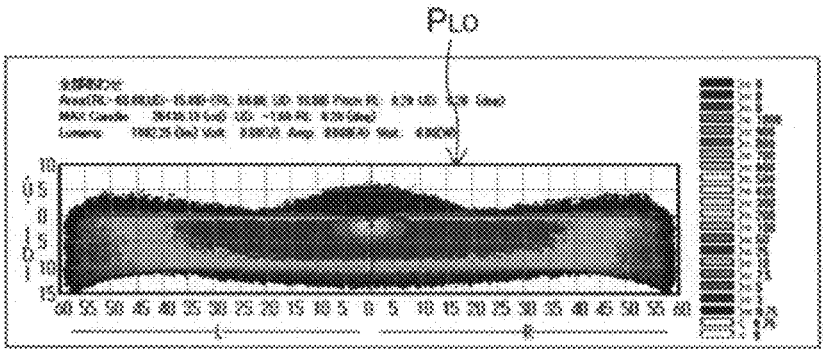
FIG. 51A is an example of the vehicle lamp 10K (lens body 12K) light distribution pattern for low beam is formed by the PLO (synthetic light distribution pattern)
Figure 51B:
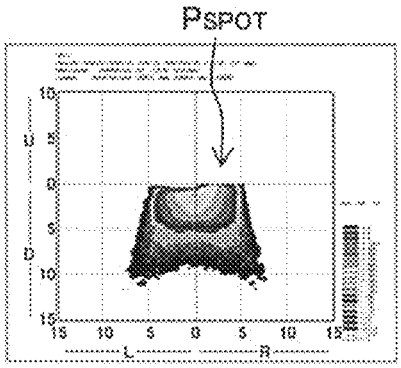
FIGS. 51B to 51D illustrate various parts distribution light pattern PSPOT, PMID, PWIDE.
Figure 51C:
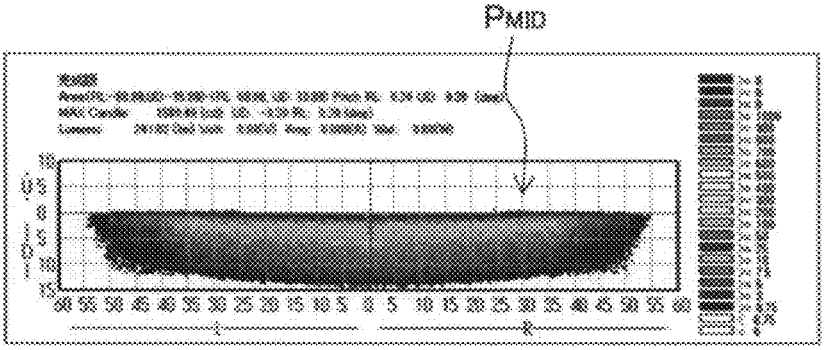
Figure 51D:
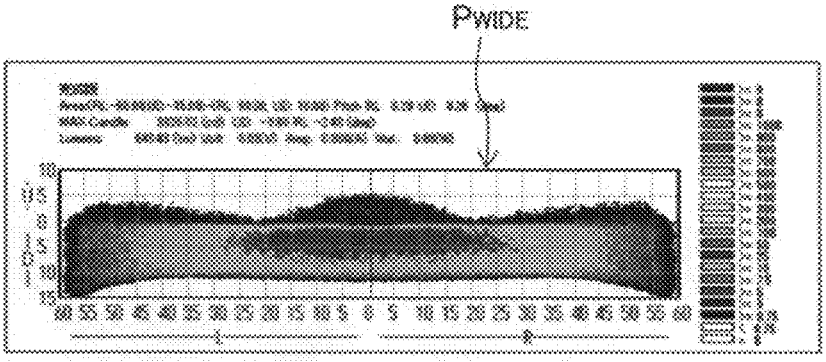

FIG. 49 is a perspective view of the vehicular lamp 10K (lens body 12K), FIG. 50 A is a top view, FIG. 50 B is a front view, FIG. 50 C is a side view. In the example of FIG. 51 A is a light distribution pattern PLO (synthesized light distribution pattern) for a low beam formed by the vehicle lamp 10K (lens body 12K), each section partitioned shown in FIG. 51 B~FIG. 51 (d-) light pattern PSPOT, PMID, is formed by PWIDE is superimposed.

Figure 52A:
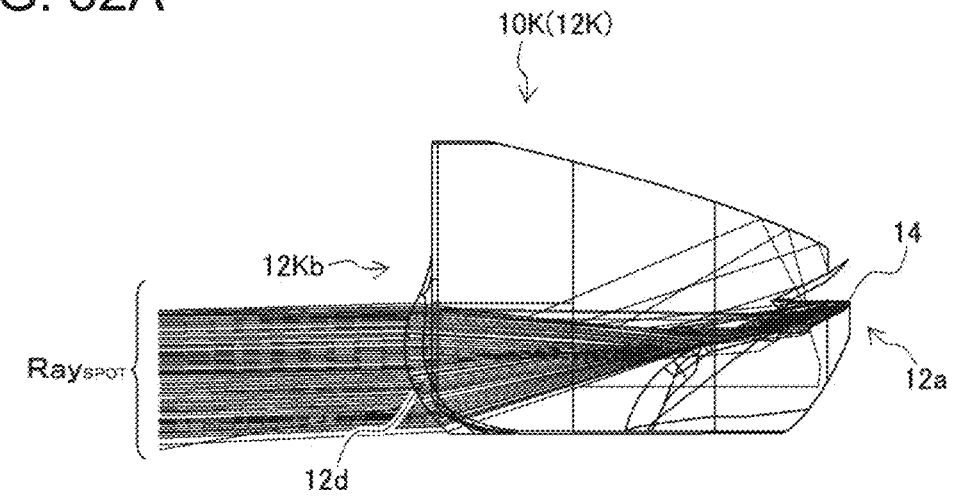
FIG. 52A is a side view of the first optical system.
Figure 52B:
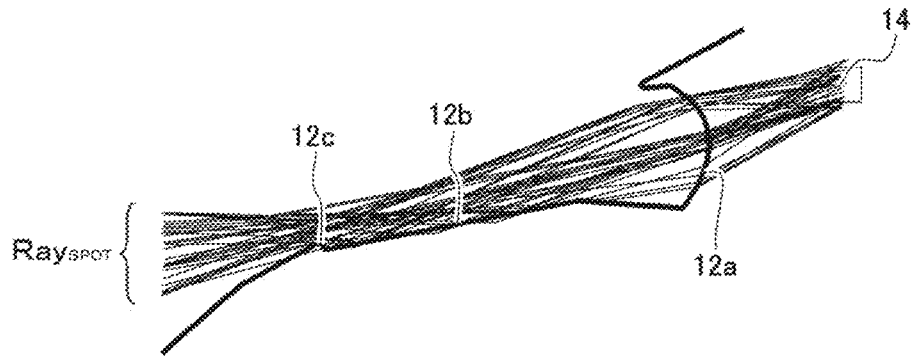
FIG. 52B is an enlarged side view of the first optical system.
Figure 53A:
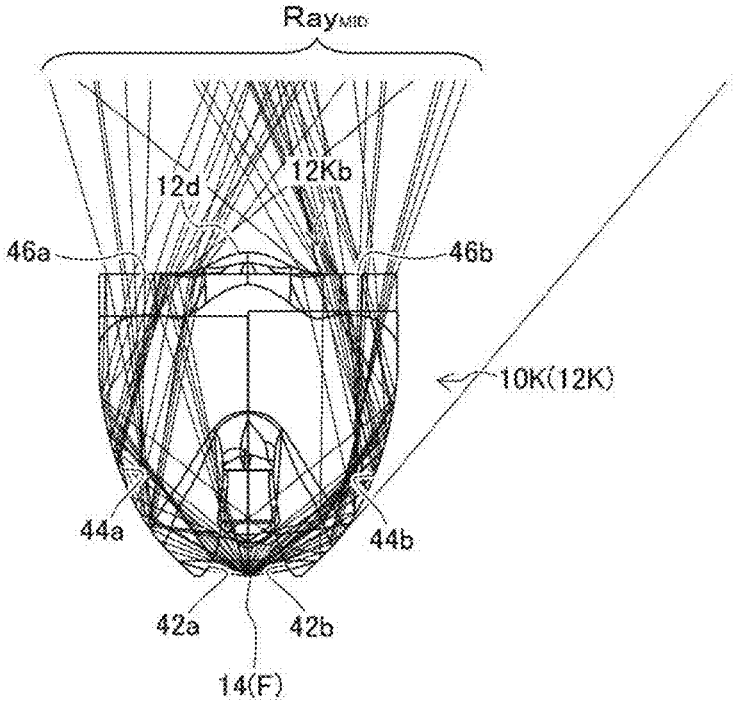
FIG. 53A is a top view of a second optical system.
Figure 53B:
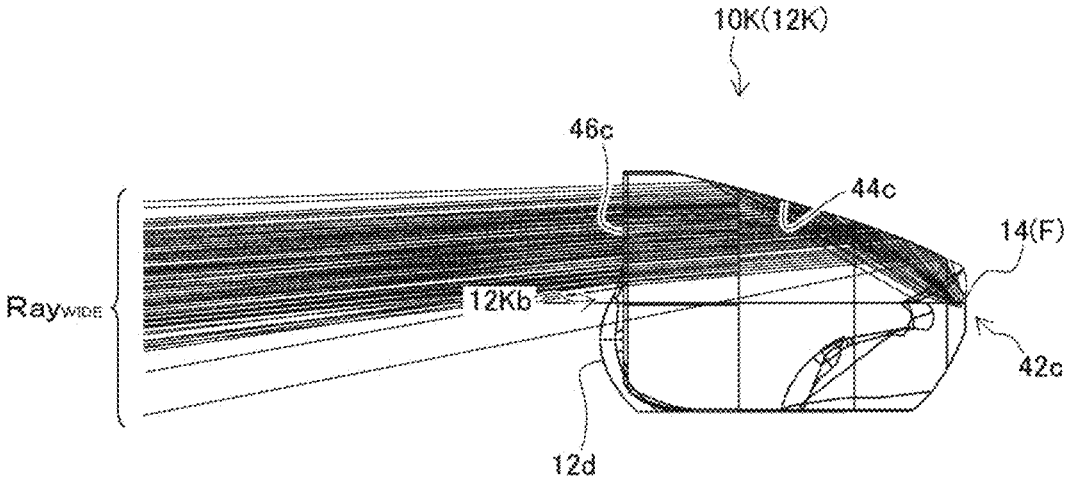
FIG. 53B is a side view of a third optical system.

Lens body 12K of the present embodiment, similarly to the sixth embodiment, a first optical system for forming a spot light distribution pattern PSPOT (see FIG. 51 B) (FIG. 52 A, FIG. 52 B see), see second optical system for forming a mid light distribution pattern PMID diffused from the light distribution pattern PSPOT for spot reference (FIG. 51 C) (FIG. 53 A), and, from the mid-light distribution pattern PMID diffuse wide light distribution pattern PWIDE (FIG. 51 (d-) refer) third optical system for forming an and a (FIG. 53 B refer).

Hereinafter, the sixth will focus on differences from the vehicle lighting device 10J embodiment (the lens body 12 J), the same configuration as the sixth embodiment of the vehicular lamp 10J (lens body 12 J) is the same description thereof is omitted a reference numeral.

49, as shown in FIG. 50, the lens body 12K of the present embodiment is a lens body disposed in front of the light source 14, a rear end portion 12Kaa, front end 12Kbb, rear end 12Kaa a front end portion 12Kbb disposed right and left pair of side 44*a* between, 44*b*, includes a top surface 44*c* and a lower surface 44*d*, (to be exact, the reference point F) a light source 14 which enters the inner lens member 12K light from the front end 12Kbb (by being irradiated forward emitted from the exit surface 12Kb), is constructed as a lens body forming a light distribution pattern PLo low beam (corresponding to a predetermined light distribution pattern of the present invention) that shown in FIG. 51 A. Lens body 12K includes a lower reflecting surface 12*b* disposed between the rear end portion 12Kaa a front end portion 12Kbb, lens body of bell-shaped narrowed cone shape toward the rear end portion 12Kaa side from the front end 12Kbb side It is configured as a.

Lens body 12K of the present embodiment, similarly to the above embodiments, injecting a polycarbonate or a transparent resin such as acrylic, cooling, (by injection molding) by solidifying are integrally formed.

Figure 54A:
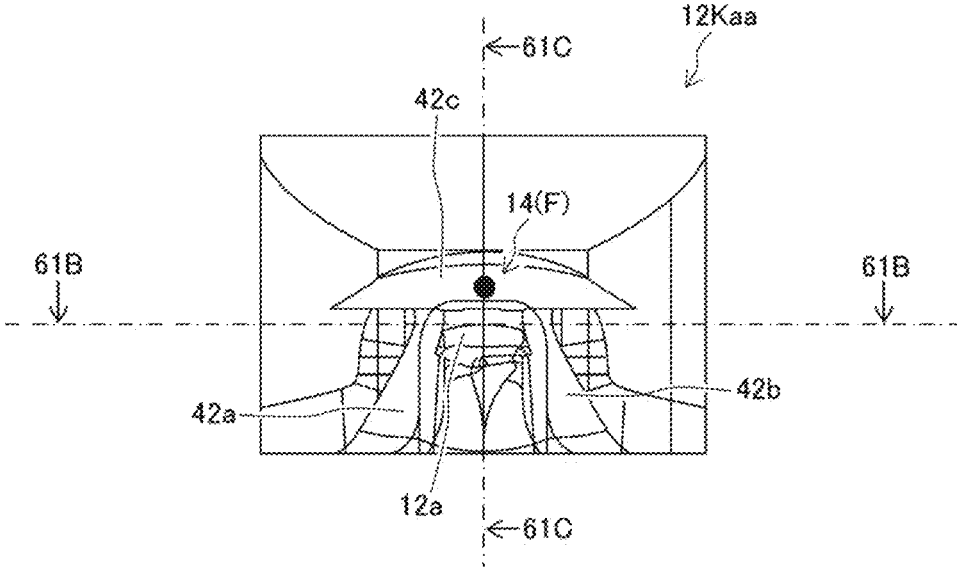
FIG. 54A is a front view of the rear end portion 12Kaa of the lens body 12K.
Figure 54B:
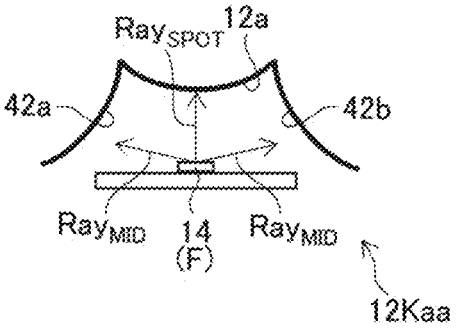
FIG. 54B is B-B sectional view of FIG. 54A (schematic diagrams).
Figure 54C:
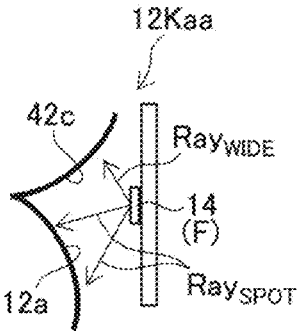
FIG. 54C is C-C sectional view of FIG. 54A (schematic diagrams).

FIG. 54 A is a front view of the rear end portion 12Kaa of lens body 12K, FIG. 54 B FIG. 54 B-B sectional view of A (schematic view), FIG. 54 C FIG. 54A is C-C in cross-sectional view of a (schematically).

FIG. 54 A, as shown in FIG. 54 B, the rear end 12Kaa of the lens body 12K, the first entrance surface 12*a*, and, on both left and right sides of the first entrance surface 12*a*, the light source 14 and the first entrance space disposed so as to surround the left and right sides are pair of left and right entrance surface 42*a* between the face 12*a*, includes 42*b*. The rear end portion 12Kaa, as shown in FIG. 54 A, FIG. 54

C, further, on the upper side of the first entrance surface 12*a*, surrounding the space between the light source 14 and the first entrance surface 12*a* from the upper side it includes an incident surface 42*c* on which are arranged like.

Tip of the lower reflecting surface 12*b* includes a shade 12*c*.

Front end 12Kbb of the lens body 12K includes a exit surface 12Kb, the exit surface 12Kb, as shown in FIG. 49, the same exit surface 12*d* of the first embodiment (convex towards the front convex surface), the arranged pair of exit surface 46*a* on the right and left sides of the exit face 12*d*, 46 *b*, and includes an emitting surface 12*d* and the pair of output surface 46*a*, outgoing surface 46*c* disposed above the 46*b*. Emitting surface 12*d* and the pair of left and right exit surface 46*a*, 46 *b* (and the exit surface 46*c*) and via the connecting surface 46*d* surrounding the exit face 12*d* (surface optical function is not intended) step without smoothly It is connected.

FIG. 52 A is a side view of the first optical system, FIG. 52 B is an enlarged side view.

FIG. 52 A, as shown in FIG. 52 B, the first incident surface 12*a*, the lower reflection surface 12 *b* (and shade 12*c*) and the exit surface 12Kb is incident from the first incident surface 12*a* to the inner lens member 12K light was shielded in part by the shade 12*c* of the light RaySPOT from the light source 14, and the light that is internally reflected under the reflection surface 12*b* is a part of the exit face 12Kb region A1 (exit plane 12*d*. By being irradiated forward emitted from FIG. 50 B refer), as shown in FIG. 51 B, the light distribution pattern PSPOT (present for spots including the cut-off line defined by the shade 12*c* to the upper edge constitute a first optical system for forming an equivalent) to the first light distribution pattern of the invention.

FIG. 53 A is a top view of a second optical system.

As shown in FIG. 53 A, a pair of left and right entrance surface 42*a*, 42*b*, a pair of left and right side faces 44*a*, 44*b*, and the exit surface 12Kb pair of left and right entrance surface 42*a*, entering from 42*b* inside the lens body 12K light RayMID from the left and right pair of side 44*a*, a light source 14 which is internally reflected at 44*b* on the mainly region of the left and right sides of a part A1 of the exit surface 12Kb A2, A3 (pair of exit surface 46*a*, 46 *b*. By being irradiated forward emitted from FIG. 50 B refer), as shown in FIG. 51 C, is superimposed on the spot light distribution pattern PSPOT, mid diffused from the light distribution pattern PSPOT for spot constitute a second optical system for forming a use light distribution pattern PMID.

A pair of left and right entrance surface 42*a*, 42*b*, of the light from the light source 14 does not enter the first entrance surface 12*a* of light (mainly, the light RayMID extending in the lateral direction. FIG. 54 B refer) is a plane that is incident to the inner lens member 12K is refracted structure, as shown in FIG. 54 B, the surface of the curved convex toward the light source 14 (e.g., a free-form surface) It is.

A pair of left and right side faces 44*a*, 44*b*, as shown in FIG. 50 A, when viewed from left and right pair of side 44*a* toward the rear end portion 12Kaa side from the front end 12Kbb side, the spacing between 44*b* is tapered surface of the convex curved surface shape toward the outside narrowed (for example, free-form surface) is constructed as a. Shape also, the pair of left and right side surfaces 44*a*, 44*b*, as shown in FIG. 50 C, which in side view, its upper and lower edges towards the rear end portion 12Kaa side from the front end 12Kbb side narrows in a tapered shape It is configured as a surface.

Incidentally, a pair of left and right sides 44*a*, 44*b* are a pair of left and right entrance surface 42*a*, the light RayMID pair from the light source 14 incident on the inner lens member 12K from 42*b* exit surface 46*a*, toward the 46*b* internal reflection (total internal reflection) a reflective surface for, not used in metal deposition.

A pair of left and right exit surface 46*a*, 46*b* is configured as a surface of a planar shape. Of course, not limited to this, it may be configured as a surface of a curved surface.

The second optical system configured as described above, on a virtual vertical screen, the light distribution pattern PMID for mid shown in FIG. 51 C is formed.

Vertical dimension of the mid-beam light distribution pattern PMID is approximately 15 degrees in FIG. 51 C, not limited to this, for example, a pair of left and right entrance surface 42*a*, 42*b* of the surface shape (e.g., curvature in the vertical direction) can be freely adjusted by adjusting the.

The position of the upper edge of the mid-beam light distribution pattern PMID is along the horizontal line in FIG. 51 C, is not limited thereto, a pair of left and right entrance surface 42*a*, 42*b* of the surface shape (e.g., a pair of left and right incident surface 42*a*, can be freely adjusted by adjusting the 42*b* slope of).

Further, the right end and left end of the mid-beam light distribution pattern PMID is extends to the right to about 55 degrees and the left about 55 degrees FIG. 51 C, not limited to this, for example, a pair of left and right entrance surface 42*a*, 42*b* and/or right and left pair of side 44*a*, 44*b* (for example, each of the horizontal curvature) can be adjusted freely by adjusting the.

FIG. 53 B is a side view of a third optical system.

As shown in FIG. 53 B, the upper entrance surface 42*c*, the upper surface 44*c*, and the exit surface 12Kb, the light from the light source 14 which is internally reflected at the upper surface 44*c* is incident from the upper incident surface 42*c* in the inner lens member 12K RayWIDE is, primarily emitting surface area of the left and right sides of the part of the region A1 and some area A1 of the 12Kb A2, A3 each of the upper side of the area A4 (exit surface 46*c*. By being irradiated forward emitted from FIG. 50 B refer), as shown in FIG. 51 (d-), it is superimposed on the spot light distribution pattern PSPOT and mid light distribution pattern PMID, distribution for Mid constitute a third optical system for forming a light distribution pattern PWIDE for wide that has diffused from the light pattern PMID.

The upper incident surface 42*c*, the light (mainly not enter the first entrance surface 12*a* of the light from the light source 14 extends upward light RayWIDE. In terms FIG. 54 C refer) enters inside the lens body 12K is refracted structure, as shown in FIG. 54 C, the surface of the curved convex toward the light source 14 (e.g., a free-form surface) It is.

The upper surface 44*c* is 49, as shown in FIG. 50 C, in side view, from the front end 12Kbb side of the lens body 12K convex outwardly inclined obliquely downward toward the rear end portion 12Kaa side surfaces It is configured as a surface shape. The upper surface 44*c*, as shown in FIG. 50 A, when viewed from the front end 12Kbb side of the lens body 12K is the left edge and right edge toward the rear end portion 12Kaa side shape narrows in a tapered shape It is configured as a surface. Specifically, the upper surface 44*c* is (to be exact, the reference point F) a light source 14 which is incident from the upper incident surface 42*c* in the inner lens member 12K that surface so that light RayWIDE is relates to the vertical direction, the collimated light from shape is formed. The upper surface 44*c* is directed to a horizontal direction, in FIG. 50 C, and extends in a direction perpendicular to the paper surface.

Incidentally, the upper surface 44*c* is a reflecting surface for internal reflection towards the light RayWIDE from the light source 14 which is incident from the upper incident surface 42*c* in the inner lens member 12K to the exit surface 46*c* (total reflection), metal deposition is not used.

Exit surface 46*c* is configured as a surface of a planar shape. Of course, not limited to this, it may be configured as a surface of a curved surface.

As the third optical system, in place of the upper incident surface 42*c*, and includes an emitting surface 46*c*, the light RayWIDE from the light source 14 which is incident from the upper incident surface 42*c* inside the lens body 12K is internally reflected by being irradiated forward emitted directly from without exit surface 46*c* that, as shown in FIG. 51 D, may be used an optical system for forming a light distribution pattern PWIDE for wide.

The third optical system having the above structure, on a virtual vertical screen, the light distribution pattern PWIDE for wide shown in FIG. 51 D are formed.

Vertical dimension of the light distribution pattern PWIDE for wide is about 15 degrees in FIG. 51 (d-), not limited to this, for example, to adjust the surface shape of the upper incident surface 42*c* (e.g., the vertical curvature) it can be freely adjusted by.

The position of the upper edge of the wide light distribution pattern PWIDE, although substantially along a horizontal line in FIG. 51 D, not limited to this, it is possible to freely adjust by adjusting the inclination of the upper surface 44*c*.

In the present embodiment, the upper surface 44*c*, as shown in FIG. 49, the vertical plane including the reference axis AX1 includes a left upper surface 44*c*2 and the right upper surface 44*c*3, which is divided into right and left, upper left surface 44*c*2 and the right upper surface 44*c*3 of each inclination are different from each other. More specifically, it is inclined to below the right upper surface 44*c*3 the upper left surface 44*c*2. Thus, as shown in FIG. 51 D, the light distribution pattern PWIDE for wide, the upper edge, the upper edge of the left side is intended to include a cut-off line of the lower left and right stepped than the right upper edge against vertical line it is (in the case of right-hand traffic). Of course, on the contrary, it may be inclined to the upper left surface 44*c*2 above the right top surface 44*c*3. Thus, a light distribution pattern PWIDE for wide, upper edge of the left side with respect to the vertical line can be made, including the cutoff line of the higher lateral stepped than the right upper edge (the case of left-hand traffic).

Further, the right end and left end of the wide light distribution pattern PWIDE is extends to the right to about 60 degrees and the left about 60 degrees FIG. 51 D, not limited to this, for example, on the entrance surface 42*c* (e.g., horizontal it can be adjusted freely by adjusting the direction curvature).

Next, a description will be given of the appearance of the light source 14 non-lighting at the time of the lens body 12K.

Lens body 12K of the present embodiment, the light source 14 non-lit, when viewed from multiple directions, the inside though lens body becomes appearance with "sparkling feeling" as if they were emitted.

Figure 55A:
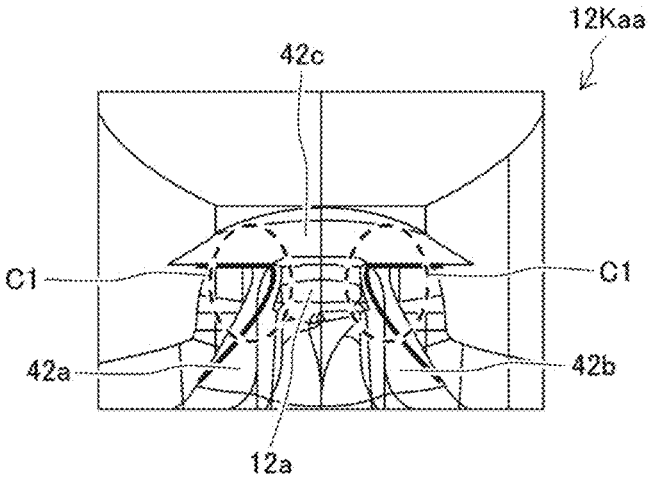
FIG. 55A to FIG. 55C illustrate the entrance surface 12*a*, 42*a*, 42*b*, 42*c* are, in top view and/or side view, the V-shaped (or V-shape open towards the front end portion 12Kbb side one it is a diagram that represents the thing that make up the part).
Figure 55B:
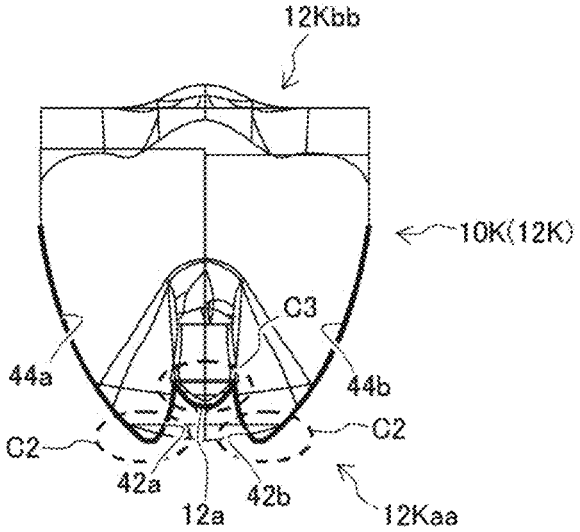
Figure 55C:
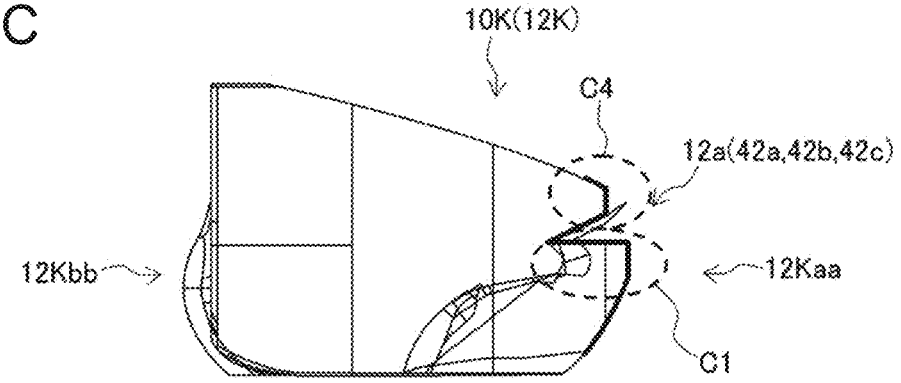

This, external light incident from the emission surface 12Kb inside the lens body 12K (e.g., sunlight) that is in the internal reflection (total internal reflection) easily satisfies the condition that constitutes inside the lens body 12K, specifically a lens body 12K is configured as a lens body of bell-shaped narrowed cone shape toward the rear end portion 12Kaa side from the front end 12Kbb side (FIG. 50 A, FIG. 50 C refer to) the (in addition to the first condition), the incident surface 12*a*, 42*a*, 42*b*, at least one of 42*c*, when viewed and/or side view, V-shape open towards the front end portion 12Kbb side (or the V-shaped some) is due to constitute a reference (FIG. 55 A~FIG. 55 C in the code C1~C4 is shown in a dashed circle (bold line)) the (second condition). Note that the first condition, but if they meet at least one of the conditions in the second condition.

For example, a pair of left and right entrance surface 42*a*, 42*b* is a side view, constitute a V-shape open towards the front end portion 12Kbb side (FIG. 55 A, the code C1 in FIG. 55 C within the circle of the dotted line shown (thick line) reference). Further, a pair of left and right entrance surface 42*a*, 42*b* is a top view, constitutes a part of a V-shape open towards the front end portion 12Kbb side (dotted line indicated by the reference numeral C2 in FIG. 55 B within the circle (thick line) reference). The first entrance surface 12*a* is a top view, constitute a V-shape open towards the front end portion 12Kbb side (FIG. 55 B in the code C3 is shown in a dashed circle (bold line) see). The upper incident surface 42*c* is a side view, a front end 12Kbb constitutes a part of a V-shape open towards the side (FIG. 55 C the dotted line in the circle indicated by the reference numeral C4 in (thick line) reference).

Above as in, in addition to the lens body 12K is configured as a lens body of bell shape narrowed on the rear end portion 12Kaa side conical towards the front end 12Kbb side, the incident surface 12*a*, 42*a*, 42*b*, at least one of the 42*c*, when viewed and/or side view, the result constituting the V-shape open towards the front end portion 12Kbb side (or a portion of the V-shape), the lens body from the emission surface 12Kb external light incident inside 12K (e.g., sunlight) repeats internal reflection (total internal reflection) inside the lens body 12K (the V-shaped portion, etc.), most of which various directions again from the exit surface 12Kb emitted to.

Figure 56A:
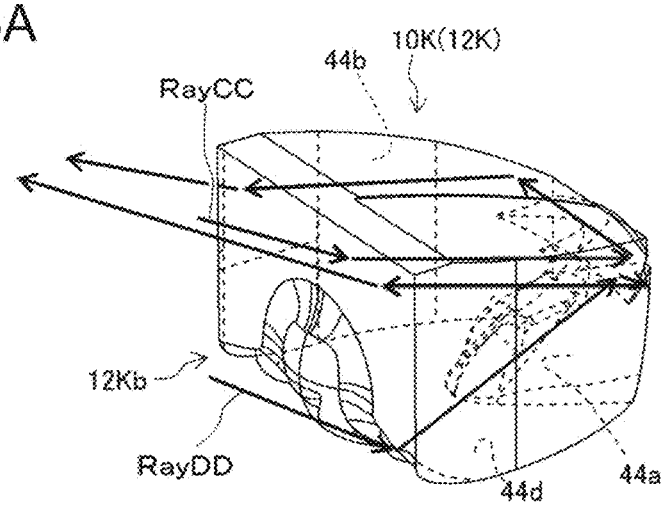
FIG. 56A is incident from the exit surface 12Kb inside the lens body 12K external light RayCC, RayDD (e.g., sunlight) is a diagram showing an optical path to follow.
Figure 56B:
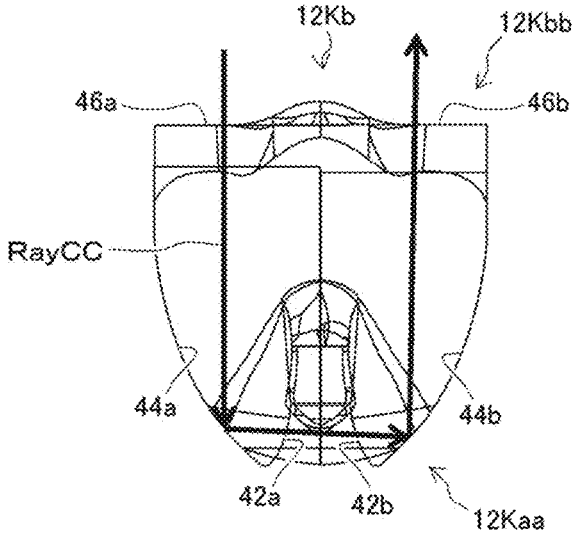
FIG. 56B is incident from the exit surface 12Kb inside the lens body 12K external light RayCC, RayDD (e.g., sunlight) is a diagram showing an optical path to follow.
Figure 56C:
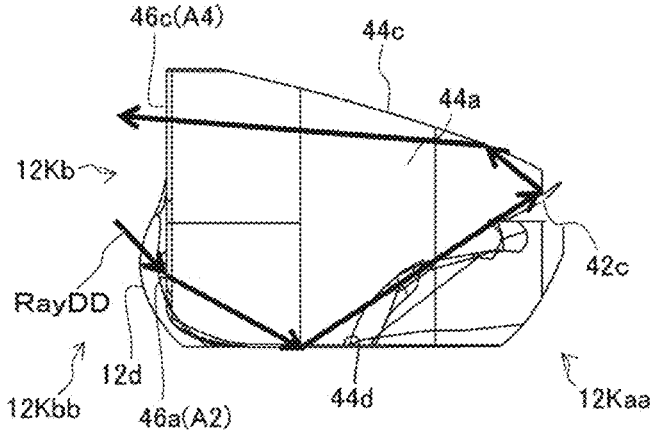
FIG. 56C is incident from the exit surface 12Kb inside the lens body 12K external light RayCC, RayDD (e.g., sunlight) is a diagram showing an optical path to follow.

For example, the external light RayCC shown in FIG. 56 A, FIG. 56 B is incident from the exit surface 12Kb inside the lens body 12K, the left side surface 44*a*, an internal reflection in this order on the right side 44*b* (total reflection) after being emits again from exit surface 12Kb. Further, for example, external light RayDD shown in FIG. 56 A, FIG. 56 C is incident from the exit surface 12Kb inside the lens body 12K, the lower surface 44*d*, the upper incident surface 42*c*, internal reflection in this order on the upper surface 44*c* (which has been totally reflected), emitted again from the exit surface 12Kb.

Figure 57:
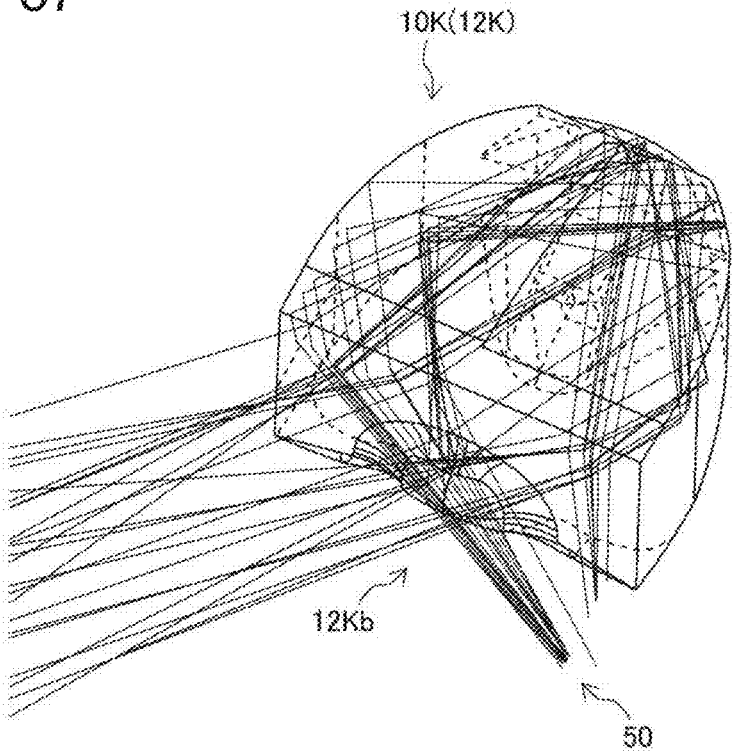
FIG. 57 illustrates in front of the lens body 12K arranged light source 50 likened to external light, a diagram representing the optical path where light traced from the light source 50 which enters the inner lens member 12K from the emission surface 12Kb.

Actual driving environment (for example, running under the environment in broad daylight), the above-mentioned external light RayCC, not limited to RayDD, outside light from any direction (for example, sunlight) is incident on the internal lens body 12K, the lens internal reflection in the body 12K internal (the V-shaped portion, etc.) repeatedly (total reflection), most of which is emitted in various directions from again exit surface 12Kb (see FIG. 57). As a result, the lens member 12K is in the light source 14 non-lit, when viewed from multiple directions, the inside though lens body becomes appearance with "sparkling feeling" as if they were emitted. FIG. 57 is a light source 50 which resemble the ambient light in front of the lens body 12K are arranged, represent the exit surface 12Kb optical path where light is traced from the light source 50 which enters the inner lens member 12K (the simulation result).

According to this embodiment, in addition to the effects of the sixth embodiment, further, it can achieve the following effects.

That is, the appearance does not become monotonous lens body 12K and the vehicle lighting device 10K provided with the same, in particular, in the light source 14 non-lit, when viewed from multiple directions, such as if as if the lens body interior is emitting light it is possible to provide a vehicle lamp 10K that "glitter feeling" with a lens body 12K and this becomes a great looking. As a result, the visibility of the light source 14 non-lit (vehicular lamp 10K, thus, this is the visibility of the vehicle mounted) can be increased.

Its appearance that does not become monotonous, the lens body 12K is not a conventional simple plano-convex lens, the rear end portion 12Kaa the front end portion and a pair of side surfaces 44*a* disposed between 12*bb*, 44*b*, upper face 44*c* and the lower surface enclosed cross section 44*d* is due be configured as a lens having a rectangular shape.

In addition, in the light source 14 non-lighting at the time, when viewed from multiple directions, as if the lens body inside becomes the appearance that "glitter feeling" as if they emit light, lens body 12K is from the front end 12Kbb side in addition to towards the rear end portion 12Kaa side it is configured to narrow the cone-like, at least one of the incident surface, when viewed and/or side view, open towards the front end 12Kbb side results that are part of a V-shaped or V-shaped, external light incident from the emission surface 12Kb inside the lens body 12K (e.g., sunlight) is, the lens body 12K internal (the V-shaped portion or the like) repeated internal reflection (total internal reflection) in the most part is by emitted in various directions from the re-emitting surface 12Kb.

Incidentally, the first to sixth embodiments and the concept described in the modified examples, for example, concept of "decomposing a condensing function" described in the second embodiment, "camber described in the third embodiment idea of imparting angular", and the concept of the blurring which occurs due to the application of the camber angle to improve as described above, the idea described in the fourth embodiment, "imparting slant angle", and, idea the rotation that occurs due to the application of the slant angle of suppressing as described above, the idea described in the fifth embodiment the "camber angle and slant angle", and, the camber angle and slant the blur and the rotation along with occur on the grant of the corner, the idea of improvement and to suppress in the manner described above, it is of course can be applied to the vehicle lamp 10K of the present embodiment (lens body 12K).

Next, the lens bodies 12L which is a first modification of the lens body 12K of the seventh embodiment will be described with reference to the drawings.

Figure 58A:
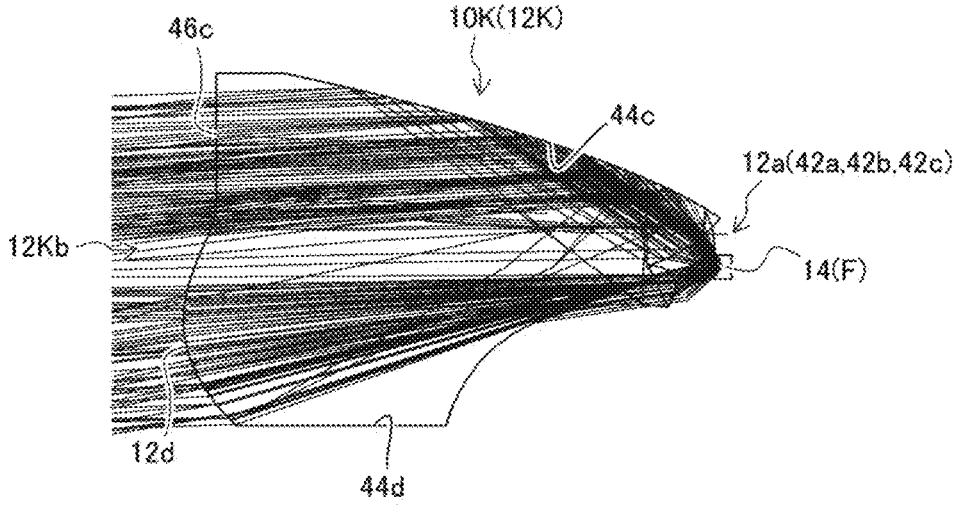
FIG. 58A is a longitudinal sectional view showing an optical path in which light is traced from a light source 14 which enters the inner lens member 12K of the eleventh embodiment.
Figure 58B:
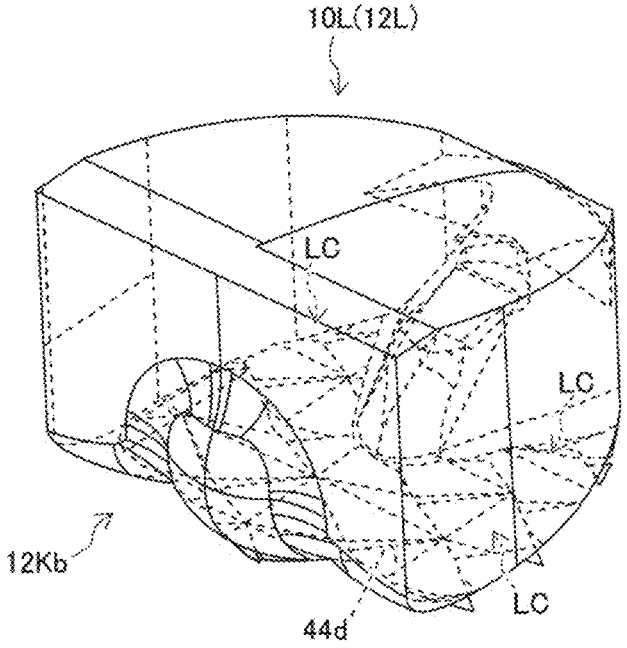
FIG. 58B is a perspective view of the lens body 12L (Modification).

FIG. 58 A is a longitudinal sectional view showing an optical path in which light is traced from a light source 14 which enters the inner lens member 12K of the seventh embodiment, FIG. 58 B is a perspective view of a lens body 12L of the modification.

The present inventors have confirmed by simulation, as shown in FIG. 58 A, in the above-described lens body 12K of the seventh embodiment, the incident surface 12*a* incident, 42*a*, 42*b*, the inner lens member 12K from 42*c* the light from the light source 14 that is not incident on the lower surface 44*d*, i.e., lower surface 44*d* each light distribution pattern PSPOT, PMID, be a region that is not used in formation of PWIDE was found.

Lens body 12L of this modification, as shown in FIG. 58 B, the respective light distribution patterns PSPOT, PMID, a plurality of lens cut LC square pyramid shape on the lower surface 44*d* not used for formation of PWIDE (e.g., elevation plane angle 30°, which corresponds to that imparted pitch 5 mm, the mountain height 3 mm). Otherwise, the same configuration as the lens body 12K of the seventh embodiment. Incidentally, each of the lens cut LC is the same size, may be identical in shape, a different size may be different shapes. Further, it may be arranged aligned with, or may be randomly arranged.

According to this modification, in addition to the effects of the seventh embodiment, furthermore, it can achieve the following effects.

That is, in the light source 14 non-lit, when viewed from multiple directions, as if the lens body interior is looking with a "sparkling feeling" as if they were light-emitting lens body 12L and the vehicle lighting device equipped with this 10L it can be provided. As a result, the visibility of the light source 14 non-lit (vehicle lamp 10L, and hence, this is the visibility of the vehicle mounted) can be increased.

This, external light incident from the emission surface 12Kb inside the lens body 12L (e.g., sunlight) is various inside the lens body 12L (more lenses of quadrangular pyramid granted to the lower surface 44*d* cut LC, etc.) is by emitted in various directions from the re-emitting surface 12Kb is internally reflected in the direction (total reflection).

The present inventors have found that in order to confirm this effect, the lens body of the lens body 12L and Comparative Examples of the present modified example (lens body 12K of the seventh embodiment) was actually manufactured, each of the emission surface 12Kb, luminance total (trade name: Prometric) was used.

Figure 59A:
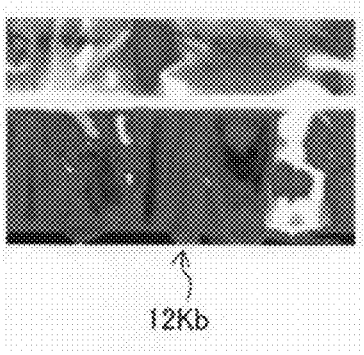
FIG. 59A to FIG. 59C illustrate diagram showing the lens body 12L (the modified example) measurement results of the emission surface 12Kb of (luminance distribution), FIG. 59D to FIG. 59F Comparative Example lens body (Eleventh Embodiment form of the lens body 12K) of the exit surface 12Kb of measurement results (which is a diagram showing the luminance distribution).
Figure 59B:
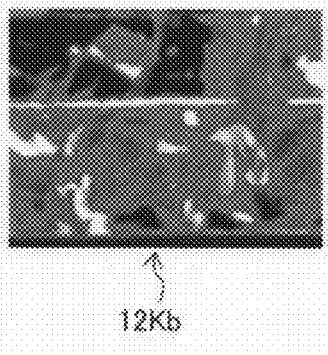
Figure 59C:
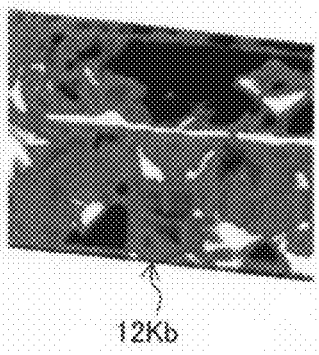
Figure 59D:
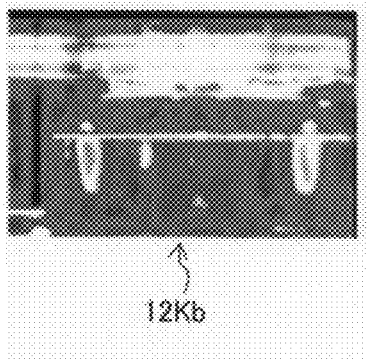
Figure 59E:
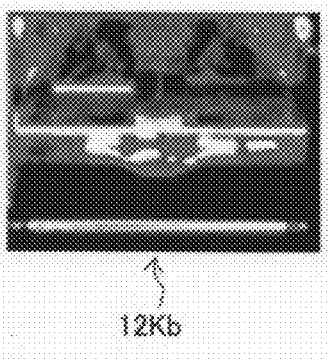
Figure 59F:
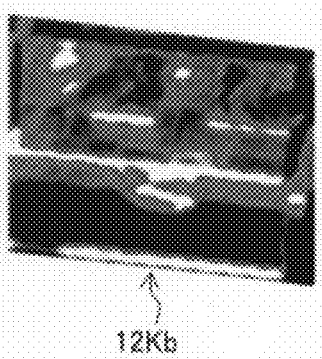

FIG. 59 A~FIG. 59 C is a diagram showing the measurement result of the emission surface 12Kb of the lens body 12L of the present modified example (luminance distribution), FIG. 59D~FIG. 59 F is a comparative example lens body (seventh embodiment of the lens body 12K) of the exit surface 12Kb measurements is a diagram representing the (luminance distribution). The numerical values in the figures represents a measurement position. For example, the left and right in FIG. 59 A 0°, the upper and lower 0° left and right 0° measurement positions of the measurement results shown in FIG. 4 (luminance distribution) with respect to the center of the exit surface 12Kb, vertical 0° (i.e., It represents that it is a position directly in front). The same applies to other figures. Then, in each figure, black parts indicate that a relatively low luminance, the white portion represents that a relatively high brightness.

FIG. 59 Referring to A~FIG. 59 F, toward the lens body 12L of this modification having the lower surface 44*d* having a plurality of lens cut LC is applied in a quadrangular pyramid shape, compared with a flat lower surface 44*d* examples lens body of than (lens body 12K of the seventh embodiment), that the white portion and the black portion over the exit surface 12Kb whole area is divided clearly, that is, is more of the lens body 12L of the present modification, comparative example from body of the lens (lens body 12K of the seventh embodiment), in the light source 14 non-lit, when viewed from multiple directions, it is seen that a great looking though a as if it emits light "sparkling sensitive".

Incidentally, the lower surface 44*d* are four not limited to the plane including the plurality of lens cut LC pyramidal, internal reflection is incident from the exit surface 12Kb inside the lens body 12L in the external light various directions to reach the lower surface 44*d* (only needs to be configured as a surface which is again emitted from the emission surface 12Kb is totally reflected). For example, the lower face 44*d* is four to pyramid may be configured as a surface including a plurality of lens cut of polygonal pyramid shape other than the shape, constructed as a plane including the embossed surface or cut surface comprising a plurality of minute irregularities otherwise it may be.

Next, a second modification is an example lens body 12M of the lens body 12K of the seventh embodiment will be described with reference to the drawings.

Figure 60A:
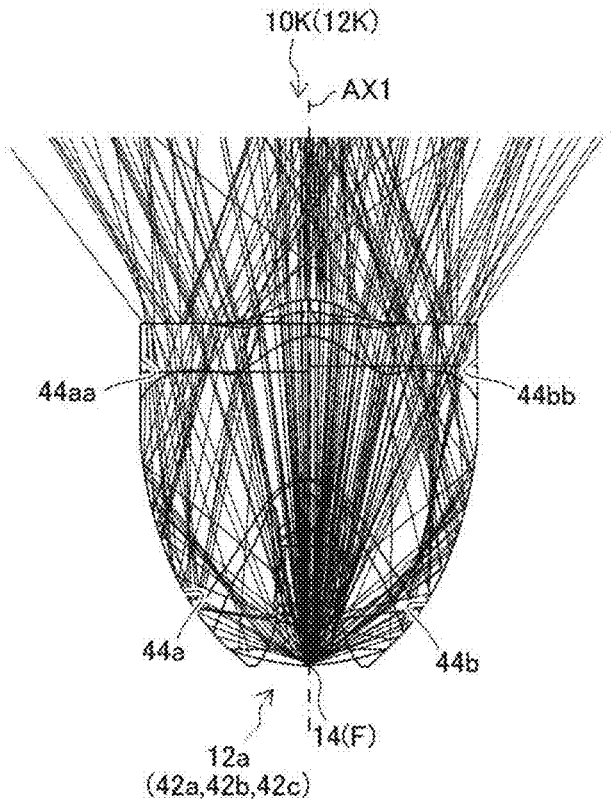
FIG. 60A is a cross-sectional view showing an optical path in which light is traced from a light source 14 which enters the inner lens member 12K of the eleventh embodiment.
Figure 60B:
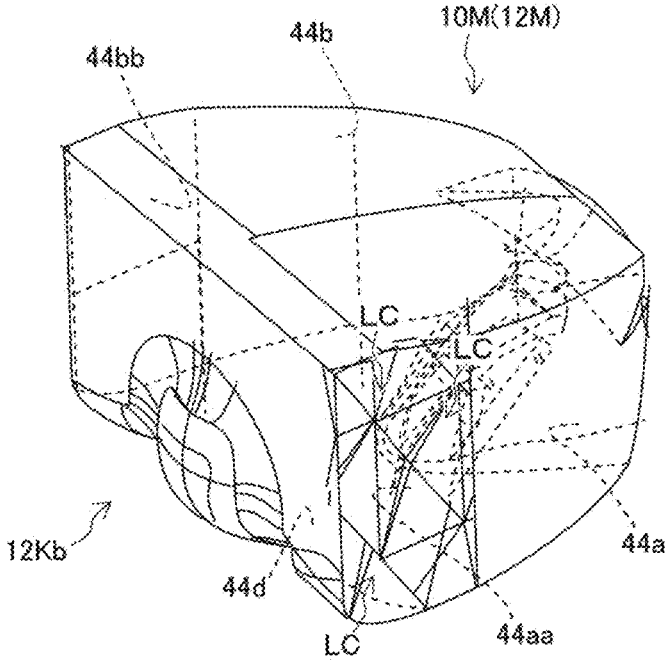
FIG. 60B is a perspective view of the lens body 12M (this modification).

FIG. 60 A is a cross sectional view representing an optical path in which light traced from the light source 14 incident on the inner lens member 12K of the seventh embodiment, FIG. 60 B is a perspective view of a lens body 12M of the modification.

The present inventors have confirmed by simulation, as shown in FIG. 60 A, in the above-described lens body 12K of the seventh embodiment, the incident surface 12*a* incident, 42*a*, 42*b*, the inner lens member 12K from 42*c* the light from the light source 14 that has a pair of left and right side surfaces 44*a*, extending from the front edge of 44*b* forward (e.g., the reference axis extending in a direction parallel to AX 1) has been extended areas 44Aa, it does not enter the 44*bb*, i.e., extension region 44Aa, 44*bb* each light distribution pattern PSPOT, PMID, be a region that is not used in formation of PWIDE was found.

Lens body 12M of this modification, as shown in FIG. 60 B, the respective light distribution patterns PSPOT, PMID, a plurality of lenses of quadrangular pyramid in the extension region 44*aa* and/or 44*bb* not used for the formation of PWIDE cut LC correspond to those granted (for example, elevation surface angle of 30°, pitch 5 mm, crest height 3 mm) a. Otherwise, the same configuration as the lens body 12K of the seventh embodiment. Incidentally, each of the lens cut LC is the same size, may be identical in shape, a different size may be different shapes. Further, it may be arranged aligned with, or may be randomly arranged.

According to this modification, in addition to the effects of the seventh embodiment, furthermore, it can achieve the following effects.

That is, in the light source 14 non-lit, when viewed from multiple directions, as if the lens body interior is looking with a "sparkling feeling" as if they were light-emitting lens body 12M and a vehicular lamp provided with the same 10M it can be provided. As a result, the visibility of the light source 14 non-lit (vehicular lamp 10M, in turn, this is the visibility of the vehicle mounted) can be increased.

This, external light incident from the emission surface 12Kb inside the lens body 12M (e.g., sunlight) is the lens body 12M internal (extension area 44Aa, a plurality of lens cut LC like quadrangular pyramid, issued to 44*bb*) is by emitted in various directions from the re-emitting surface 12Kb is internally reflected (total reflection) in various directions in.

Incidentally, the extension region 44Aa, 44*bb* are four not limited to the plane including the plurality of lens cut LC pyramidal, the extension region 44Aa is incident from the exit surface 12Kb inside the lens body 12M, various external light reaching the 44*bb* only needs to be configured as a surface which is again emitted from the emission surface 12Kb is the direction on the inner surface reflections (total internal reflection). For example, the extension region 44Aa, 44*bb* includes four to pyramid may be configured as a surface including a plurality of lens cut of polygonal pyramid shape other than the shape, embossed surface or cut surface comprising a plurality of minute irregularities otherwise it may be configured as a surface.

Figure 61A:
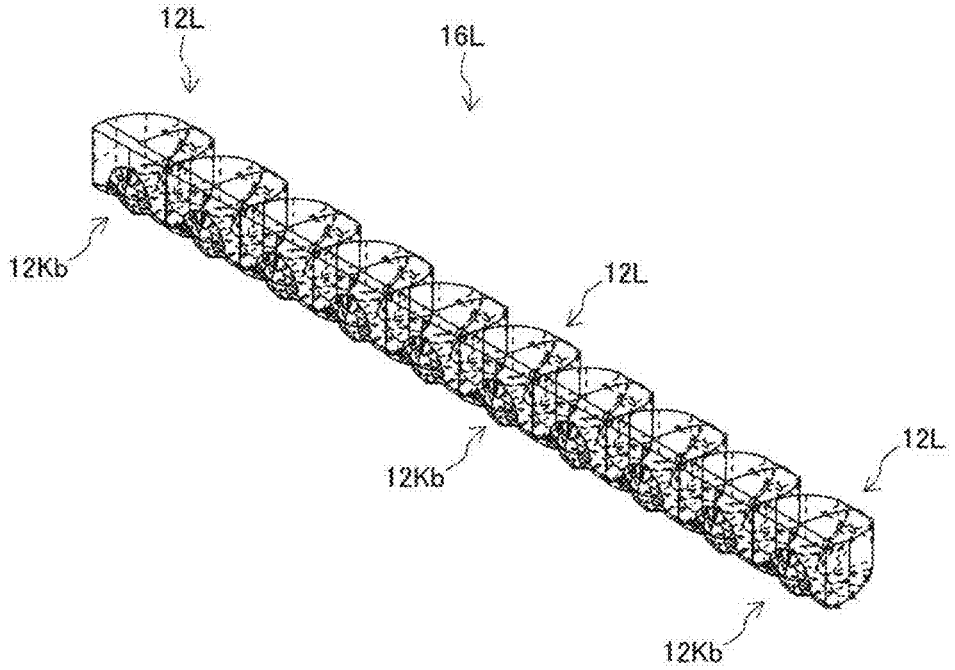
FIG. 61A is a perspective view of a lens conjugate 16L which a plurality of lens bodies 12L which is a first modification of the connection of the lens body 12K of the eleventh embodiment.
Figure 61B:
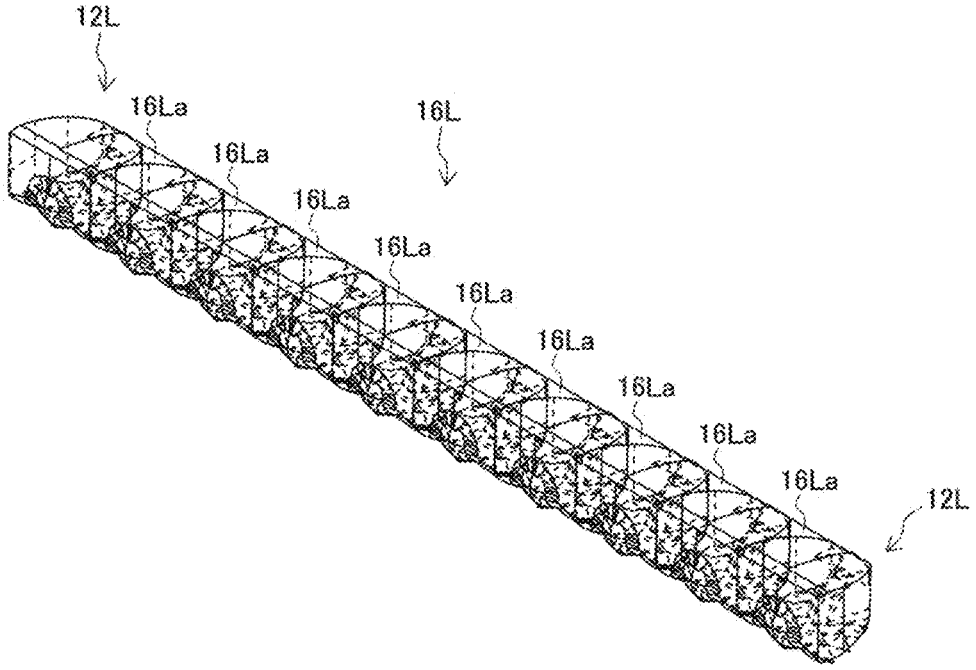
FIG. 61B is a perspective view of the lens conjugate 16L linked a plurality of lens body 12L is a first modification of the lens body 12K of the eleventh embodiment.

FIG. 61 A is a perspective view of a lens conjugate 16L linked a plurality of lens body 12L is a first modification of the lens body 12K of the seventh embodiment.

As shown in FIG. 61 A, a lens conjugate 16L includes a plurality of lens body 12L. Lens conjugate 16L (plurality of lens bodies 12L) is in a mold, injecting a polycarbonate or a transparent resin such as acrylic, cooling, are integrally molded (injection molding) by solidifying. A plurality of lens body 12L each exit surface 12Kb is disposed in a line in the horizontal direction in a state adjacent to each other, constitute the exit surface groups of looking with a sense of unity extending horizontally in a line.

By using the lens conjugate 16L having the above structure, it is possible to construct a vehicle lamp appearance with a sense of unity extending horizontally in a line. The lens conjugate 16L is molded in a state of physical separation of a plurality of lens body 12L, it may be constructed by concatenating (held) by a holding member such as a lens holder (not shown).

As shown in FIG. 61 B, may be pressurized meat 16La the gaps between each of the lens body 12L. For example, the lower surface 44*d* may block the gap between the lens body 12L each extend, or in the gaps between each of the lens body 12L, physically shaped additional lens unit as a separate member (the lower surface 44*d* similar additional lens part including the lower surface) may be arranged. Thus, even external light incident from this, the lens bodies 12L inside the bottom surface 44*d* (i.e., a plurality of lens cut LC) again from the exit surface 12Kb is internally reflected (total reflection) in different directions by the action of the results so that the emitted, it is possible to further enhance the above-mentioned "sparkling feeling".

Next, the vehicle lighting device of the eighth embodiment 10 N (lens body 12N), will be described with reference to the drawings.

Vehicle lamp 10N of the present embodiment (the lens body 12N) is configured as follows.

FIG. 62 is a perspective view of the vehicular lamp 10 N (lens body 12N), FIG. 63 A is a top view, FIG. 63 B is a front view, FIG. 63 C is a side view. In the example of FIG. 64 A is a light distribution pattern PLO (synthesized light distribution pattern) for a low beam formed by the vehicle lamp 10 N (lens body 12N), each section partitioned shown in FIG. 64 B~FIG. 64 E light pattern PSPOT, PMID_L, PMID_R, is formed by PWIDE is superimposed.

Vehicle lamp 10N of the present embodiment (the lens body 12N), relative to the sixth embodiment of the vehicular lamp 10J shown in FIG. 39 (the lens body 12 J), a pair of right and left second lower reflecting surfaces 48*a*, 48*b* (and shade 48*c*, which corresponds to what you add the 48*d*). Then, the final emission surface of the lens body 12N of the present embodiment (second output surface 12A2*b*), unlike the sixth embodiment, as the slant angle and/or the surface of the semi-cylindrical camber angle is imparted (cylindrical surface) It is configured. Further, the upper surface 44Nc of the present embodiment differs from the sixth embodiment, the light from the light source 14 which is incident from the upper incident surface 42*c* inside the lens body 12N functions as emission surface for emitting. Otherwise, the same configuration as the sixth embodiment of the vehicular lamp 10 J (lens body 12 J).

Figure 70A:
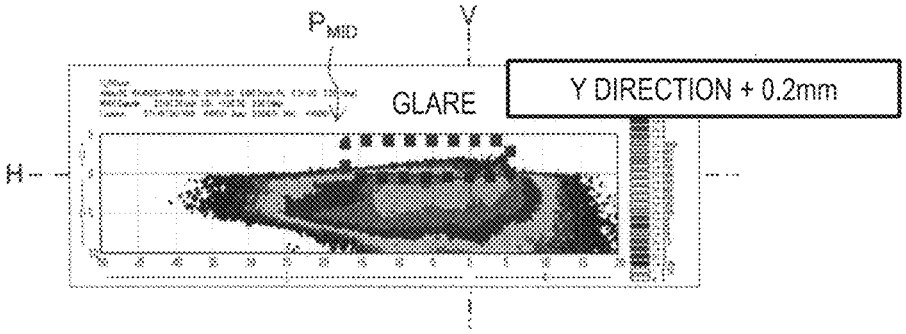
FIG. 70A is a diagram depicting glare generated when the light source 14 (light emitting surface) is 1 $mm^2$ and the relative positional relationship of the lens body 12J with respect to the light source 14 is shifted from the design value in the Y direction (vertical direction) by +0.2 mm.
Figure 70B:
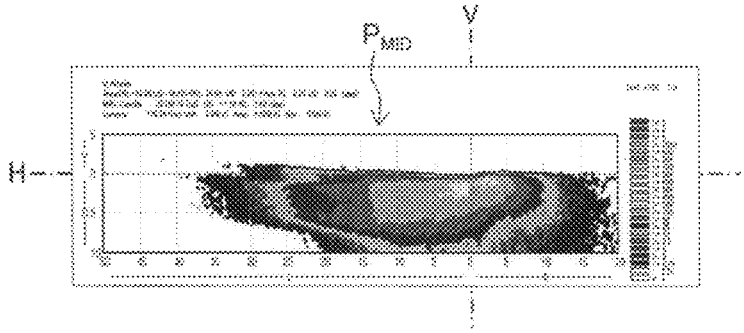
FIG. 70B is a diagram depicting a state in which glare is not generated in the intermediate light distribution pattern $P_{MID}$ when the relative positional relationship of the lens body 12J with respect to the light source 14 is exactly the same as the design values.

The present inventors have confirmed by simulation, in the sixth embodiment of the vehicular lamp 10 J (lens body 12J), if the relative positional relationship of the lens body 12J with respect to the light source 14 was deviated from the design value, FIG. 70 (as shown in a), the glare was found to occur in mid-light distribution pattern PMID. FIG. 70 A, the light source 14 (light emitting surface) in 1 mm square, the relative positional relationship of the lens body 12J with respect to the light source 14 occurs when was +0.2 mm deviation in Y-direction (vertical direction) from the design value It represents the glare.

If the relative positional relationship of the lens body 12J with respect to the light source 14 is designed value, as shown in FIG. 70 B, not glare occurs mid light distribution pattern PMID.

However, when actually fabricating a vehicle lamp, the assembly due to the influence of errors such as, it is difficult to a relative positional relationship between the lens body 12J with respect to the light source 14 to the designed value, the relative of the lens body 12J with respect to the light source 14 Do positional relationship is deviated from the design value.

The present inventor, due to deviate from the relative positional relationship is a design value of the lens body 12J with respect to the light source 14 as described above, to suppress the glare is produced in mid-light distribution pattern PMID, extensive Study result, apart from the first lower reflection surface 12*b* constituting the first optical system for forming a light distribution pattern PSPOT for spots (and shade 12*c*), a second optical system for forming a light distribution pattern PMID for mid to left and right pair of second lower reflecting surface 48*a* on, 48*b* (and shade 48*c*, 48*d*) by adding a light that causes the glare is light distribution below the cut-off line, to the mid-light distribution pattern PMID glare found that it is possible to suppress occurrence.

Based on this finding, the vehicle lamp 10 N (lens body 12N) of the present embodiment, the first lower reflection surface 12 *b* (and the shade 12*c*) separate from, the second lower reflecting surface of the pair arranged on the left and right sides 48*a*, and includes a 48*b* (and shade 48*c*, 48*d*).

Hereinafter, the differences from the sixth embodiment of the vehicular lamp 10 J (lens body 12 J) will be mainly described, the same reference numerals are given to the same configuration as the sixth embodiment of the vehicular lamp 10 J (lens body 12 J) denoted by the description thereof is omitted.

Figure 69:
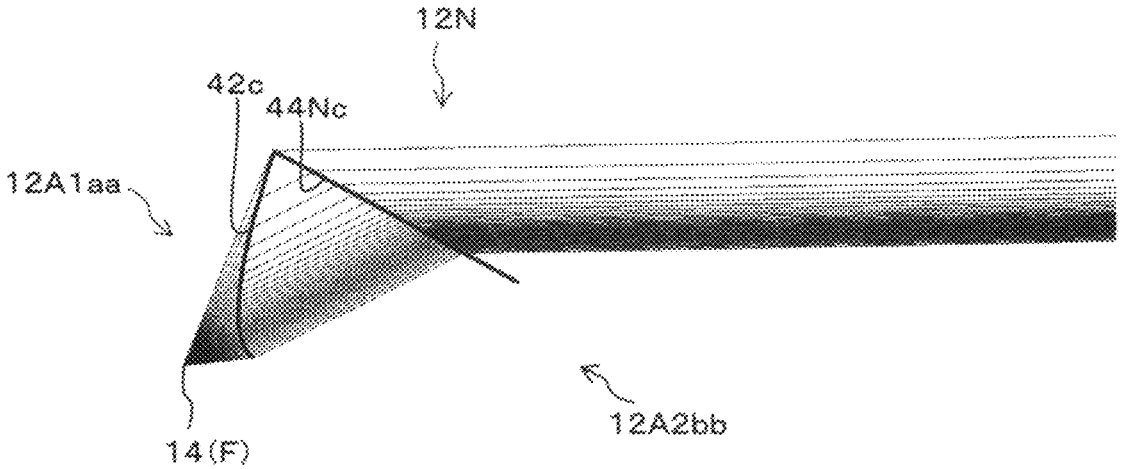
FIG. 69 is a side view of the third optical system (only major optical surfaces).

Lens body 12N of the present embodiment, similarly to the sixth embodiment, a first optical system for forming a spot light distribution pattern PSPOT (see FIG. 64 B) in addition to (FIG. 42 A refer), further, mid light distribution pattern PMID_L diffused from the light distribution pattern PSPOT for spot, PMID_R (FIG. 64 C, FIG. 64 (d-) refer) second optical system for forming (see FIG. 66, FIG. 67), and, and a wide light distribution and diffusion from the light distribution pattern PMID for mid pattern PWIDE (FIG. 64 E reference) third optical system for forming a (see FIG. 69).

Lens body 12N of the present embodiment is a lens body disposed in front of the light source 14, FIG. 62, as shown in FIG. 63, the rear end, a front end, between the rear end and the front end disposed right and left pair of side 44*a*, comprises 44*b* and top 44Nc, light from the light source 14 incident on the inner lens member 12N is, is irradiated forward emitted from the front end (second output surface 12A2*b*) and top 44Nc the Rukoto, as shown in FIG. 64 A, is configured as a lens body forming a light distribution pattern for low beam PLo comprising a cut-off line to the upper edge.

Specifically, the lens body 12N has a first rear end portion 12A1*aa*, first forward end 12A1*bb*, first rear end portion 12A1*aa* and arranged left and right pair of side 44*a* between the first front end 12A1*bb*, 44*b*, and, a first lens unit 12A1 including a first lower reflecting surface 12*b* disposed between the first rear end portion 12A1*aa* a first front end 12A1*bb*, is disposed in front of the first lens unit 12A1, after the second end 12A2*aa*, a second lens portion 12A2 including a second front end 12A2*bb*, a first lens unit 12A1 includes a connecting portion 12A3 which connects the second lens portion 12A2, further, after the first of the first lens portion 12A1 end 12A1*aa* and disposed upper surface 44Nc between the second front end 12A2*bb* of the second lens portion 12A2, and, between the first rear end portion 12A1*aa* a first front end 12A1*bb* of the first lens unit 12A1*aa* and, the second lower reflecting surface 48*a* of the pair which is disposed on the left and right sides of the first lower reflection surface 12 *b*, which is configured as a lens comprising a 48*b*.

Lens body 12N of the present embodiment, similarly to the above embodiments, injecting a polycarbonate or a transparent resin such as acrylic, cooling, (by injection molding) by solidifying are integrally formed.

Figure 65A:
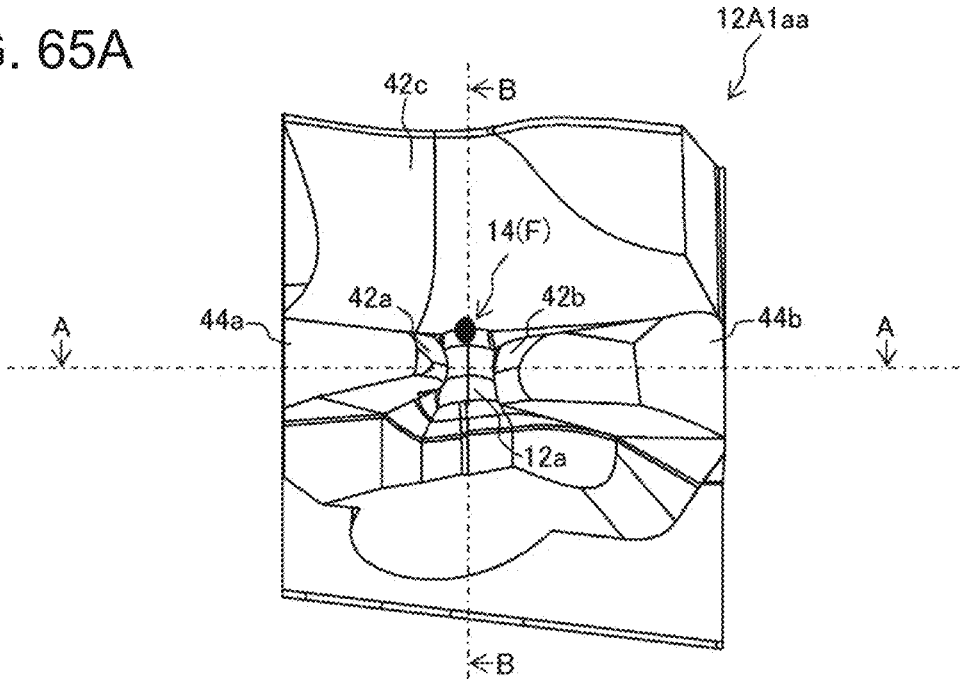
FIG. 65A is a front view of the first rear end portion 12A1*aa* of the first lens unit 12A1.
Figure 65B:
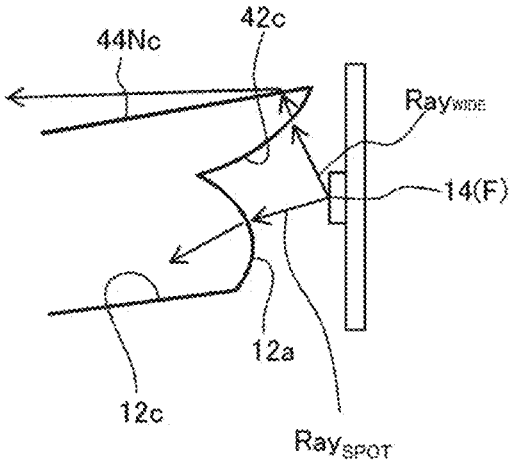
FIG. 65B is a B-B cross-sectional view (schematic diagram) of FIG. 65A.

FIG. 65 A is a front view of a first rear end portion 12A1*aa* of the first lens unit 12A1, FIG. 65 B is a diagram 65 B-B sectional view of A (schematic diagram). Incidentally, the A-the A sectional view in FIG. 65 A (schematic diagrams) is the same as FIG. 43 B.

FIG. 43, as shown in FIG. 65 A, first rear end portion 12A1*aa* of the first lens unit 12A1 includes a first entrance surface 12*a*, and, on both left and right sides of the first entrance surface 12*a*, a first entrance surface 12*a* light source 14 and the spatial arrangement so as to surround the left and right sides are pair of left and right entrance surface 42*a* between the first entrance surface 12*a* which is arranged in the vicinity includes 42*b*. The first rear end 12A1*aa*, as shown in FIG. 65 A, FIG. 65 B, further, on the upper side of the first entrance surface 12*a*, the light source 14 and the space between the first entrance surface 12*a* upward It contains on the entrance surface 42*c* disposed so as to surround from.

The distal end of the first lower reflection surface 12*b* includes a shade 12*c*.

The first front end 12A1*bb* of the first lens unit 12A1 is, as shown in FIG. 62, the first semi-cylindrical surface in the vertical direction or a substantially first output surface of the semi-cylindrical vertically extending 12A1*a* (present invention equivalent), and includes first output surface 12A1*a* right and left sides in the arranged a pair of left and right exit surface 46*a*, 46*b* (corresponding to a pair of left and right middle exit surface of the present invention).

The second rear end portion 12A2*aa* of the second lens unit 12A2 includes a second entrance surface 12A2*a* (corresponding to an intermediate plane of incidence of the present invention), the second front end 12A2*bb* of the second lens portion 12A2 and the second emission surface 12A2*b* contains a (corresponding to a final output surface of the present invention).

The final exit surface (second output surface 12A2*b*), unlike the sixth embodiment, the slant angle and/or camber angle is formed as a surface of a semi-cylindrical granted. Along with this, the cylindrical axis of the final exit surface (second output surface 12A2*b*) (and focal line F12A2*b*) is tilted relative to horizontal. Slant angle and/or camber angle is imparted by the technique described in the third to fifth embodiments and the like. Then, the above blurring and rotation occurring due to the application of slant angle and/or camber angle is improved and suppressed by the technique described in the third to fifth embodiments and the like.

Of course, not limited to this, the final exit surface (second output surface 12A2*b*) is slant angle and/or camber angle is not given, i.e., semicircular cylindrical axis (and focal line F12A2*b*) is extending in the horizontal direction it may be configured as a columnar surface.

Connecting portion 12A3 includes a first lens portion 12A1 and the second lens portion 12A2, in each of the upper, first forward end of the first lens unit 12A1 12A1*bb*, second rear end portion of the second lens portion 12A2 12A2*aa* and consolidated are connected in a state enclosed space S is formed in parts 12A3.

FIG. 42 A, the first incident surface 12*a*, the first lower reflection surface 12 *b* (and shade 12*c*), a first semi-cylindrical surface (first exit surface 12A1*a*), an intermediate incidence surface (second incident surface 12A2*a*) and final output surface (second output surface 12A2*b*) are light blocking part by the shade 12*c* of the first lower reflection surface 12*b* of the light from the light source 14 incident from the first incident surface 12*a* to the inner lens member 12N light and light that is internally reflected by the first lower reflecting surface 12*b* is emitted from the first semi-cylindrical surface (first output surface 12A1*a*) the lens body 12N external, further, an intermediate incidence surface (second incident from the incident surface 12A2*a*) inside the lens body 12N emitted from the final exit surface (second output surface 12A2*b*), by being irradiated forward, is defined in the upper end edge by the shade 12*c* of the first lower reflection surface 12*b* constitute a first optical system for forming a light distribution pattern PSPOT for spot (corresponding to the light converging pattern of the present invention) comprising a cut-off line that.

The first optical system configured as described above, onto a virtual vertical screen, the spot light distribution pattern PSPOT shown in FIG. 64 B is formed.

Figure 66:
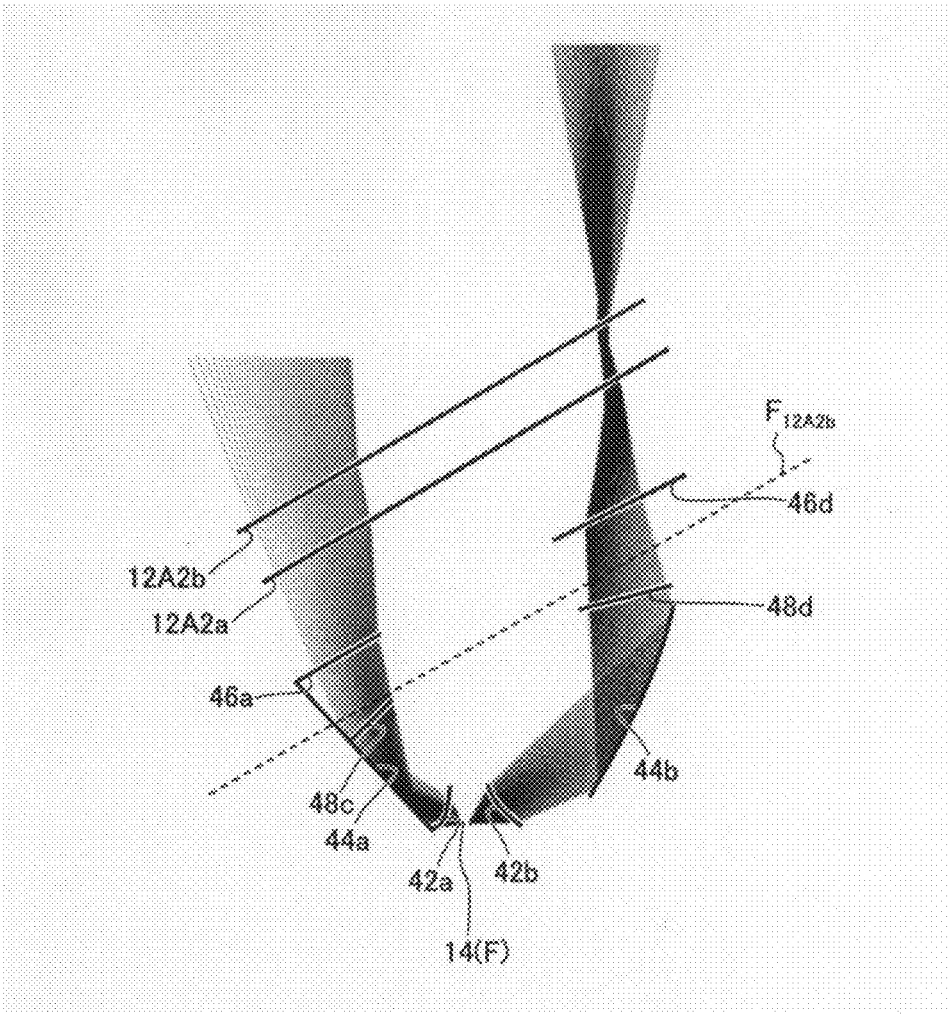
FIG. 66 is a lateral cross-sectional view (only major optical surfaces) of the second optical system.
Figure 67:
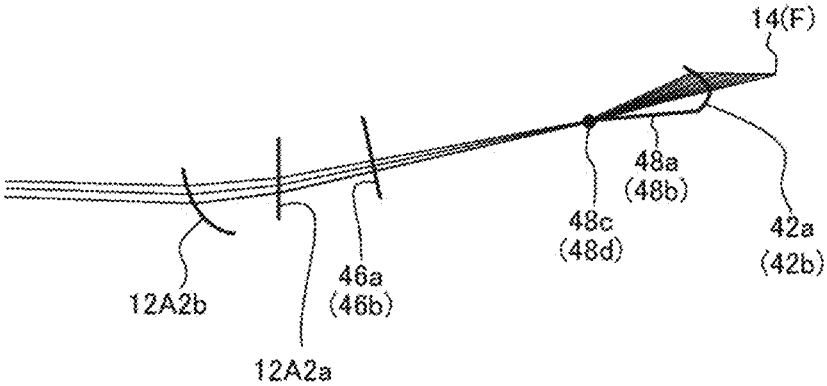
FIG. 67 is a longitudinal cross-sectional view (only major optical surfaces) of the second optical system.

FIG. 66 is a cross-sectional view of a second optical system (primary optical surfaces only), FIG. 67 is a longitudinal sectional view (main optical surfaces only).

FIG. 66, as shown in FIG. 67, a pair of left and right entrance surface 42*a*, 42*b*, a pair of left and right side faces 44*a*, 44*b*, a pair of right and left second lower reflecting surfaces 48*a*, 48*b* (and the shade 48*c*, 48*d*), a pair of left and right intermediate exit surface (pair of exit surface 46*a*, 46 *b*), an intermediate incidence surface (second incident surface 12A2*a*) and final output surface (second output surface 12A2*b*) is a pair of left and right entrance surface 42*a*, the inner lens element 12N from 42*b* incident to the right and left pair of side 44*a*, left and right pair of second lower reflecting surface 48*a* of the light from the light source 14 which is internally reflected at 44*b*, 48*b* of the shade 48*c*, the part shaded in light and left-right pair by 48*d* 2 lower reflecting surface 48*a*, the light that is internally reflected by 48*b* is emitted from the pair of left and right intermediate exit surface (pair of exit surface 46*a*, 46 *b*) to the lens body 12N external, further, an intermediate incidence surface (second incident surface 12A2*a*) after entering the inner lens member 12N emitted from the final exit surface (second output surface 12A2*b*), by being irradiated forward, as shown in FIG. 64 C, FIG. 64 (d-), spot configuration is superimposed on the use light distribution pattern PSPOT, mid light distribution pattern PMID_L that has diffused from the light distribution pattern PSPOT for the spot, (the first corresponds to the diffusion pattern of the present invention) and a second optical system of the left and right pair to form a PMID_R doing.

Figure 68:
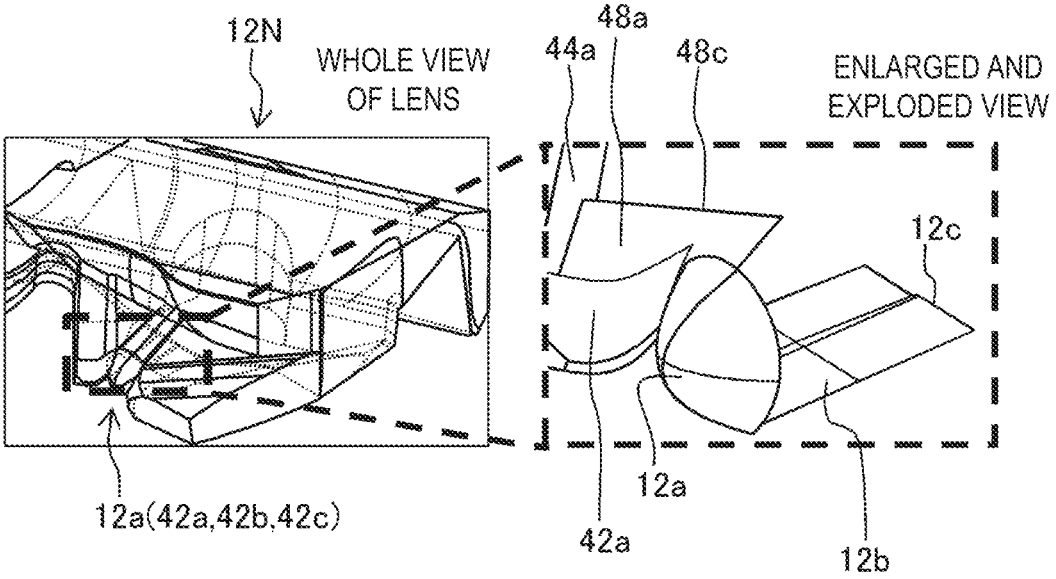
FIG. 68 is an enlarged perspective view of an area around the second lower reflection surface 48*a* (and the shade 48*c*) disposed on the left.

A pair of right and left second lower reflecting surfaces 48*a*, 48*b* are a pair of left and right entrance surface 42*a*, a reflecting surface of a planar shape extending forward from the lower edge of 42*b* (or the lower edge vicinity). FIG. 68 is an enlarged perspective view of the vicinity of the second lower reflecting surface 48*a* disposed on the left side (and shade 48*c*). A pair of right and left second lower reflecting surfaces 48*a*, 48*b* of the tip, the shade 48*c*, contain 48*d*.

A pair of right and left second lower reflecting surfaces 48*a*, 48*b* is, the pair of right and left second lower reflecting surface 48*a* of the light from the light source 14 incident on the inner lens member 12N, the light incident on the 48*b* by the reflecting surface for total reflection, metal deposition is not used. A pair of right and left second lower reflecting surface 48*a* of the light from the light source 14 incident on the inner lens member 12N, the light incident on 48*b*, the pair of right and left second lower reflecting surface 48*a*, it is internally reflected at 48*b* final exit toward the surface (the second exit surface 12A2*b*), toward the road surface direction is refracted in the final exit surface (the second exit surface 12A2*b*). That is, the pair of right and left second lower reflecting surface 48*a*, the reflected light is internally reflected by 48*b* is shaped to be superimposed on the light distribution pattern below the cut-off line is folded back border the cut-off line. Thus, mid light distribution pattern PMID_L, PMID_R (FIG. 64 C, FIG. 64 (d-) refer) is cut-off line to the upper edge of the formed.

Shade 48*c*, the position of the 48*d* to mid light distribution pattern PMID_L, the cutoff line of PMID_R is suitably formed is different depending on conditions such as the slant angle and/or camber angle, it is difficult to represent in a concrete numerical values is there.

However, for example, mid each time using a predetermined simulation software, the shade for focal line F12A2*b* final exit surface (second output surface 12A2*b*) (see FIG. 66) 48*c*, to change gradually the position of the 48*d*, changing use the light distribution pattern PMID_L, by checking the PMID_R, mid light distribution pattern PMID_L, shade 48*c* to cut-off line of PMID_R is properly formed, it is possible to find the position of 48*d*.

A pair of left and right entrance surface 42*a*, 42*b*, of the light from the light source 14 does not enter the first entrance surface 12*a* of light (mainly, the light RayMID extending in the lateral direction. FIG. 43 B refer) is a plane that is incident inside the first lens portion 12A1 is refracted, as shown in FIG. 43 B, the surface of the curved convex toward the light source 14 (e.g., free-form surface) It is configured as a.

Specifically, a pair of left and right entrance surface 42*a*, 42*b* mainly includes the pair of left and right entrance surface 42*a*, a pair of left and right incident from 42*b* inside the lens body 12N side 44*a*, a light source 14 which is internally reflected at 44*b* light from the relates vertical direction, the pair of right and left second lower reflecting surface 48*a*, shade 48*b* 48*c*, and condensed near 48*d* (see FIG. 67), and relates to a horizontal direction, the diffusion (see FIG. 66) so to, the surface shape is configured.

For example, in FIG. 66, left entrance surface 42*a*, the light from the light source 14 which is internally reflected by the left side surface 44*a* is incident from the left entrance surface 42*a* inside the lens body 12N is relates to the vertical direction, the left second lower reflector focused on the shade 48*c* vicinity of the surface 48*a* (see FIG. 67), and relates to a horizontal direction, it diffuses without condensed (see FIG. 66) as its surface shape is formed.

On the other hand, in FIG. 66, right entrance surface 42*b*, the light from the light source 14 which is internally reflected by the right side 44*b* is incident from the right entrance plane 42*b* inside the lens body 12N is relates to the vertical direction, the right second lower reflector focused on the shade 48*d* near the surface 48*b* (see FIG. 67), and relates to a horizontal direction, the final exit surface after condensed with (second output surface 12A2*b*) near to the diffusion (see FIG. 66), the surface shape is formed.

The second optical system of the above construction, on the virtual vertical screen, FIG. 64 C, mid light distribution pattern PMID_L shown in FIG. 64 D, PMID_R is formed.

The present inventor has any pair of right and left second lower reflecting surface 48*a* as described above, 48*b* (and the shade 48*c*, 48*d*) by adding the relative positional relationship of the lens body 12N respect to the light source 14 from the design value even displaced in the direction of glare it was confirmed by simulation that can be prevented from occurring in mid light distribution pattern PMID (PMID_L, PMID_R).

Incidentally, the light distribution pattern PMID_R for mid shown in mid-light distribution pattern PMID_L and FIG. 64 (d-) shown in FIG. 64 C is not symmetrical to each other, the final exit surface (second output surface 12A2*b*) is, is by slant angle and/or camber angle is formed as a surface of a semi-cylindrical granted. The final exit surface (second output surface 12A2*b*) is slant angle and/or camber angle is not granted, i.e., the cylindrical axis (and focal line F12A2*b*) is configured as a semi-cylindrical surface extending in the horizontal direction If it is, and the mid-light distribution pattern PMID_L and mid-light distribution pattern PMID_R, the shape of each other left and right symmetry.

FIG. 69 is a side view of a third optical system (primary optical surfaces only).

As shown in FIG. 69, the upper incident surface 42*c* and the upper surface 44Nc, by light from a light source 14 which is incident from the upper incident surface 42*c* in the inner lens member 12N is irradiated forward emitted from the upper surface 44Nc, FIG. 64 E, the spot light distribution pattern PSPOT and mid-light distribution pattern PMID_L, is superimposed on the PMID_R, mid light distribution pattern PMID_L, PWIDE light distribution pattern for a wide diffused than PMID_R (of the present invention constitute a third optical system which forms an equivalent) to the second diffusion pattern.

Light distribution pattern PWIDE for wide is near the center of the upper edge there is a light distribution pattern shape including a recess recessed downward. The reason is as follows.

Figure 71:
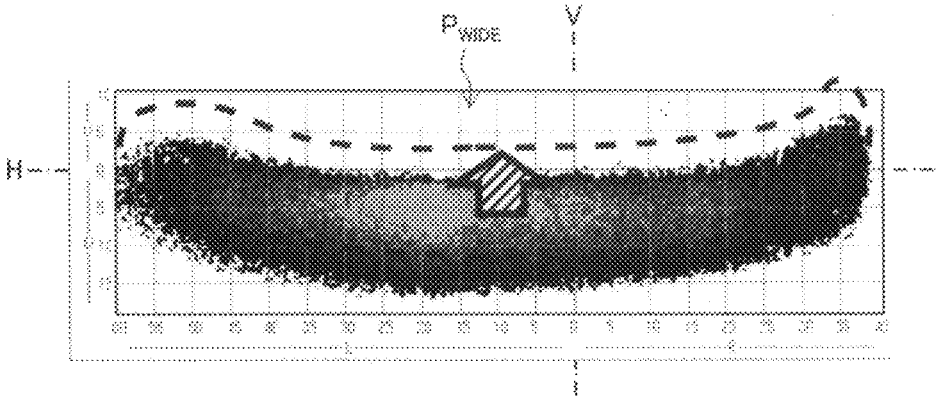
FIG. 71 is a diagram depicting a state in which glare is generated when the relative positional relationship of the lens body 12N with respect to the light source 14 is shifted from the design value in the Y direction (vertical direction).

The present inventors have confirmed by simulation, when the relative positional relationship of the lens body 12N respect to the light source 14 was deviated from a designed value (for example, if the lens body 12N is shifted vertically downward with respect to the light source 14), FIG. 71 as indicated by a dotted line, a result of the wide-angle light distribution pattern PWIDE is moved to the overall vertically upward, glare occurs in the area of the intersection near the H line and the V line (the region preceding vehicle and the oncoming vehicle is present) it was found to be. FIG. 71 is a glare represents what happens when the relative positional relationship between the lens body 12N respect to the light source 14 is shifted in the Y direction (vertical direction) from the design value.

If the relative positional relationship of the lens body 12N respect to the light source 14 is designed value, as shown in FIG. 64 E, since the wide light distribution pattern PWIDE is formed at a proper position, the glare does not occur.

However, when actually manufacturing vehicle light (the lens body), assembled by the influence of the error and the like, it is difficult to a relative positional relationship between the lens body 12N respect to the light source 14 to the designed value, the lens member with respect to the light source 14 relative positional relationship of 12N is deviated from the design value.

The present inventors have, due to the relative positional relationship between the lens body 12N respect to the light source 14 as described above deviates from the design value, the wide light distribution pattern PWIDE moves generally vertically upward, H since glare in the region of intersection near the lines and V lines (regions preceding vehicle or an oncoming vehicle is present) can be inhibited from occurring, a result of intensive studies, the light distribution pattern PWIDE for wide, is near the center of the upper edge by the light distribution pattern shape including a recess recessed downward, even if the wide light distribution pattern PWIDE is moved to generally vertically above the region of intersection near the H line and the V line (the preceding vehicle glare found that it is possible to suppress occurrence in area), an oncoming vehicle is present.

Based on this finding, the light distribution pattern PWIDE for wide is near the center of the upper edge there is a light distribution pattern shape including a recess recessed downward.

Wide light distribution pattern PWIDE shape near the center comprises a recess which is recessed below the upper edge may be formed as follows.

The upper incident surface 42*c*, the light (mainly not enter the first entrance surface 12*a* of the light from the light source 14 extends upward light RayWIDE. In FIG. 65 B refer) enters inside the first lens portion 12A1 is refracted plane, as shown in FIG. 65 B, the surface of the curved convex toward the light source 14 (e.g., free-form surface) It is configured as a.

Upper surface 44Nc, unlike the sixth embodiment, FIG. 62, as shown in FIG. 69, the front end portion of the lens body 12N rear end portion from (second front end 12A2*bb*) side (first rear end portion 12A1*aa*) side headed are arranged in an inclined posture obliquely upward, the light from the light source 14 which is incident from the upper incident surface 42*c* inside the lens body 12N functions as emission surface for emitting. Upper surface 44Nc is configured as a surface of a planar shape. Of course, not limited to this, the upper surface 44*c* may be configured as a surface of a curved surface.

The upper incident surface 42*c* and/or top 44Nc, as shown in FIG. 64 E, a wide light distribution pattern PWIDE shape near the center of the upper edge includes a recessed portion recessed downwardly is formed, the surface shape is formed.

The third optical system having the above structure, on a virtual vertical screen, the light distribution pattern PWIDE for wide shown in FIG. 64 E is formed.

According to this embodiment, in addition to the effects of the sixth embodiment, further, it can achieve the following effects.

That is, it realizes the appearance with a sense of unity, which extends linearly in a predetermined direction, yet, to form one in a plurality of light distribution patterns (the spot light distribution pattern PSPOT, mid light distribution pattern PMID_L, PMID_R etc.) it is possible to provide a lens body 12N capable. Note that exhibit this effect, a minimum sufficient that comprises a first optical system and second optical system, third optical system may be omitted as appropriate.

It can be realized appearance with a sense of unity, which extends linearly in a predetermined direction, by the last exit surface (second output surface 12A2*b*) is configured as a semi-cylindrical surface (refracting surface of the semi-cylindrical) it is.

One the plurality of light distribution patterns (the spot light distribution pattern PSPOT, mid light distribution pattern PMID_L, PMID_R etc.) can be formed in one lens body 12N plurality of optical systems, namely, a spot the first optical system for forming a light distribution pattern PSPOT, mid light distribution pattern PMID_L, is by and a second optical system or the like to form a PMID_R.

Further, according to this embodiment, by influence of assembly error, as the relative positional relationship of the lens body 12N respect to the light source 14 was deviated from the design value, glare mid light distribution pattern PMID (PMID_L, PMID_R) There can be suppressed. This is due to that it comprises mid light distribution pattern PMID (PMID_L, PMID_R) a second optical system pair second lower reflecting surface 48*a* to form a, 48*b* (and shade 48*c*, 48*d*).

Further, according to this embodiment, by influence of assembly error, the relative positional relationship of the lens body 12N respect to the light source 14 is deviated from the design value, even as a wide light distribution pattern PWIDE has moved vertically upward, glare can be suppressed. This wide light distribution pattern PWIDE is by the central vicinity of the upper edge is formed as a light distribution pattern shape including a recess recessed downward. Note that exhibit this effect, a minimum, it is sufficient that a third optical system, the first optical system and/or the second optical system may be omitted as appropriate.

Next, a description will be given of a modification of the lens body 12N. This modification, instead of the upper surface 44Nc, using the upper surface 44*c* of the sixth embodiment, further, correspond to the lens body 12N adding the second emission surface of the sixth embodiment 12A2*b* (the extension region 12A2*b*4).

In this modification, as shown in FIG. 49 C, the upper entrance surface 42*c*, the upper surface 44*c* and the second output surface 12A2*b* (extension regions 12A2*b*4) is, the upper surface incident from the upper incident surface 42*c* inside the lens body 12N 44*c* in light RayWIDE from the inner surface reflected light source 14, by being irradiated forward emitted from the second emission surface 12A2*b* (extension regions 12A2*b*4), as shown in FIG. 64 E, a light distribution pattern for a spot PSPOT and mid-light distribution pattern PMID_L, is superimposed on the PMID_R, mid light distribution pattern PMID_L, constituting the third optical system for forming a light distribution pattern PWIDE for wide diffused than PMID_R.

The upper incident surface 42*c* and/or the top surface 44*c* is near the center of the upper edge is so wide light distribution pattern PWIDE shape, including a recess which is recessed downward is formed, the surface shape is formed. For example, as the light reflected from the region near the center in the lateral direction of the upper surface 44*c* is irradiated downward from the light reflected from the region of the right and left sides, a region near the center in the lateral direction than the area of the left and right sides tilt down (or, recessed). Thus, as shown in FIG. 64 E, near the center of the top edge it can form a wide light distribution pattern PWIDE shape including the concave portion recessed downwardly.

The present modification also, it is possible to achieve the same effect as the eighth embodiment.

Next, a ninth embodiment, a vehicle lamp 60 to form a light distribution pattern for high beam (the lens body 62) will be described with reference to the drawings.

Figure 72A:
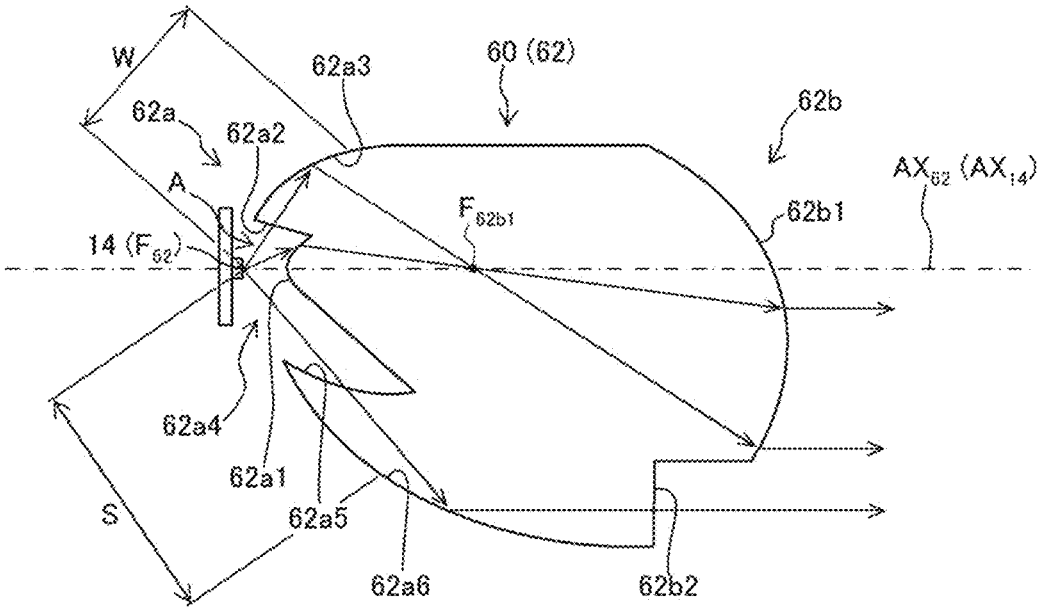
FIG. 72A is a longitudinal cross-sectional view of the vehicular lighting fixture 60 (lens body 62)
Figure 72B:
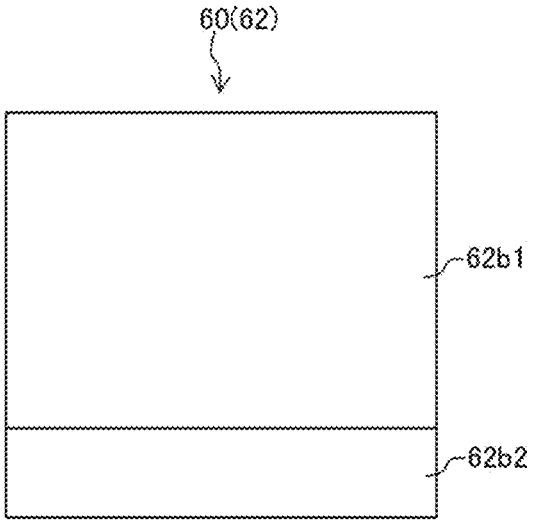
FIG. 72B is a front view thereof.
Figure 73A:
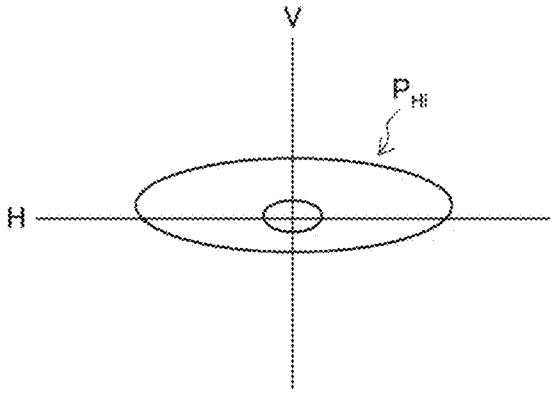
FIG. 73A is an example of a high beam light distributed pattern $P_{Hi}$ (composite light distribution pattern) formed by the vehicular lighting fixture 60 (lens body 62)
Figure 73B:
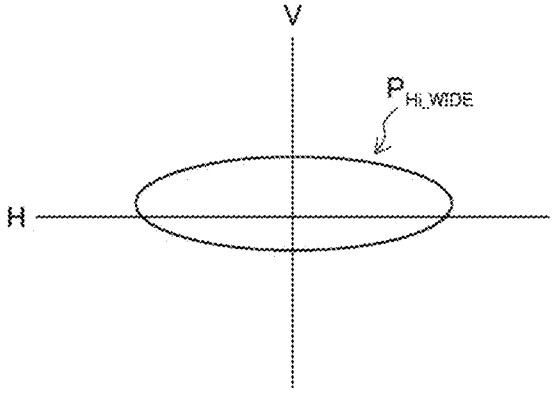
FIG. 73B is an example of a wide light distribution pattern $P_{Hi\ WIDE}$.
Figure 73C:
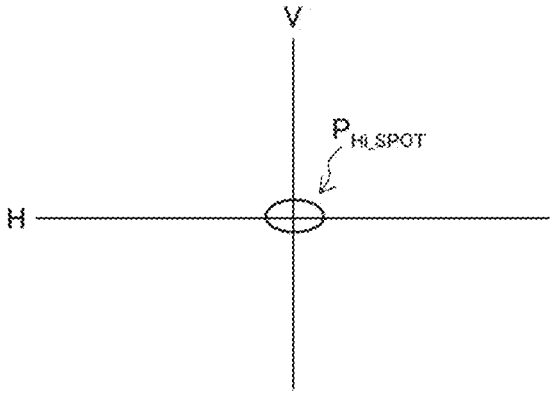
FIG. 73C is an example of a spot light distribution pattern $P_{Hi\ SPOT}$.

FIG. 72 A is a longitudinal sectional view of a vehicular lamp 60 (lens body 62), FIG. 72 B is a front view. In the example of FIG. 73 A, the high-beam light distribution pattern PHi formed by the vehicular lamp 60 (lens body 62) (combined light distribution pattern), each unit shown in FIG. 73 B, FIG. 73 C distribution light pattern PHi_SPOT, are formed by PHi_WIDE is superimposed. Light distribution pattern PHi_SPOT for spot corresponds to the light converging pattern of the present invention, the light distribution pattern PHi_WIDE for wide is equivalent to the diffusion pattern of the present invention.

As shown in FIG. 72, the vehicle lamp 60 of the present embodiment, the light source 14, includes a lens body 62 or the like disposed in front of the light source 14, approximately 25 m from directly facing a virtual vertical screen (vehicle front to the vehicle front on placement are) in the forward direction to form a light distribution pattern PHi for high beam, shown in FIG. 73 A.

Light source 14 is disposed at the rear end portion 62*a* near the lens body 62 in a posture toward the light emitting surface in front (reference point F62 near the optical design). Optical axis AX14 of the light source 14 may be coincident with the reference axis AX62 extending in the longitudinal direction of the vehicle, may be inclined with respect to the reference axis AX62.

Lens body 62 is a lens body disposed in front of the light source 14 includes a rear end portion 62*a*, the front end portion 62 *b*, the light from the lens body 62 *a* light source 14 which enters the interior, the front end portion 62 *b* (for Wide by being irradiated forward emitted from the exit surface 62*b*1 of the light distribution pattern and the exit surface 62*b*2 of the light distribution pattern for a spot), the lens body forming a light distribution pattern PHi for high beam, shown in FIG. 73 A It is configured as a. Lens body 62 is injected polycarbonate or transparent resin such as acrylic, cooling, (by injection molding) by solidifying are integrally formed.

The lens body 62, a light distribution pattern for wide was spreading from the light distribution pattern PHi_SPOT for spot PHi_WIDE the first optical system for forming an (FIG. 73 B reference), and, spot light distribution pattern PHi_SPOT (FIG. 73 C It includes a second optical system for forming a reference).

The rear end portion 62*a* of the lens body 62 is internally reflected light from the incident plane A, a light source 14 which enters the inner lens 62 from the incident plane A of the light distribution pattern for wide light distribution pattern wide (total reflection) and the reflecting surface 62*a*3 of the light distribution pattern for wide, the incident surface 62*a*5 of the light distribution pattern for a spot, and the light from the light source 14 incident from the incident surface 62*a*5 of the light distribution pattern for a spot inside the lens body 62 it includes a reflective surface 62*a*6 of the light distribution pattern for a spot to internal reflection.

As shown in FIG. 72 A, the incident plane A of the light distribution pattern for wide is first incident surface 62*a*1 of the convex toward the light source 14, from the outer peripheral edge of the first incident surface 62*a*1 extends rearward of the space between the light source 14 and the first incident surface 62*a*1, and includes a second entrance surface 62*a*2 cylindrical surrounding the range other than the notch portion 62*a*4 which light passes from the light source 14.

Reflective surface 62*a*3 of the light distribution pattern for wide is disposed outside of the second entrance surface 62*a*2, the inner surface reflects light from the light source 14 incident on the inner lens 62 from the second incident surface 62*a*2 (total reflection) for reflecting it is a surface.

Figure 74A:
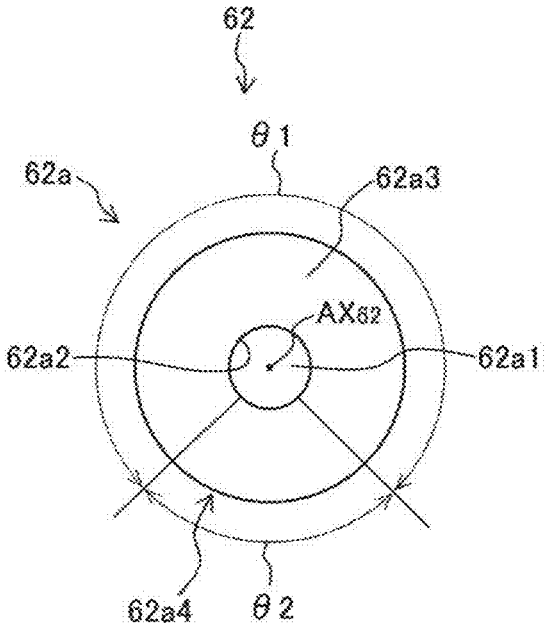
FIG. 74A is a front view of the rear end portion 62*a* (an area around the first entrance surface 62*a*1, the second entrance surface 62*a*2, and the reflection surface 62*a*3 for the wide light distribution pattern)
Figure 74B:
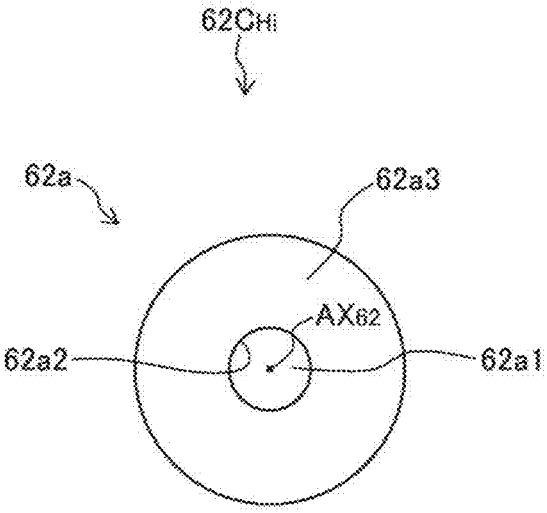
FIG. 74B is a front view of the rear end portion 62*a* (an area around the first entrance surface 62*a*1, the second entrance surface 62*a*2, and the reflection surface 62*a*3 for the wide light distribution pattern) of the lens body 72C, which is a modification of the lens body 72.

FIG. 74 A, the rear end portion 62*a* of the lens 62 is a front view of (a first incident surface 62*a*1, near the reflection surface 62*a*3 of the second incident surface 62*a*2 and the light distribution pattern wide).

Of the space between the light source 14 and the first incident surface 62*a*1, the range of the angle θ1 shown in FIG. 74 A is surrounded by a second incident surface 62*a*2 (and a reflective surface 62*a*3 of the light distribution pattern wide) are, the scope of the angle θ2 is not surrounded by the second incident surface 62*a*2 (and a reflective surface 62*a*3 of the light distribution pattern wide), constitutes the fan-shaped notched portion 62*a*4 which light from the light source 14 passes ing.

Figure 75:
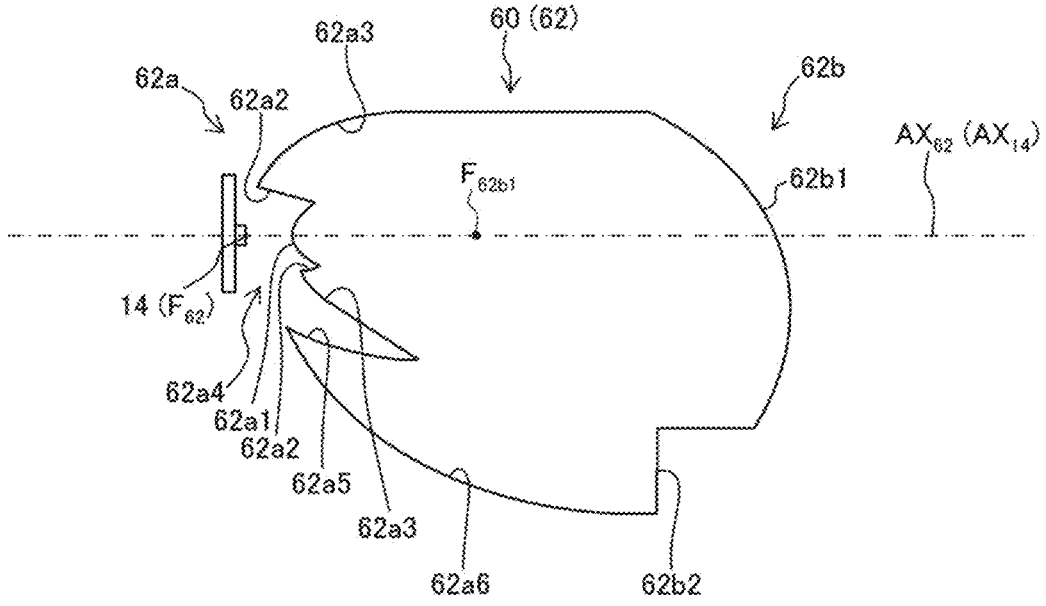
FIG. 75 is a longitudinal cross-sectional view of the lens body 62 (modification).

As shown in FIG. 75, the range of angle θ2 can be reference axis AX62 dimension is not surrounded by the relatively short second entrance surface 62*a*2 (and a reflective surface 62*a*3 of the light distribution pattern wide) good.

FIG. 72 A, the incident surface 62*a*5 of the light distribution pattern for a spot, the light incident concave toward a light source 14 incident on the inner lens 62 from the light source 14 that has passed through the notch portion 62*a*4 it is a surface.

Reflective surface 62*a*6 of the light distribution pattern for spots, the incident surface 62*a*5 of the light distribution pattern for a spot is located outside, from the light source 14 incident from the incident surface 62*a*5 of the light distribution pattern for a spot inside the lens body 62 internal reflection of the light is a reflecting surface (total reflection) to.

The front end portion of the lens body 62 62 *b* includes an exit surface 62*b*1 and exit surface 62*b*2 of the light distribution pattern arranged spots on the lower side of the light distribution pattern wide.

The first optical system for forming a wide light distribution pattern PHi_WIDE (see FIG. 73 B) is constructed as follows.

As shown in FIG. 72 A, the entrance surface A (a first incident surface 62*a*1 and the second incidence surface 62*a*2) of the light distribution pattern for wide, reflecting surface 62*a*3 of the light distribution pattern for wide, and, distribution for wide exit surface 62*b*1 for optical pattern, light, distribution for wide from the incident plane a (first incident surface 62*a*1 and the second incidence surface 62*a*2) light source 14 which enters the inner lens 62 from the light distribution pattern for a wide emitted from the exit surface 62*b*1 for optical pattern, it constitutes a first optical system for forming a light distribution pattern PHi_WIDE for wide is emitted forward.

Specifically, the first incident surface 62*a*1, the second incident surface 62*a*2, reflective surface 62*a*3 of the light distribution pattern wide and, the exit surface 62*b*1 of the light distribution pattern for wide, a lens body from the first entrance surface 62*a* 62 the light from the light source 14 incident on the inside, and, from the second entrance surface internal reflection at the reflective surface 62*a*3 of the light distribution pattern for a wide incident inside the lens body 62 from 62*a* (total reflection) light sources 14 light is emitted from the emitting surface 62*b*1 of the light distribution pattern for wide, it constitutes a first optical system for forming a light distribution pattern PHi_WIDE for wide is emitted forward.

Exit surface 62*b*1 of the light distribution pattern for wide, the cylinder axis is formed as a horizontal semi-cylindrical surfaces (cylindrical surface) which extends (FIG. 72 A the direction perpendicular to the medium paper). Focal line of the exit surface 62*b*1 of the light distribution pattern for wide is the FIG. 72 A, and extends in the horizontal direction at a position indicated by reference numeral F62*b*1 (FIG. 72 A the direction perpendicular to the medium paper). Of course, not limited to this, the exit surface 62*b*1 of the light distribution pattern for wide may be configured as a slant angle and/or the surface of the semi-cylindrical camber angle is imparted (cylindrical surface).

Figure 76A:
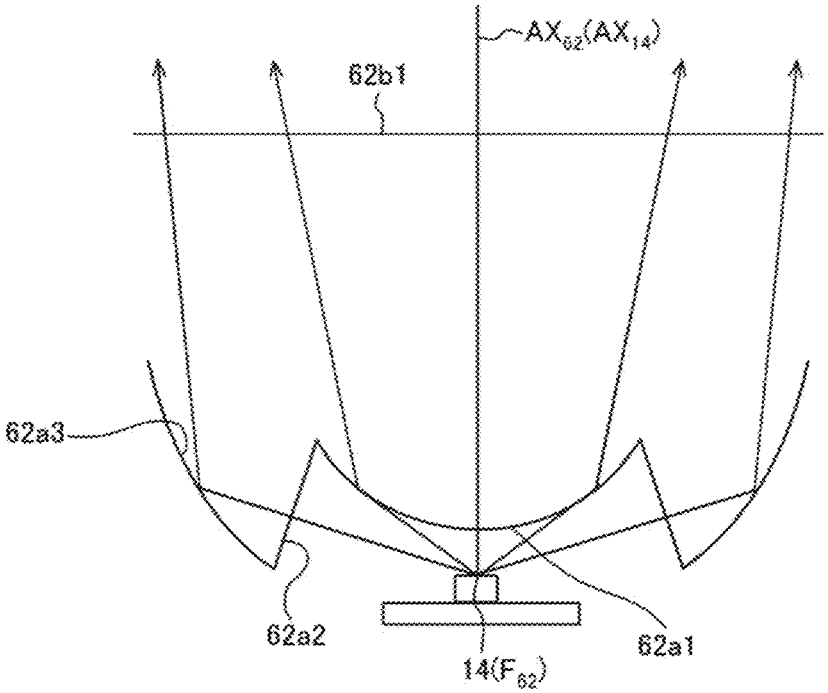
FIG. 76A is a diagram depicting a state when the light from the light source 14, which enters the lens body 62 through the entrance surface A (first entrance surface 62*a*1 and second entrance surface 62*a*2) for a wide light distribution pattern, is diffused in the horizontal direction.
Figure 76B:
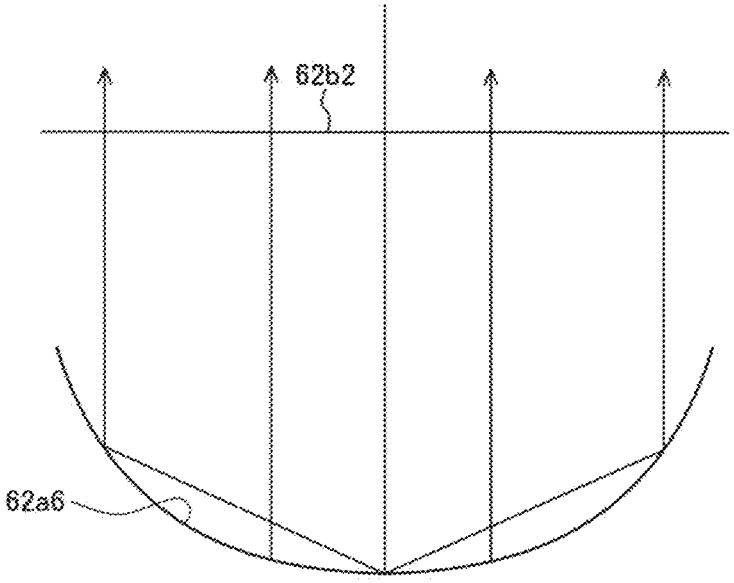
FIG. 76B is a diagram depicting a state when the light from the light source 14, which enters the lens body 62 through the entrance surface 62*a*5 for a spot light distribution pattern, is internally reflected on the reflection surface 62*a*6 for the spot light distribution pattern, and is collimated.

The first incident surface 62*a*1 is a plane light from the light source 14 is incident on the inner lens 62 is refracted, the surface of the curved convex toward the light source 14 (e.g., free-form surface) is constructed as a. Specifically, the first incident surface 62*a*1 is the light from the first incident surface 62*a*1 light source 14 which enters the inner lens 62 from and relates to the vertical direction, the focal line of the exit surface 62*b*1 of the light distribution pattern for a wide F62*b*1 was condensed near (see FIG. 72 A), and relates to a horizontal direction, the diffusion (see FIG. 76 A) as (or as collimated), the surface shape is configured there.

The second incident surface 62*a*2 is a plane light which does not enter the first entrance surface 62*a*1 is incident on the inner lens 62 is refracted out of the light from the light source 14, rearward from the outer peripheral edge of the first incident surface 62*a*1 extending out of the space between the light source 14 and the first incident surface 62*a*1, a cylindrical surface surrounding a range other than the notch portion 62*a*4 which light passes from the light source 14 (e.g., free-form surface) is configured as there.

Reflective surface 62*a*3 of the light distribution pattern for wide is disposed outside of the second entrance surface 62*a*2, the surface of internal reflection (total internal reflection) of light from the light source 14 incident on the inner lens 62 from the second incident surface 62*a*2 It is configured as a. Reflective surface 62*a*3 of the light distribution pattern for wide is a reflection surface for internal reflection (total internal reflection) of light from the light source 14 incident on the inner lens 62 from the second incident surface 62*a*2, metal deposition is not used. Specifically, the reflective surface 62*a*3 of the light distribution pattern for wide is incident on the inner lens 62 from the second incident surface 62*a*2 internally reflected by the reflecting surface 62*a*3 of the light distribution pattern for the wide (total reflection) light from the light source 14 relates to the vertical direction, and condensed near focal lines F62*b*1 of the exit surface 62*b*1 of the light distribution pattern wide (see FIG. 72 A), and relates to a horizontal direction, the diffusion (FIG. 76 A refer) as (or as collimated), the surface shape is formed.

The first optical system configured as described above, onto a virtual vertical screen, the light distribution pattern PHi_WIDE for wide shown in FIG. 73 B is formed.

That is, the light from the light source 14 incident on the inner lens body 62 from the first incident surface 62*a*1, and, internal reflection at the reflective surface 62*a*3 of the light distribution pattern for a wide incident on the inner lens 62 from the second incident surface 62*a*2 light from (total reflection) light sources 14 is directed to a vertical direction, after condensing in the vicinity focal lines F62*b*1 of the exit surface 62*b*1 of the light distribution pattern wide (see FIG. 72 A), the wide light distribution It is emitted from the exit surface 62*b*1 of the pattern. At that time, the light from the light source 14 emitted from the emitting surface 62*b*1 of the light distribution pattern for wide by the action of the exit surface 62*b*1 of the light distribution pattern for wide, is collected relates vertical direction, with respect to the reference axis AX62 parallel on, and, by being emitted forward as light diffused respect horizontal direction to form a light distribution pattern PHi_WIDE for wide shown in FIG. 73 B.

Spot light distribution pattern PHi_SPOT second optical system for forming (FIG. 73 C reference), is constructed as follows.

As shown in FIG. 72 A, the incident surface 62*a*5 of the light distribution pattern for a spot, reflective surface 62*a*6 of the light distribution pattern for a spot, and the exit surface 62*b*2 of the light distribution pattern for spot light distribution for spots from the incident surface 62*a*5 of the pattern is incident on the inner lens 62 is the light from the light source 14 which is internally reflected by the reflecting surface 62*a*6 of the light distribution pattern for a spot, emitted from the exit surface 62*b*2 of the light distribution pattern for a spot constitute a second optical system for forming a light distribution pattern PHi_SPOT for spot is irradiated forward.

Specifically, the incident surface 62*a*5 of the light distribution pattern for a spot, reflective surface 62*a*6 of the light distribution pattern for a spot, and the exit surface 62*b*2 of the light distribution pattern for spot passes through the cutout portion 62A4, spot internal reflection at the reflective surface 62*a*6 of the incident from the incident surface 62*a*5 for use light distribution pattern inside the lens body 62 for light distribution pattern for a spot light from a (total reflection) light sources 14, a light distribution pattern for a spot and of the exit from the exit surface 62*b*2, it is irradiated to the front form a second optical system for forming a light distribution pattern PHi_SPOT for the spot.

Figure 77:
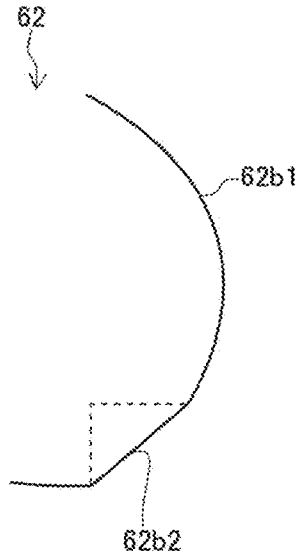
FIG. 77 is a longitudinal cross-sectional view of the emission surface 62*b*2 (modification) for the spot light distribution pattern.

Exit surface 62*b*2 of the light distribution pattern for spot is configured as a surface of a planar shape orthogonal to the reference axis AX62. Of course, not limited to this, the exit surface 62*b*2 of the light distribution pattern for a spot may be configured as a surface of a curved surface. Also, exit surface 62*b*2 of the light distribution pattern for spots, as shown in FIG. 77, be configured as a surface of a planar shape or a curved shape continuous with the lower edge of the exit surface 62*b*1 of the light distribution pattern for a wide good.

Exit surface 62*b*2 of the light distribution pattern for spot is located behind the position from the output surface 62*b*1 of the light distribution pattern wide (see FIG. 72 A). Of course, not limited to this, the exit surface 62*b*2 of the light distribution pattern for spots, arranged in a same position as the exit surface 62*b*1 of the light distribution pattern forward position or wide from the output surface 62*b*1 of the light distribution pattern for a wide it may be.

Incident surface 62*a*5 of the light distribution pattern for spots, a plane light from the light source 14 is incident on the inner lens 62 is configured as a surface of a concave curved shape towards the light source 14. Specifically, the incident surface 62*a*5 of the light distribution pattern for spots (more accurately, a reference point F 62) the light source 14 is configured as a surface of a spherical shape centered. Thus, light from the light source 14 can be prevented from Fresnel reflection loss at the time of entering the inner lens 62 from the incident surface 62*a*5 of the light distribution pattern for a spot. Of course, not limited to this, the incident surface 62*a*5 of the light distribution pattern for spots, surfaces other than the surface of the spherical shape centered on the light source 14 (e.g., free-form surface) may be configured as a.

Reflective surface 62*a*6 of the light distribution pattern for spots, the incident surface 62*a*5 of the light distribution pattern for a spot is located outside, from the light source 14 incident from the incident surface 62*a*5 of the light distribution pattern for a spot inside the lens body 62 internal reflection of the light is configured as a (total reflection) surfaces. Reflective surface 62*a*6 of the light distribution pattern for spot, a reflective surface for internal reflection of light from the light source 14 incident on the inner lens 62 from the incident surface 62*a*5 of the light distribution pattern for a spot (total reflection), the metallized not used. Specifically, the reflective surface 62*a*6 of the light distribution pattern for spots, internal reflection is incident on the inner lens 62 from the incident surface 62*a*5 of the light distribution pattern for a spot on the reflecting surface 62*a*6 of the light distribution pattern for that spot (total reflection) is, light from the light source 14 emitted from the emitting surface 62*b*2 of the light distribution pattern for spot relates to a vertical direction is collimated (see FIG. 72 A), and is collimated regard horizontally as (FIG. 76 B refer), the surface shape is formed. As the reflective surface 62*a*6 of the light distribution pattern for a spot, for example, focus (to be exact, the reference point F 62) the light source 14 can be used a reflecting surface of the parabolic system set in the vicinity.

The second optical system configured as described above, on a virtual vertical screen, the spot light distribution pattern PHi_SPOT shown in FIG. 73 C is formed.

That is, the cutout portion passes through 62A4, internal reflection (total internal reflection) incident from the incident surface 62*a*5 of the light distribution pattern for a spot on the inner lens 62 by the reflecting surface 62*a*6 of the light distribution pattern for spot light sources 14 light from relates vertical and horizontal directions, after being collimated and emitted from the exit surface 62*b*2 of the light distribution pattern for a spot. At this time, since the light from the light source 14 emitted from the emitting surface 62*b*2 of the light distribution pattern for a spot, which is configured as a surface of a planar shape exit surface 62*b*2 of the light distribution pattern for a spot is perpendicular to the reference axis AX62 relates the vertical and horizontal directions, by being emitted forward as light parallel to the reference axis AX62, to form a light distribution pattern PHi_SPOT for spot shown in FIG. 73 C.

Light distribution pattern PHi_SPOT for spots, focused than light distribution pattern PHi_WIDE for wide, and, becomes luminous intensity is high. As a result, high-beam light distribution pattern PHi formed by light distribution pattern PHi_SPOT and wide light distribution pattern PHi_WIDE for spot is superimposed (synthesized light distribution pattern), high center luminous intensity, excellent in long-distance visibility It becomes a thing.

The becomes light distribution pattern PHi_SPOT for spot condensed from the light distribution pattern PHi_WIDE for Wide, wide light distribution pattern PHi_WIDE is parallel to the reference axis AX62 relates vertical direction and diffused relates horizontally for being formed of a light, it relates the vertical and horizontal directions spot light distribution pattern PHi_SPOT, is due to be formed by the light parallel to the reference axis AX62.

The intensity of the light distribution pattern PHi_SPOT for spot is higher than the light distribution pattern PHi_WIDE for wide, the light source 14 and the reflective surface 62*a*6 of the light distribution pattern for a spot (and/or the incident surface 62*a*5 of the light distribution pattern for a spot) the distance between the, compared to the distance between the light source 14 and the reflecting surface 62*a*3 of the light distribution pattern wide (and/or the incident surface 62*a*1,62*a*2 the light distribution pattern wide), because they are longer in the second optical system for forming a light distribution pattern PHi_SPOT for spot, compared to the first optical system for forming a light distribution pattern PHi_WIDE for wide, the light source image of the light source 14 becomes relatively small, the relatively is by light distribution pattern PHi_SPOT for spot is formed with a small light source image.

That is, as shown in FIG. 72 A, in the first optical system a distance W is relatively close between the light source 14 and the reflecting surface 62*a*3 of the light distribution pattern for wide, the light source image of the light source 14 is large because it is suitable for a wide light distribution pattern PHi_WIDE. Meanwhile, in the distance S is relatively far second optical system between the light source 14 and the reflecting surface 62*a*6 of the light distribution pattern for a spot, since the light source image of the light source 14 is reduced, the spot light distribution pattern PHi_SPOT Are suitable.

Incidentally, by adjusting the angle θ1 and θ2 shown in FIG. 74 A, it is possible to balance the intensity of the luminous intensity and a wide light distribution pattern PHi_WIDE light distribution pattern PHi_SPOT for spot.

Figure 78:
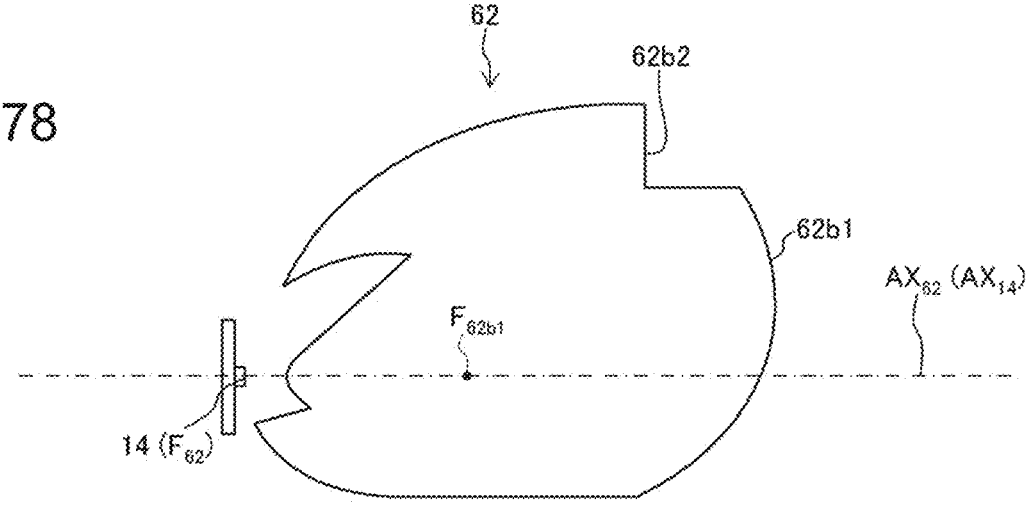
FIG. 78 is a longitudinal cross-sectional view of the lens body 62 (modification).

The lens body 62 of the present embodiment, as shown in FIG. 78 may be used upside down.

According to the present embodiment can achieve the following effects.

That is, it is possible to provide a lens body 62 which can form one at the spot light distribution pattern PHi_SPOT and wide light distribution pattern PHi_WIDE is superimposed high beam distribution pattern PHi (combined light distribution pattern).

This is one of the lens body 62 is by that it comprises a second optical system for forming a first optical system and the light distribution pattern PHi_SPOT for spot light distribution pattern is formed PHi_WIDE for wide.

Further, according to this embodiment, as a result of the luminous intensity of the light distribution pattern PHi_SPOT for spot is higher than the light distribution pattern PHi_WIDE for wide, it is formed by the light distribution pattern PHi_SPOT and wide light distribution pattern PHi_WIDE for spot is superimposed that high-beam light distribution pattern PHi (the combined light distribution pattern), high center luminosity can be made excellent in long-distance visibility.

The intensity of the light distribution pattern PHi_SPOT for spot is higher than the light distribution pattern PHi_WIDE for wide, the light source 14 and the reflective surface 62*a*6 of the light distribution pattern for a spot (and/or the incident surface 62*a*5 of the light distribution pattern for a spot) the distance between the, compared to the distance between the light source 14 and the reflecting surface 62*a*3 of the light distribution pattern wide (and/or the incident surface 62*a*1,62*a*2 the light distribution pattern wide), because they are longer in the second optical system for forming a light distribution pattern PHi_SPOT for spot, compared to the first optical system for forming a light distribution pattern PHi_WIDE for wide, the light source image of the light source 14 becomes relatively small, the relatively is by light distribution pattern PHi_SPOT for spot is formed with a small light source image.

Next, a description will be given of the lens body 62A is a modification of the lens body 62.

Figure 79:
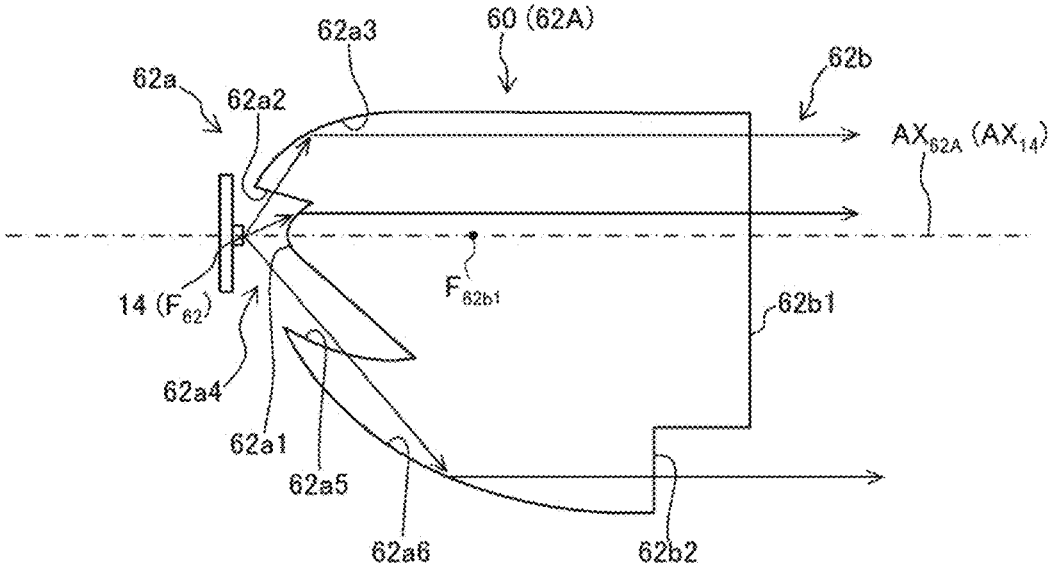
FIG. 79 is a longitudinal cross-sectional view of the lens body 62A (modification).

FIG. 79 is a longitudinal sectional view of a lens body 62A.

In the lens body 62A of this modification, the exit surface 62*b*1 of the light distribution pattern for wide is configured as a surface of a planar shape.

The first incident surface 62*a*1, the light from the light source 14 emitted from the emitting surface 62Ab1 for light distribution pattern for a wide incident from the first incident surface 62*a*1 inside the lens body 62A is relates to the vertical direction, the collimated and it relates to a horizontal direction, so as to diffuse, the surface shape is formed. Further, the reflecting surfaces 62*a*3 of the light distribution pattern for wide is incident from the second entrance surface 62*a* inside the lens body 62A internal reflection at the reflective surface 62*a*3 of the light distribution pattern for the wide (total reflection), for a wide light from the light source 14 emitted from the emitting surface 62*a*1 of the light distribution pattern relates vertical direction is collimated, and relates to a horizontal direction, so as to diffuse, the surface shape is formed. Otherwise, the same configuration as the lens body 62 of the ninth embodiment.

By lens body 62A of the present modification can achieve the same effect as the ninth embodiment.

Next, a description will be given of the lens body 62B is a modification of the lens body 62.

Figure 80:
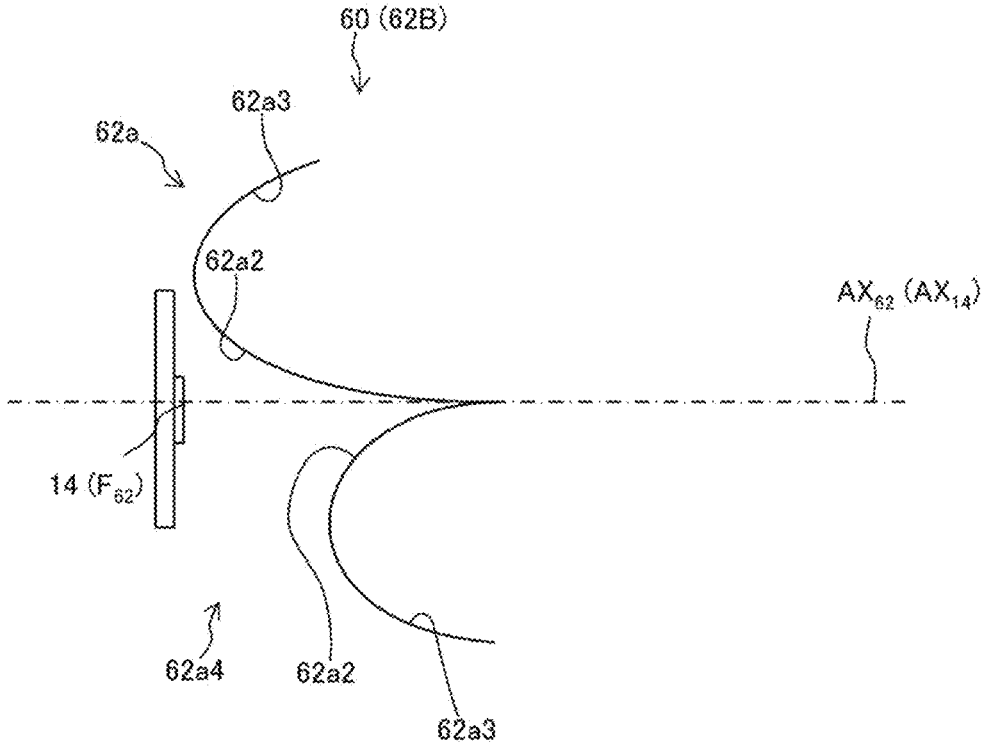
FIG. 80 is a longitudinal cross-sectional view of the rear end portion 62*a* of the lens body 62B (modification).

FIG. 80 is a longitudinal sectional view of the rear end portion 62*a* of the lens body 62B.

In the lens body 62B of this modification, the first incident surface 62*a*1 is omitted. That is, the incident plane A of the light distribution pattern for wide is constituted only by the second entrance surface 62*a*. Otherwise, the same configuration as the lens body 62 of the ninth embodiment.

By lens body 62B of this modification, it is possible to achieve the same effect as the ninth embodiment.

Next, a tenth embodiment, a vehicle lamp 70 to form a light distribution pattern or a high beam light distribution pattern for low beam (the lens body 72) will be described with reference to the drawings.

Vehicle lamp 70 of the present embodiment (the lens body 72) is constructed as follows.

Figure 81A:
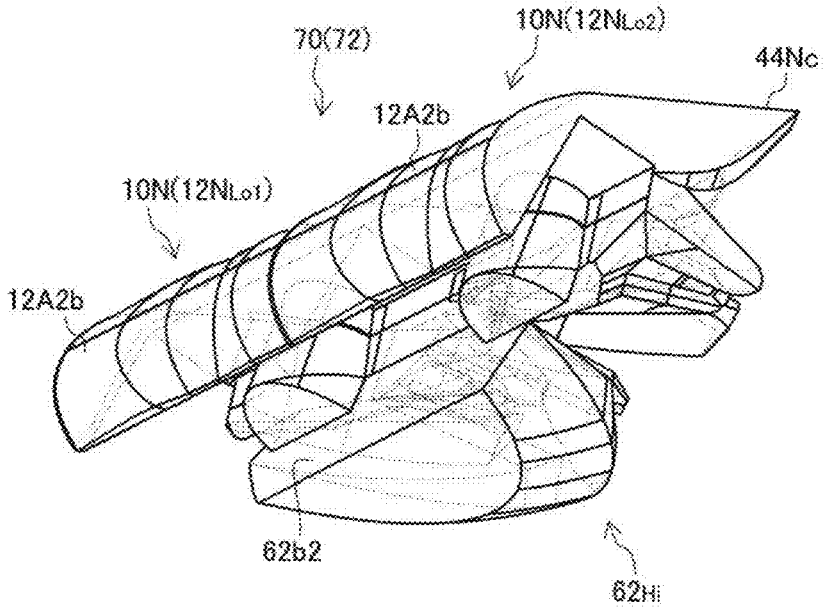
FIG. 81A is a perspective view of the vehicular lighting fixture 70 (lens body 72) viewed from the diagonally lower front side.
Figure 81B:
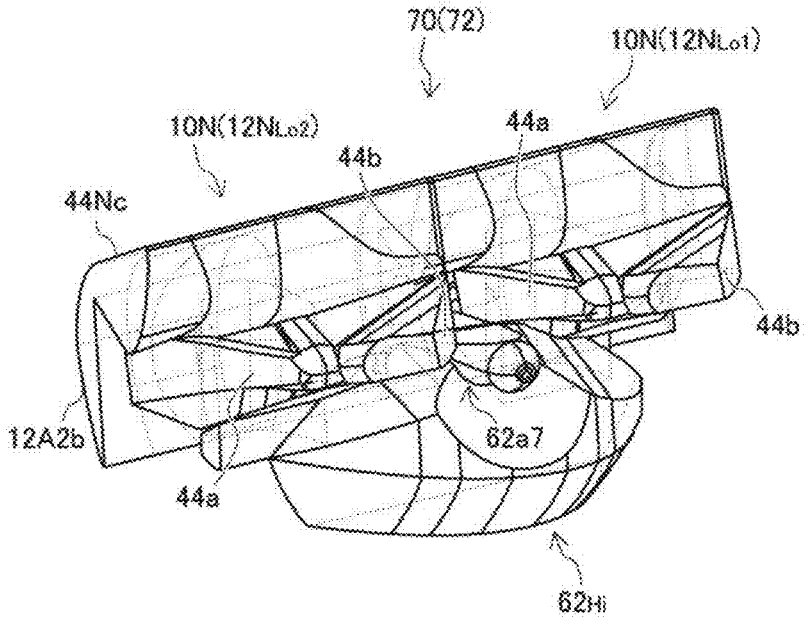
FIG. 81B is a perspective view of the vehicular lighting fixture 70 (lens body 72) viewed from the diagonally lower back side.
Figure 83:
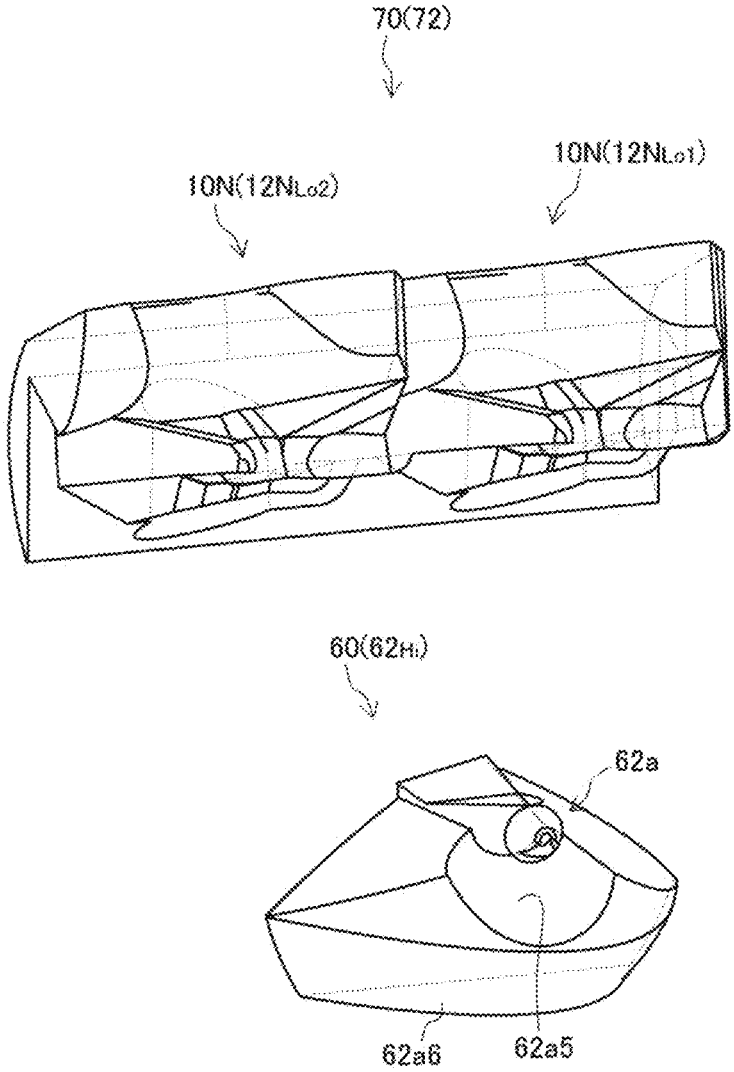
FIG. 83 is an exploded perspective view of the vehicular lighting fixture 70 (lens body 72).

Perspective view from the front and obliquely downward in FIG. 81 A is the vehicle lamp 70 (lens body 72), in a perspective view seen from the rear obliquely upward of FIG. 81 B is a vehicle lamp 70 (lens body 72) is there. FIG. 82 A is a top view, FIG. 82 B is a front view, FIG. 82 C is a side view. FIG. 83 is an exploded perspective view of the vehicular lamp 70 (lens body 72).

As shown in FIG. 81 to FIG. 83, the vehicle lamp 70 of the present embodiment (the lens body 72), two of the eighth embodiment of a vehicular lamp 10 N (lens body 12N) and one vehicle of the ninth embodiment It corresponds to one with use lamp 60 (the lens body 62).

Hereinafter, one of the lens body 12N referred to as a first lens portion 12NLo1 (corresponding to the first lens unit for a low-beam of the present invention), a second low-beam of the other lens member 12N second lens unit 12NLo2 (present invention corresponding to the lens portion) and called, referred to as a lens body 62 third lens unit 62Hi (corresponding to the third lens unit of the high beam of the present invention).

Lens body 72 (12NLo1,12NLo2,62Hi) injects polycarbonate or transparent resin such as acrylic, cooling, (by injection molding) by solidifying are integrally formed. That is, each lens portion 12NLo1,12NLo2,62Hi, by being integrally molded and connected to each other without passing through the interface.

The first and second lens portions 12NLo1,12NLo2 has the same configuration as the lens body 12N shown in FIG. 63. That is, the first and second lens portions 12NLo1, 12NLo2, as shown in FIG. 82 A or the like, a lens unit disposed in front of the first light source 14Lo1 and the second light source 14Lo2 for low beam for a low-beam on, respectively, includes a rear end 12A1*aa* and front end 12A2*bb*, light from each light source 14Lo1,14Lo2 incident inside each lens unit 12NLo1,12NLo2 is, the front end portion 12A2*bb* of each lens unit 12NLo1,12NLo2 (No. by being irradiated forward emitted from the second output face 12A2*b*), it is constructed as a lens unit which forms a low beam light distribution pattern PLo reference (FIG. 64 A) including a cutoff line on an upper edge.

FIG. 82 B region AA1 enclosed by one-dot chain line in the area where light from the first light source 14Lo1 and the second light source 14Lo2 to form the low beam light distribution pattern PLo (see FIG. 64 A) is emitted shows.

The rear end portion 12A1*aa* of the first and second lens portions 12NLo1,12NLo2, respectively, the cone-shaped toward the front end side of the rear end portion 12A1*aa* from the front end 12A2*bb* side of each lens portion 12NLo1,12NLo2 (or bell shape) conical section narrowing in (in FIG. 82 A, a pair of left and right side faces 44*a*, partial reference, including 44*b*) includes a.

The first and second lens portions 12NLo1,12NLo2 the FIG. 82 B, as shown in FIG. 82 C, are arranged in parallel in a direction inclined relative to the horizontal, and, as shown in FIG. 82 A the space between the conical portion of the first lens unit 12NLo1 (first corresponding to the cone portion of the present invention) and the conical portion of the second lens body 12NLo2 (corresponding to the second cone portion of the present invention) They are connected to each other in a state but which are formed. Of course, the invention is not limited to this, the first lens unit 12NLo1 and the second lens unit 12NLo2 may be linked to each other are arranged in parallel in the horizontal direction.

The first and second lens portions 12NLo1,12NLo2 the portion where the optical function of the first lens unit 12NLo1 is not intended (e.g., left side) and the optical function of the second lens unit 12NLo2 is not intended location (e.g., right side) and are connected (see FIG. 81 B).

Front end 12A2*bb* of the first and second lens portions 12NLo1,12NLo2 includes slant angle and/or exit surface of semicylindrical the camber angle is applied (the second emission surface 12A2*b*). Of course, not limited to this, the front end portion 12A2*bb* of the first and second lens portions 12NLo1,12NLo2 may include emitting surface of the semicircular columnar cylinder axis extending in the horizontal direction (second output surface 12A2*b*).

Light distribution pattern for low beam, by the first light source 14Lo1 and the second light source 14Lo2 for low beam for low beam is turned on, the low beam light distribution pattern PLo formed by each lens unit 12NLo1, 12NLo2 (FIG. 64 (*a*)) is formed as a synthesized light distribution pattern superimposed.

The third lens unit 62Hi has the same structure as the lens body 62 shown in FIG. 72 A. However, the front end portion of the third lens unit 62Hi the FIG. 72 differs from the lens body 62 shown in A, the rear end portion 12A1*aa* and the rear end portion of the second lens portion 12NLo2 of the first and second lens portions 12NLo1,12NLo2 is connected to 12A1*aa* (see FIG. 81 B). Otherwise, the third lens unit 62Hi has the same structure as the lens body 62 shown in FIG. 72 A.

Figure 84A:
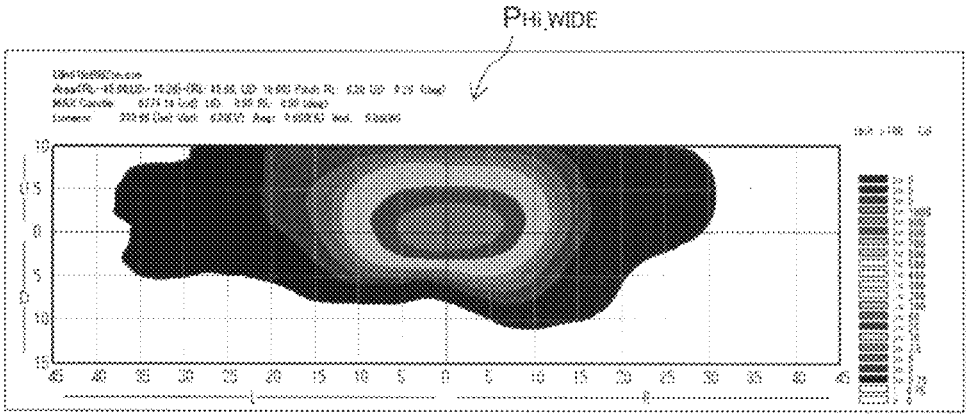
FIG. 84A is an example of a wide light distribution pattern $P_{Hi\ WIDE}$ formed by the vehicular lighting fixture 70 (lens body 72)
Figure 84B:
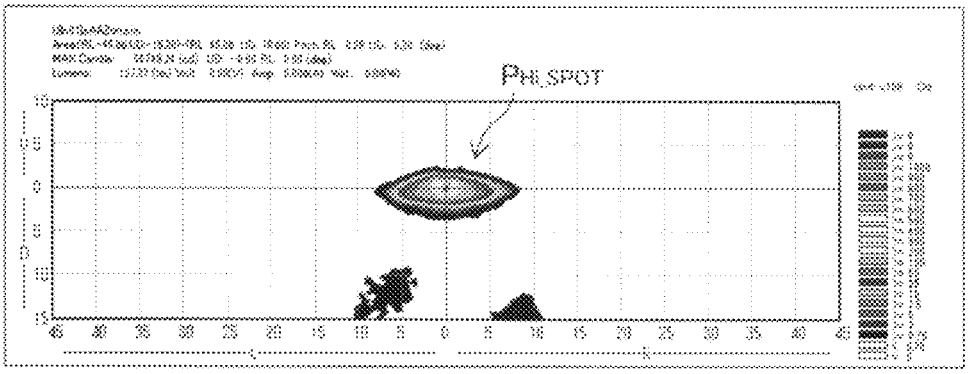
FIG. 84B is an example of a spot light distribution pattern $P_{Hi\ SPOT}$ formed thereby.

The third lens unit 62Hi, as shown in FIG. 82 A or the like, a lens unit disposed in front of the third light source 14Hi for high beam, a third light source 14Hi incident inside the third lens unit 62Hi light from the by being irradiated forward emitted from the front end of the first and second lens portions 12NLo1,12NLo2 12A2*bb* (second output surface 12A2*b*), FIG. 84 A, FIG. 84 B each unit distributed light pattern PHi_SPOT shown, PHi_WIDE is configured as a lens body forming a light distribution pattern for high beam PHi superimposed (synthesized light distribution pattern).

Region surrounded by a two-dot chain line in FIG. 82 in B AA2 represents a region where light from the third light source 14Hi to form a wide light distribution pattern PHi_WIDE for high beam (see FIG. 84 A) is emitted ing. Region AA3 surrounded by a solid line in FIG. 82 in B shows a region where light is emitted from the third light source 14Hi to form a spot light distribution pattern PHi_SPOT for high beam (see FIG. 84 B).

As shown in FIG. 81 B, the third lens unit 62Hi it is at least partially disposed in the space between the cone body and the cone portion of the second lens portion 12NLo2 of the first lens unit 12NLo1 in state point where optical function of the rear end portion 12A1*aa* of the rear end portion 12A1*aa* and the second lens portion 12NLo2 of the first lens unit 12NLo1 is not intended (for example, the rear end portion of the first lens unit 12NLo1 12A1*aa* and the the connecting portion) of the rear end portion 12A1*aa* two lens portions 12NLo2, each of the conical body portion (particularly, a pair of left and right side faces 44*a*, which is connected in a form that does not interfere with 44*b*).

Figure 85:
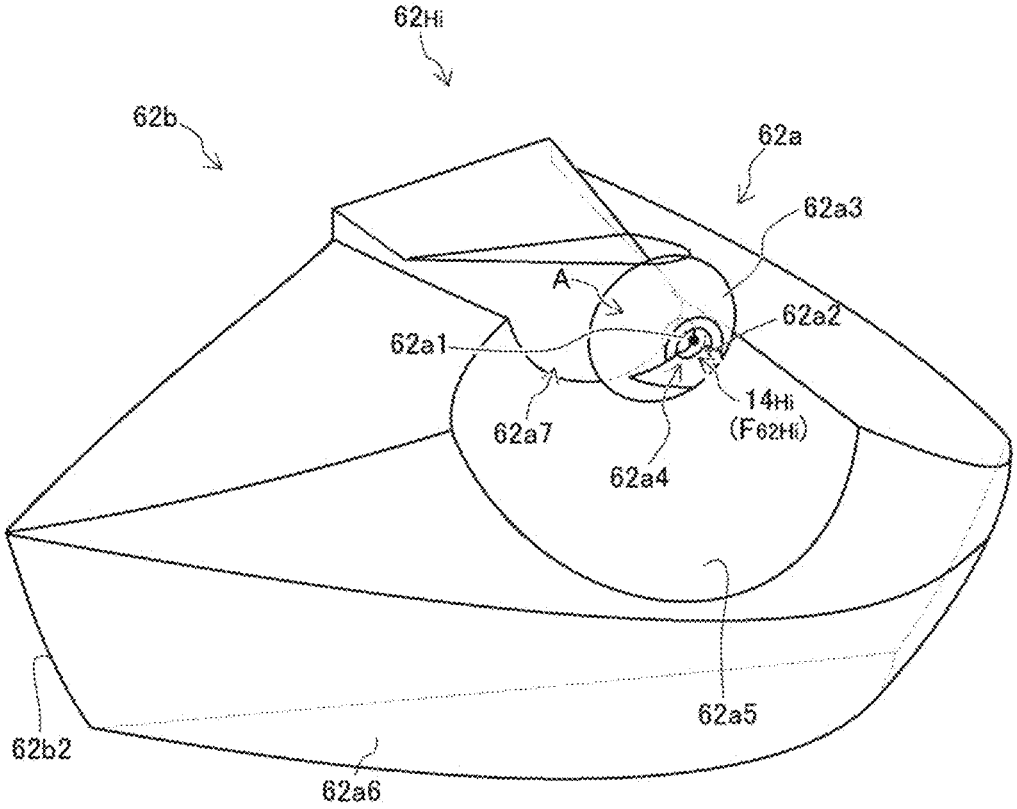
FIG. 85 is a perspective view of the third lens unit $\mathbf{62}_{Hi}$ viewed from the diagonally upper back side.
Figure 86:
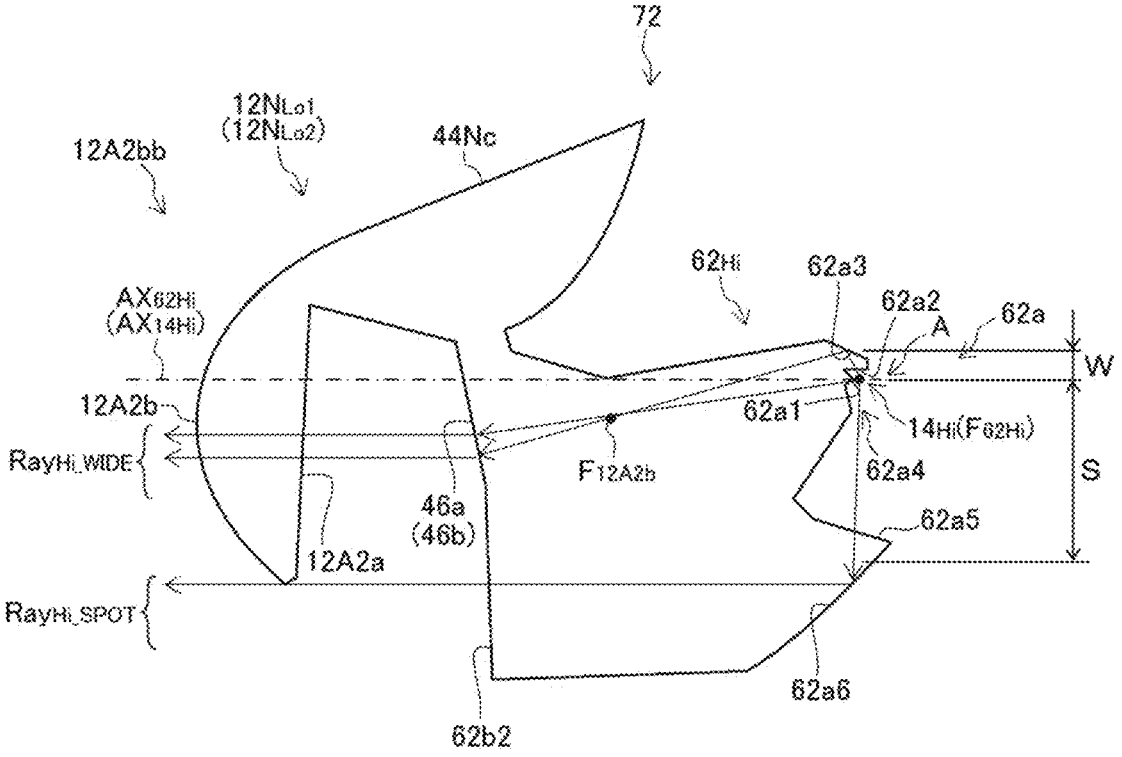
FIG. 86 is a longitudinal cross-sectional view (schematic diagram) of the lens body 72.

FIG. 85 is a perspective view from the rear obliquely upward of the third lens unit 62Hi. FIG. 86 is a longitudinal sectional view of the lens body 72 (schematic diagram).

FIG. 85, as shown in FIG. 86, the rear end portion 62*a* of the third lens unit 62Hi has the same structure as the lens body 62 shown in FIG. 72 A. That is, the rear end portion 62*a* of the third lens unit 62Hi the incident plane A of the light distribution pattern for wide, from a third light source 14Hi incident inside the third lens unit 62Hi from the entrance surface A of the light distribution pattern for a wide of the reflecting surface 62*a*3 of the light distribution pattern for wide to internal reflection of light, the incident surface 62*a*5 of the light distribution pattern for the spot, and was incident from the incident surface 62*a*5 of the light distribution pattern for a spot inside the third lens portion 62Hi the light from the third light source 14Hi includes a reflective surface 62*a*6 of the light distribution pattern for a spot to internal reflection.

Incident plane A of the light distribution pattern for wide, the third light source 14Hi first entrance surface 62*a*1 of the convex shape toward the, from the outer peripheral edge of the first incident surface 62*a*1 extending toward the rear, the third light source 14Hi a first of the space between the incident surface 62*a*1, and includes a second entrance surface 62*a*2 cylindrical surrounding the range other than the notch portion 62*a*4 which light passes from the third light source 14Hi.

Reflective surface 62*a*3 of the light distribution pattern for wide is disposed outside of the second entrance surface 62*a*2, the inner surface reflects light from the third light source 14Hi incident from the second incident surface 62*a*2 inside the third lens unit 62Hi reflection it is a surface.

Incident plane A (first incident surface 62*a*1 and the second incident surface 62*a*2) and a reflective surface 62*a*3 of the light distribution pattern for wide light distribution pattern wide, as shown in FIG. 81 B, as shown in FIG. 85, the 1 the rear end 12A1*aa* of the lens portion 12NLo1 and rear ends 12A1*aa* of the second lens unit 12NLo2 is disposed at the distal end portion of the extension portion 62*a*7 extending rearward from the connecting portion.

Incidentally, omitted extension 62A7, the portion near the trailing end 12A1*aa* are connected at the rear end 12A1*aa* and the second lens portion 12NLo2 of the first lens unit 12NLo1, the incident plane A of the light distribution pattern wide (the it is also possible to place a 1-incident surface 62*a*1 and the second incident surface 62*a*2) and a reflective surface 62*a*3 of the light distribution pattern for a wide (cone portion of the first lens portion 12NLo1 and of the cone portion of the second lens portion 12NLo2 in a space between, when the third light source 14Hi and which can be arranged board mounted).

Among them, the reflecting surface for the light distribution pattern similar range of angle θ1 is for the second incident surface 62*a*2 (and wide to that shown in FIG. 74 A of the space between the third light source 14Hi a first entrance surface 62*a*1 Although surrounded by 62A3), the range of the angle θ2 is not surrounded by the second incident surface 62*a*2 (and a reflective surface 62A3 of the light distribution pattern wide), fan-shaped light from the third light source 14Hi passes constitute a notch 62*a*4. Incidentally, in the same manner as shown in FIG. 75, the range of angle θ2, the dimensions of the reference axis AX62Hi direction are surrounded by relatively short second entrance surface 62*a*2 (and a reflective surface 62*a*3 of the light distribution pattern wide) it may be.

Incident surface 62*a*5 of the light distribution pattern for spot is incident surface of the concave light from the third light source 14Hi which has passed through the cutout portion 62*a*4 toward the third light source 14Hi incident inside the third lens unit 62Hi.

Reflective surface 62*a*6 of the light distribution pattern for a spot is disposed outside of the entrance surface 62*a*5 of the light distribution pattern for a spot, a third incident from the incident surface 62*a*5 of the light distribution pattern for a spot inside the third lens unit 62Hi the light from the light source 14Hi is a reflective surface to internal reflection.

As shown in FIG. 82 B, FIG. 82 C, the front end portion of the third lens unit 62Hi the first and second lens portions 12NLo1,12NLo2 front end 12A2*bb* of (semicylindrical exit surface 12A2*b*) it includes exit surface 62*b*2 of the light distribution pattern for a spot which is arranged downward.

The first optical system for forming a wide light distribution pattern PHi_WIDE (see FIG. 84 A) is constructed as follows.

Figure 87A:
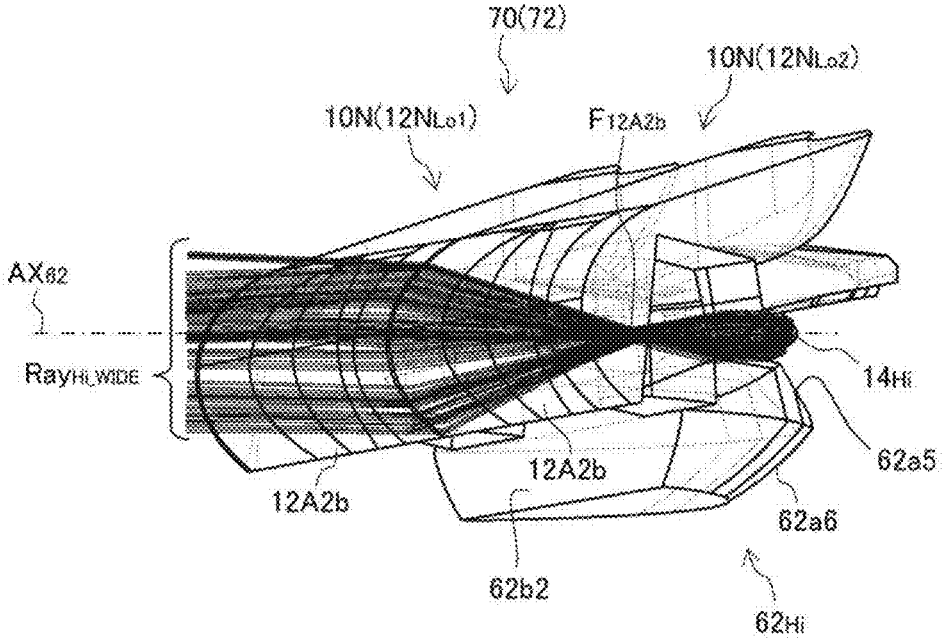
FIG. 87A is a side view depicting a state when the light $Ray_{Hi\ WIDE}$ from the third light source $\mathbf{14}_{Hi}$, which entered the third lens unit $\mathbf{62}_{Hi}$, is emitted from the front end portion 12A1*bb* (semi-cylindrical emission surface 12A2*b*) of the first and second lens units $\mathbf{12N}_{Lo1}$ and $\mathbf{12N}_{Lo2}$.
Figure 87B:
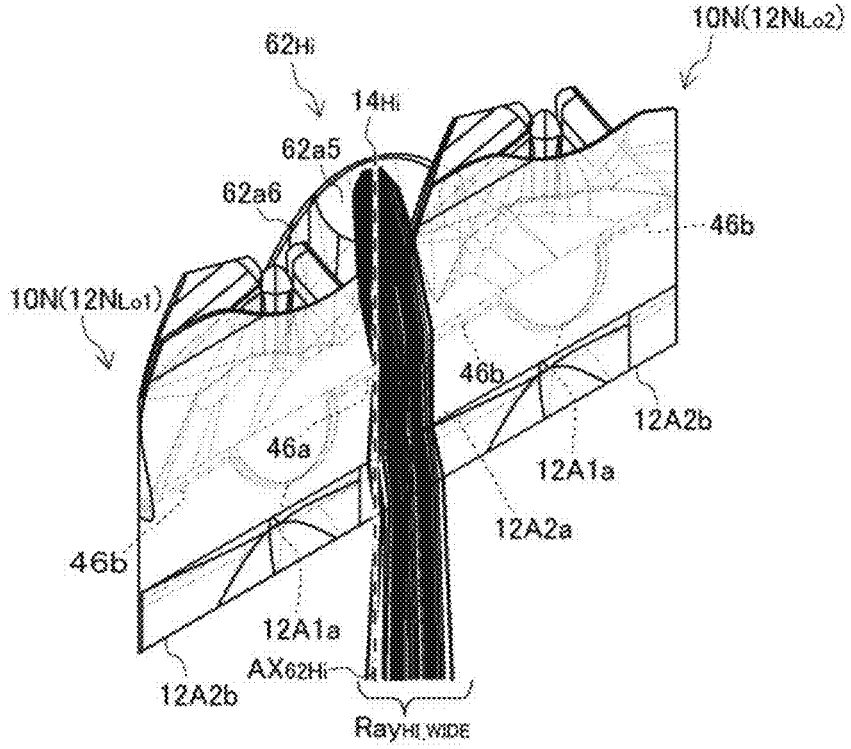
FIG. 87B is a top view thereof.

FIG. 85 As shown in to FIG. 87, the incident plane A (first incident surface 62*a*1 and the second incidence surface 62*a*2) of the light distribution pattern for wide, reflecting surface 62*a*3 of the light distribution pattern for wide, first and second the front end 12A2*bb* of the lens section 12NLo1,12NLo2 (semi-cylindrical shape of the exit surface 12A2*b*), the third lens unit 62Hi inside from the incident surface a of the light distribution pattern for a wide (the first incident surface 62*a*1 and the second incident surface 62*a*2) light RayHi_WIDE from the third light source 14Hi incident on are emitted from the front end of the first and second lens portions 12NLo1,12NLo2 12A2*bb* (semicylindrical exit surface 12A2*b*), for wide for high beam is emitted forward constitute a first optical system for forming a light distribution pattern PHi_WIDE (see FIG. 84 A).

The first incident surface 62*a*1 is a plane light from the third light source 14Hi enters inside the third lens unit 62Hi is refracted, the surface of the curved convex toward the third light source 14Hi (e.g., free-form surface) as It is configured. Specifically, the first incident surface 62*a*1, the light RayHi_WIDE from the third light source 14Hi incident from the first incident surface 62*a*1 inside the third lens unit 62Hi is relates to the vertical direction, the first and second lens portions 12NLo1 was condensed near focal lines F12A2*b* of the front end of the 12NLo2 12A2*bb* (semicylindrical exit surface 12A2*b*) (FIG. 86 and FIG. 87 A see), and relates to a horizontal direction, the diffusion (FIG. 87 B the reference) as (or as collimated), the surface shape is formed.

The second incident surface 62*a*2 is a plane light RayHi_WIDE which does not enter the first entrance surface 62*a*1 enters the interior third lens unit 62Hi is refracted out of the light from the third light source 14Hi, the outer peripheral edge of the first incident surface 62*a*1 extends rearward from, among the space between the third light source 14Hi a first entrance surface 62*a*1, a cylindrical surface surrounding a range other than the notch portion 62*a*4 which light RayHi_SPOT passes from the third light source 14Hi (e.g., free-form surface) is constructed as a.

Reflective surface 62*a*3 of the light distribution pattern for wide is disposed outside of the second entrance surface 62*a*2, the inner surface reflecting light RayHi_WIDE from the third light source 14Hi incident from the second incident surface 62*a*2 inside the third lens unit 62Hi (It is configured as a total reflection) surfaces. Reflective surface 62*a*3 of the light distribution pattern for wide is a reflective surface to the inner surface reflecting light RayHi_WIDE from the third light source 14Hi incident from the second incident surface 62*a*2 inside the third lens portion 62Hi (total internal reflection), the metal vapor deposition not used. Specifically, the reflective surface 62*a*3 of the light distribution pattern for wide from the second incident surface 62*a*2 enters the interior third lens unit 62Hi internal reflection at the reflective surface 62*a*3 of the light distribution pattern for the wide (total reflection) light RayHi_WIDE from the third light source 14Hi is relates to the vertical direction, and condensed near focal lines F12A2*b* of the front end of the first and second lens portions 12NLo1,12NLo2 12A2*bb* (semicylindrical exit surface 12A2*b*) (FIG. 86 and FIG. 87 A see), and relates to a horizontal direction, diffuse reference (FIG. 87 B) as (or as collimated), the surface shape is formed.

The first optical system configured as described above, onto a virtual vertical screen, the light distribution pattern PHi_WIDE for wide shown in FIG. 84 A is formed.

That is, the third light RayHi_WIDE from the light source 14Hi, and, for light distribution pattern for a wide incident from the second incident surface 62*a*2 inside the third lens unit 62Hi incident from the first incident surface 62*a*1 inside the third lens unit 62Hi internal reflection at the reflective surface 62*a*3 of the light RayHi_WIDE from (total reflection) by the third light source 14Hi relates vertical direction, the front end portion of the first and second lens portions 12NLo1,12NLo2 12A2*bb* (semicylindrical exit surface 12A2*b*) focal lines F12A2*b* near the condensing after (FIG. 86 and FIG. 87 A refer), as shown in FIG. 87 B, an intermediate output surface of the first and second lens portions 12NLo1,12NLo2 (left and right exit surface 46*a*, emitted from the 46 *b*) to the lens body 72 outside, further, the first and incident from the middle plane of incidence of the first and second lens portions 12NLo1,12NLo2 (second incident surface 12A2*a*) inside the lens body 72 of the front end portion of the second lens unit 12NLo1,12NLo2 12A2*bb* (semicylindrical exit surface 12A2*b*), emitted from the region AA2 enclosed by the two-dot chain line in FIG. 82 B. At that time, light RayHi_WIDE from the third light source 14Hi emitted from the front end of the first and second lens portions 12NLo1,12NLo2 12A2*bb* (semicylindrical exit surface 12A2*b*) is the first and the second lens unit 12NLo1,12NLo2 by the action of the front end 12A2*bb* (semicylindrical exit surface 12A2*b*), is condensed respect the vertical direction, parallel to the reference axis AX62Hi, and, by being emitted forward as light diffused relates horizontally, to form a light distribution pattern PHi_WIDE for wide shown in FIG. 84 A.

Spot light distribution pattern PHi_SPOT second optical system for forming (FIG. 84 B reference), is constructed as follows.

As shown in FIG. 85 to FIG. 87, the incident surface 62*a*5 of the light distribution pattern for a spot, reflective surface 62*a*6 of the light distribution pattern for a spot, and the exit surface 62*b*2 of the light distribution pattern for spot light distribution for spots from the incident surface 62*a*5 of the pattern is incident inside the third lens unit 62Hi light RayHi_SPOT from the third light source 14Hi which is internally reflected by the reflecting surface 62*a*6 of the light distribution pattern for a spot, the emission of the light distribution pattern for a spot emitted from the surface 62*b*2, to constitute a second optical system for forming a spot light distribution pattern PHi_SPOT for high beam is emitted forward (see FIG. 84 B).

Specifically, the incident surface 62*a*5 of the light distribution pattern for a spot, reflective surface 62*a*6 of the light distribution pattern for a spot, and the exit surface 62*b*2 of the light distribution pattern for spot passes through the cutout portion 62A4, spot from the incident surface 62*a*5 for use light distribution pattern is incident on the internal third lens portion 62Hi light RayHi_SPOT from the third light source 14Hi that are internal reflection (total internal reflection) in the reflective surface 62*a*6 of the light distribution pattern for a spot, spot emitted from the exit surface 62*b*2 for use light distribution pattern, it is emitted forward constitute a second optical system for forming a spot light distribution pattern PHi_SPOT (see FIG. 84 B).

Exit surface 62*b*2 of the light distribution pattern for spot is configured as a surface of a planar shape orthogonal to the reference axis AX62Hi. Of course, not limited to this, the exit surface 62*b*2 of the light distribution pattern for a spot may be configured as a surface of a curved surface.

Exit surface 62*b*2 of the light distribution pattern for spots are arranged from the front end portion of the first and second lens portions 12NLo1,12NLo2 12A2*bb* (semicylindrical emitting surface 12A2*b*) behind the position (see FIG. 86). Of course, not limited to this, the exit surface 62*b*2 of the light distribution pattern for spot, forward position or the first and the front end portion of the first and second lens portions 12NLo1,12NLo2 12A2*bb* (semicylindrical exit surface 12A2*b*) it may be disposed at the same position as the front end portion of the second lens unit 12NLo1,12NLo2 12A2*bb* (semicylindrical exit surface 12A2*b*).

Incident surface 62*a*5 of the light distribution pattern for the spot, in terms of light RayHi_SPOT from the third light source 14Hi is incident on the inside third lens portion 62Hi, is configured toward the third light source 14Hi as the surface of the concave curved surface shape there. Specifically, the incident surface 62*a*5 of the light distribution pattern for spots (more accurately, a reference point F62Hi) third light source 14Hi is configured as a surface of a spherical shape centered. Thus, it is possible to suppress Fresnel reflection loss when light RayHi_SPOT from the third light source 14Hi is incident from the incident surface 62*a*5 of the light distribution pattern for a spot inside the third lens unit 62Hi. Of course, not limited to this, the incident surface 62*a*5 of the light distribution pattern for spots, surfaces other than the surface of the spherical shape centered on the third light source 14Hi (e.g., free-form surface) may be configured as a.

Figure 88A:
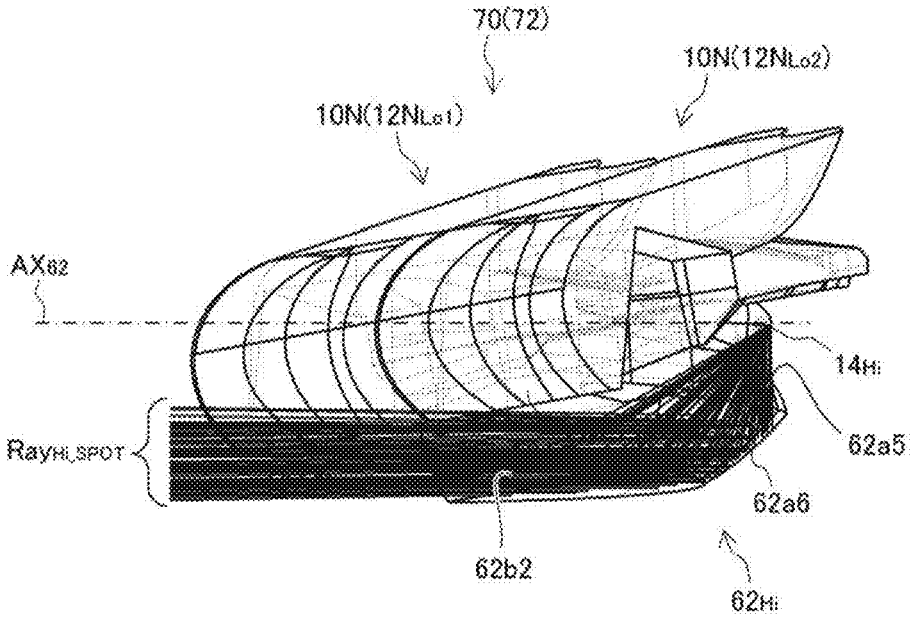
FIG. 88A is a side view depicting a state when the light $Ray_{Hi\ SPOT}$ from the third light source $\mathbf{14}_{Hi}$, which entered the third lens unit $\mathbf{62}_{Hi}$, is emitted from the emission surface 62*b*2 for the spot light distribution pattern.
Figure 88B:
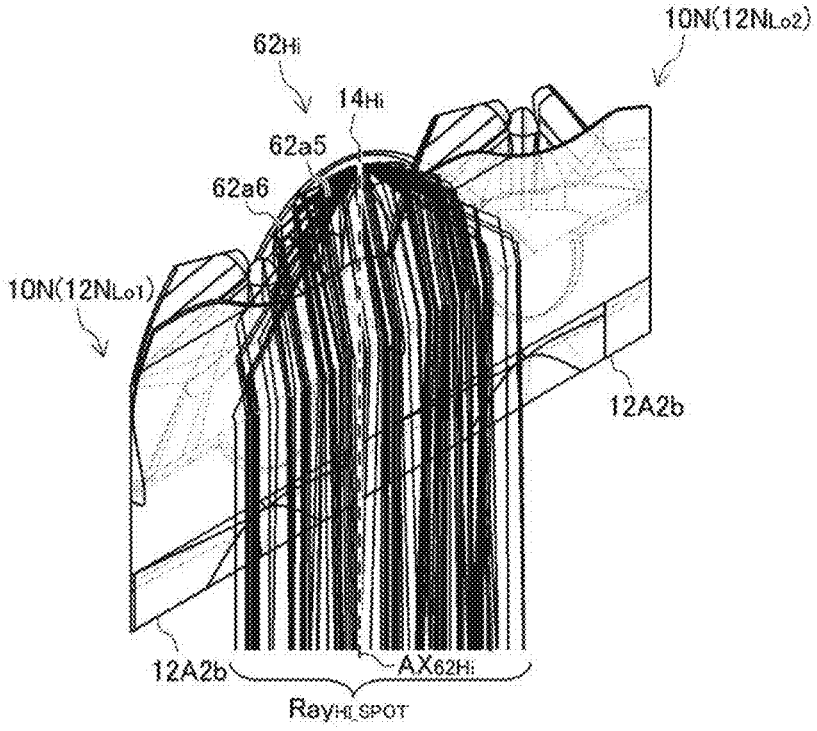
FIG. 88B is a top view thereof.

Reflective surface 62*a*6 of the light distribution pattern for a spot is disposed outside of the entrance surface 62*a*5 of the light distribution pattern for a spot, a third incident from the incident surface 62*a*5 of the light distribution pattern for a spot inside the third lens unit 62Hi internal reflection light RayHi_SPOT from the light source 14Hi is configured as a (total reflection) surfaces. Reflective surface 62*a*6 of the light distribution pattern for the spot, internal reflection light RayHi_SPOT from the third light source 14Hi incident from the incident surface 62*a*5 of the light distribution pattern for a spot inside the third lens portion 62Hi (total internal reflection) to the reflective surface in, metal deposition is not used. Specifically, the reflective surface 62*a*6 of the light distribution pattern for spots on the reflecting surface 62*a*6 of the light distribution pattern for the spot incident from the incident surface 62*a*5 of the light distribution pattern for a spot inside the third lens unit 62Hi is internally reflected (total reflection), the light RayHi_SPOT from the third light source 14Hi emitted from the emitting surface 62*b*2 of the light distribution pattern for spot relates to a vertical direction is collimated (see FIG. 86 and FIG. 88 A), and as is collimated also the horizontal direction (see FIG. 88 B), the surface shape is formed. As the reflective surface 62*a*6 of the light distribution pattern for a spot, for example, focus (to be exact, the reference point F62Hi) third light source 14Hi may be used a reflecting surface of the parabolic system set in the vicinity.

The second optical system configured as described above, on a virtual vertical screen, the spot light distribution pattern PHi_SPOT shown in FIG. 84 B is formed.

That is, passes through the notch portion 62A4, which is internally reflected incident from the incident surface 62*a*5 of the light distribution pattern for a spot inside the third lens unit 62Hi by the reflecting surface 62*a*6 of the light distribution pattern for a spot (total reflection) light RayHi_SPOT from the third light source 14Hi relates vertical and horizontal directions, after being collimated and emitted from the exit surface 62*b*2 of the light distribution pattern for a spot. At that time, light RayHi_SPOT from the third light source 14Hi emitted from the emitting surface 62*b*2 of the light distribution pattern for a spot is formed as a surface of a planar shape exit surface 62*b*2 of the light distribution pattern for a spot is perpendicular to the reference axis AX62Hi and since that relates the vertical and horizontal directions, by being emitted forward as parallel light with respect to the reference axis AX62Hi, to form a light distribution pattern PHi_SPOT for spot shown in FIG. 84 B.

Light distribution pattern PHi_SPOT for spots, focused than light distribution pattern PHi_WIDE for wide, and, becomes luminous intensity is high. As a result, high-beam light distribution pattern PHi formed by light distribution pattern PHi_SPOT and wide light distribution pattern PHi_WIDE for spot is superimposed (synthesized light distribution pattern), high center luminous intensity, excellent in long-distance visibility It becomes a thing.

The becomes light distribution pattern PHi_SPOT for spot condensed from the light distribution pattern PHi_WIDE for Wide, wide light distribution pattern PHi_WIDE is parallel to the reference axis AX62Hi relates vertical direction and diffused relates horizontally for being formed of a light RayHi_WIDE, relates the vertical and horizontal directions spot light distribution pattern PHi_SPOT, it is due to be formed by parallel light RayHi_SPOT respect to the reference axis AX62Hi.

The intensity of the light distribution pattern PHi_SPOT for spot is higher than the light distribution pattern PHi_WIDE for wide, the third light source 14Hi and the reflective surface 62*a*6 of the light distribution pattern for a spot (and/or the incident surface of the light distribution pattern for a spot 62*a*5) the distance between the, compared to the distance between the third light source 14Hi a reflecting surface 62*a*3 of the light distribution pattern wide (and/or the incident surface 62*a*1,62*a*2 the light distribution pattern wide), long setting because they are, in the second optical system for forming a light distribution pattern PHi_SPOT for spot, compared to the first optical system for forming a light distribution pattern PHi_WIDE for wide, the light source image of the third light source 14Hi is relatively small ones next, is by spot light distribution pattern PHi_SPOT is formed by the relatively small light source image.

That is, as shown in FIG. 86, in the first optical system a distance W is relatively close between the third light source 14Hi a reflecting surface 62*a*3 of the light distribution pattern for wide, the light source image of the third light source 14Hi is becomes larger, it is suitable for a wide light distribution pattern PHi_WIDE. Meanwhile, in the distance S is relatively far second optical system between the third light source 14Hi a reflecting surface 62*a*6 of the light distribution pattern for a spot, since the light source image of the third light source 14Hi decreases, distribution for spots It is suitable for the light pattern PHi_SPOT.

Incidentally, by adjusting the angle θ1 and θ2 shown in FIG. 74 A, it is possible to balance the intensity of the luminous intensity and a wide light distribution pattern PHi_WIDE light distribution pattern PHi_SPOT for spot.

Light distribution pattern PHi for high beam, a first light source 14Lo1 for low beam, by the third light source 14Hi for the second light source 14Lo2 and high beam low beam is turned on, the spot light distribution pattern PHi_SPOT for high beam (FIG. 84 B refer), is formed as a synthesized light distribution pattern wide light distribution pattern PHi_WIDE (FIG. 84 A see) and the light distribution pattern PLo low beam reference (Figures FIG. 64 A) are superimposed for the high beam that. Of course, not limited to this, a light distribution pattern PHi high beam, by the third light source 14Hi for high beam is turned on, the high-beam spot light distribution pattern PHi_SPOT (see FIG. 84 B) and for high beam wide light distribution pattern PHi_WIDE (FIG. 84 A refer) may be formed as a synthesized light distribution pattern superimposed.

According to the present embodiment can achieve the following effects.

That is, it is possible to realize the first and miniaturization of the second lens unit 12NLo1,12NLo2 and the lens body 72 in which the third lens portion 62Hi for high beam is formed integrally for low beam. This is the first, third lens unit 62Hi is disposed in the space between at least a portion of the second cone portion of the first cone portion of the first lens unit 12NLo1 second lens unit 12NLo2 in the state, coupled with and the rear end portion of the rear end portion and the second lens portion 12NLo2 of the first lens unit 12NLo1 (rather than a parallel arrangement, are connected in the form of a series arrangement) that, in the second, the first and front end of the second lens unit 12NLo1,12NLo2 for low beam (emission surface 12A2*b*), and a separate front end the front end portion of the third lens unit 62Hi (emission surface) is physically separated for high beam (emitting surface) instead of being configured as, enclosed (part of the exit surface 12A2*b*) (FIG. 82 B first and front end of the second lens unit 12NLo1,12NLo2 for low beam by the two-dot chain line in the front end portion of the third lens unit 62Hi reference region AA2) is for high beam (that constitutes the exit surface) (i.e., a portion of the emission surface 12A2*b* for low beam also serves as the exit surface for high beam) it is due.

Further, it is possible to provide a lens body 72 which can form one at the spot light distribution pattern PHi_SPOT and wide light distribution pattern PHi_WIDE is superimposed high beam distribution pattern PHi (combined light distribution pattern).

This is one of the lens body 72 is by that it comprises a second optical system for forming a first optical system and the light distribution pattern PHi_SPOT for spot light distribution pattern is formed PHi_WIDE for wide.

As a result of the luminous intensity of the light distribution pattern PHi_SPOT for spot is higher than the light distribution pattern PHi_WIDE for wide, high-beam light distribution pattern is formed by light distribution pattern PHi_SPOT and wide light distribution pattern PHi_WIDE for spot is superimposed PHi (the combined light distribution pattern), high center luminosity can be made excellent in long-distance visibility.

The intensity of the light distribution pattern PHi_SPOT for spot is higher than the light distribution pattern PHi_WIDE for wide, the third light source 14Hi and the reflective surface 62*a*6 of the light distribution pattern for a spot (and/or the incident surface of the light distribution pattern for a spot 62*a*5) the distance between the, compared to the distance between the third light source 14Hi a reflecting surface 62*a*3 of the light distribution pattern wide (and/or the incident surface 62*a*1,62*a*2 the light distribution pattern wide), long setting because they are, in the second optical system for forming a light distribution pattern PHi_SPOT for spot, compared to the first optical system for forming a light distribution pattern PHi_WIDE for wide, the light source image of the third light source 14Hi is relatively small ones next, is by spot light distribution pattern PHi_SPOT is formed by the relatively small light source image.

As described above, the concept of "first lens portion of the low beam, the second lens portion of the low-beam, and, integrally molding the third lens portion of the high beam" is the vehicle of the eighth embodiment shown in FIG. 62 is not limited to use lamp 10 N (lens body 12N) and the ninth embodiment of the vehicle lamp shown in FIG. 72 64 (lens 66), the vehicle lighting device according to the above embodiments (lens body) and other others it can be applied to various vehicle lighting device (lens body).

For example, as the first and second lens unit, in place of the lens body 12N of the eighth embodiment shown in FIG. 62, the lens 12 of the first embodiment shown in FIG. 1, a lens of the second embodiment shown in FIG. 16 body 12A, the lens of the sixth embodiment shown in FIG. 39 12 J, or may be used lens body 12K of the seventh embodiment shown in FIG. 49. Both of these lens body is because the lens portion of the low beam.

Here, as the first and second lens unit, in place of the lens body 12N of the eighth embodiment shown in FIG. 62, the lens body 72A will be described using the lens body 12K of the seventh embodiment shown in FIG. 49.

Figure 89A:
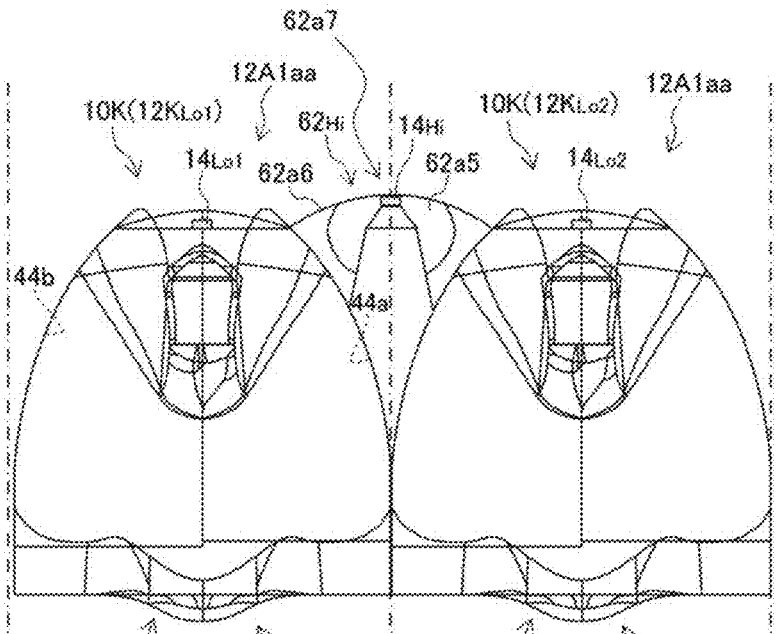
FIG. 89A is a top view of the lens body 72A (modification)
Figure 89B:
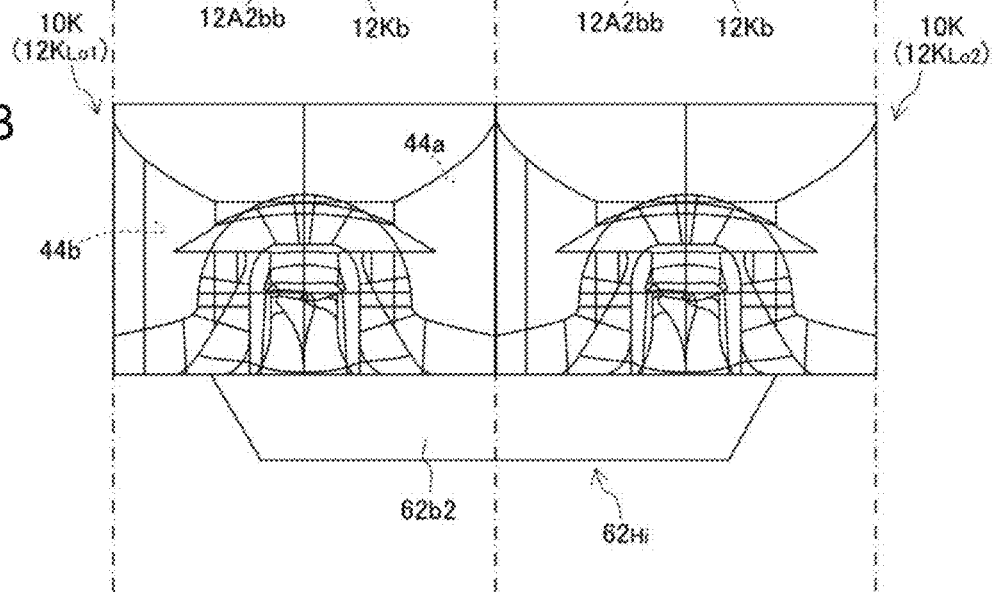
FIG. 89B is a front view thereof.

FIG. 89 A is a top view of a lens body 72A, FIG. 89 B is a front view.

Lens body 72A of this modification, the 10 vehicle lamp of two eighth embodiment of the lens body 72 of the embodiment 10N (the lens body 12N), two of the seventh embodiment of the vehicular lamp 10K (correspond to those obtained by replacing in the lens body 12K). Otherwise, the lens body 72A of this modification has the same structure as the lens body 72 of the tenth embodiment.

As shown in FIG. 89 A, the rear end portion 12A1*aa* of the first and second lens portions 12KLo1,12KLo2 respectively, from the front end 12A2*bb* side of each lens portion 12KLo1,12KLo2 the front end side of the rear end portion 12A1*aa* contains cone section that narrows the cone-shaped (or bell-shaped) (in the FIG. 89 A, a pair of left and right sides 44*a*, part reference, including 44*b*) and toward.

The first and second lens portions 12KLo1,12KLo2, as shown in FIG. 89 B, arranged in parallel in a horizontal direction, as shown in FIG. 89 A, the conical portion of the first lens unit 12KLo1 (the They are connected to each other with a space formed between the first corresponding to the cone portion) and cone portion of the second lens body 12KLo2 of the invention (corresponding to the second cone portion of the present invention). Of course, the invention is not limited to this, the first lens unit 12KLo1 and the second lens unit 12KLo2 may be linked to each other are arranged in parallel in a direction inclined relative to the horizontal.

Front end 12A2*bb* of the first and second lens portions 12KLo1,12KLo2 includes exit surface 12Kb planar shape extending in the horizontal direction (46*a* in FIG. 49, 46 *b*, 46*c* refer) to. Of course, not limited to this, the front end portion 12A2*bb* of the first and second lens portions 12NLo1,12NLo2 may include an emission face 12Kb planar shape slant angle and/or camber angle is applied.

The first incident surface 62*a*1 is emitted from the from the first incident surface 62*a*1 enters the interior third lens unit 62Hi first and front end of the second lens unit 12KLo1, 12KLo2 12A2*bb* (exit surface 12Kb planar shape) light from the third light source 14Hi that is, relates to vertical, collimated, and relates to a horizontal direction, so as to diffuse, the surface shape is formed. Further, the reflecting surfaces 62*a*3 of the light distribution pattern for wide is the second entrance surface 62*a* enters the interior third lens unit 62Hi internal reflection at the reflective surface 62*a*3 of the light distribution pattern for the wide (total reflection), light from the third light source 14Hi emitted from the front end of the first and second lens portions 12KLo1,12KLo2 12A2*bb* (exit surface 12Kb planar shape) relates to a vertical direction is collimated, and relates to a horizontal direction, so as to diffuse to, the surface shape is configured. Otherwise, the same configuration as the lens body 72 of the tenth embodiment.

By lens body 72A of the present modification can achieve the same effects as the tenth embodiment.

Next, a description will be given of the lens body 72B is a modification of the lens body 72.

In the lens body 72B of this modification, similarly to the rear end portion 62*a* of the lens body 62B shown in FIG. 80, the first incident surface 62*a*1 it is omitted. That is, the incident plane A of the light distribution pattern for wide is composed only of the second incident surface 62*a*2. Otherwise, the same configuration as the lens body 72 of the tenth embodiment.

By lens body 72B of this modification, it is possible to achieve the same effect as the tenth embodiment.

Then, the lens body 72 (third lens portion 62Hi) is a modification of the lens body 72C (third lens unit 62CHi) will be described.

Lens body 72C of the present modification (a third lens unit 62CHi) is incident surface 62*a*5 of the third lens unit light distribution pattern for a spot from 62Hi shown in FIG. 85 or the like, reflective surfaces 62*a*6 of the light distribution pattern for a spot and, exit surface 62*b*2 of the light distribution pattern for a spot, i.e., correspond to those omitting the second optical system for forming a spot light distribution pattern PHi_SPOT for high beam (see FIG. 84 B).

FIG. 74 B is a front view of the lens body 72C rear end 62*a* of the (third lens portion 62CHi) (the first incident surface 62*a*1, near the reflective surface 62*a*3 of the second incident surface 62*a*2 and the light distribution pattern for wide) it is.

Lens body 72C of the present modification in the (third lens unit 62CHi), as shown in FIG. 74 B, the space between the third light source 14Hi a first entrance surface 62*a*1 and the second incident surface 62*a*2 (and It is surrounded by the reflecting surface 62*a*3 of the light distribution pattern wide). That is, in the lens body 72C of the present modification (a third lens unit 62CHi), fan-shaped notch portion 62*a*4 which light from the third light source 14Hi passes is omitted.

According to this modification, it is possible to form only the diffusion pattern PHi_WIDE for high beam. Further, by adjusting the surface shape of the first incident surface 62*a*1 and/or the second incident surface 62*a*2, it is also possible to form only the light distribution pattern for a spot for high beam.

Next, the vehicle lighting device 10P of the eleventh embodiment will be described with reference to the drawings.

Vehicle lamp 10P of the present embodiment is configured as follows.

Figure 90A:
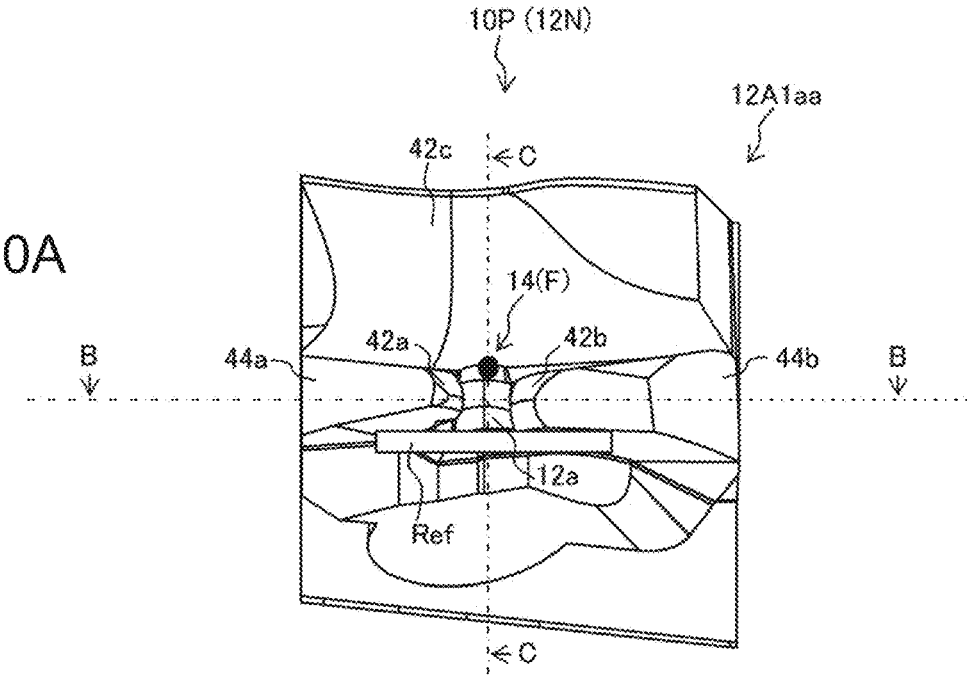
FIG. 90A is a front view of the rear end portion 12A1*aa* of the lens body 12N constituting the vehicular lighting fixture 10P.
Figure 90B:
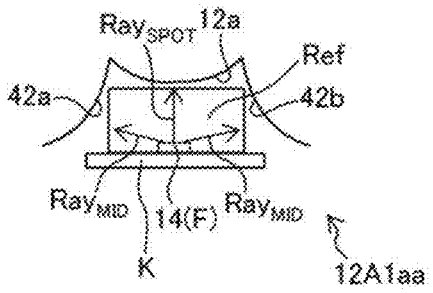
FIG. 90B is a B-B cross-sectional view (schematic diagram) of FIG. 90A.
Figure 90C:
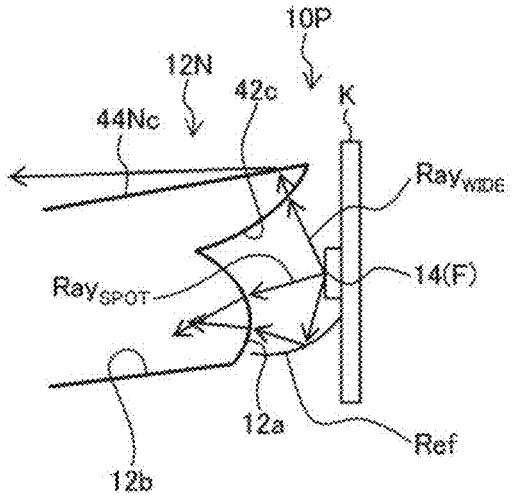
FIG. 90C is a C-C cross-sectional view (schematic diagram) of FIG. 90A.

FIG. 90 A is a front view of the rear end portion 12A1*aa* of the lens body 12N constituting the vehicle lamp 10P of the present embodiment, FIG. 90 B FIG. 90 B-B sectional view of A (schematic diagrams) FIG. 90 C is a C-C in cross-sectional view of FIG. 90 A (schematic diagram).

FIG. 90 A, as shown at FIG. 90 C, the vehicle lamp 10P of the present embodiment, obtained by adding a reflective surface Ref for vehicle lighting device 10N of the eighth embodiment shown in FIG. 62 Equivalent to.

In the vehicle lamp 10N of the eighth embodiment, the left and right side pair of left and right entrance surface 42*a* of the space between light source 14 and the first entrance surface 12*a*, surrounded by 42*b* on (see FIG. 43 B) because you are, light RayMID from the light source 14 that extends to the left and right direction, the left and right pair of the incident surface 42*a*, directly incident from 42*b* inside the lens body 12N, low-beam light distribution pattern PLO (mid-light distribution pattern PMID_L, PMID_R) used in the formation. Further, since is the upper of the space between light source 14 and the first incident face 12*a* is surrounded by the upper incident surface 42*c* (see FIG. 65 B), the light RayWIDE from the light source 14 extending upwards, directly incident from the on the entrance surface 42*c* inside the lens body 12N, is used to form the low beam light distribution pattern PLO (light distribution pattern PWIDE for wide).

Figure 91:
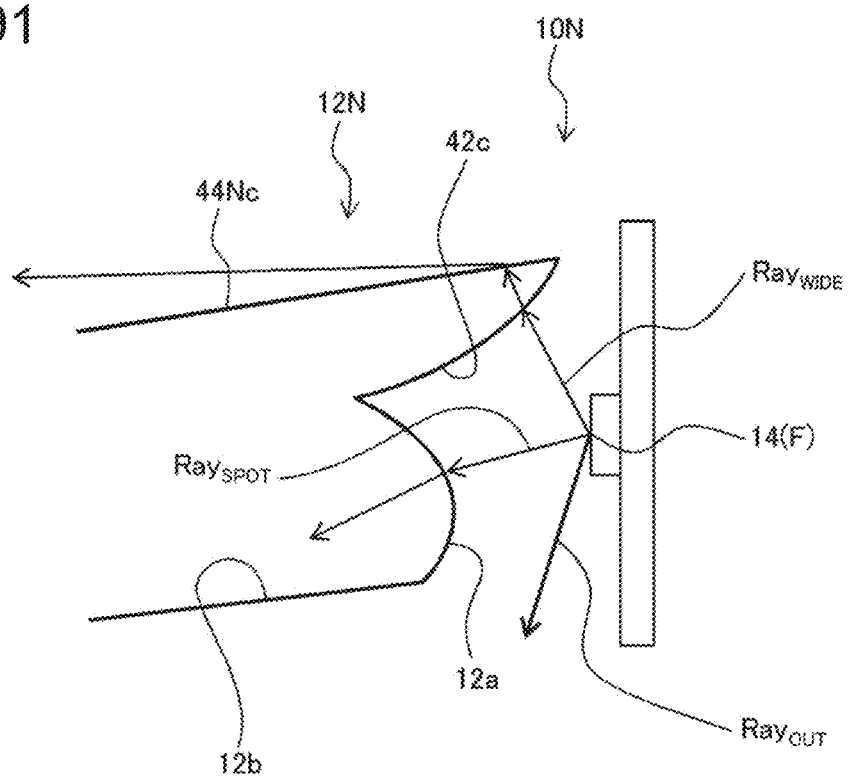
FIG. 91 is a diagram depicting a state of the vehicular lighting fixture 10N of Embodiment 8 when the light $Ray_{OUT}$ from the light source 14, which spreads downward, does not enter the lens body 12N.

However, in the vehicle lighting device 10N of the eighth embodiment, as shown in FIG. 91, the light RayOUT from a light source 14 which extends downwards, does not enter inside the lens body 12N, formation of the light distribution pattern PLO low beam not used to.

Vehicle lamp 10N of the present embodiment, the lens body light RayOUT from the light source 14 extending in the downward direction not incident inside the lens body 12N rear end 12A1*aa* (i.e. the incident surface 12*a*, 42*a*, 42*b*) of the lens body 12N from by entering the internal 12N, for use in formation of the light distribution pattern for low beam PLO, and a reflective surface Ref.

Reflecting surface Ref reflects the light RayOUT other than the light directly incident from the rear end 12A1*aa* of the lens body 12N inside the lens body 12N of the light from the light source 14 rear end 12A1*aa* (i.e. the incident surface 12*a*, 42*a*, a reflective surface for incident 42*b*) inside the lens body 12N.

As shown in FIG. 90 A~FIG. 90 C, the reflective surface Ref is the lower space between the light source 14 and the first entrance surface 12*a*, arranged to surround the space from the lower side ing. Reflecting surface Ref is fixed to the substrate K, the light source 14 is mounted. Of course, not limited to this, the reflecting surface Ref can be fixed to a housing (not shown) or the like constituting the lamp chamber vehicular lamp 10P is accommodated.

Reflecting surface Ref is to metal deposition of aluminum vapor deposition or the like may be a reflector that has been subjected, may be a metal plate mirror-processing has been performed, it may be a mirror member, other than this it may be a reflective member.

Reflecting surface Ref may be a reflecting surface of a planar shape, it may be a reflective surface of curved shape.

In the vehicle lamp 10P with the above configuration, as shown in FIG. 90 C, the light from the light source 14 extending in the downward direction, is disposed below the space between the light source 14 and the first entrance surface 12*a* was being reflected by the reflecting surface Ref, the rear end portion 12A1*aa* (i.e. the incident surface 12*a*, 42*a*, 42*b*) of the lens body 12N incident from inside the lens body 12N, low-beam distribution pattern PLO (spot light distribution pattern PSPOT, mid light distribution pattern PMID_L, used in the formation of PMID_R).

At that time, reflected light from the reflecting surface Ref incident from the first incident surface 12*a* to the inner lens member 12N is, the first optical system for forming a spot light distribution pattern PSPOT (see FIG. 74 B) (FIG. 42 (the first lower reflection surface 12*b* which constitute the a)) (and shade 12*c*), is controlled below the cutoff line. Therefore, due to the reflected light from the reflecting surface Ref incident from the first incident surface 12*a* to the inner lens element 12N, glare occurs in the spot light distribution pattern PSPOT for low beam (see FIG. 64 B) it can be suppressed.

Further, a pair of left and right entrance surface 42*a*, the reflected light from the reflecting surface Ref incident from 42*b* inside the lens body 12N is, mid light distribution pattern PMID_L, PMID_R (FIG. 64 C, FIG. 64 (d-) refer) to the second optical system (FIG. 66, FIG. 67 reference) the second lower reflecting surface 48*a* of the pair constituting the forming, 48*b* (and the shade 48*c*, 48*d*) by, is controlled below the cutoff line. Therefore, the pair of left and right entrance surface 42*a*, due to the reflected light from the reflecting surface Ref incident inside the lens body 12N from 42*b*, mid light distribution pattern PMID_L for low beam, suppressing the glare occurs PMID_R be able to.

According to this embodiment, in addition to the effects of the eighth embodiment, further, it can achieve the following effects.

That, and a lens member 12N which is disposed in front of the light source 14 and the light source 14 to form a light distribution pattern including a cutoff line on an upper edge (spot light distribution pattern PSPOT, mid light distribution pattern PMID_L, PMID_R) a in the fabricated vehicle lamp 10P as, light use efficiency can be suppressed. This light RayOUT from the light source 14 that spreads light (downward than the light which enters directly into the lens body 12N of the light from the light source 14. FIG. 91 of the lens body 12N and reflects the reference) rear end 12A1*aa* (i.e. the incident surface 12*a*, 42*a*, is by having a reflective surface Ref to incident 42*b*) inside the lens body 12N.

Next, a description will be given of the reflective surface RefA is a modification of the reflective surface Ref.

Figure 92:
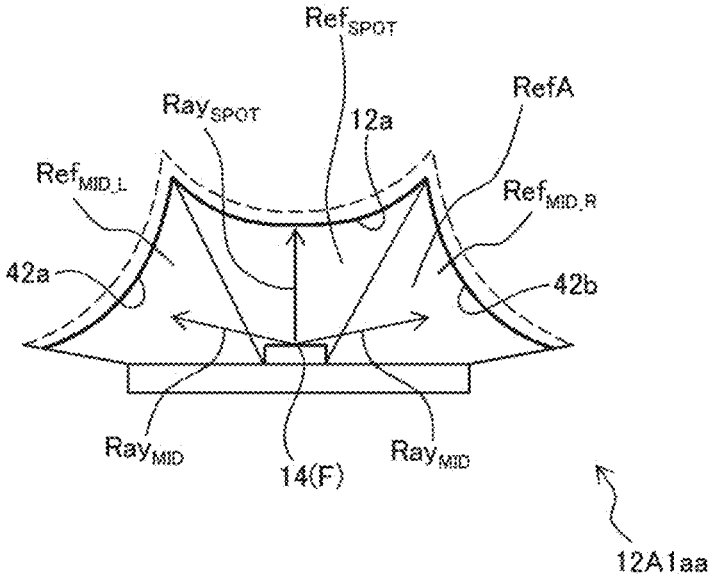
FIG. 92 is an example (top view) of the reflection surface RefA (modification).

FIG. 92 is an example of a reflecting surface RefA of this modification (top view).

Reflecting surface RefA of this modification is constituted incident surface 12*a*, 42*a*, the first reflective region RefSPOT partitioned into three in correspondence to 42*b*, the second reflective region RefMID_L, as a reflective surface comprising a third reflective region RefMID_R ing. Specifically, the reflecting surface RefA of this modification, the first reflective region RefSPOT be incident from the first incident surface 12*a* reflects a portion of the light inside the lens body 12N from the light source 14, light from the light source 14 the second reflective region RefMID_L where the is incident from the other one of the incident surface 42*a* of the pair of left and right entrance surface reflects a part inside the lens body 12N, and reflects another part of the light from the light source 14 It is formed as a reflecting surface comprising a third reflective region RefMID_R be incident from the other incident surface 42*b* inside the lens body 12N of the pair of left and right entrance surface on. Each of the reflection region RefSPOT, RefMID_L, the leading edge of RefMID_R is, in top view, the incident surface 12*a*, 42*a*, has a shape along the 42*b*.

Figure 93:
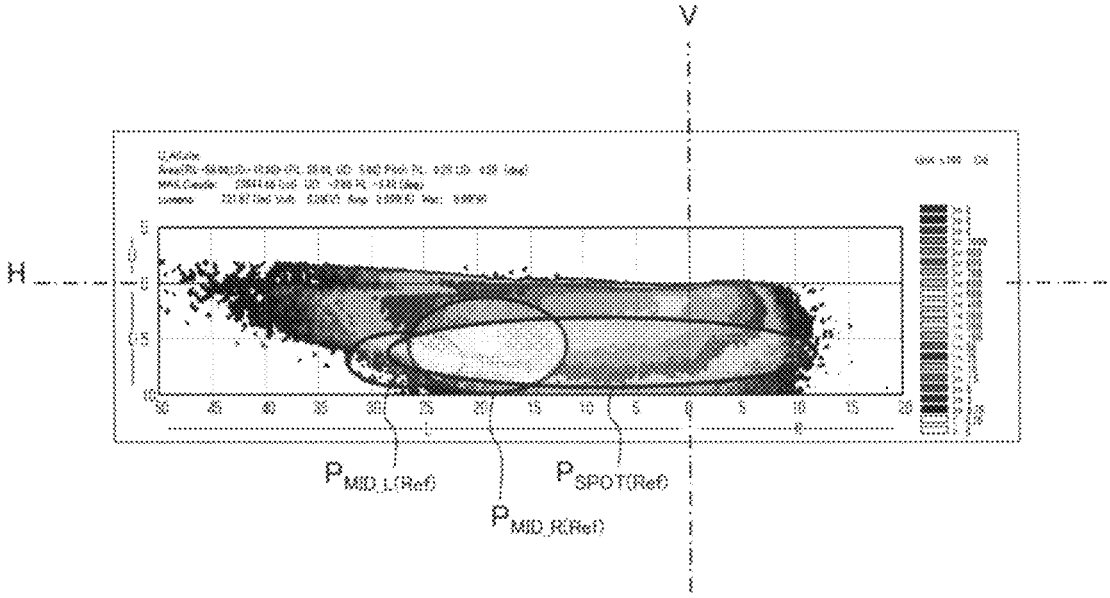
FIG. 93 is a diagram depicting regions where reflected lights from the reflection regions $Ref_{SPOT}$, $Ref_{MID\ L}$ and $Ref_{MID\ R}$ are distributed respectively.

The first reflective region RefSPOT the reflected light from the first reflective region RefSPOT incident from the first incident surface 12*a* to the inner lens member 12N is, for example, are light distribution in the region indicated by reference numeral PSPOT in FIG. 93 (Ref) to so, the surface shape is configured. The second reflective region RefMID_L the reflected light from the second reflective region RefMID_L entering from the left entrance surface 42*a* inside the lens body 12N is, for example, are light distribution in a region shown by reference numeral PMID_L in FIG. 93 (Ref) as described above, the surface shape is formed. The third reflective region RefMID_R the reflected light from the third reflecting region RefMID_R entering from the right entrance plane 42*b* inside the lens body 12N is, for example, are light distribution in a region shown by reference numeral PMID_R in FIG. 93 (Ref) as described above, the surface shape is formed. Of course, not limited to this, each of the reflective regions RefSPOT, RefMID_L, RefMID_R, like each of the reflected light is light distribution in the other regions, the surface shape may be configured.

According to the reflective surface RefA of this modification, each of the reflection region RefSPOT, RefMID_L, by individually adjusting the RefMID_R, each of the reflection region RefSPOT incident each of the incident surface 12*a*, 42*a*, from 42*b* inside the lens body 12N, RefMID_L, it is possible to individually control the reflected light from the RefMID_R.

As described above, "by adding a reflective surface, improve the utilization efficiency of light from the light source 14" concept is not limited to the vehicle lamp 10N of the eighth embodiment, according to the above embodiments it can be applied to a vehicle lamp and other various other vehicle lamp.

This will be described below.

Figure 94A:
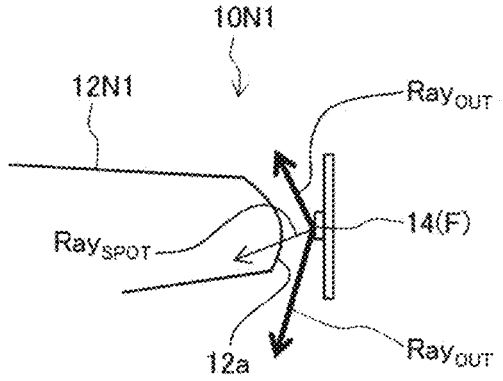
FIG. 94A is a diagram depicting a state of the vehicular lighting fixture 10N1 when the light $Ray_{OUT}$ from the light source 14, which spreads in vertical directions, does not enter the lens body 12N1.
Figure 94B:
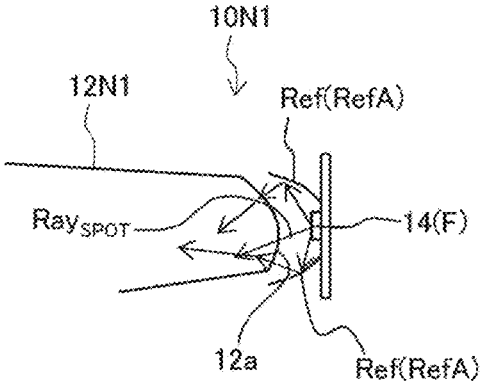
FIG. 94B is a diagram depicting a state when the reflection surface Ref (RefA) is added to the vehicular lighting fixture 10N1 in FIG. 94A.

For example, formed as shown in FIG. 94 A, the upper incident surface from the vehicle lamp 10 N (lens body 12N) of the eighth embodiment 42*c*, i.e., a wide light distribution pattern PWIDE (see FIG. 64 E) third optical system (FIG. 69 reference) omit the vehicle lamp 10N1 (lens body 12N1) is assumed to be.

In the vehicle lighting device 10N1, as shown in FIG. 94 A, light RayOUT from the light source 14 extending upward and downward, it does not enter inside the lens body 12N1, formation of the light distribution pattern PLO low beam not used to.

Therefore, "by adding a reflective surface, improve the utilization efficiency of light from the light source 14" based on the idea that, as shown in FIG. 94 B, disposing a reflective surface Ref (or RefA).

Reflecting surface Ref (or RefA) to the upper and lower space between the light source 14 and the first entrance surface 12*a*, respectively, it is arranged so as to surround the space from the upper and lower.

In the reflecting surface Ref (or RefA) to add the vehicular lamp 10N1 as described above, as shown in FIG. 94 B, the rear end portion of the lens body 12N1 (i.e. the incident surface 12*a*, 42*a*, 42*b*) from the light other than the light directly incident to the inner lens body 12N1, i.e., light from the light source 14 extending in the vertical direction, the light source 14 and the upper and the reflecting surface which is disposed below the space between the first entrance surface 12*a* is reflected by the Ref (or RefA), the rear end portion of the lens body 12N1 (ie incident surface 12*a*, 42*a*, 42*b*) incident on the internal lens body 12N1 from, low-beam light distribution pattern PLO (spot light distribution pattern PSPOT, mid light distribution pattern PMID_L, used in the formation of PMID_R).

At that time, reflected light from the reflecting surface is incident to the inner lens member 12N1 from the first incidence plane 12*a* Ref (or RefA) comprises a first optical system for forming a spot light distribution pattern PSPOT (see FIG. 64 B) (FIG. 42 A see) the first lower reflection surface 12*b* which constitutes the (and shade 12*c*), it is controlled below the cutoff line. Therefore, glare due to the light reflected from the reflecting surface is incident to the inner lens member 12N1 from the first incidence plane 12*a* Ref (or RefA), the spot light distribution pattern PSPOT for low beam (see FIG. 64 B) There can be suppressed.

Further, a pair of left and right entrance surface 42*a*, the reflected light from the reflecting surface is incident to the inner lens member 12N1 from 42*b* Ref (or RefA), mid light distribution pattern PMID_L, PMID_R (FIG. 64 C, FIG. 64 (d- the second optical system (FIG. 66 to form a)), the second lower reflecting surface 48*a* of the pair constituting the reference FIG. 67), by 48*b* (and the shade 48*c*, 48*d*), are controlled below the cutoff line. Therefore, due to the reflected light from the left and right pair of the incident surface 42*a*, the reflecting surface is incident on the internal lens body 12N1 from 42*b* Ref (or RefA), mid-light distribution pattern PMID_L for low beam, glare is generated in the PMID_R it can be inhibited from.

According to this modification, similarly to the eleventh embodiment can provide the following effects.

That, and a light source 14 and the lens body 12N1 disposed in front of the light source 14 to form a light distribution pattern including a cutoff line on an upper edge (spot light distribution pattern PSPOT, mid light distribution pattern PMID_L, PMID_R) a in the vehicle lamp 10N1 configured to, light utilization efficiency can be suppressed. This light RayOUT from the light source 14 that spreads light (vertical direction other than the light directly incident to the inner lens member 12N1 of the light from the light source 14. FIG. 94 A reference) due to the fact that with a reflected rear end 12A1*aa* of the lens body 12N1 with (ie incident surface 12*a*, 42*a*, 42*b*) reflective surface to be incident on the internal lens body 12N1 from Ref (or RefA) a it is.

Figure 95A:
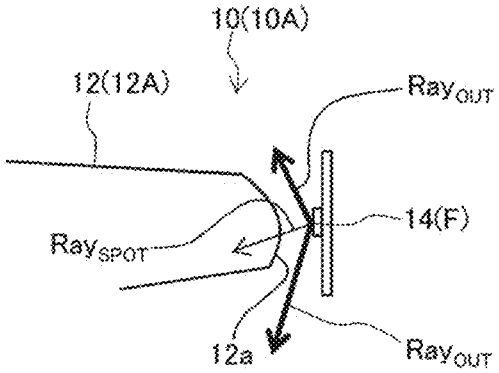
FIG. 95A is a diagram depicting a state of the vehicular lighting fixture 10 of Embodiment 1 (vehicular lighting fixture 10A of Embodiment 2) when the light $Ray_{OUT}$ from the light source 14, which spreads in vertical and horizontal directions, does not enter the lens body 12 or 12A.
Figure 95B:
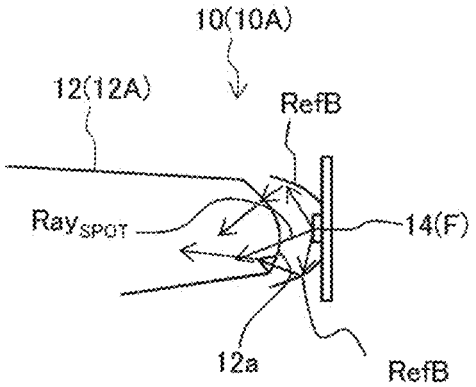
FIG. 95B is a diagram depicting a state when the reflection surface RefB is added to the vehicular lighting fixture 10 or 10A in FIG. 95A.

Also, for example, in the vehicle lamp 10 of the first embodiment (the same is true vehicle lamp 10A of the second embodiment shown in FIG. 16) shown in FIG. 1, as shown in FIG. 95 A, vertically and horizontally light RayOUT from a light source 14 that extends does not enter the inner lens member 12, 12A, is not used in formation of the light distribution pattern for low beam PLO.

Therefore, "by adding a reflective surface, improve the utilization efficiency of light from the light source 14" based on the idea that, as shown in FIG. 95 B, disposing a reflective surface RefB.

Reflective surface RefB is constituted from the incident surface 12*a* side as the rear cylindrical reflecting surface extending toward the (light source 14 side), it is arranged so as to surround the space between the light source 14 and the incident surface 12*a*.

In the first embodiment of the vehicle lamp 10N adding a reflective surface RefB (vehicle lamp 10A of the second embodiment is also the same) as described above, as shown in FIG. 95 B, the lens body 12,12A during a rear end portion from (i.e. the incident surface 12*a*) light other than light entering directly into the lens body 12, 12A, i.e., the light from the light source 14 extending in the vertical and horizontal directions, the light source 14 and the incident surface 12*a* of the space is reflected in the arrangement so as to surround the in-cylinder-shaped reflecting surfaces RefB, the rear end portion of the lens body 12, 12A (i.e. the incident surface 12*a*) incident from inside the lens body 12, 12A, the low-beam light distribution used to form the pattern.

At that time, the optical system the light reflected from the reflecting surface RefB incident from the first incident surface 12*a* to the inner lens body 12,12A is, to form a light distribution pattern for low beam (FIG. 2 A, the see FIG. 17 A) by the lower reflecting surface 12*b* constituting the (and shade 12*c*), it is controlled below the cutoff line. Therefore, due to the reflected light from the reflecting surface RefB incident inside the lens body 12,12A from the incident surface 12*a*, the glare light distribution pattern for low beam can be suppressed.

According to this modification, similarly to the eleventh embodiment can provide the following effects.

That is, the light source 14 and a lens body 12,12A disposed in front of the light source 14, a light distribution pattern configured vehicular lamp so as to form a (light distribution pattern for low beam) including the cutoff line on an upper edge in 10, 10A, it is possible to light use efficiency can be suppressed. This light RayOUT from the light source 14 that spreads light (vertical and horizontal directions other than the light entering directly into the lens body 12,12A of the light from the light source 14. Is by FIG. 95 A see) further comprising a rear end portion 12A1*aa* (i.e. reflective surface RefB to be incident from the incident surface 12*a*) inside the lens body 12,12A the lens body 12,12A reflects.

A vehicular lighting fixture 64 (lens body 66) for forming an ADB light distribution pattern will be described next as Embodiment 12 with reference to the drawings.

Figure 96:
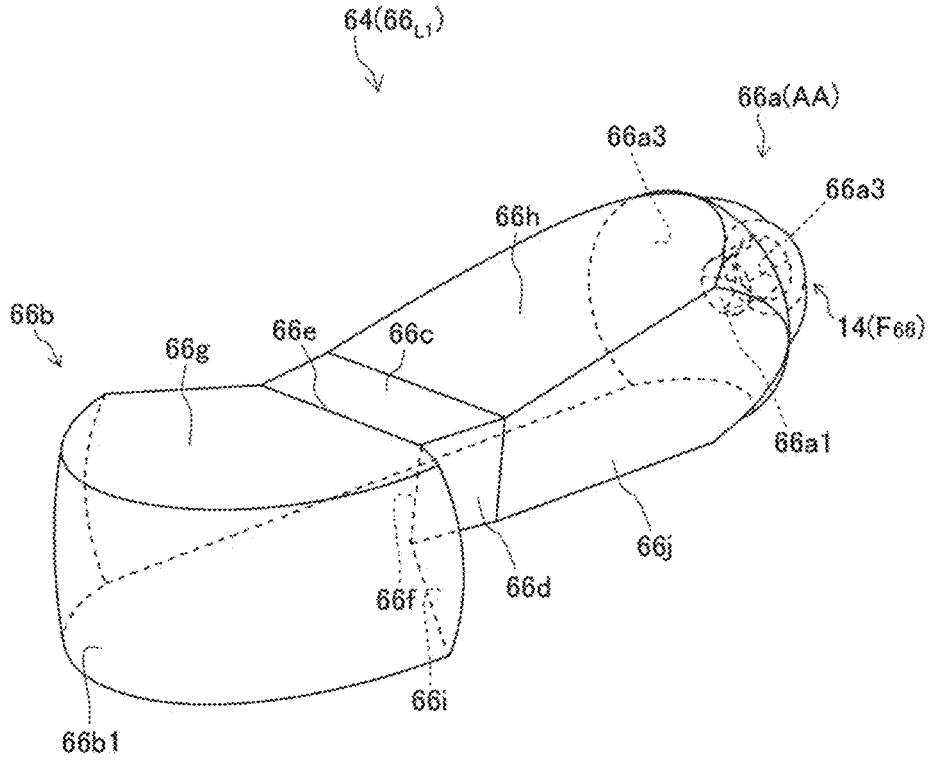
FIG. 96 is a perspective view of the vehicular lighting fixture 64 (lens body 66).
Figure 98A:
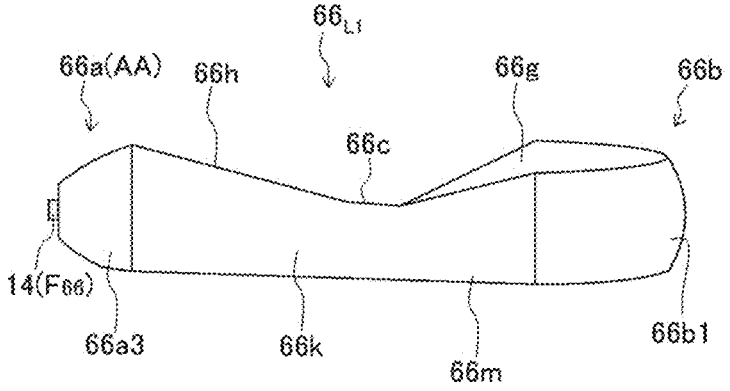
FIG. 98A is a right side view of the lens body $\mathbf{66}_{L1}$.
Figure 98B:
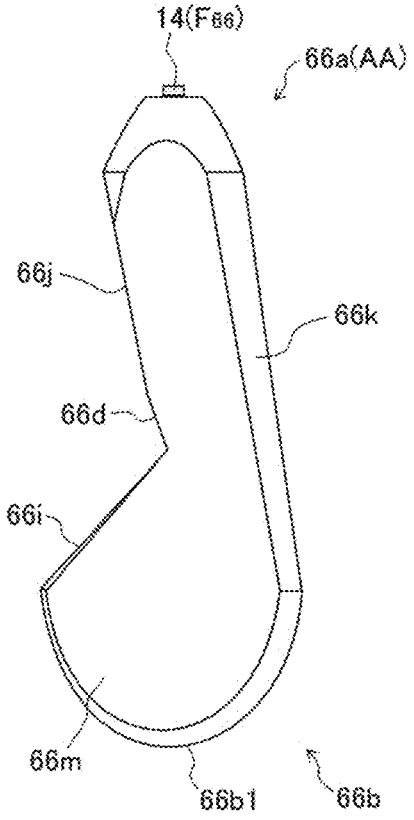
FIG. 98B is a bottom view thereof.
Figure 99A:
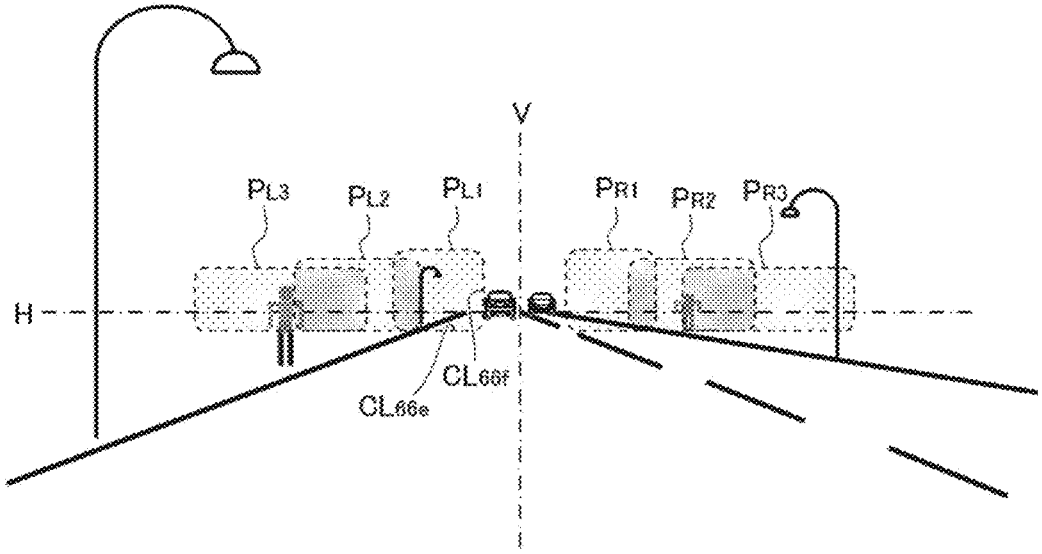
FIGS. 99A and 99B are examples of ADB light distribution patterns $P_{L1}$ to $P_{L3}$ and $P_{R1}$ to $P_{R3}$ which are formed by the vehicular lighting fixture 64 (lens body 66).
Figure 99B:
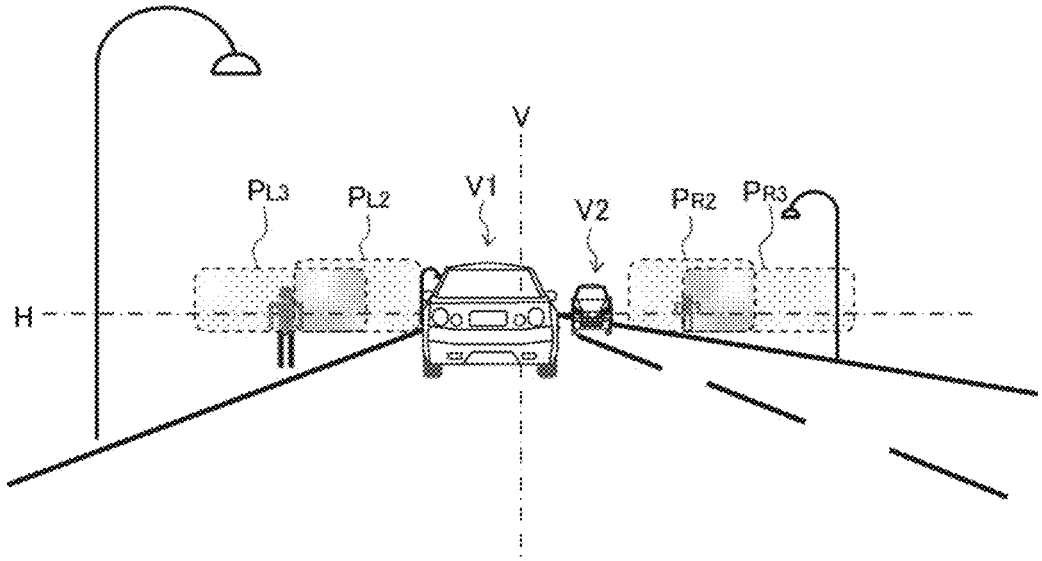

FIG. 96 is a perspective view of the vehicular lighting fixture 64 (lens body 66), FIG. 97A is a rear view of the lens body 66, and FIG. 97B is a top view, FIG. 97C is a front view, FIG. 97D is a left side view, FIG. 98A is a right side view, and FIG. 98B is a bottom view thereof. FIG. 99A and FIG. 99B are examples of ADB light distribution patterns $P_{L1}$ to $P_{L3}$ and $P_{R1}$ to $P_{R3}$ formed by the vehicular lighting fixture 64 (lens body 66).

As illustrated in FIG. 96 to FIG. 98, the vehicular lighting fixture 64 of this embodiment includes a light source 14, a lens body 66 which is disposed in front of the light source 14 and the like, and forms an ADB light distribution pattern (e.g. ADB light distribution pattern $P_{L1}$) depicted in FIG. 99A on a virtual vertical screen (disposed in front of the front surface of the vehicle by about 25 m), which faces the front surface of the vehicle.

A light distribution-variable type vehicular lighting fixture (ADB: Adaptive Driving Beam) can be implemented by using a plurality of vehicular lighting fixture 64.

For example, three vehicular lighting fixtures $\mathbf{64}_{L1}$ to $\mathbf{64}_{L3}$, which are configured to form three ADB light distribution patterns $P_{L1}$ to $P_{L3}$ disposed on the left of the vertical line V in FIG. 99A, and three vehicular lighting fixtures $\mathbf{64}_{R1}$ to $\mathbf{64}_{R3}$, which are configured to form three ADB light distribution patterns $P_{R1}$ to $P_{R3}$ disposed on the right side of the vertical line V, are prepared. Then a controller, such as a CPU, determines whether an irradiation-prohibited object (e.g. preceding vehicle or oncoming vehicle) exists in front of this vehicle, based on the detection result of an imaging apparatus (e.g. CCD camera) or the like, which functions as a detection unit to detect an object in front of this vehicle in which these vehicular lighting fixtures $\mathbf{64}_{L1}$ to $\mathbf{64}_{L3}$ and $\mathbf{64}_{R1}$ to $\mathbf{64}_{R3}$ are installed, and if it is determined that an irradiation-prohibited object exists, the corresponding light source 14 is turned OFF or dimmed so that the ADB light distribution pattern is not formed in a region where the irradiation-prohibited object exists. FIG. 99B is an example when the corresponding light source 14 is turned OFF, so that the ADB light distribution patterns $P_{L1}$ and $P_{R1}$ are not formed in a region where the irradiation-prohibited object (e.g. preceding vehicle V1 or oncoming vehicle V2) exists.

The ADB light distribution pattern disposed on the left side of the vertical line V in FIG. 99A (e.g. ADB light distribution pattern $P_{L1}$) is formed by the lens body 66 illustrated in, for example, FIG. 96 to FIG. 98. The ADB light distribution pattern disposed on the right side of the vertical line V in FIG. 99A (e.g. ADB light distribution pattern $P_{R1}$) is formed by a lens body (not illustrated) having a shape which is a laterally inverted shape of the lens body 66 illustrated in, for example, FIG. 96 to FIG. 98. In other words, the lens body 66, which forms the ADB light distribution pattern disposed on the left side of the vertical line V (e.g. ADB light distribution pattern $P_{L1}$), and the lens body which forms the ADB light distribution pattern disposed on the right side of the vertical line V (e.g. ADB light distribution pattern $P_{R1}$), have substantially the same bilateral symmetric shape. Hence the lens body 66, which forms the ADB light distribution pattern disposed on the left side of the vertical line V (e.g. ADB light distribution pattern $P_{L1}$), will be described herein below, and description on the lens body, which forms the ADB light distribution pattern disposed on the right side of the vertical line V (e.g. ADB light distribution pattern $P_{R1}$), will be omitted.

As illustrated in FIG. 97B and FIG. 97D, the light source 14 is disposed near the rear end portion 66*a* of the lens body 66 (near the reference point $F_{66}$ in the optical design), so that the light emitting surface thereof is directed forward. The optical axis $AX_{14}$ of the light source 14 may match with the reference axis $AX_{66}$ extending in the front-back direction of the vehicle, or may be inclined from the reference axis $AX_{66}$.

The lens body $66_{L1}$, which forms the ADB light distribution pattern $P_{L1}$ illustrated in FIG. 99A, will be described below.

The lens body $66_{L1}$ is a lens body disposed in front of the light source 14, and includes a rear end portion 66*a* and a front end portion 66*b*, and is configured as a lens body which forms the ADB light distribution pattern $P_u$ including a lower cut-off line $CL_{66e}$ and a vertical cut-off line $CL_{66f}$ as illustrated in FIG. 99A, when the light from the light source 14 which entered the lens body $66_L$ is emitted from the front end portion 66*b* (emission surface 66*b*1), and is irradiated forward. The lens body $66_{L1}$ is integrally molded by injecting transparent resin (e.g. polycarbonate, acrylic), and cooling and solidifying the resin (by injection molding).

The lens body $66_{L1}$ has an upper reflection surface 66*c* and a vertical reflection surface 66*d* disposed between the rear end portion 66*a* and the front end portion 66*b* thereof. The tip portion of the upper reflection surface 66*c* and the tip portion of the vertical reflection surface 66*d* include shades 66*e* and 66*f* respectively.

The rear end portion 66*a* of the lens body $66_{L1}$ includes an entrance portion AA through which the light from the light source 14 enters the lens body $66_{L1}$, and a reflection surface 66*a*3 on which the light from the light source 14, which entered the lens body $66_{L1}$ through the entrance portion AA, is internally reflected (total reflection).

Figure 100A:
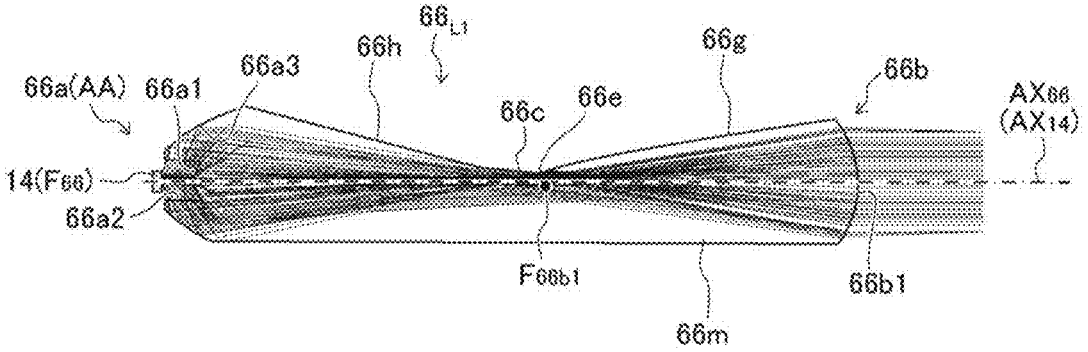
FIG. 100A is a longitudinal cross-sectional view of the lens body 66.
Figure 100B:
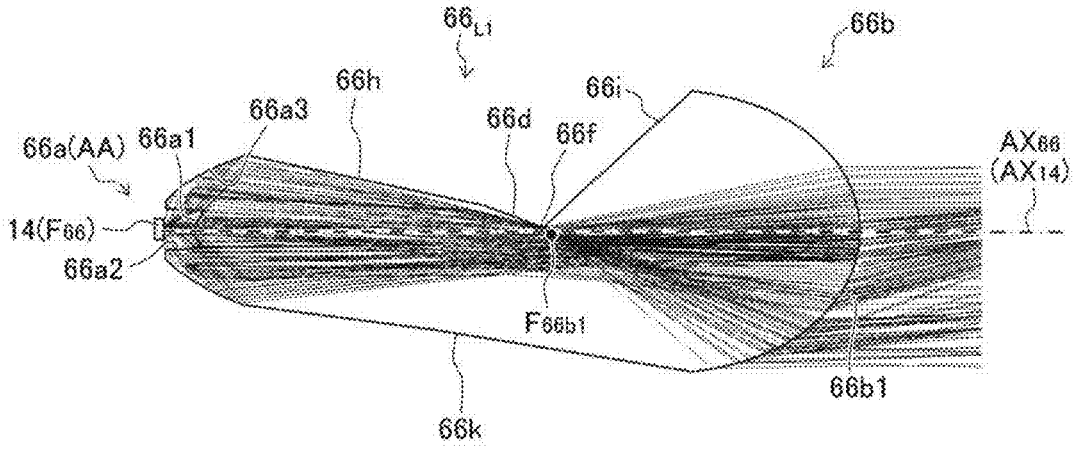
FIG. 100B is a lateral cross-sectional view thereof.

FIG. 100A is a longitudinal cross-sectional view of the lens body $66_{L1}$, and FIG. 100B is a lateral cross-sectional view thereof.

As illustrated in FIG. 100A and FIG. 100B, the entrance portion AA includes a first entrance surface 66*a*1 which curves upward toward the light source 14, and a second entrance surface 66*a*2 which has a cylindrical shape which extends backward from the outer periphery of the first entrance surface 66*a*1, and surrounds the space between the light source 14 and the first entrance surface 66*a*1.

The reflection surface 66*a*3 is disposed outside the second entrance source 66*a*2, and internally reflects (total reflection) the light from the light source 14 which entered the lens body $66_{L1}$ through the second entrance surface 66*a*2.

The front end portion 66*b* of the lens body $66_{L1}$ includes the emission surface 66*b*1.

The entrance portion AA (first entrance surface 66*a* and second entrance surface 66*a*2), the reflection surface 66*a*3, the upper reflection surface 66*c*, the vertical reflection surface 66*d*, and the front end portion 66*b* (emission surface 66*b*1) constitute an optical system, which forms the ADB light distribution pattern $P_{L1}$, including the cut-off lines $CL_{66e}$ and $CL_{66f}$ specified by the shade 66*e* of the upper reflection surface 66*c* and the shade 66*f* of the vertical reflection surface 66*d*, on the lower edge and on one side edge (side edge on the vertical line V side in FIG. 99A) of the pattern, as illustrated in FIG. 99A, when the light partially shielded by the shade 66*e* of the upper reflection surface 66*c* and the shade 66*f* of the vertical reflection surface 66*d* and the light internally reflected by the upper reflection surface 66*c* and the vertical reflection surface 66*d*, out of the light from the light source 14 which entered the lens body $66_{L1}$ through the entrance portion AA (first entrance surface 66*a* and the second entrance surface 66*a*2), are emitted from the front end portion 66*b* and are irradiated forward.

In concrete terms, the first entrance surface 66*a*1, the second entrance surface 66*a*2, the reflection surface 66*a*3, the upper reflection surface 66*c*, the vertical reflection surface 66*d* and the emission surface 66*b*1 constitute an optical system, which forms the ADB light distribution pattern $P_{L1}$, including the cut-off lines $CL_{66e}$ and $CL_{66f}$ specified by the shade 66*e* of the upper reflection surface 66*c* and the shade 66*f* of the vertical reflection surface 66*d*, on the lower edge and on one side edge (side edge on the vertical line V side in FIG. 99A) of the pattern, as illustrated in FIG. 99A, when the light partially shielded by the shade 66*e* of the upper reflection surface 66*c* and the shade 66*f* of the vertical reflection surface 66*d* and the light internally reflected (total reflection) by the upper reflection surface 66*c* and the vertical reflection surface 66*d*, out of the light from the light source 14 which entered the lens body $66_{L1}$ through the first entrance surface 66*a*1 and the light from the light source 14 which entered the lens body $66_{L1}$ through the second entrance surface 66*a*2 and internally reflected (total reflection) by the reflection surface 66*a*3, are emitted from the emission surface 66*b*1 and are irradiated forward.

The emission surface 66*b*1 is configured as a curved lens surface which extends forward. The focal point $F_{66b1}$ of the emission surface 66*b*1 is located near the intersection of the shade 66*e* of the upper reflection surface 66*c* and the shade 66*f* of the vertical reflection surface 66*d* (see FIG. 100A, FIG. 100B). The optical axis $AX_{66b1}$ of the emission surface 66*b*1 matches the reference axis $AX_{66}$ which extends toward the front-back direction of the vehicle.

The first entrance surface 66*a*1 is a surface through which the light from the light source 14 is refracted and enters the lens body $66_{L1}$, and is configured as a curved surface (e.g. free-form surface) which extends toward the light source 14. In concrete terms, the surface shape of the first entrance surface 66*a*1 is configured such that the light from the light source 14, which entered the lens body $66_{L1}$ through the first entrance surface 66a1, converges near the focal point $F_{66b1}$ of the emission surface 66b1 in the vertical direction and the horizontal direction (see FIG. 100A and FIG. 100B). The surface shape of the first entrance surface 66a1 is by no means limited to this, and may be configured such that the light from the light source 14, which entered the lens body $\mathbf{66}_u$ through the first entrance surface 66a1, is collimated in the vertical direction and the horizontal direction.

The second entrance surface 66a2 is a surface through which the light not entering the first entrance surface 66a1, out of the light from the light source 14, is refracted and enters the lens body $\mathbf{66}_{L1}$, and is configured as a cylindrical surface (e.g. free-form surface), which extends backward from the outer periphery of the first entrance surface 66a1 and surrounds the space between the light source 14 and the first entrance surface 66a1.

The reflection surface 66a3 is disposed outside the second entrance surface 66a2 and internally reflects (total reflection) the light from the light source 14 which enters the lens body $\mathbf{66}_{L1}$ through the second entrance surface 66a2, and is not formed by metal deposition. In concrete terms, the surface shape of the reflection surface 66a3 is configured such that the light from the light source 14, which entered the lens body $\mathbf{66}_{L1}$ through the second entrance surface 66a2 and is internally reflected (total reflection) by the reflection surface 66a3, is condensed near the focal point $F_{66b1}$ of the emission surface 66b1 in the vertical direction and the horizontal direction (see FIG. 100A and FIG. 100B). The surface shape of the reflection surface 66a3 is by no means limited to this, and may be configured such that the light from the light source 14, which is internally reflected by the reflection surface 66a3, is collimated in the vertical direction and the horizontal direction.

The shade 66e of the upper reflection surface 66c and the shade 66f of the vertical reflection surface 66d are included in a plane perpendicular to the reference axis $AX_{66}$. The cross-section of the lens body $\mathbf{66}_{L1}$ sectioned by this plane has an approximately rectangular shape, which includes the shade 66e (edge) of the upper reflection surface 66c and the shade 66f (edge) of the vertical reflection surface 66d.

The upper reflection surface 66c is configured as a reflection surface which internally reflects (total reflection) the light from the light source 14, and returns this light at the lower cut-off line $CL_{66e}$ specified by the shade 66e of the upper reflection surface 66c, so as to superimpose this light on the ADB light distribution pattern $P_L$. In concrete terms, the upper reflection surface 66c is configured as a plane shape reflection surface which is inclined in a direction of increasing distance from the reference axis $AX_{66}$ as the distance from the shade 66e of the upper reflection surface 66c increases backward, so that the reflected light from the upper reflection surface 66c is controlled to position at the upper side from the lower cut-off line $CL_{66e}$ (see FIG. 97D).

The upper reflection surface 66c is a reflection surface which totally reflects the light which entered the upper reflection surface 66c, out of the light from the light source 14 which entered the lens body $\mathbf{66}_{L1}$, and is not formed by metal deposition. The light which entered the upper reflection surface 66c, out of the light from the light source 14 which entered the lens body $\mathbf{66}_{L1}$, is internally reflected (total reflection) by the upper reflection surface 66c, is directed to the emission surface 66b1, is refracted by the emission surface 66b1, and is directed to the region where the ADB light distribution pattern $P_{si}$ is formed (predetermined region). In other words, the reflected light, which was internally reflected (total reflection) by the upper reflection surface 66c, is returned to the lower cut-off line $CL_{66e}$, and is superimposed on the ADB light distribution pattern $P_{L1}$.

According to the upper reflection surface 66c having the above configuration, a first advantage is that the lower cut-off line $CL_{66e}$ formed on the lower end edge of the ADB light distribution pattern $P_{L1}$ can be formed as a clear line. A second advantage is that distribution of the light from the light source 14 into a range which is outside the ADB light distribution pattern, (that is, a region lower than the lower cut-off line $CL_{66e}$) can be prevented. A third advantage is that the luminosity of the ADB distribution pattern $P_{L1}$, particularly the luminosity of an area near the lower cut-off line $CL_{66e}$, can be increased. This is because the light from the light source 14 which entered the lens body $\mathbf{66}_{L1}$ converges near the focal point $F_{66b1}$ of the emission surface 66b1 with respect to the vertical direction and the horizontal direction (see FIG. 100A and FIG. 100B), and because the reflected light internally reflected (total reflection) by the upper reflection surface 66c is returned at the lower cut-off line $CL_{66e}$, and is superimposed on the ADB light distribution pattern $P_{L1}$.

The vertical reflection surface 66d is configured as a reflection surface which internally reflects (total reflection) the light from the light source 14, and returns this light at the vertical cut-off line $CL_{66f}$ specified by the shade 66f of the vertical reflection surface 66d, so as to superimpose this light on the ADB light distribution pattern $P_{L1}$. In concrete terms, the vertical reflection surface 66d is configured as a plane-shaped reflection surface which is inclined in a direction of increasing distance from the reference axis $AX_{66}$ as the distance from the shade 66f of the vertical reflection surface 66d increases backward, so that the reflected light from the vertical reflection surface 66d is controlled to be on the left side from the vertical cut-off line $CL_{66f}$ (see FIG. 97B).

The vertical reflection surface 66d is a reflection surface which totally reflects the light which entered the vertical reflection surface 66d, out of the light from the light source 14 which entered the lens body $\mathbf{66}_{L1}$, and is not formed by metal deposition. The light which entered the vertical reflection surface 66d, out of the light from the light source 14 which entered the lens body $\mathbf{66}_{L1}$, is internally reflected (total reflection) by the vertical reflection surface 66d, is directed to the emission surface 66b1, is refracted by the emission surface 66b1, and is directed to the region where the ADB light distribution pattern $P_{L1}$ is formed (predetermined region). In other words, the reflected light, which as internally reflected (total reflection) by the vertical reflection surface 66d, is returned at the vertical cut-off line $CL_{66f}$, and is superimposed on the ADB light distribution pattern $P_{L1}$.

According to the vertical reflection surface 66d having the above configuration, a first advantage is that the vertical cut-off line $CL_{66f}$ formed on one side edge of the ADB light distribution pattern $P_{L1}$ (side edge on the vertical line V side in FIG. 99A) can be formed as a clear line. A second advantage is that distribution of the light from the light source 14 into a range which is outside the ADB light distribution pattern, (that is, a region on the vertical line V side from the vertical cut-off line $CL_{66f}$), can be prevented. As a result, the generation of glare on the irradiation-prohibited object (e.g. preceding vehicle or oncoming vehicle) in front of this vehicle can be effectively controlled. A third advantage is that the luminosity of the ADB light distribution pattern $P_{L1}$, particularly the luminosity of an area near the vertical cut-off line $CL_{66f}$, can be increased. This is because the light from the light source 14, which entered the lens body $\mathbf{66}_{L1}$, converges near the focal point $F_{66b1}$ of the emission surface 66b1 with respect to the vertical direction and the horizontal direction (see FIG. 100A and FIG. 100B), and because the reflected light internally reflected (total reflection) on the vertical reflection surface 66d is returned at the vertical cut-off line $CL_{66f}$, and is superimposed on the ADB light distribution pattern $P_{L1}$.

As illustrated in FIGS. 97B and 97D, a plane-shaped surface 66g, which extends in roughly a horizontal direction (a bridging surface for which an optical function is not intended), is formed between the tip (shade 66d) of the upper reflection surface 66c and the upper edge of the emission surface 66b1. Further, a plane-shaped surface 66h, which is inclined in a direction of increasing distance from the reference axis $AX_{66}$ as the distance increases backward from the rear edge of the upper reflection surface 66c (a bridging surface for which an optical function is not intended), is formed between the rear edge of the upper reflection surface 66c and the upper edge of the reflection surface 66a3.

Further, a plane-shaped surface 66i, which is inclined in a direction of decreasing distance from the reference axis $AX_{66}$ as the distance increases backward from the left side edge of the emission surface 66b1 (a bridging surface for which the optical function is not intended), is formed between the tip (shade 66f) of the vertical reflection surface 66d and the left side edge of the emission surface 66b1. Furthermore, a plane-shaped surface 66j, which is inclined in a direction of increasing distance from the reference axis $AX_{66}$ as the distance increases backward from the rear end edge of the vertical reflection surface 66d (bridging surface for which the optical function is not intended), is formed between the rear end edge of the vertical reflection surface 66d and the left side edge of the reflection surface 66a3.

Further, a plane-shaped surface 66k, which is inclined in a direction decreasing distance from the reference axis $AX_{66}$ as the distance increases backward from the right side edge of the emission surface 66b1 (a bridging surface for which optical function is not intended), is formed between the right side edge of the emission surface 66b1 and the right side edge of the reflection surface 66a3.

Further, the lower surface 66m of the lens body $\mathbf{66}_{L1}$ is also a plane-shaped surface, which extends roughly in the horizontal direction (a bridging surface for which the optical function is not intended).

Each bridging surface is not limited to the above description, but may have a curved shape instead of a plane shape.

By the lens body $\mathbf{66}_{L1}$ having the above configuration, the ADB light distribution pattern $P_{L1}$ illustrated in FIG. 99A is formed on the virtual vertical screen.

The lower end portion of the ADB light distribution pattern $P_{L1}$ illustrated in FIG. 99A is located lower than the horizontal line H, because the positional relationship between the focal point $F_{66b1}$ of the emission surface 66b1 and the upper reflection surface 66c, and the inclination of the reference axis $AX_{62}$ and/or the surface shape of the emission surface 66b1, are adjusted, so that the lower end portion of the ADB light distribution pattern $P_{L1}$ is located lower than the horizontal line H.

Figure 101:
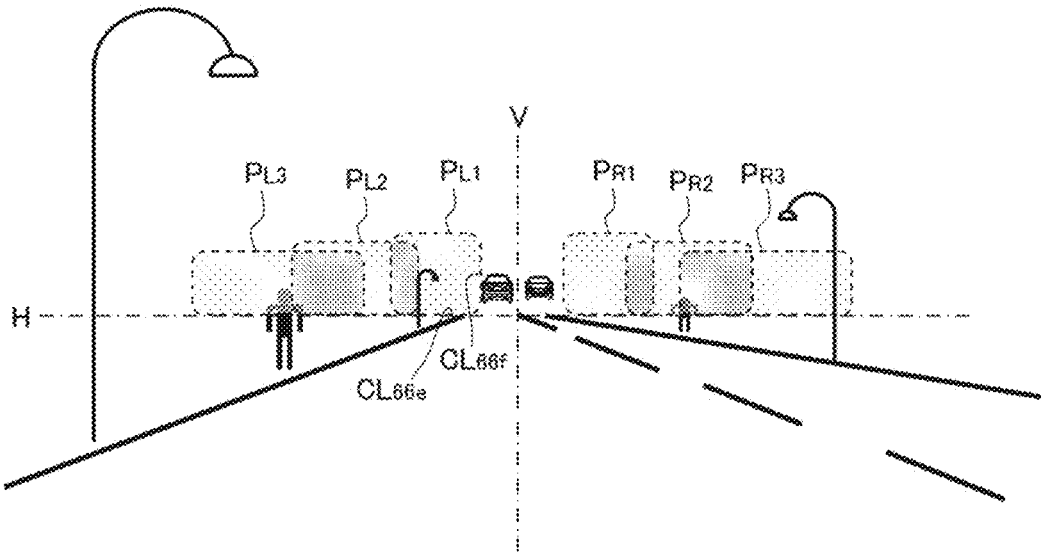
FIG. 101 is an example of the ADB light distribution patterns $P_{L1}$ to $P_{L3}$ and $P_{R1}$ to $P_{R3}$ (modification) which are formed by the vehicular lighting fixture 64 (lens body 66).

The position of the ADB light distribution pattern $P_{L1}$ is by no means limited to the above description, but the ADB light distribution pattern $P_{L1}$ may be formed on any appropriate position by adjusting the positional relationship between the focal point $F_{66b1}$ of the emission surface 66b1 and the upper reflection surface 66c, and the inclination of the reference axis $AX_{62}$ and/or the surface shape of the emission surface 66b1. For example, each ADB light distribution pattern may be formed such that the lower end portion thereof is located on the horizontal line H, as illustrated in FIG. 101.

The lens bodies $\mathbf{66}_{L2}$ and $\mathbf{66}_{L3}$, which form the ADB light distribution patterns $P_{L2}$ and $P_{L3}$, other than the ADB light distribution pattern $P_{L1}$ illustrated in FIG. 99A, can be configured by adjusting the surface shape of each emission surface 66b1, and/or the roughly rectangular cross-sectional profile (or size), including the shade 66e (edge) of the upper reflection surface 66c and the shade 66f (edge) of the vertical reflection surface 66d.

According to this embodiment, the following effect can be demonstrated by the functions of the upper reflection surface 66c and the vertical reflection surface 66d.

A first effect is that the ADB light distribution pattern $P_{L1}$, which includes the cut-off lines specified by the shade 66e of the upper reflection surface 66c and the shade 66f of the vertical reflection surface 66d (lower cut-off line $CL_{66e}$ and vertical cut-off line $CL_{66f}$), can be formed on the lower edge and on one side edge of the pattern.

A second effect is that the lower cut-off line $CL_{66e}$, formed on the lower edge of the ADB light distribution pattern $P_{L1}$, and the vertical cut-off line $CL_{66f}$, formed on one side edge, can be formed as clear lines.

A third effect is that distribution of light from the light source into the range which is outside the ADB light distribution pattern, (that is, a region lower than the lower cut-off line), can be prevented. In the same manner, distribution of light from the light source 14, in a region on the vertical line V side from the vertical cut-off line $CL_{66f}$, can be prevented. As a result, generation of glare on the irradiation-prohibited object (e.g. preceding vehicle or oncoming vehicle) in front of this vehicle can be effectively controlled.

A fourth effect is that a shift of the lower cut-off line $CL_{66}$, and the vertical cut-off line $CL_{66f}$ of the ADB light distribution pattern $P_u$ can be prevented, even if the relative positional relationship of the lens body 66 with respect to the light source 14 shifts from the design values due to assembly error or the like.

A vehicular lighting fixture 74 (lens body 76) of Embodiment 13 will be described next with reference to the drawing.

The vehicular lighting fixture 74 (lens body 76) of this embodiment is configured as follows.

Figure 102:
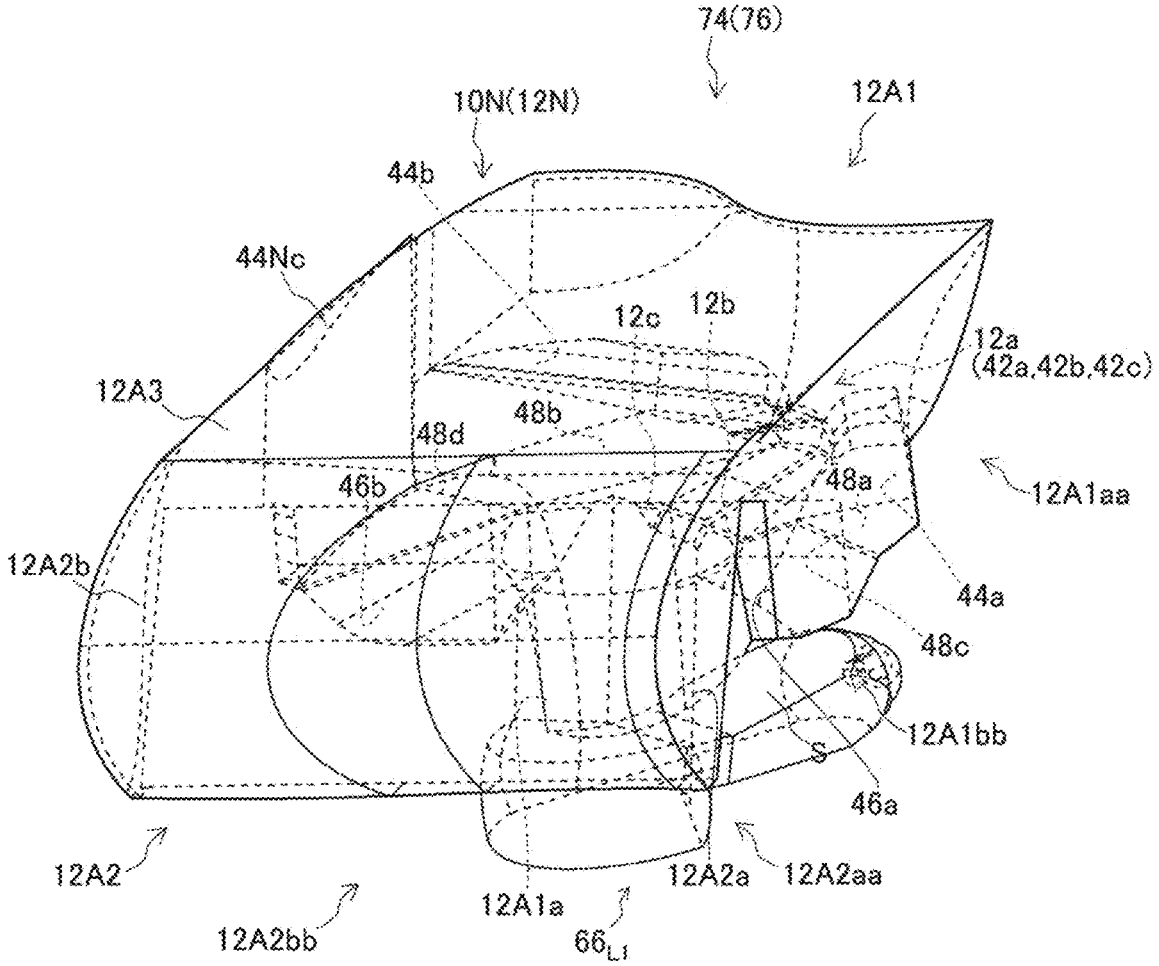

FIG. 102 is a perspective view of the vehicular lighting fixture 74 (lens body 76), and FIG. 103A is a rear view, FIG. 103B is a front view, FIG. 103C is a bottom view, and FIG. 103D is a right side view thereof.

As illustrated in FIG. 102 and FIG. 103, the vehicular lighting fixture 74 (lens body 76) corresponds to a combination of the vehicular lighting fixture 10N (lens body 12N) of Embodiment 8 illustrated in FIG. 62, and the vehicular lighting fixture 64 (lens body 66) of Embodiment 12 illustrated in FIG. 96.

The lens body 12N is hereafter called "first lens unit 12N" and the lens body 66 is hereafter called "second lens unit 66".

As illustrated in FIG. 103A and FIG. 103D, the lens body 74 includes a first lens unit 12N, a second lens unit $\mathbf{66}_{L1}$, and a connecting unit 68 which connects the first lens unit 12N and the second lens unit $\mathbf{66}_{L1}$, and is integrally molded by injecting transparent resin (e.g. polycarbonate and acrylic), and cooling and solidifying the resin (by injection molding). In other words, each lens unit 12N and $\mathbf{66}_{L1}$ are interconnected without a boundary surface by being integrally molded.

Figure 104:
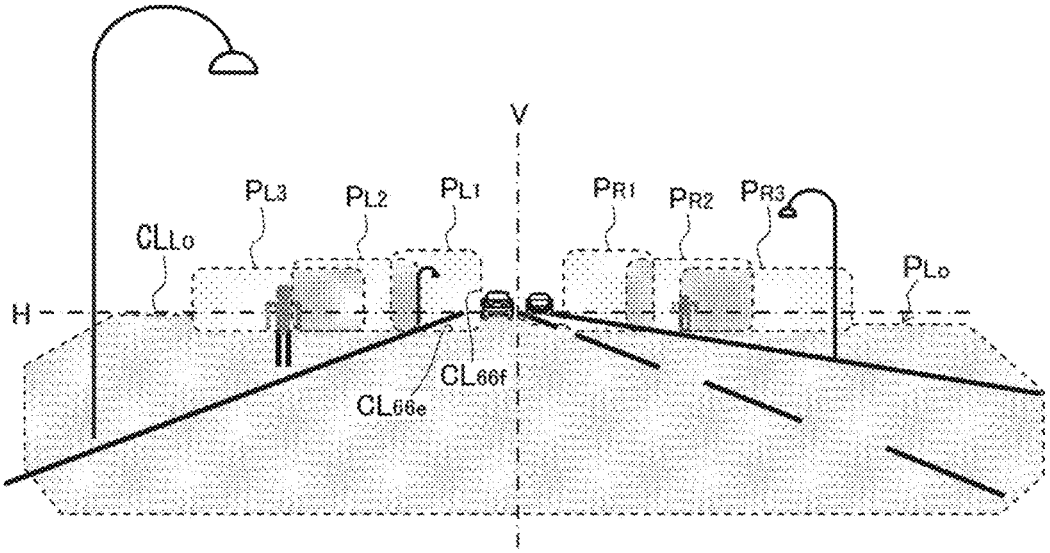

FIG. 104 illustrates examples of the low beam light distribution pattern $P_{Lo}$ formed by the first lens unit 12N and the ADB light distribution patterns $P_{L1}$ to $P_{L3}$ and $P_{R1}$ to $P_{R3}$, which are formed by the second lens unit 66 or the like. As illustrated in FIG. 104, the ADB light distribution patterns $P_{L1}$ to $P_{L3}$ and $P_{R1}$ to $P_{R3}$ are disposed in the horizontal direction in the state where the lower end portions thereof are partially superimposed on the upper portion of the low beam light distribution pattern $P_{Lo}$. The positions of the ADB light distribution patterns $P_{L1}$ to $P_{L3}$ and $P_{R1}$ to $P_{R3}$ are by no means limited to the above description, but the ADB light distribution patterns $P_{L1}$ to $P_{L3}$ and $P_{R1}$ to $P_{R3}$ may be disposed in the horizontal direction in the state where the lower end portions thereof are not superimposed on the upper portion of the low beam light distribution pattern $P_{Lo}$.

The first lens unit 12N has the same configuration as the lens body 12N illustrated in FIG. 63. In other words, as illustrated in FIG. 103A or the like, the first lens unit 12N, is a lens unit which is disposed in front of the first light source $\mathbf{14}_{Lo}$ and includes a rear end portion 12A1*aa* and a front end portion 12A2*bb*, and is configured as a lens unit which forms the low beam light distribution pattern $P_{Lo}$ including the cut-off line $CL_{Lo}$ on the upper edge, as illustrated in FIG. 104, when the light from the first light source $\mathbf{14}_{Lo}$, which entered the first lens unit 12N, is emitted from the front end portion 12A2*bb* (second emission surface 12A2*b*) of the first lens unit 12N and is irradiated forward. The low beam light distribution pattern $P_{Lo}$, which includes the cut-off line $CL_{Lo}$ on the upper edge, corresponds to the "first light distribution pattern including the first cut-off line".

The second lens unit $\mathbf{66}_{L1}$ has the same configuration as the lens body $\mathbf{66}_{L1}$ illustrated in FIG. 96. In other words, as illustrated in FIG. 103A or the like, the second lens unit $\mathbf{66}_{L1}$ is a lens unit which is disposed in front of the second light source $\mathbf{14}_{ADB}$, and includes the rear end portion 66*a* and the front end portion 66*b*, and is configured as a lens unit which forms the ADB light distribution pattern $P_{L1}$ including the lower cut-off line $CL_{66e}$ and the vertical cut-off line $CL_{66f}$, as illustrated in FIG. 104, when the light from the second light source $\mathbf{14}_{ADB}$, which entered the second lens unit $\mathbf{66}_{L1}$, is emitted from the front end portion 66*b* (emission surface 66*b*1) and is irradiated forward. The ADB light distribution pattern $P_{L1}$, which includes the lower cut-off line $CL_{66e}$ and the vertical cut-off line $CL_{66f}$, corresponds to the "second light distribution pattern including the second cut-off line".

The first lens unit 12N and the second lens unit $\mathbf{66}_{L1}$ are integrally molded in a positional state, so that the relative positional relationship between the low beam light distribution pattern $P_{Lo}$ (cut-off line $CL_{Lo}$) and ADB light distribution pattern$_{L1}$ (cut-off lines $CL_{66e}$ and $CL_{66f}$) becomes a predetermined positional relationship (e.g. see FIG. 104).

The first lens unit 12N and the second lens unit $\mathbf{66}_{L1}$ are connected by the connecting unit 68. The connection is by no means limited to this, and the first lens unit 12N and the second lens unit $\mathbf{66}_{u}$ may be directly connected.

The connecting unit 68 connects a portion of the first lens unit 12N, for which optical function is not intended, and a portion of the second lens unit $\mathbf{66}_{L1}$, for which optical function is not intended. In concrete terms, as illustrated in FIG. 103A and FIG. 103D, the connecting unit 68 connects the lower surface of the first lens unit 12N and the surface 66*g*, which is formed between the rear edge of the upper reflection surface 66*c* and the upper edge of the reflection surface 66*a*3 of the second lens unit $\mathbf{66}_{L1}$ (see FIG. 96). The connection is by no means limited to the above description, and the connecting unit 68 may connect a surface other than the lower surface (e.g. side surface) of the first lens unit 12N and a surface other than the surface 66*g* (e.g. at least one of surface 66*h*, surface 66*i*, surface 66*j*, surface 66*k*, and the lower surface 66*m*) of the second lens unit $\mathbf{66}_{L1}$. Further, instead of being connected via the connecting unit 68, the first lens unit 12N and the second lens unit $\mathbf{66}_{L1}$ may be integrally molded by directly connecting a portion of the first lens unit 12N, for which optical function is not intended (e.g. lower surface of the first lens unit 12N), and a portion of the second lens unit $\mathbf{66}_{L1}$, for which optical function is not intended (e.g. surface 66*g*).

According to this embodiment, the following effects can be demonstrated in addition to the effects of Embodiment 12.

In other words, in the lens body 76 having the first lens unit 12N which forms the low beam light distribution pattern $P_{Lo}$, including the cut-off line $CL_{Lo}$ on the upper end edge, and the second lens unit $\mathbf{66}_{L1}$ which forms the ADB light distribution pattern $P_{L1}$, including the cut-off line (e.g. lower cut-off line $CL_{66e}$ and vertical cut-off line $CL_{66f}$), the lens body in which the relative positional relationship between the low beam light distribution pattern $P_{Lo}$ (cut-off line $CL_{Lo}$) and the ADB light distribution pattern $P_{L1}$ (cut-off lines $CL_{66e}$ and $CL_{66f}$) does not shift as time elapses, can be provided. As a result, an aiming adjustment mechanism, and a correction of the relative positional relationship between the low beam light distribution pattern $P_{Lo}$ and the ADB light distribution pattern $P_{L1}$ using the aiming adjustment mechanism are not needed.

This is because the first lens unit 12N and the second lens unit $\mathbf{66}_{L1}$ are integrally molded in a positioned state so that the relative positional relationship between the low beam light distribution pattern $P_{Lo}$ (cut-off line $CL_{Lo}$) and the ADB light distribution pattern $P_{L1}$ (cut-off lines $CL_{66e}$ and $CL_{66f}$) is a predetermined positional relationship.

As mentioned above, the concept that "the first lens unit which forms the first light distribution pattern, including the first cut-off line, and the second lens unit which forms the second light distribution pattern, including the second cut-off line, are integrally molded so that the relative positional relationship between the first light distribution pattern (first cut-off line) and the second light distribution pattern (second cut-off line) becomes a predetermined positional relationship" may be applied not only to the vehicular lighting fixture 10N (lens body 12N) of Embodiment 8 illustrated in FIG. 62 and the vehicular lighting fixture 64 (lens body 66) of Embodiment 12 illustrated in FIG. 96, but may also be applied to the vehicular lighting fixture (lens body) of each embodiment mentioned above, and to various other vehicular lighting fixtures (lens bodies).

For example, for the first lens unit, the lens body 12 of Embodiment 1 illustrated in FIG. 1, the lens body 12A of Embodiment 2 illustrated in FIG. 16, the lens body 12J of Embodiment 6 illustrated in FIG. 39, the lens body 12K of Embodiment 7 illustrated in FIG. 49, or the lens body 66 of the Embodiment 12 illustrated in FIG. 96 may be used instead of the lens body 12N of Embodiment 8 illustrated in FIG. 62. This is because all of these lens bodies are the first lens units which forms the first light distribution pattern including the first cut-off line.

Further, for the second lens unit, the lens body 12 of Embodiment 1 illustrated in FIG. 1, the lens body 12A of Embodiment 2 illustrated in FIG. 16, the lens body 12J of Embodiment 6 illustrated in FIG. 39, the lens body 12K of Embodiment 7 illustrated in FIG. 49, or the lens body 12N of Embodiment 8 illustrated in FIG. 62 may be used instead of the lens body 66 of Embodiment 12 illustrated in FIG. 96.

This is because all of these lens bodies are the second lens units which forms the second light distribution pattern including the second cut-off line.

Next, the vehicle lighting device of the fourteenth embodiment 10Q (lens body 12Q), will be described with reference to the drawings.

Vehicle lamp 10Q of the present embodiment (the lens body 12Q) is constructed as follows.

Figure 105:
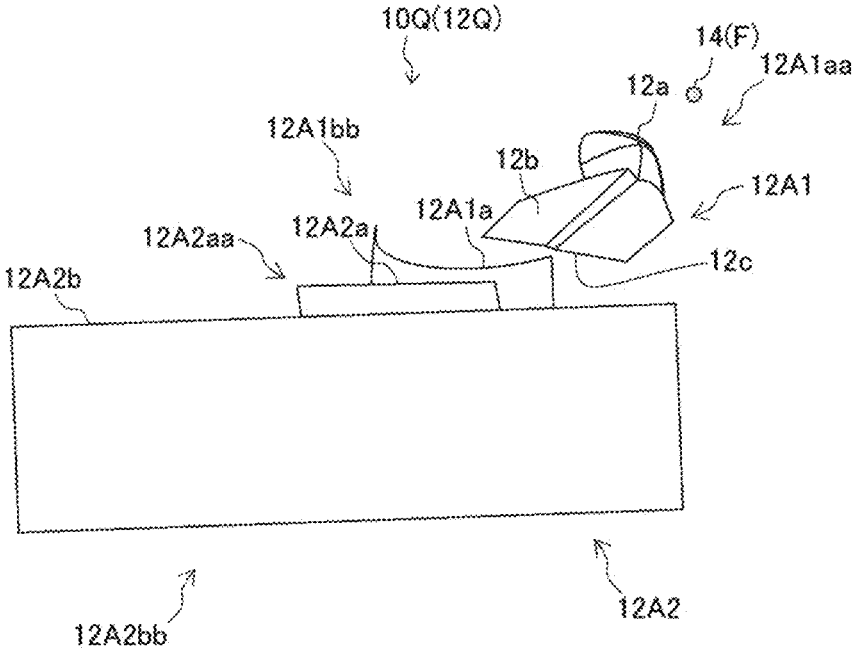
Figure 106A:
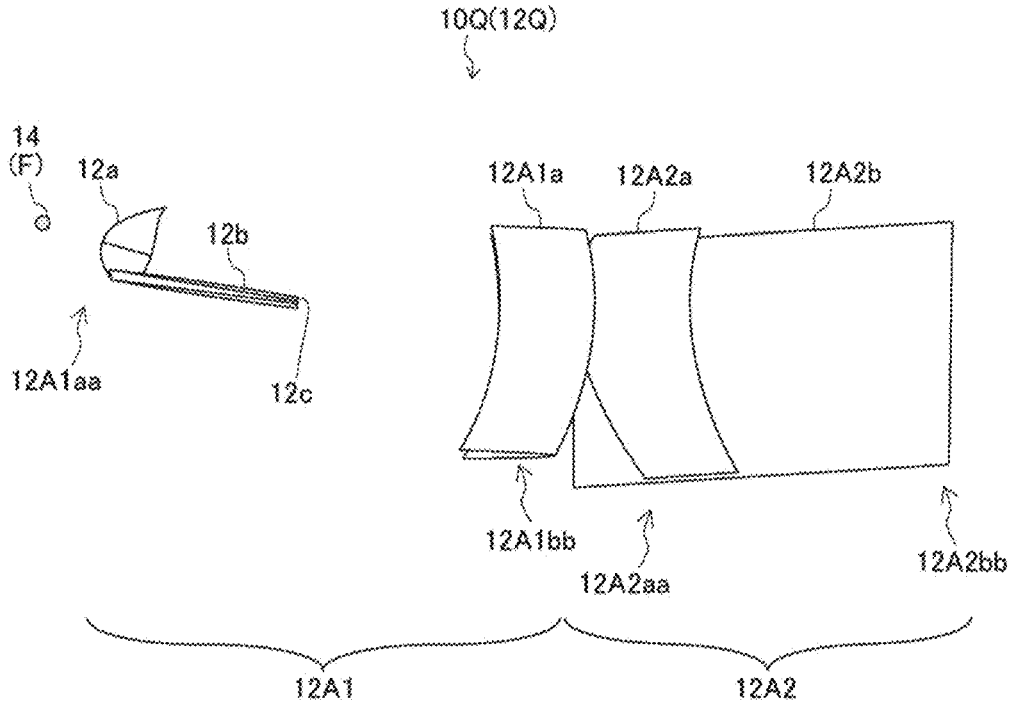
Figure 106B:
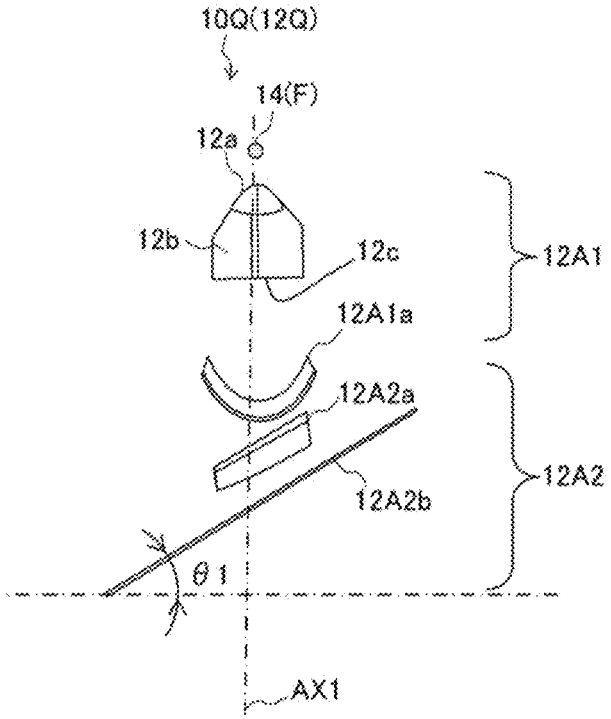
Figure 107A:
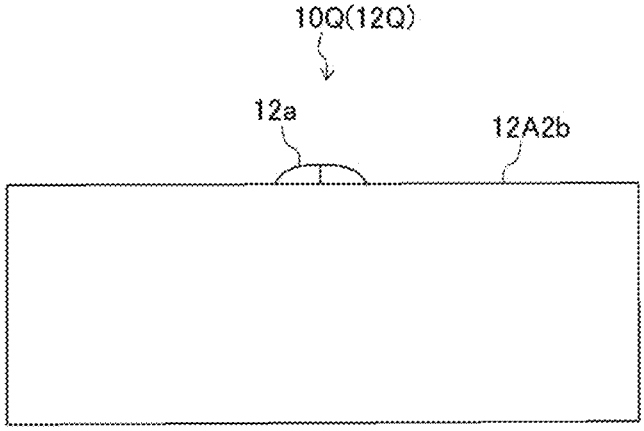
Figure 107B:
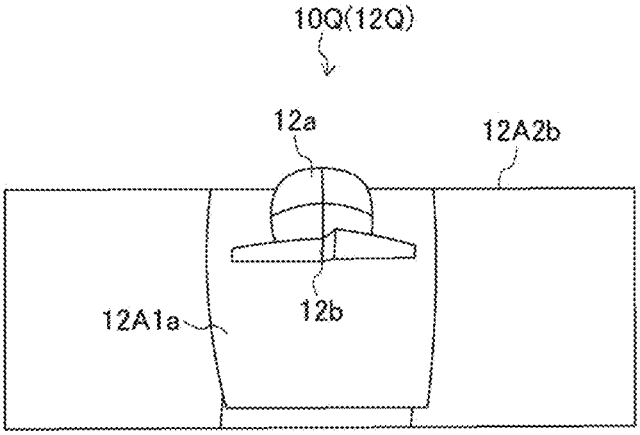

FIG. 105 is a perspective view of the vehicular lamp 10Q (lens body 12Q) (Major optical surface only), FIG. 106 A is a side view (main optical surfaces only), FIG. 106 B is a top view (main optical surface only), FIG. 107 A is a front view (main optical surfaces only), FIG. 107 B is a rear view (the main optical surfaces only).

As shown in FIG. 105 through FIG. 107, the vehicle lamp 10Q of the present embodiment (the lens body 12Q) the final exit surface of a second embodiment of the vehicular lamp 10A shown in FIG. 16 (lens body 12A) (second the exit surface 12A2*b*) correspond to those configured as a surface of a planar shape.

When comparing the vehicle lamp 10A of the vehicular lamp 10Q and the second embodiment of the present embodiment, it is mainly different in the following points.

First, in the above-described vehicle lamp 10A of the second embodiment, the final exit surface (second output surface 12A2*b*) is semi-cylindrical surface is configured as a (cylindrical surface), a vertical condenser whereas was in charge, in the vehicle lamp 10Q of the present embodiment, the final exit surface (second output surface 12A2*b*) is configured as a surface of a planar shape, it is responsible for the vertical condenser no (or almost no charge) points.

Secondly, in the vehicle lamp 10A of the second embodiment, the first intermediate output surface (first output surface 12A1*a*) and an intermediate incidence surface (second incident surface 12A2*a*), respectively, the curvature relates vertically grant has been yet no (see etc. FIG. 17 A), whereas no charge in the vertical direction of the condenser (or little charge), in the vehicle lamp 10Q of the present embodiment, the first intermediate exit face at least one of (first output surface 12A1*a*) and an intermediate incidence surface (second incident surface 12A2*a*) has curvature is imparted relates vertical direction (see FIG. 106 A), the vertical condenser that is in charge of.

Otherwise, the same configuration as the vehicle lamp 10A of the second embodiment. Hereinafter abbreviated said second focuses on the differences from the vehicle lighting device 10A embodiment, a description thereof will be denoted by the same reference numerals are given to the same configuration as the vehicle lamp 10A of the second embodiment.

As shown in FIG. 105 through FIG. 107, the vehicle lamp 10Q of the present embodiment, similar to the vehicle lamp 10A of the second embodiment, a light source 14, a first lens unit 12A1 disposed in front of the light source 14, a second lens portion 12A2 disposed in front of the first lens unit 12A1, provided with light from the light source 14 is irradiated forward through the first lens portion 12A1 and the second lens portion 12A2 in this order the Rukoto, are configured to form a light distribution pattern for low beam, including a cut-off line to the upper edge.

The first lens portion 12A1 and the second lens portion 12A2 of the present embodiment is respectively similar to the first lens portion 12A1 and the second lens portion 12A2 of the second embodiment configuration.

That is, the first lens portion 12A1 of the present embodiment is provided with a lower reflecting surface 12*b* disposed between the rear end portion 12A1*aa* the front end portion 12A1*bb* of the first lens portion 12A1. Tip of the lower reflecting surface 12*b* includes a shade 12*c*. The rear end portion 12A1*aa* of the first lens unit 12A1 includes a first entrance surface 12*a*. Front end 12A1*bb* of the first lens unit 12A1 includes a first intermediate output surface (the first output surface 12A1*a*). The rear end portion 12A2*aa* of the second lens unit 12A2 includes intermediate the entrance surface (the second entrance surface 12A2*a*). Front end 12A2*bb* of the second lens unit 12A2 includes a final exit surface (second exit surface 12A2*b*).

The first lens portion 12A1 and the second lens portion 12A2, as shown in FIG. 16 or the like, may be configured as a lens body that is connected by a connecting portion 12A3, as shown in FIG. 25, such as a lens holder it may be configured as linked lens body by a holding member 18.

Figure 108:
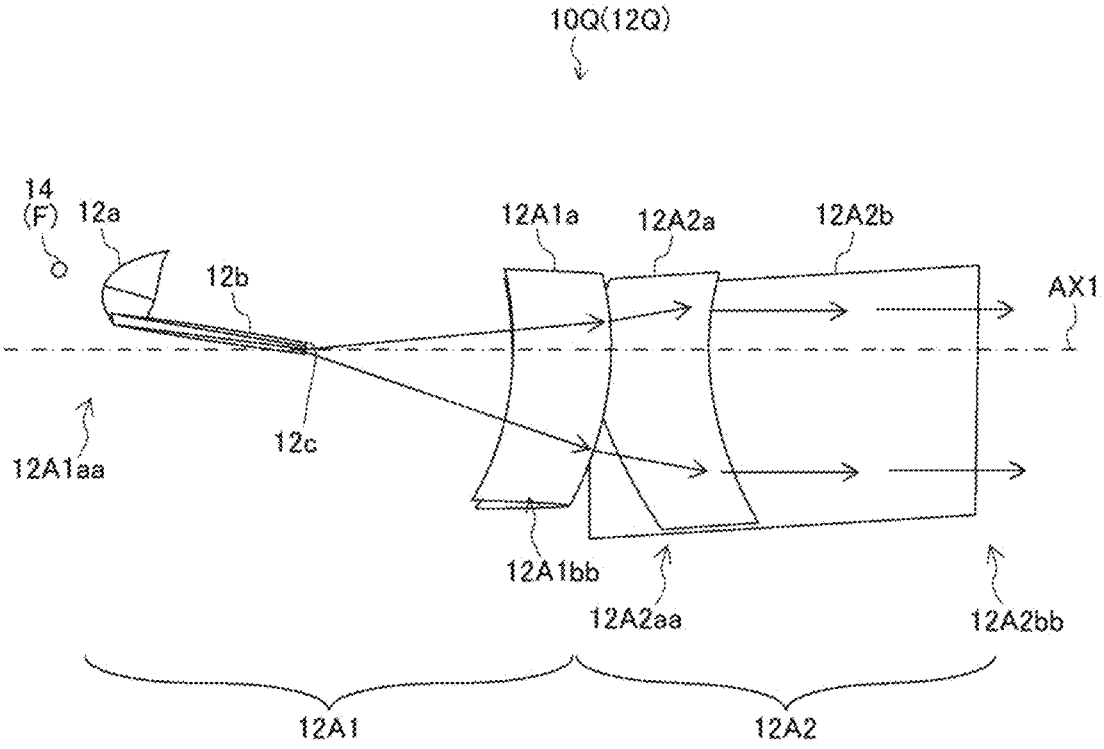

As shown in FIG. 108, the first incident surface 12*a*, the lower reflection surface 12 *b*, the first intermediate output surface (first output surface 12A1*a*), an intermediate incidence surface (second incident surface 12A2*a*) and final output surface (second output surface 12A2*b*) is internally reflected at the partial blocking light and the lower reflecting surface 12*b* by the shade 12*c* of the inner lower reflecting surface 12*b* of the light from the light source 14 incident from the first incident surface 12*a* inside the first lens portion 12A1 (all reflected) light is from the first intermediate output surface (first output surface 12A1*a*) emitted in the first lens unit 12A1 outside, further, intermediate the entrance surface (the second entrance surface 12A2*a*) inside the second lens portion 12A2 the incident and emitted from the final exit surface (second output surface 12A2*b*), by being irradiated forward, the first light distribution pattern including a cutoff line that is defined by the shade 12*c* of the lower reflecting surface 12*b* to the upper edge (e.g., it constitutes a first optical system for forming a light distribution pattern for low beam).

The final exit surface (second output surface 12A2*b*) is camber angle θ1 is given (see FIG. 106 B), and extending in a horizontal direction (FIG. 107 A refer) planar shape (e.g., outline a rectangle is configured as a surface of a planar shape) of the. Of course, not limited to this, the final exit surface (second output surface 12A2*b*), similar to that shown in FIG. 33, to slant angle θ2 may be configured as a surface of a planar shape which is imparted, camber angle θ1 and slant angle θ2 may be configured as a surface of a planar shape which is imparted.

Further, the final exit surface (second output surface 12A2*b*), as shown in FIG. 109 A, the surface of the planar shape camber angle θ1 and the slant angle θ2 is not granted, i.e., perpendicular to the first reference axis AX1 and, and, a planar shape extending in the horizontal direction (e.g., outer planar shape of a rectangle) may be configured as a surface of. Further, the final exit surface (second output surface 12A2*b*), as shown in FIG. 109 B, the lower end edge so as to be located forward with respect to the upper edge, is arranged in a posture which is inclined rearwardly obliquely upward it may, furthermore, the camber angle and/or slant angle may be granted. Conversely, the final exit surface (second output surface 12A2*b*), as its upper edge is located forward relative to the lower edge, may be arranged in a posture which is inclined rearwardly obliquely downward, further camber angular and/or slant angle may be granted.

Incidentally, when camber angle, as in the third embodiment, among the light distribution pattern for low beam, between the first intermediate output surface (first exit surface 12A1*a*) the intermediate incidence surface (second incident surface 12A2*a*) blurs without side is condensing interval is widened. Blurring which occurs due to the application of the camber angle can be improved by the technique described in the third embodiment.

Further, when imparting slant angle, as in the fourth embodiment, a state in which the light distribution pattern for low beam is rotated (or, it can be said blurred state) becomes. Rotation generated with the application of the slant angle can be suppressed by the technique described in the fourth embodiment.

The final exit surface (second output surface 12A2*b*) may be any surface of the planar shape is not limited to a flat surface (see FIG. 109 A) orthogonal to the first reference axis AX 1, slightly convex frontward it faces may be configured as a (FIG. 109 C references), conversely, it may be configured as a surface of slightly convex toward the rear. The final exit surface (second output surface 12A2*b*), by constituting a slightly convex surface toward the front (see FIG. 109 C), it is possible to emphasize the flat feeling.

At least one of the first intermediate output surface (first output surface 12A1*a*) and an intermediate incidence surface (second incident surface 12A2*a*) the final emitting surface light from a light source 14 for emitting the (second output surface 12A2*b*) (precisely the light from the reference point F) is relates to the vertical direction, so that the collimated light (parallel light rays with respect to the first reference axis AX 1), the surface shape is formed (see FIG. 108).

Light (precisely, the light from the reference point F) from a light source 14 that emits from the final exit surface (second output surface 12A2*b*) parallel relates vertical direction, with respect to the light (first reference axis AX1 collimated a ray) become the first intermediate output surface (first output surface 12A1*a*) and/or intermediate incidence surface (second incident surface 12A2*a*) (conditions such as the respective surface shape) is such slant angle and/or camber angle because different depending on the conditions, it is difficult to express in specific numerical values or the like.

However, for example, using a predetermined simulation software, gradually changing the surface shape of the first intermediate output surface (first output surface 12A1*a*) and/or intermediate incidence surface (second incident surface 12A2*a*) (adjustment), the final exit surface each time change (to be precise, the light from the reference point F) light from the light source 14 emitted from the (second output surface 12A2*b*) by checking the optical path of the final exit surface (second output surface light (more precisely from a light source 14 that emits from 12A2*b*), the light from the reference point F) is relates to the vertical direction, a first intermediate as a collimated light (rays parallel to the first reference axis AX 1) it can be found exit surface (first output surface 12A1*a*) and/or intermediate incidence surface (second incident surface 12A2*a*) (conditions such as the respective surface shape).

According to the vehicle lamp 10Q of the present embodiment (the lens body 12Q), in addition to the effects of such second embodiment, furthermore, it can achieve the following effects.

First, it is possible to provide a lens member 12Q and the vehicle lighting device 10Q having the same of appearance with a sense of unity, which extends linearly in a predetermined direction. This final exit surface (second output surface 12A2*b*) is by that it is configured as a surface of a planar shape.

Second, the final exit surface (second output surface 12A2*b*) is planar shape despite the lens body 12Q and which can form a light distribution pattern for low beam which is focused in the horizontal and vertical directions it is possible to provide a vehicle lamp 10Q with. This first intermediate output surface of the first lens portion 12A1 (first output surface 12A1*a*) is in charge of the horizontal condensing mainly, the first intermediate output surface mainly in the vertical direction of the condenser (first emission is due to at least one will be in charge of the surface 12A1*a*) and the intermediate plane of incidence (the second incident surface 12A2*a*).

Third, vertical dimensions of the final exit surface (second output surface 12A2*b*) H1 (see FIG. 110 A), the vertical dimensions of the final exit plane of the second embodiment (second output surface 12A2*b*) H2 (compared FIG. 110 B and see), it is possible to shorten. As a result, the lens body 12Q can be miniaturized.

Figure 110B:
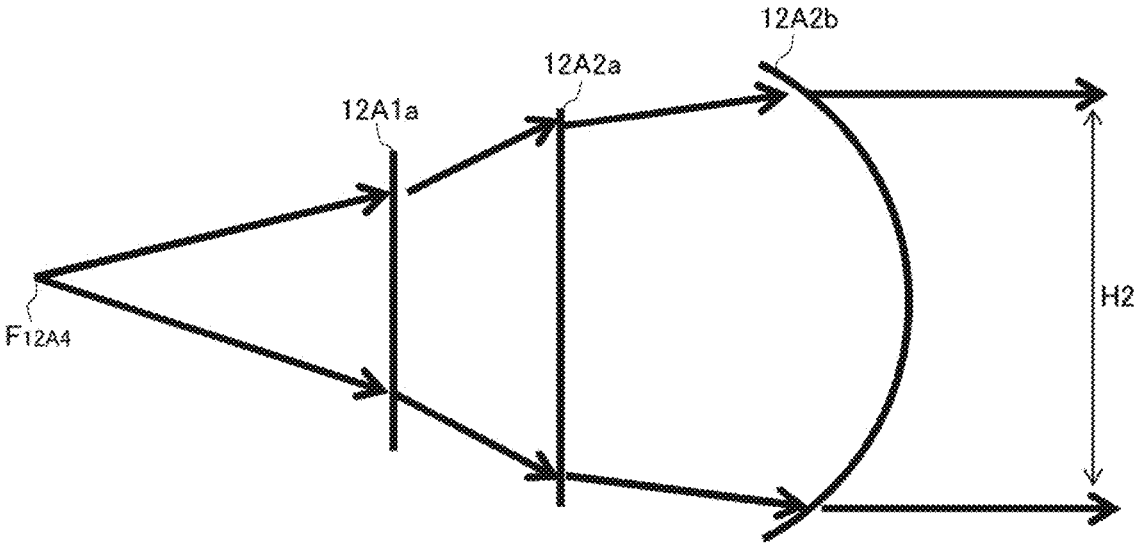

The final output surface in the vertical dimension H1 of (second output surface 12A2*b*), compared with the vertical dimensions of the final exit plane of the second embodiment (second output surface 12A2*b*) H2, can be short, first, in the second embodiment, as shown in FIG. 110 B, the first intermediate output surface (first output surface 12A1*a*) and an intermediate incidence surface (second incident surface 12A2*a*) respectively curvature relates vertical direction imparted since it is not, while spreads about the vertical direction of the light emitted from the first intermediate output surface out of focus F12A4 (or reference point corresponding to the focal F12A4) (first output surface 12A1*a*) is relatively large on, imparting in this embodiment, as shown in FIG. 110 A, the first intermediate output surface (first output surface 12A1*a*) and/or intermediate incidence surface (second incident surface 12A2*a*) the curvature relates vertically because it is, the focal F12A4 first intermediate output surface out (or corresponding reference point on the focal F12A4) to spread about the vertical direction of the light emitted from the (first output surface 12A1*a*) is relatively small, the 2, in the second embodiment, as shown in FIG. 110 B, light emitted from the focus F12A4 (or reference point corresponding to the focal F12A4) is emitted from the final exit surface (second output surface 12A2*b*) the case is collimated, whereas spread with respect to the vertical direction between the intermediate incidence surface (second incident surface 12A2*a*) the final exit surface (second output surface 12A2*b*), in the present embodiment, FIG. 110 (a as shown in), the light emitted from the focus F12A4 (or reference point corresponding to the focal F12A4), at the time of entering from the intermediate incident surface (second incident surface 12A2*a*) inside the second lens portion 12A2, is collimated, the intermediate do not spread with respect to the vertical direction between the incident surface (second incident surface 12A2*a*) the final exit surface (second exit surface 12A2*b*), is due.

Fourth, the final emitting surface while maintaining the vertical dimension H1 of (second output surface 12A2*b*), the first reference axis AX1 direction dimension of the second lens portion 12A2, i.e., intermediate the incident surface (second incident surface 12A2*a*) the distance L (see FIG. 110 A) between the last exit surface (second output surface 12A2*b*) can relatively be longer that the. That is, the intermediate plane of incidence (the second incident surface 12A2*a*) the final exit surface (the second exit surface 12A2*b*) lens of the distance L is relatively long new appearance between the 12Q and vehicle lamp 10Q having the same it is possible to provide. This is spread with respect to the vertical direction between the light emitted from the focus F12A4 (or reference point corresponding to the focal F12A4) intermediate the entrance surface (the second entrance surface 12A2*a*) the final exit surface (second exit surface 12A2*b*) not is by (FIG. 110 A refer).

Fifth, the upper and/or side of between the intermediate incidence surface (second incident surface 12A2*a*) the final exit surface (second exit surface 12A2*b*), texturing and character represented by stamping or the like, symbols and/or can be subjected to design of graphics, etc., also can be attached a seal or plate or the like in which the design is formed. That is, the character represented by the embossed or stamped or the like on the upper surface and/or side of between the intermediate incidence surface (second incident surface 12A2*a*) the final exit surface (second exit surface 12A2*b*), symbols and/or figures, and the like it is possible to provide a design has been performed (or the design is formed seals and plate or the like is attached) lens body 12Q and the vehicle lighting device 10Q having the same new appearance. This is because it can be the distance L between the intermediate incidence surface (second incident surface 12A2*a*) the final exit surface (second output surface 12A2*b*) relatively long, intermediate incidence surface (second incident surface 12A2*a*) the final exit plane (between the second output surface 12A2*b*), character represented by embossed or stamped or the like, symbols and/or sufficient space for applying the design of figure and the like (top and/or side) it is by can be ensured.

As described above, the concept of "make up the final exit surface (second exit surface 12A2*b*) as the surface of the planar shape" is not limited to the vehicle lamp 10A of the second embodiment, the vehicle according to the above embodiments it can be applied to use lamp and other various other vehicle lamp.

This will be described below.

For example, the concept of "make up the final exit surface (second exit surface 12A2*b*) as the surface of the planar shape" can be applied to the sixth embodiment of the vehicular lamp 10 J (lens body 12 J) shown in FIG. 39.

In this case, the first optical system for forming a spot light distribution pattern PSPOT (see FIG. 41 B) (FIG. 42 A refer) in the same manner as the fourteenth embodiment, the first intermediate output surface (first At least one of the emission surface 12A1*a*) and an intermediate incidence surface (second incident surface 12A2*a*) the final emission surface (the light from the light source 14 emitted from the second emission surface 12A2*b*) (precisely, the light from the reference point F) is relates to the vertical direction, so that the collimated light (parallel light rays with respect to the first reference axis AX 1), the surface shape is formed.

The second optical system for forming a mid-light distribution pattern for PMID (see FIG. 41 C) in the (FIG. 42 B refer), the fourteenth embodiment as well, a pair of left and right second intermediate output surface (a pair of left and right exit surface 46*a*, at least one of the 46 *b*) and the intermediate incidence surface (second incident surface 12A2*a*), light from the light source 14 that emits from the final exit surface (second output surface 12A2*b*) is relates to the vertical direction, as the collimated light, the surface shape is formed. For example, left and right pair of second intermediate output surface 46*a*, 46 *b* (and/or intermediate incidence surface 12A2*a*) the light from the light source 14 that emits from the final exit surface (second output surface 12A2*b*) is relates to the vertical direction, the collimated and so that the light, as shown in FIG. 111, is configured as a surface curvature is applied.

The present modification also, it is possible to achieve the same effect as the fourteenth embodiment.

The lens bodies of the present modification, similar to that shown in FIG. 25, molded in a state where the first lens unit 12A1 and a second lens portion 12A2 physically separated, by the holding member 18 such as a lens holder both may be the consist by concatenating (retained).

Also in this modification, the upper surface 44*d* (see FIG. 112 A) and/or side surfaces between the intermediate incidence surface (second incident surface 12A2*a*) the final exit surface (second exit surface 12A2*b*), Shibo character represented by the processing and stamping, etc., can be subjected to design such symbols and/or graphics, also seals and the plate to which the design is formed (e.g., a transparent seal and the transparent plate) to paste the like it can.

Further, for example, concept of "final exit surface constituting the (second output surface 12A2*b*) as the surface of the planar shape", the sixth embodiment of the upper incident surface 42*c* from the vehicle lighting device 10 J (lens body 12 J) shown in FIG. 39, i.e., may be applied to a wide light distribution pattern PWIDE third optical system for forming a (FIG. 41 (d-) see) (FIG. 42 C refer) vehicle lamp is omitted (lens body).

Further, for example, concept of "final exit surface (second exit surface 12A2*b*) constituting a surface of the planar shape", also apply to the eighth embodiment of a vehicular lamp 10N shown in FIG. 62 (lens body 12N) it can.

In this case, in the first optical system for forming a spot light distribution pattern PSPOT (see FIG. 64 B) (see FIG. 42 A), similarly to the fourteenth embodiment, the first intermediate output surface (first At least one of the emission surface 12A1*a*) and an intermediate incidence surface (second incident surface 12A2*a*) the final emission surface (the light from the light source 14 emitted from the second emission surface 12A2*b*) (precisely, the light from the reference point F) is relates to the vertical direction, so that the collimated light (parallel light rays with respect to the first reference axis AX 1), the surface shape is formed.

Further, mid light distribution pattern PMID_L, PMID_R (FIG. 64 C, FIG. 64 (d-) refer) second optical system for forming a (see FIG. 66, FIG. 67), similarly to the fourteenth embodiment, the left and right a pair of second intermediate output surface (left-right pair of the emitting surface 46*a*, 46 *b*) and at least one intermediate incidence surface (second incident surface 12A2*a*) from a light source 14 that emits from the final exit surface (second output surface 12A2*b*) light relates vertical direction, so that a collimated light, the surface shape is formed. For example, left and right pair of second intermediate output surface 46*a*, 46 *b* (and/or intermediate incidence surface 12A2*a*) the light from the light source 14 that emits from the final exit surface (second output surface 12A2*b*) is relates to the vertical direction, the collimated and so that the light, as shown in FIG. 111, is configured as a surface curvature is applied.

The present modification also, it is possible to achieve the same effect as the fourteenth embodiment.

The lens bodies of the present modification, similar to that shown in FIG. 25, molded in a state where the first lens unit 12A1 and a second lens portion 12A2 physically separated, by the holding member 18 such as a lens holder both may be the consist by concatenating (retained).

Also in this modification, the upper surface 44Nc (see FIG. 112 B) and/or side surfaces between the intermediate incidence surface (second incident surface 12A2*a*) the final exit surface (second exit surface 12A2*b*), Shibo character represented by the processing and stamping, etc., can be subjected to design such symbols and/or graphics, also seals and the plate to which the design is formed (e.g., a transparent seal and the transparent plate) to paste the like it can.

On the upper surface between the intermediate incidence surface (second incident surface 12A2*a*) the final exit surface (second output surface 12A2*b*) 44Nc (see FIG. 112 B), the character represented by the embossed or stamped or the like, symbols and/or subjected to design a figure and the like, or a seal or plate to which the design is formed (e.g., a transparent seal and the transparent plate) if the pasting or the like, the character, the design of such symbols and/or graphics, it can be projected on the road surface.

Further, for example, concept of "final exit surface constituting the (second output surface 12A2*b*) as the surface of the planar shape", the eighth embodiment of the upper incident surface 42*c* from the vehicle lamp 10 N (lens body 12N) shown in FIG. 62, i.e., it may be applied to a wide light distribution pattern PWIDE (FIG. 64 E refer) third optical system for forming a (FIG. 69 see) abbreviated vehicle lamp (the lens body).

Next, the vehicle lighting device 74A of the fifteenth embodiment will be described with reference to the drawings.

Vehicle lamp 74A of the present embodiment is configured as follows.

FIG. 113 is a schematic structural view of a vehicle lamp 74A of the present embodiment.

As shown in FIG. 113, the vehicle lamp 74A of the present embodiment, vehicle front left three vehicle lamp arranged in parallel 74AL1~74AL3, 3 one vehicle lamp which is arranged parallel to the vehicle front right 74AR1~light distribution variable type lamp having a 74AR3: with (ADB Adaptive Driving Beam), the light emitted from each of the vehicle lighting device 74AL1~74AL3,74AR1~74AR3 forward, directly facing virtual vehicle front vertical screen (vehicle is located in about 25 m forward from the front) light distribution pattern for low beam on PLo (PLo1~PLo6) and ADB for the light distribution pattern PL1~PL3, PR1 to form a~PR3. Light distribution pattern PLo low-beam, low-beam light distribution pattern PLo1~PLo6 each of the vehicle lamp 74AL1~74AL3,74AR1~74AR3 form is formed as a synthetic light distribution pattern superimposed. ADB light distribution pattern PL1~PL3, PR1~PR3, each lower end is arranged in the horizontal direction in a form overlapping the upper end portion of the light distribution pattern for low beam PLo (PLo1~PLo6). Thus, it is possible to suppress the discomfort that occurs when both the light distribution patterns are overlapped.

Three vehicle lighting device 74AR1~74AR3 which is arranged parallel to the vehicle front right side, a substantially identical configuration. Further, there is in substantially the same configuration symmetrical to the vehicle front right three of the vehicular lamp that is arranged in parallel 74AR1~74AR3 and the vehicle front left three vehicle lamp arranged in parallel 74AL1~74AL3.

Therefore, hereinafter, it will be mainly described vehicle lamp 74AR1 configured to form a low beam light distribution pattern PLo4 and ADB light distribution pattern PR1.

FIG. 114 is a vertical cross-sectional view of the vehicle lamp 74AR1 (schematic diagram), and FIG. 115 is a top view (schematic diagram).

As shown in FIG. 114 and FIG. 115, the vehicle lamp 74AR1 is eighth embodiment of a vehicular lamp 10 N (first light source 14Lo, the first lens element 12N) shown in FIG. 62 relative to the second light source 14ADB, correspond to those you add a second lens body 66AR1.

Vehicle lamp 74AR1 a first light source 14Lo, the first lens member 12N which is disposed in front of the first light source 14Lo, the second light source 14ADB, and, the second lens body 66AR1 or the like which is disposed in front of the second light source 14ADB the provided, on a virtual vertical screen, as shown in FIG. 113, distribution for ADB light distribution pattern PLo4 and respective lower end portions for a low beam is arranged in the horizontal direction in a form overlapping the upper end portion of the light distribution pattern PLo low beam light pattern PL1~PL3, PR1 to form the ADB for the light distribution pattern PR1 of the ~PR3.

The first lens member 12N is the same configuration as the lens body 12N shown in FIG. 63. That is, the first lens member 12N is a diagram 114 and as shown in FIG. 115, the rear end portion 12A1*aa* the front end portion first lower reflecting surface 12*b* and the first disposed between 12A2*bb* of the first lens body 12N and a prolonged incident surface 44*f* which is extended forward and obliquely downward from the tip end portion of the lower reflecting surface 12*b*.

Extending incident surface 44*f* is a surface which light from the second light source 14ADB emitted from the front end portion of the second lens body 66AR1 (emission surface 66Ab1) enters inside the first lens body 12N, the tip of the first lower reflection surface 12*b* It is configured as a surface of the extended plane shape or a curved shape forward and obliquely downward from the unit (shade 12*c*). Of course, not limited to this, extending the incident plane 44*f*, the tip portion of the first lower reflection surface 12 *b* (the shade 12*c*) which may be configured as a surface of a planar shape or a curved shape which extends obliquely rearward and downward (FIG. 116 references).

The rear end portion 12A1*aa* of the first lens member 12N includes a first entrance surface 12*a*. The distal end of the first lower reflection surface 12*b* includes a shade 12*c*.

The first entrance surface 12*a*, the front end portion of the first lower reflection surface 12*b* and the first lens element 12N 12A2*bb* (second output surface 12A2*b*) has a first light source 14Lo incident from the first incident surface 12*a* inside the first lens body 12N light is internally reflected (total reflection) by the partial blocking light and the first lower reflection surface 12*b* by the shade 12*c* of the first lower reflection surface 12*b* of the light from the front end portion of the first lens body 12N 12A2*bb* (by being irradiated forward emitted from the second output surface 12A2*b*), first to form a light distribution pattern PLo4 low beam including a cutoff line CLLo defined by the shade 12*c* of the first lower reflection surface 12*b* on the upper edge constitute an optical system.

The second light source 14ADB, as shown in FIG. 114 and FIG. 115, is disposed the light emitting surface in the rear end portion 66*a* near the second lens body 66AR1 in a posture directed to a forward (the reference point F66A vicinity of the optical design) ing. The optical axis AX14 of the second light source 14ADB may be not coincide with the reference axis AX66A extending in the longitudinal direction of the vehicle, it may be inclined with respect to the reference axis AX66A.

FIG. 117 is a perspective view of the second lens body 66AR1.

As shown in FIG. 117, the second lens body 66AR1 is a lens body 66 of the twelfth embodiment shown in FIG. 97, wherein the shade 66*e*, a 66*f*, and, along a plane orthogonal to the reference axis AX66, exit surface correspond to those obtained by removing the portion including the 66*b*1.

The second lens body 66AR1 has a reflecting surface 66*c* and the longitudinal reflecting surface 66*d* on which is disposed between the rear end portion 66*a* and the front end portion 66*b* of the second lens body 66AR1. Tip of the tip and the longitudinal reflecting surface 66*d* of the upper reflection surface 66*c* are respectively, the shade 66*e*, comprise 66*f*.

The rear end portion 66*a* of the second lens body 66AR1 the second light from the second light source 14ADB enters entrance section AA which enters inside the second lens body 66AR1, and, from the entrance portion AA inside the second lens body 66AR1 2 the light from the light source 14ADB includes a reflective surface 66*a*3 to internal reflection (total internal reflection).

FIG. 114, as shown in FIG. 115, the incident portion AA is the first incident surface of the projection toward the second light source 14ADB 66*a*1, from the outer peripheral edge of the first incident surface 66*a*1 extends rearward, the second light source 14ADB When it includes a second entrance surface 66*a*2 cylindrical surrounding the space between the first entrance surface 66*a*1.

Reflective surface 66*a*3 is disposed outside of the second entrance surface 66A2, is a reflection surface for internal reflection (total internal reflection) of light from the second light source 14ADB incident from the second incident surface 66*a*2 inside the second lens body 66AR1.

The front end 66*b* of the second lens body 66AR1 includes an exit surface 66Ab1.

Emitting surface 66Ab1, as shown in FIG. 117, the planar shape orthogonal shade 66*e* of the upper reflection surface 66*c* that outer shape, fan-like form enclosed by shades 66*f* and arc C of the longitudinal reflecting surface 66*d*, and the reference axis AX66A or it is formed as a surface of a curved surface. Of course, the present invention is not limited to this, the exit surface 66Ab1 is a rectangular shape the outline includes a shade 66*f* of shade 66*e* and vertical reflective surface 66*d* of the upper reflective surface 66*c*, and, of flat shape or curved shape perpendicular to the reference axis AX66A it may be configured as a surface.

FIG. 118 is an enlarged longitudinal sectional view of the vicinity of the exit surface 66Ab1 extended incident surface 44*f* and the second lens body 66AR1 of the first lens member 12N.

As illustrated in FIG. 118, out on the reflective surface shade 66*e* vicinity of the area 66Ab2 of 66*c* of the exit surface 66Ab1 of the second lens body 66AR1 is, from the second light source 14ADB emitted from the area 66Ab2 in the second lens body 66AR1 external light is diffused as (linear reference arrow attached to the distal end in FIG. 118), it is desirable that the surface shape is formed. Specifically, of the reflecting surface 66*c* of the shade 66*e* near the region 66Ab2 of the exit surface 66Ab1 of the second lens body 66AR1, as shown in FIG. 118, is configured as a surface of a curved shape convex toward the outside there. Of course, the present invention is not limited to this, out on the reflective surface shade 66*e* vicinity of the area 66Ab2 of 66*c* of the exit surface 66Ab1 of the second lens body 66AR1 is, texturing and more than one minute unevenness (for example, the lens cut) as a surface which has been subjected to it may be configured.

The second lens body 66AR1 (exit surface 66Ab1), the light from the second light source 14ADB emitted from the emitting surface 66Ab1 of the second lens body 66AR1 is, the out of the extended incident surface 44*f* and the first lower reflective surface 12*b* first from the shade 12*c* near the region 12*b*1 of the lower reflecting surface 12*b* to be incident inside the first lens body 12N, it is disposed near the extension incident surface 44*f* (see FIG. 118).

The second lens body 66AR1 is, the so that more of the light from the second light source 14ADB is incident inside the first lens body 12N emitted from the emitting surface 66Ab1 of the second lens body 66AR1, to the reference axis AX66A horizontal It is arranged in an inclined position with respect to (see FIG. 114). Of course, not limited to this, the second lens body 66AR1, the reference axis AX66A may be arranged in a posture extending in the horizontal direction.

The first lens body 12N and the second lens body 66AR1 is while maintaining the relationship between the above two, is held by a holding member such as a bracket (not shown).

Incident portion AA (the first incident surface 66*a*1 and the second incident surface 66*a*2), above the reflecting surface 66*c*, vertical reflective surface 66*d*, the exit surface 66Ab1 of the second lens body 66AR1, extension incident surface 44*f*, and, of the first lens body 12N front end 12A2*bb* (second output surface 12A2*b*), the incident portion AA of which the reflecting surface of the light from the second light source 14ADB incident from (first incident surface 66*a*1 and the second incidence surface 66*a*2) inside the second lens body 66AR1 shade 66*e* and internal reflection in the partial blocking light, as well as on the reflective surface 66*c* and vertical reflective surface 66*d* by the shade 66*f* of the vertical reflective surface 66*d* (total internal reflection) light of 66*c* is, the exit surface of the second lens body 66AR1 66Ab1 emitted from further extension incident surface 44*f* and the first lens element 12N from the shade 12*c* near the region 12*b*1 of the first lower reflecting surface 12*b* is incident inside the first lens body 12N of the first lower reflection surface 12*b* emitted from the front end 12A2*bb* (second output surface 12A2*b*), by being irradiated forward, the bottom edge and the shade 66*e* of the upper reflection surface 66*c* on one side edge (side edge in FIG. 113 vertical line V side) and cutoff line CL66*e* defined by the shade 66*f* of the longitudinal reflecting surface 66*d*, constitute a second optical system for forming an ADB light distribution pattern PR1 containing CL66*f*.

More specifically, the first incident surface 66*a*1, the second incident surface 66*a*2, reflective surface 66*a*3, above the reflecting surface 66*c*, vertical reflective surface 66*d*, the exit surface of the second lens body 66AR1 66Ab1, extension incident surface 44*f*, and, first front end 12A2*bb* of the lens body 12N (second output surface 12A2*b*), the light from the second light source 14ADB incident from the first incident surface 66*a*1 inside the second lens body 66AR1, and, a second lens from the second incident surface 66*a*2 body 66AR1 light shielding part by the shade 66*f* of the second shade of which the reflecting surface 66*c* of the light from the light source 14ADB 66*e* and the longitudinal reflecting surface 66*d* which has been internally reflected (total reflection) by the reflecting surface 66*a*3 enters the interior and internally reflected on the reflection surface 66*c* and the longitudinal reflecting surface 66*d* (total reflection) light is emitted from the exit surface 66Ab1 of the second lens body 66AR1, further, of the extension incident surface 44*f* and the first lower reflection surface 12*b* emitted from the front end portion of the first lens body 12N from the shade 12*c* near the region 12*b*1 enters inside the first lens body 12N of the first lower reflection surface 12*b* 12A2*bb* (second output surface 12A2*b*), are emitted forward thing by, cut-off line CL66*e* which is defined by the lower edge and one side edge shade of shade 66*e* and vertical reflective surface 66*d* of the upper reflective surface 66*c* (the side edge in the drawing 113 vertical line V side) 66*f*, ADB, including CL66*f* constitute a second optical system for forming a use light distribution pattern PR1.

The light incident inside the first lens body 12N from prolonged incident surface 44*f* is emitted from a portion of the front end 12A2*bb* (second output surface 12A2*b*) of the first lens body 12N through the range of the angle θA in FIG. 114. Incidentally, if the extension incident surface 44*f* is formed as a surface of a planar shape or a curved shape which extends obliquely rearward and downward from the front end portion (the shade 12*c*) of the first lower reflection surface 12 *b* (see FIG. 116), the extension of incidence the light incident inside the first lens body 12N from the surface 44*f* is emitted from the entire surface of the front end 12A2*bb* of the first lens body 12N through the range of the angle θB in FIG. 114 (second output surface 12A2*b*). As a result, it is possible to the entire surface of the front end portion of the first lens body 12N 12A2*bb* (second output surface 12A2*b*) causes visible as emitted.

The first incident surface 66*a*1 is a plane light from the second light source 14ADB enters inside the second lens body 66AR1 is refracted, the surface of the curved convex toward the second light source 14ADB (e.g., free-form surface) as It is configured. Specifically, the first incident surface 66*a*1 is the light from the second light source 14ADB from the first incident surface 66*a*1 is incident inside the second lens body 66AR1 is relates to the vertical and horizontal directions, the shade of the upper reflection surface 66*c* is focused in the vicinity of the intersection Cp of shade 66*f* of the 66*e* and vertical reflective surface 66*d* (see FIG. 114 and FIG. 115) as such, the surface shape is configured.

Incidentally, the light from the second light source 14ADB incident from the first incident surface 66*a*1 inside the second lens body 66AR1 is condensed is not limited to the vicinity of the intersection Cp, for example, the first lens body 12N of (lens 12A4) focus F12A4 may be another position in the vicinity and the like. Further, the light from the second light source 14ADB incident from the first incident surface 66*a*1 inside the second lens body 66AR1 is condensed may be the internal second lens body 66AR1, the second lens body 66AR1 external it may be.

Of course, the invention is not limited to this, the first incident surface 66*a*1, the light from the second light source 14ADB incident from the first incident surface 66*a*1 inside the first lens body 66AR1 is relates to the vertical and horizontal directions, to be collimated to, the surface shape may be configured.

The second incident surface 66*a*2 is a plane light which does not enter the first entrance surface 66*a*1 enters the 66R1 inside the second lens body is refracted out of the light from the second light source 14ADB, from the outer peripheral edge of the first incident surface 66*a*1 extends toward the rear, a cylindrical surface surrounding a space between the second light source 14ADB a first entrance surface 66*a*1 (eg, free curved surface) is formed as a.

Reflective surface 66*a*3 is arranged on the outside of the second incident surface 66*a*2, in terms of internal reflection of light (total internal reflection) from the second light source 14ADB incident from the second incident surface 66*a*2 inside the second lens body 66R1, metal vapor deposition is not used. Specifically, the reflecting surfaces 66A3, the light from the second light source 14ADB that is from the second incident surface 66*a*2 enters the inside second lens body 66AR1 internal reflection in the reflecting surface 66*a*3 (total reflection) is vertical and to a horizontal direction, is focused in the vicinity of the intersection Cp of shade 66*f* of shade 66*e* and vertical reflective surface 66*d* of the upper reflective surface 66*c* (see FIG. 114 and FIG. 115) as such, the surface shape is configured.

Incidentally, the light condensing light from the second light source 14ADB which is internally reflected by the reflecting surface 66*a*3 (total reflection) is not limited to the vicinity of the intersection Cp, for example, focus F12A4 vicinity of the first lens body 12N (lens 12A4) another may be the position and the like. Further, light from the second light source 14ADB which is internally reflected by the reflecting surface 66*a*3 (total reflection) is to collect light may be an internal second lens body 66AR1, a second lens body 66AR1 external it may be.

Of course, not limited to this, reflective surface 66*a*3, the light from the second light source 14ADB which is internally reflected in the reflecting surface 66*a*3 is relates to the vertical and horizontal directions, as will be collimated, the surface shape has been configured it may be.

Above the reflecting surface 66*c* is, by folding the light from the second light source 14ADB that is internally reflected in the on the reflective surface 66*c* (total internal reflection), the lower cut-off line CL66*e* which is defined by the shade 66*e* of the upper reflective surface 66*c* on the border ADB It is configured as a reflective surface to be superimposed on the use light distribution pattern PR1. Specifically, the upper reflection surface 66*c*, the reference axis AX66A accordance light reflected from the the reflective surface 66*c* is to be controlled above the lower cut-off line CL66*e*, toward the rear from the shade 66*e* of the on the reflective surface 66*c* It is formed as a reflecting surface of the planar shape inclined in a direction away from (see FIG. 114).

The upper reflection surface 66*c* is a reflecting surface that totally reflects the light incident on the on the reflective surface 66*c* of the light from the second light source 14ADB incident inside the second lens body 66AR1, metal deposition is not used. Light incident within the reflection surface 66*c* of the light from the second light source 14ADB incident inside the second lens body 66AR1 is internally reflected in the on the reflective surface 66*c* (total reflection) is directed to the exit surface 66Ab1, the exit surface toward the area to light distribution pattern PR1 for ADB to refraction is formed (a predetermined area) in 66Ab1. In other words, a form of internal reflection on the reflection surface 66*c* (total internal reflection) is the reflected light is superimposed on the ADB for the light distribution pattern PR1 is folded to border the lower cut-off line CL66*e*.

According on the reflecting surface 66*c* having the above structure, first, it is possible to a lower cut-off line CL66*e* formed at the lower end edge of the ADB light distribution pattern PR1 as clear. Secondly, unnecessary extent as a light distribution pattern for ADB, i.e., it is possible to prevent the light from the second light source 14ADB are light distribution below the lower cut-off line CL66*e*. Third, the degree of ADB light distribution pattern PR1, particularly, it is possible to increase the intensity of the lower cutoff line CL66*e* vicinity. This is, light from the second light source 14ADB incident inside the second lens body 66AR1 is, the vertical direction and to a horizontal direction, condensing in the vicinity of the intersection Cp of shade 66*f* of shade 66*e* and vertical reflective surface 66*d* of the upper reflective surface 66*c* to (see FIG. 114 and FIG. 115) thing, and, that the internal reflection on the reflection surface 66*c* (total internal reflection) is the reflected light is superimposed on the ADB for the light distribution pattern PR1 is folded to border the lower cut-off line CL66*e* it is due.

Vertical reflective surface 66*d* is, by folding the light from the second light source 14ADB to be internal reflection in the vertical reflective surface 66*d* (total internal reflection), the vertical cut-off line CL66*f* which is defined by the shade 66*f* of the vertical reflective surface 66*d* on the border ADB It is configured as a reflective surface to be superimposed on the use light distribution pattern PR1. Specifically, the longitudinal reflecting surface 66*d*, like the light reflected from the longitudinal reflecting surface 66*d* is controlled from the vertical cutoff line CL66*f* the right, the reference axis AX66A toward rearward from the shade 66*f* of the longitudinal reflecting surface 66*d* It is formed as a reflecting surface of the planar shape inclined in a direction away from (see FIG. 115).

Vertical reflective surface 66*d* is a reflection surface for totally reflecting the light incident on the longitudinal reflecting surface 66*d* of the light from the second light source 14ADB incident inside the second lens body 66AR1, metal deposition is not used. Light incident on the longitudinal reflecting surface 66*d* of the light from the second light source 14ADB incident inside the second lens body 66AR1 is directed internal reflection in the longitudinal reflecting surface 66*d* (total reflection) is in the exit surface 66Ab1, exit surface toward the area to light distribution pattern PR1 for ADB to refraction is formed (a predetermined area) in 66Ab1. In other words, a form of internal reflection in the vertical reflective surface 66*d* (total internal reflection) is the reflected light is superimposed on the vertical cut-off line CL66*f* is folded on the border to the ADB for the light distribution pattern PR1.

According to the longitudinal reflecting surface 66*d* of the above configuration, the first, the vertical cutoff line CL66*f* formed on one side edge of the ADB light distribution pattern PR1 (side edge in FIG. 113 vertical line V side) shall clear it can be. Secondly, unnecessary extent as a light distribution pattern for ADB, that is, the light from the second light source 14ADB can be inhibited from being light distribution from the vertical cutoff line CL66*f* the vertical line V side. As a result, the vehicle front of the irradiation-prohibited object (e.g., preceding vehicle or oncoming vehicle) can effectively suppress the generation of glare for. Third, the degree of ADB light distribution pattern PR1, particularly, it is possible to increase the intensity of the vertical cut-off line CL66*f* vicinity. This is, light from the second light source 14ADB incident inside the second lens body 66AR1 is, the vertical direction and to a horizontal direction, condensing in the vicinity of the intersection Cp of shade 66*f* of shade 66*e* and vertical reflective surface 66*d* of the upper reflective surface 66*c* to (see FIG. 114 and FIG. 115) thing, and, that the internal reflection in the vertical reflective surface 66*d* (total internal reflection) is the reflected light is superimposed on the vertical cut-off line CL66*f* is folded on the border to the ADB for the light distribution pattern PR1 it is due.

Between the arc C of the outer shape of the exit surface 66Ab1 and the leading edge of the reflective surface 66*a*3 is provided on a surface 66*p* tether that optical function is not intended is formed.

In the second lens body 66AR1 the above configuration, light from the second light source 14ADB incident from the first incident surface 66*a*1 inside the second lens body 66AR1, and, entering the second entrance surface 66*a*2 inside the second lens body 66AR1 and internal reflection at the reflecting surface 66*a*3 by (total internal reflection) has been shaded light and above the reflecting surface part by the shade 66*f* of the second out on the reflective surface 66*c* of the light from the light source 14ADB shade 66*e* and vertical reflective surface 66*d* 66*c* and light that has been internal reflection (total internal reflection) in a vertical reflective surface 66*d* is emitted from the exit surface 66Ab1 of the second lens body 66AR1. At that time, the light emitted from the emitting surface 66Ab1 of the second lens body 66AR1, intensity distribution on the exit surface 66Ab1 of the second lens body 66AR1 (light source image) is formed.

The second lens body luminous intensity distribution formed on the exit surface 66Ab1 of 66AR1 (light source image), the focal F12A4 shade 12*c* vicinity (e.g., near the center in the lateral direction of the shade 12*c*) a first lens member 12N which is set to (lens 12A4), i.e., an intermediate exit face (first output surface 12A1*a*), by the action of an intermediate incidence surface (second incident surface 12A2*a*) and final output surface (second output surface 12A2*b*), are inverted projection, the virtual vertical screen above, to form the ADB for the light distribution pattern PR1 shown in FIG. 113. FIG. 119 represents a simulation result of the ADB light distribution pattern PR1 formed on the virtual vertical screen.

The vehicular lamp 74AR1 the above structure, on a virtual vertical screen, the light distribution pattern PLo4 and ADB light distribution pattern PR1 low beam shown in FIG. 113 is formed.

ADB light distribution pattern PR1 is, as shown in FIG. 113, the lower end portion is arranged in a form overlapping the upper end portion of the light distribution pattern for low beam PLo. This portion of the light from the second light source 14ADB emitted from the emitting surface 66Ab1 of the second lens body 66AR1 is, from the shade 12*c* near the region 12*b*1 of the first lower reflection surface 12*b* of the first lower reflection surface 12*b* enters the inside the first lens element 12N, is by passing above the focal F12A4 of the first lens body 12N (lens 12A4).

Or more, as has been described vehicle lamp 74AR1 that is configured to form a low-beam light distribution pattern PLo4 and ADB for the light distribution pattern PR1, to form a low-beam light distribution pattern PLo5 and ADB for the light distribution pattern PR2 configured vehicular lamp 74AR2, as well as the vehicle lamp 74AR3 configured to form a light distribution pattern PLo6 and the light distribution pattern PR3 for ADB for low beam also be configured in the same manner as in the above vehicle lamp 74AR1 can.

For example, ADB light distribution pattern PR2 adjusts the relative positional relationship between the focus F12A4 the second lens of the first lens body 12N constituting the vehicle lamp 74AR2 (lens 12A4) 66AR2 (output surface 66Ab1) it is, as shown in FIG. 113 may be formed at a position shifted to the right relative to the ADB light distribution pattern PR1. The same applies to the light distribution pattern PR3 for ADB.

The vehicle that is configured to form the configured vehicle lamp 74AL1, light distribution patterns PLo2 and ADB for low beam light distribution pattern PL2 so as to form a light distribution pattern PLo1 and ADB for low-beam light distribution pattern PL1 use lamp 74AL2, as well as the vehicle lamp 74AL3 configured to form a light distribution pattern PLo3 and the light distribution pattern PL3 for ADB for low beam is also obtained by inverting the right and left of the second lens body 66AR1 shown in FIG. 117 shape by using the second lens body 66AL1 like (not shown) can be configured in the same manner as in the above vehicular lamp 74AR1.

Incidentally, emission surface 66Ab1 of each second lens body of 66AL1~66AL3,66AR1~66AR3 may be the same size or may be different sizes.

Next, the operation example of the vehicular lamp 74A of the above configuration (operation example of a light distribution variable type vehicle lighting device).

In the following description, the image pickup device functioning as a detecting means for detecting a vehicle ahead of the object vehicle lamp 74AL1~74AL3, 74AR1~74AR3 is mounted (eg, CCD camera) based on a detection result of such, CPU, etc. If the controller determines whether the vehicle ahead to the irradiation-prohibited object (e.g. a preceding vehicle or an oncoming vehicle) is present, it is determined that the irradiation-prohibited object is present, and there is the irradiation-prohibited object so that the light distribution pattern for the ADB are not formed in a region, to turn off or dim the second light source 14ADB of the relevant. FIG. 120. A, the control device such as a CPU is, the vehicle front to the irradiation-prohibited object (e.g. a preceding vehicle or an oncoming vehicle) is determined that is not present, the vehicle lamp 74AL1~74AL3,74AR1~74AR3 each it is an example of lighting the second light source 14ADB. FIG. 120. B, the control device such as a CPU may determine an irradiation-prohibited object ahead of the vehicle (the preceding vehicle V1 or oncoming vehicle V2) are present, for ADB in a region where the irradiation-prohibited object is present as the light distribution pattern PL 1, PR1 is not formed, an example in which turns off the second light source 14ADB applicable.

According to this embodiment, in addition to the effects of the eighth embodiment, further, it can achieve the following effects.

That is, a light distribution pattern for low beam (for example, a light distribution pattern PLo4 low beam) and its lower end is a light distribution pattern for low beam (for example, a light distribution pattern for low beam PLo4) distribution for ADB arranged in a form overlapping the upper end portion of the light pattern (e.g., ADB light distribution pattern PR4) configured vehicular lamp to form a (e.g., a vehicle lamp 74AR1) it is possible to downsize the.

This forms a light distribution pattern for low beam (for example, the light distribution pattern for PLo4 low beam) light forming the (first light from the light source 14Lo) and ADB light distribution pattern (e.g., ADB light distribution pattern PR1) optical front end 12A2*bb* (second output surface rather than exiting from separate lens body are arranged in parallel in a front view (the second light source light from 14ADB), the first lens element 10N are the same lens body it is due to be emitted from the 12A2*b*).

The second lens member (e.g., the second lens body 66AR1) emitting surface 66Ab1 light from the second light source 14ADB emitted from the extension incident surface 44*f* and the first lower reflection surface of the first lower reflection surface 12*b* of the from 12*b* of the shade 12*c* vicinity of the area 12*b*1 so as to enter inside the first lens body 12N, the second lens body (for example, the second lens body 66AR1) by placing in the vicinity of the extension incident surface 44*f* the exit surface 66Ab1 of, can be a lower end portion forms a light distribution pattern for low beam (for example, the light distribution pattern for PLo4 low beam) ADB light distribution pattern arranged in a form overlapping the upper end portion of the (e.g., the light distribution pattern PR1 for ADB).

Further, by the action of the upper reflecting surface 66*c* and the longitudinal reflecting surface 66*d*, it is possible to achieve the following effects.

First, a light distribution pattern for ADB including the lower cutoff line CL66*e* and vertical cut-off line CL66*f* defined by the bottom edge and the shade 66*f* of one of the upper reflection surface 66*c* to the side edges shade 66*e* and the longitudinal reflecting surface 66*d* (e.g., ADB light distribution pattern PR1) can be formed.

To a 2, ADB light distribution pattern (e.g., the light distribution pattern for PR1 ADB) to the vertical cutoff line CL66*f* as clear formed below the cutoff line CL66*e* and one side edge is formed on the lower edge of can.

To the 3, ADB light distribution pattern (e.g., the light distribution pattern for PR1 ADB) unnecessary extent as, i.e., to prevent the light from the second light source 14ADB are light distribution below the lower cut-off line CL66*e* can. Similarly, it is possible to light from the second light source 14ADB can be inhibited from being light distribution from the vertical cut-off line CL66*f* to the vertical line V side. As a result, the vehicle front of the irradiation-prohibited object (e.g., preceding vehicle or oncoming vehicle) can effectively suppress the generation of glare for.

Fourth, assembly due to the effect of error or the like, the second lens element relative to the second light source 14ADB (e.g., the second lens body 66AR1) as the relative positional relationship of deviating from the design value, a light distribution pattern for ADB (for example, it is possible to suppress the deviation is lower cutoff line CL66*e* and vertical cut-off line CL66*f* the light distribution pattern PR1) ADB.

In addition, the second lens body (for example, the second lens body 66AR1) by adjusting the surface shape of the area 66Ab2 of shade 66*e* vicinity of out on the reflective surface 66*c* of the exit surface 66Ab1 of, the low-beam light distribution pattern (for example, low beam use the light distribution pattern PLo4) and ADB light distribution pattern (e.g., the light distribution pattern PR1) and without discomfort for ADB (naturally) can be visually recognized as being connected.

Moreover, the vertical dimensions of the final exit surface (second output surface 12A2*b*), compared with the vertical dimensions of the final exit plane of the thirteenth embodiment (second output surface 12A2*b*), can be increased. The first lens body 12N (ie, lenses 12A4) the focal length of the second lens portion 66 of the thirteenth embodiment (ie, exit surface 66*b*1) compared to the focal length of the can be made longer. As a result, it is possible to the MAX light intensity of the light distribution pattern for each of the ADB higher than the thirteenth embodiment.

Next, a modification will be described.

In the vehicle lamp 74A of the fifteenth embodiment, in place of the vehicular lamp 10 N (lens body 12N), the vehicle lamp 10 of the first embodiment shown in FIG. 1 (the lens body 12), first shown in FIG. 16 2 vehicle lamp 10A (lens body 12A) embodiment, the sixth vehicle lamp 10 J (lens body 12 J) of the embodiment shown in FIG. 39, a seventh embodiment of a vehicular lamp 10K (lens body 12K shown in FIG. 49), or may be used a conventional vehicle light 200 (the lens body 220) shown in FIG. 132 A. All of these, the first lower reflection surface 12 *b* (and shade 12*c*), extending incident surface 44*f* and focus F12A4 shade 12*c* vicinity (e.g., near the center in the lateral direction of the shade 12*c*) a first lens member 12N which is set to (lens 12A4) is from has a structure corresponding to each (or may be provided).

The present modification also, it is possible to achieve the same effect as the fifteenth embodiment.

Next, the vehicle lighting device 74B of the sixteenth embodiment will be described with reference to the drawings.

Vehicle lamp 74B of the present embodiment is configured as follows.

FIG. 121 is a schematic structural view of a vehicle lamp 74B of the present embodiment.

As shown in FIG. 121, the vehicle lamp 74B of the present embodiment, the vehicle lamp is disposed in the vehicle front left 74BL, a light distribution variable type provided with a vehicle lamp 74BR disposed on the vehicle front right vehicular lamp: in (ADB Adaptive Driving Beam), each of the vehicle lamp 74BL, by light irradiated forward from 74BR, it is disposed from the virtual vertical screen (vehicle front to approximately 25 m front which face the vehicle front) low-beam light distribution pattern PLo on (PLo1, PLo2) and ADB for the light distribution pattern PL1~PL3, PR1 to form a~PR3. A light distribution pattern for low beam PLo, each of the vehicle lamp 74BL, is formed as a synthesized light distribution pattern for low beam light distribution pattern PLo1, PLo2 is superimposed 74BR forms. ADB light distribution pattern PL1~PL3, PR1~PR3, each lower end is arranged in the horizontal direction in a form overlapping the upper end portion of the light distribution pattern for low beam PLo (PLo1, PLo2). Thus, it is possible to suppress the discomfort that occurs when both the light distribution patterns are overlapped.

The vehicle lamp 74BL that is disposed to the vehicle lamp 74BR and vehicle front left disposed on the vehicle front right are substantially the same configuration symmetrical.

Therefore, in the following, will be described in the configuration has been centered on the vehicle lamp 74BR so as to form a light distribution pattern PLo2 and light distribution patterns PR1~PR3 for the ADB for the low beam.

FIG. 122 is a top view of a vehicle lamp 74BR (schematic view).

As shown in FIG. 122, the vehicle lamp 74BR is an eighth embodiment of a vehicular lamp 10 N (first light source 14Lo, the first lens element 12N) relative to the second light source 14ADB a second lens shown in FIG. 62 obtained by adding a combination of the body 66A (3 pairs), in particular, the combination of the second light source 14ADB and the second lens body 66AR1, the combination of the second light source 14ADB and the second lens body 66AR2, and, second 2 light source 14ADB and correspond to those you add the combination of the second lens body 66AR3. In FIG. 121 and FIG. 122, the second light source 14ADB is omitted.

Then, the exit surface 66Ab1R1~66Ab1R3 of each of the second lens body 66AR1~66AR3, the light from the second light source 14ADB of each emitted from the emitting surface 66Ab1R1~66Ab1R3 of each of the second lens body 66AR1~66AR3 is, extension incident from the surface 44*f* and the shade 12*c* near the region 12*b*1 of the first lower reflection surface 12*b* of the first lower reflection surface 12*b* to be incident inside the first lens body 12N, arranged in parallel in the horizontal direction in the vicinity of the extension incident surface 44*f* to have (see FIG. 122).

In the vehicle lamp 74BR of the configuration described above, by the light from the second light source 14ADB of each emitted from the emitting surface 66Ab1R1~66Ab1R3 of each of the second lens body 66AR1~66AR3, emission of each of the second lens body 66AR1~66AR3 luminous intensity distribution (light source image) is formed on the surface 66Ab1R1~66Ab1R3.

Light intensity distribution formed on the exit surface 66Ab1R1~66Ab1R3 of the second lens body 66AR1~66AR3 of each (light source image) was set focus F12A4 within the shade 12*c* vicinity (e.g., near the center in the lateral direction of the shade 12*c*) the first lens body 12N (lens 12A4), i.e., an intermediate exit face (first output surface 12A1*a*), by the action of an intermediate incidence surface (second incident surface 12A2*a*) and final output surface (second output surface 12A2*b*), inverted projection is, on the imaginary vertical screen, to form a light distribution pattern PR1~PR3 for ADB shown in FIG. 121.

The vehicular lamp 74BR the above structure, on a virtual vertical screen, the light distribution pattern PR1~PR3 light distribution pattern PLo2 and ADB for low beam shown in FIG. 121 is formed.

Light distribution pattern PR1~PR3 for ADB, as shown in FIG. 121, the lower end portion is arranged in a form overlapping the upper end portion of the light distribution pattern for low beam PLo. This is because part of the light from each of the second light source 14ADB emitted from the emitting surface 66Ab1R1~66Ab1R3 of each of the second lens body 66AR1~66AR3, the first lower reflection surface 12*b* of the first lower reflection surface 12*b* from the vicinity of the shade 12*c* of the regions 12*b*1 enters inside the first lens body 12N, it is by passing above the focal F12A4 of the first lens body 12N (lens 12A4).

Have been described above configured vehicle light 74BR so as to form a light distribution pattern PLo2 and the light distribution pattern PR1~PR3 for ADB for low beam, the light distribution pattern PLo1 and the light distribution pattern PL 1~PL 3 for ADB for low beam for even vehicle lamp 74BL that is configured to form, it can be constructed in the same manner as in the above vehicular lamp 74BR1.

According to this embodiment, in addition to the effects of the fifteenth embodiment, further, it can achieve the following effects.

That is, a plurality of combination of the second light source 14ADB and the second lens body 66A to one of the first lens body 12N (e.g., three pairs) by preparing a plurality of ADB light distribution pattern (e.g., for ADB it is possible to form the light distribution pattern PR1~PR3).

Next, a modification will be described.

In the vehicle lamp 74B of the sixteenth embodiment, in place of the vehicular lamp 10 N (lens body 12N), the vehicle lamp 10 of the first embodiment shown in FIG. 1 (the lens body 12), first shown in FIG. 16 2 vehicle lamp 10A (lens body 12A) embodiment, the sixth vehicle lamp 10 J (lens body 12 J) of the embodiment shown in FIG. 39, a seventh embodiment of a vehicular lamp 10K (lens body 12K shown in FIG. 49), or may be used a conventional vehicle light 200 (the lens body 220) shown in FIG. 132 A. All of these, the first lower reflection surface 12 *b* (and shade 12*c*), extending incident surface 44*f* and focus F12A4 shade 12*c* vicinity (e.g., near the center in the lateral direction of the shade 12*c*) a first lens member 12N which is set to (lens 12A4) is from has a structure corresponding to each (or may be provided).

The present modification also, it is possible to achieve the same effects as the sixteenth embodiment.

Next, the second lens element 66B which is a modified example of the second lens body 66A, will be described with reference to the drawings.

FIG. 123 is a longitudinal sectional view of a vehicular lamp 74AR1 using the second lens body 66BR1 a modification of the second lens body 66AR1.

As shown in FIG. 123, the second lens body 66BR1 of this modification, it corresponds to that of arranging the bent portion 66*q* between the rear end portion 66*a* and the front end portion 66*b* of the second lens body 66AR1. The bent portion 66*q* includes an intermediate reflective surface 66*r*. Intermediate reflective surface 66*r* is, in terms of internal reflection of light (total internal reflection) from the second light source 14ADB incident inside the second lens body 66BR1, metal deposition is not used. Intermediate reflective surface 66*r* is configured as a surface of a planar shape. Otherwise, the same configuration as the second lens body 66AR1.

In the above-mentioned second lens body 66BR1 configuration, light from the second light source 14ADB that is internally reflected (total reflection) in the first incident surface 66*a*1 intermediate reflective surface is incident inside the second lens body 66BR1 66*r* and, shade on the reflective surface 66*c* out of the light from the second light source 14ADB which are sequentially in the internal reflection (total internal reflection) in from the second incident surface 66*a*2 the second lens body 66BR1 reflective surface is incident on the internal 66*a*3 and intermediate reflective surface 66*r* light that has been internal reflection (total internal reflection) in the 66*e* and light, as well as on the reflective surface has been shielded in part by the shade 66*f* of the vertical reflective surface 66*d* 66*c* and vertical reflective surface 66*d* is emitted from the exit surface 66Ab1 of the second lens body 66BR1. At that time, the light emitted from the emitting surface 66Ab1 of the second lens body 66BR1, intensity distribution on the exit surface 66Ab1 of the second lens body 66BR1 (light source image) is formed.

The second lens body luminous intensity distribution formed on the exit surface 66Ab1 of 66BR1 (light source image), the focal F12A4 shade 12*c* vicinity (e.g., near the center in the lateral direction of the shade 12*c*) a first lens member 12N which is set to (lens 12A4), i.e., an intermediate exit face (first output surface 12A1*a*), by the action of an intermediate incidence surface (second incident surface 12A2*a*) and final output surface (second output surface 12A2*b*), are inverted projection, the virtual vertical screen above, to form the ADB for the light distribution pattern PR1 shown in FIG. 113.

The above has described a second lens body 66BR1 a modification of the second lens body 66AR1, for the second lens body 66AR2,66AR3,66AL1~66AL3, similarly to the second lens body 66BR1, after each it can be configured as a bent portion 66*q* (intermediate reflective surface 66*r*) the second lens body 66BR2,66BR3,66BL1~66BL3, including between the end 66*a* and the front end portion 66*b*.

Incidentally, concept of "disposing the bent portion 66*q* (intermediate reflective surface 66*r*) between the rear end portion 66*a* and the front end portion 66*b* 'as in the present modification is not limited to the vehicle lamp 74A of the fifteenth embodiment, can be applied to a 16-18 vehicle lamp 74B embodiment~74D and other vehicular lamp is of course.

According to the second lens body 66B of this modification, it is possible to the second light source 14ADB (or 14Hi) is positioned in a desired location. In particular, when applied to the vehicle lamp 74B of the sixteenth embodiment, it is possible to distributed a plurality of second light sources 14ADB in different places (i.e., is enhanced layout flexibility).

Next, the vehicle lighting device 74C of the seventeenth embodiment will be described with reference to the drawings.

Vehicle lamp 74C of the present embodiment is configured as follows.

FIG. 124 is a schematic structural view of a vehicle lamp 74C of the present embodiment.

As shown in FIG. 124, the vehicle lamp 74C of the present embodiment, vehicle front left four vehicle lamp arranged in parallel 74AL1~74AL4, 4 single vehicle lamp which is arranged parallel to the vehicle front right 74AR1~74AR4 (not shown) light distribution variable type lamp having a: with (ADB Adaptive Driving Beam), by light irradiated forward from each of the vehicle lighting device 74AL1~74AL4,74AR1~74AR4, the vehicle front surface directly facing form a virtual vertical screen (vehicle is located in about 25 m forward from the front) light distribution pattern for low beam on PLo (PLo1~PLo8) and ADB for the light distribution pattern PL1~PL4, PR1~PR4 to. Light distribution pattern PLo low-beam, low-beam light distribution pattern PLo1~PLo8 each of the vehicle lamp 74AL1~74AL4,74AR1~74AR4 form is formed as a synthetic light distribution pattern superimposed. ADB light distribution pattern PL1~PL4, PR1~PR4 are each lower end is arranged in the horizontal direction in a form overlapping the upper end portion of the light distribution pattern for low beam PLo (PLo1~PLo8). Thus, it is possible to suppress the discomfort that occurs when both the light distribution patterns are overlapped.

Vehicle lamp 74C of the present embodiment corresponds to the one for vehicular lamp 74A of the fifteenth embodiment, adding a vehicle lamp 74AL4 and vehicular lamp 74AR4.

Vehicle lamp 74AL4 is, in the same configuration as substantially and lamp 74AL1~74AL3 vehicle, to form a light distribution pattern PLo7 and light distribution pattern PL4 for the ADB for the low beam.

Vehicle lamp 74AR4 is, in the same configuration as substantially and lamp 74AR1~74AR3 vehicle, to form a light distribution pattern PLo8 and light distribution pattern PR4 for the ADB for the low beam.

Light distribution pattern PL4 and ADB for the light distribution pattern PR4 for ADB is, between the ADB for the light distribution pattern PL1 and the ADB for the light distribution pattern PR1, is formed in a form that has been superimposed on each other.

Vehicular lamp 74C having the above structure, similar to the vehicle lamp 74A of the fifteenth embodiment operates as a light distribution variable type vehicle lamp.

Also, according to the vehicle lamp 74C of the present embodiment, by full lighting a first light source 14Lo and the second light source 14ADB of each vehicle lamp 74AL1~74AL4,74AR1~74AR4, as shown in FIG. 125, form each of the low-beam light distribution pattern PLo formed by the vehicle lamp 74AL1~74AL4,74AR1~74AR4 (PLo1~PLo8) and each of the lower end overlaps the upper end portion of the light distribution pattern PLo for low beam (PLo1~PLo8) in it is possible to form a plurality of ADB light distribution pattern PL1~PL4, PR1~light distribution pattern for high beam PR4 is superimposed which is arranged in the horizontal direction (combined light distribution pattern).

At that time, ADB light distribution pattern PL1~PL4, PR1~PR4 is, as close to the vertical line V, a long vertical dimension, and, bright is desirable. Thus, a light distribution pattern for high beam, shown in FIG. 125 (combined light distribution pattern), the center light intensity is relatively high, it can be made excellent in long-distance visibility. In addition, the vertical dimension of the ADB for the light distribution pattern PL1~PL4, PR1~PR4 is, the exit surface of the second lens body 66AL1~66AL4,66AR1~66AR4 that make up each of the vehicle lamp 74AL1~74AL4, 74AR1~74AR4 66Ab1 the size of the (in particular, the vertical dimension) can be individually adjusted by adjusting the. Further, ADB light distribution pattern PL1~PL4, PR1~brightness of PR4 can be individually adjusted by adjusting the current applied to each of the second light source 14ADB.

According to this embodiment, in addition to the effects of the fifteenth embodiment, further, it is possible to form a high beam distribution pattern (see FIG. 125).

Next, a modification will be described.

In the seventeenth vehicular lamp 74C embodiment, in place of the vehicular lamp 10 N (lens body 12N), the vehicle lamp 10 of the first embodiment shown in FIG. 1 (the lens body 12), first shown in FIG. 16 2 vehicle lamp 10A (lens body 12A) embodiment, the sixth vehicle lamp 10 J (lens body 12 J) of the embodiment shown in FIG. 39, a seventh embodiment of a vehicular lamp 10K (lens body 12K shown in FIG. 49), or may be used a conventional vehicle light 200 (the lens body 220) shown in FIG. 132 A. All of these, the first lower reflection surface 12 *b* (and shade 12*c*), extending incident surface 44*f* and focus F12A4 shade 12*c* vicinity (e.g., near the center in the lateral direction of the shade 12*c*) a first lens member 12N which is set to (lens 12A4) is from has a structure corresponding to each (or may be provided).

The present modification also, it is possible to achieve the same effect as the 17th embodiment.

Next, a description will be given vehicle lamp 74D of the eighteenth embodiment.

Vehicle lamp 74D of the present embodiment is configured as follows.

FIG. 126 is a schematic diagram showing the configuration of the vehicle lamp 74D of the present embodiment.

As shown in FIG. 126, the vehicle lamp 74D of the present embodiment, vehicle front left three vehicle lamp arranged in parallel 74DL1~74DL3, 3 one vehicle lamp which is arranged parallel to the vehicle front right 74DR1~74DR3 in automotive lamp provided with a, with light from each of the vehicular lamp 74DL1~74DL3, 74DR1~74DR3 is emitted forward, disposed directly facing a virtual vertical screen (approximately 25 m front from the vehicle front to the vehicle front and are) on the form the low-beam light distribution pattern PLo (PLo1~PLo6) and high-beam light distribution pattern PHi (PHi1~PHi6). Light distribution pattern PLo low-beam, low-beam light distribution pattern PLo1~PLo6 each of the vehicle lamp 74DL1~74DL3,74DR1~74DR3 form is formed as a synthetic light distribution pattern superimposed. Similarly, the light distribution pattern PHi for high beam, high-beam light distribution pattern PHi1~PHi6 each of the vehicle lamp 74DL1~74DL3,74DR1~74DR3 form is formed as a synthetic light distribution pattern superimposed. Light distribution patterns phi1~Phi6 for high beam, each lower end is arranged in a form overlapping the upper end portion of the light distribution pattern for low beam PLo (PLo1~PLo6). Thus, it is possible to suppress the discomfort that occurs when both the light distribution patterns are overlapped.

Three vehicle lighting device 74DR1~74DR3 which is arranged parallel to the vehicle front right side, a substantially identical configuration. Further, there is in substantially the same configuration symmetrical to the vehicle front right three of the vehicular lamp that is arranged in parallel 74DR1~74DR3 and the vehicle front left three vehicle lamp arranged in parallel 74DL1~74DL3.

Therefore, hereinafter, it will be mainly described vehicle lamp 74DR1 configured to form a light distribution pattern PLo4 and high-beam light distribution pattern for low beam PHi4.

Vehicle lamp 74DR1 of this embodiment, the fifteenth size of the exit surface 66Ab1 of the second lens body 66AR1 constituting the vehicle lamp 74AR1 embodiments (and/or prolong the incident surface 44*f*) (in particular, the horizontal dimension) the equivalent to those with a size suitable for a light distribution pattern for high beam.

When comparing the vehicle lamp 74AR1 vehicle lamp 74DR1 and the fifteenth embodiment of the present embodiment, it is mainly different in the following points. Hereinafter, it omitted the fifteenth focuses on the differences from the vehicle lamp 74AR1 embodiment, a description thereof will be denoted by the same reference numerals are given to the same configuration as the vehicle lamp 74AR1 the fifteenth embodiment.

First, the vehicle lamp 74AR1 of the fifteenth embodiment, to form the low beam light distribution pattern PLo4 and ADB light distribution pattern PR1 for (FIG. 113 see) the vehicle lighting device of the present embodiment 74DR1 It is, to form a light distribution pattern PLo4 and high-beam light distribution pattern PHi4 for low beam (see FIG. 126) points.

Secondly, in the above-described vehicle lamp 74AR1 of the fifteenth embodiment, the size of the exit surface 66Ab1 of the second lens body 66AR1 constituting the vehicular lamp 74AR1 (and/or prolong the incident surface 44*f*) (in particular, the horizontal direction dimensions L1. FIG. 117) is, for example G is a size suitable for a light distribution pattern for ADB, in the vehicle lamp 74DR1 of the present embodiment, emission of the second lens body 66AR1 constituting the vehicle lamp 74DR1 the size of the surface 66Ab1 (and/or prolong the incident surface 44*f*) (in particular, the horizontal dimension L2. FIG. 127 A), it is a size suitable for a light distribution pattern for high beam (L2>L1) points.

Thirdly, in the above-described vehicle lamp 74AR1 of the fifteenth embodiment, the second outer shape of the exit surface 66Ab1 of the lens body 66AR1 is above the reflecting surface 66*c* shade 66*e* and the longitudinal reflecting surface 66*d* constituting the vehicle lamp 74AR1 includes a shade 66*f* (see FIG. 117) result, cut-off line CL66*e* the ADB light distribution pattern PR1 is defined by the shade 66*f* shade 66*e* and the longitudinal reflecting surface 66*d* of the on the reflecting surface 66*c*, including CL66*f* (FIG. 113 whereas the reference) shall, in the vehicle lamp 74DR1 of the present embodiment, the outer shape of the exit surface 66Ab1 of the second lens body 66AR1 constituting the vehicle lamp 74DR1 includes shade 66*e* of the upper reflection surface 66*c* but not including the shade 66*f* longitudinal reflecting surface 66*d* (see FIG. 127 A) results, including the cut-off line CL66*e* the high beam light distribution pattern PHi4 is defined by the shade 66*e* of the on the reflecting surface 66*c*, the vertical reflection It does not include a cut-off line CL66*f* which is defined by the shade 66*f* of the surface 66*d* (see FIG. 126) shall become point.

In the second lens body 66AR1 of the present embodiment, light from the second light source 14Hi incident from the first incident surface 66*a*1 inside the second lens body 66AR1, and, from the second entrance surface 66*a*2 inside the second lens body 66AR1 internal reflection at the reflective surface 66*a*3 is incident (total reflection) has been internally reflected by the partial blocking light and upper reflection surface 66*c* by the shade 66*e* of the inner on the reflective surface 66*c* of the light from the second light source 14Hi (total reflection) the light is emitted from the exit surface 66Ab1 of the second lens body 66AR1. At that time, the light emitted from the emitting surface 66Ab1 of the second lens body 66AR1, intensity distribution on the exit surface 66Ab1 of the second lens body 66AR1 (light source image) is formed.

The second lens body luminous intensity distribution formed on the exit surface 66Ab1 of 66AR1 (light source image), the focal F12A4 shade 12*c* vicinity (e.g., near the center in the lateral direction of the shade 12*c*) a first lens member 12N which is set to (lens 12A4), i.e., an intermediate exit face (first output surface 12A1*a*), by the action of an intermediate incidence surface (second incident surface 12A2*a*) and final output surface (second output surface 12A2*b*), are inverted projection, the virtual vertical screen above, to form a high beam light distribution pattern PHi4 shown in FIG. 126.

The vehicular lamp 74DR1 the above structure, on a virtual vertical screen, the light distribution pattern PLo4 and high-beam light distribution pattern for low beam PHi4 shown in FIG. 126 is formed.

High-beam light distribution pattern PHi4, as shown in FIG. 126, the lower end portion is arranged in a form overlapping the upper end portion of the light distribution pattern for low beam PLo. This portion of the light from the second light source 14Hi emitted from the emitting surface 66Ab1 of the second lens body 66AR1 is, from the shade 12*c* near the region 12*b*1 of the first lower reflection surface 12*b* of the first lower reflection surface 12*b* enters the inside the first lens element 12N, is by passing above the focal F12A4 of the first lens body 12N (lens 12A4).

Above, as has been described vehicle lamp 74DR1 configured to form a light distribution pattern PLo4 and high-beam light distribution pattern PHi4 for low beam, forming the light distribution pattern PLo5 and high-beam light distribution pattern PHi5 low beam configured vehicular lamp 74DR2, as well as the vehicle lamp 74DR3 configured to form a light distribution pattern PLo6 and high-beam light distribution pattern PHi6 for low beam also be configured in the same manner as in the above vehicle lamp 74DR1 can.

The vehicle that is configured to form the configured vehicle lamp 74DL1, light distribution pattern for low beam PLo2 and high-beam light distribution pattern PHi2 so as to form a light distribution pattern PLo1 and high-beam light distribution pattern PHi1 low beam use lamp 74DL2, as well as the vehicle lamp 74DL3 configured to form a light distribution pattern PLo3 and high-beam light distribution pattern PHi3 for low beam can also be configured in the same manner as in the above vehicular lamp 74DR1.

According to this embodiment, in addition to the effects of the eighth embodiment, further, it can achieve the following effects.

That is, a light distribution pattern for low beam (for example, a light distribution pattern PLo4 low beam) and its lower end is a light distribution pattern for low beam (for example, the light distribution pattern for PLo4 low beam) distribution for high beam, which is arranged in a form overlapping the upper end portion of the light pattern (e.g., high-beam light distribution pattern phi4) it is possible to downsize the configured vehicle lamp so as to form a (e.g., a vehicle lamp 74DR1).

This forms a light distribution pattern for low beam (for example, the light distribution pattern for PLo4 low beam) light forming the (light from the first light source 14Lo) and high beam distribution pattern (e.g., a light distribution pattern for high beam phi4) optical front end 12A2*bb* (second output surface rather than exiting from separate lens body are arranged in parallel in a front view (the second light source light from 14Hi), the first lens element 10N are the same lens body it is due to be emitted from the 12A2*b*).

The second lens member (e.g., the second lens body 66AR1) emitting surface 66Ab1 light from the second light source 14Hi emitted from the extension incident surface 44*f* and the first lower reflection surface of the first lower reflection surface 12*b* of the from 12*b* of the shade 12*c* vicinity of the area 12*b*1 so as to enter inside the first lens body 12N, the second lens body (for example, the second lens body 66AR1) by placing in the vicinity of the extension incident surface 44*f* the exit surface 66Ab1 of, can be a lower end portion forms a light distribution pattern for low beam (for example, the light distribution pattern for PLo4 low beam) high-beam light distribution pattern which is arranged in a form overlapping the upper end portion of the (e.g., a light distribution pattern for high beam phi4).

Further, by the action of the upper reflection surface 66*c*, it is possible to achieve the following effects.

First, it is possible to form a high beam distribution pattern (e.g., a light distribution pattern for high beam phi4) including the lower cutoff line CL66*e* defined by the shade 66*e* of the upper reflection surface 66*c* to the lower edge.

Second, high beam distribution pattern (e.g., high-beam light distribution pattern phi4) can be a lower cut-off line CL66*e* formed at the lower end edge of those clear.

Third, high beam distribution pattern (e.g., the light distribution pattern for PHi4 high beam) unnecessary extent as, i.e., to prevent the light from the second light source 14Hi are light distribution below the lower cut-off line CL66*e* can.

Fourth, assembly due to the effect of error or the like, the second lens element relative to the second light source 14Hi (e.g., the second lens body 66AR1) as the relative positional relationship of deviating from the design value, the light distribution pattern for high beam (for example, it is possible to suppress the deviation is below the cutoff line CL66*e* of the high beam light distribution pattern phi4).

In addition, the second lens body (for example, the second lens body 66AR1) by adjusting the surface shape of the area 66Ab2 of shade 66*e* vicinity of out on the reflective surface 66*c* of the exit surface 66Ab1 of, the low-beam light distribution pattern (for example, low beam use light distribution pattern PLo4) and high beam light distribution pattern (for example, a light distribution pattern for high beam PHi4) and there is no sense of incongruity (naturally) it can be visually recognized as being connected.

The second lens body 66A constituting the vehicle lamp 74D (e.g., the second lens body 66AR1 constituting the vehicle lamp 74DR1) outer shape of the exit surface 66Ab1 of, as shown in FIG. 127 B, the upper reflection may be a circular or elliptical shape does not include the shade 66*f* shade 66*e* and the longitudinal reflecting surface 66*d* of the surface 66*c*, as shown in FIG. 127 C, the shade of the upper reflection surface 66*c* 66*e* and the longitudinal reflecting surface 66*d* it may be a rectangular shape including a shade 66*f*, may be any other shape.

Next, a modification will be described.

In the eighteenth vehicle lamp 74D of the embodiment, in place of the vehicular lamp 10 N (lens body 12N), the vehicle lamp 10 of the first embodiment shown in FIG. 1 (the lens body 12), first shown in FIG. 16 2 vehicle lamp 10A (lens body 12A) embodiment, the sixth vehicle lamp 10 J (lens body 12 J) of the embodiment shown in FIG. 39, a seventh embodiment of a vehicular lamp 10K (lens body 12K shown in FIG. 49), or may be used a conventional vehicle light 200 (the lens body 220) shown in FIG. 132 A. All of these, the first lower reflection surface 12 *b* (and shade 12*c*), extending incident surface 44*f* and focus F12A4 shade 12*c* vicinity (e.g., near the center in the lateral direction of the shade 12*c*) a first lens member 12N which is set to (lens 12A4) is from has a structure corresponding to each (or may be provided).

The present modification also, it is possible to achieve the same effect as the 18th embodiment.

Each numerical values shown in the above embodiments and modifications are merely examples all can be used and different appropriate values.

The above-described embodiments are merely illustrative in all respects. The present invention by these descriptions is not intended to be interpreted restrictively. The present invention may be embodied in other various forms without departing from its spirit or essential characteristics.

REFERENCE SIGNS LIST

10,10A~10N . . . vehicle lamp, 12,12A, 12J, 12N . . . lens body, 12A1 . . . first lens unit, 12A1*a* . . . first output surface, 12A1*aa* . . . first rear end portion,

12A1*bb* . . . first front end, 12A2 . . . the second lens unit, 12A2*a* . . . the second incident surface, 12A2*aa* . . . the second rear end, 12A2*b* . . . the second exit surface, 12A3 . . . connecting portion, 12*a* . . . the first incident surface, 12*b* . . . reflective surface (lower reflective surface), 12*c* . . . shade, 12*d* . . . emitting surface, 14 . . . light source, 16,16C . . . lens conjugate, 18 . . . holding member, 42*a*, 42*b* . . . left and right pair of the incident surface, 42*c* . . . on the plane of incidence, 44*a*, 44*b* . . . a pair of left and right side, 44*c* . . . top surface, 44*c*1 . . . reflecting surface for overhead sign, 44*c*2 . . . upper left surface, 44*c*3 . . . right top surface, 46*a*, 46*b* . . . left and right pair of the exit surface

What is claimed is:

1. A lens body, comprising:

a first lens unit configured to form a first light distribution pattern which includes a first cut-off line; and a second lens unit configured to form a second light distribution pattern which includes a second cut-off line, wherein the first lens unit is a lens unit which is disposed in front of a first light source, and is configured as a lens unit which includes a rear end portion and a front end portion, and forms the first light distribution pattern which includes the first cut-off line when light from the first light source which entered the first lens unit is emitted from the front end portion of the first lens unit and is irradiated forward, the second lens unit is a lens unit which is disposed in front of a second light source, and is configured as a lens unit which includes a rear end portion and a front end portion, and forms the second light distribution pattern which includes the second cut-off line when light from the second light source which entered the second lens unit is emitted from the front end portion of the second lens unit and is irradiated forward, the first lens unit and the second lens unit are integrally molded so that the relative positional relationship between the first light distribution pattern and the second light distribution pattern becomes a predetermined positional relationship, the first light distribution pattern is a low beam light distribution pattern, an upper end edge of which includes the first cut-off line, and the second light distribution pattern is an Adaptive Driving Beam (ADB) light distribution pattern which includes the second cut-off line, the second lens unit includes an upper reflection surface and a vertical reflection surface, which are disposed between the rear end portion and the front end portion thereof, the rear end portion of the second lens unit includes an entrance portion through which the light from the second light source enters the second lens unit, a tip portion of the upper reflection surface and a tip portion of the vertical reflection surface each include a shade, the entrance portion, the upper reflection surface, the vertical reflection surface, and the front end portion of the second lens unit constitute an optical system configured to form the ADB light distribution pattern which includes, on the lower edge and on one side edge thereof, the second cut-off line specified by the shade of the upper reflection surface and the shade of the vertical reflection surface, when light partially shielded by the shade of the upper reflection surface and the shade of the vertical reflection surface and light internally reflected by the upper reflection surface and the vertical reflection surface, out of the light from the second light source which entered the second lens unit through the entrance portion, are emitted from the front end portion of the second lens unit and are irradiated forward.

2. The lens body according to claim 1, wherein the first lens unit includes a lower reflection surface disposed between the rear end portion and the front end portion thereof, the rear end portion of the first lens unit includes an entrance surface, a tip portion of the lower reflection surface includes a shade, the entrance surface, the lower reflection surface and the front end portion of the first lens unit constitute an optical system configured to form the first light distribution pattern which includes, on the upper edge thereof, the first cut-off line specified by the shade of the lower reflection surface, when light partially shielded by the shade of the lower reflection surface, and light internally reflected by the lower reflection surface, out of the light from the first light source which entered the first lens unit through the entrance surface, are emitted from the front end portion of the first lens unit and are irradiated forward.

3. A vehicular lighting fixture comprising the lens body according to claim 2, the first light source, and the second light source.

4. The lens body according to claim 1, wherein the first lens unit includes a lower reflection surface disposed between the rear end portion and the front end portion thereof, the rear end portion of the first lens unit includes an entrance surface, a tip portion of the lower reflection surface includes a shade, the front end portion of the first lens unit includes an intermediate emission surface, an intermediate entrance surface disposed in front of the intermediate emission surface, and a final emission surface disposed in front of the intermediate entrance surface, the intermediate emission surface includes a first semi-cylindrical surface, the cylindrical axis of which extends in a vertical direction or in an approximately vertical direction, the final emission surface is configured as a second semi-cylindrical surface, the cylindrical axis of which extends in a horizontal direction, or a second semi-cylindrical surface to which a slant angle or a camber angle is given, and the entrance surface, the lower reflection surface, the first semi-cylindrical surface, the intermediate entrance surface and the final emission surface constitute an optical system configured to form the first light distribution pattern which includes, on the upper edge thereof, the first cut-off line specified by the shade of the lower reflection surface, when light partially shielded by the shade of the lower reflection surface and light internally reflected by the lower reflection surface, out of the light from the first light source which entered the first lens unit through the entrance surface, are emitted outside the first lens unit through the first semi-cylindrical surface, enter the first lens unit through the intermediate entrance surface, are emitted from the final emission surface and are irradiated forward.

5. A vehicular lighting fixture comprising the lens body according to claim 4, the first light source, and the second light source.

6. The lens body according to claim 1, wherein the first lens unit includes a first lower reflection surface disposed between the rear end portion and the front end portion thereof, the rear end portion of the first lens unit includes a first entrance surface, a tip portion of the first lower reflection surface includes a shade, the front end portion of the first lens unit includes an intermediate emission surface, an intermediate entrance surface disposed in front of the intermediate emission surface, and a final emission surface disposed in front of the intermediate entrance surface, the intermediate emission surface includes a first semi-cylindrical surface, the cylindrical axis of which extends in a vertical direction or in an approximately vertical direction, and a left-right pair of intermediate emission surfaces disposed on the left and right sides of the first semi-cylindrical surface, the final emission surface is configured as a second semi-cylindrical surface, the cylindrical axis of which extends in a horizontal direction, or a second semi-cylindrical surface to which a slant angle or a camber angle is given, the first entrance surface, the first lower reflection surface, the first semi-cylindrical surface, the intermediate entrance surface, and the final emission surface constitute a first optical system configured to form a first partial light distribution pattern which includes, on the upper edge, the first cut-off line specified by the shade of the first lower reflection surface, when light partially shielded by the shade of the first lower reflection surface and light internally reflected by the first lower reflection surface, out of the light from the first light source which entered the first lens unit through the first entrance surface, are emitted outside the first lens unit through the first semi-cylindrical surface, enter the first lens unit through the intermediate entrance surface, are emitted from the final emission surface and are irradiated forward, the first lens unit further includes a left-right pair of side surfaces disposed between the rear end portion and the front end portion thereof, the rear end portion of the first lens unit includes a left-right pair of entrance surfaces disposed on the left and right sides of the first entrance surface so as to surround a space between the first light source and the first entrance surface from the left and right sides, the first lens unit includes a left-right pair of second lower reflection surfaces disposed between the rear end portion of the first lens unit and the front end portion of the first lens unit, and on the left and right sides of the first lower reflection surface, a tip portion of the left-right pair of the second lower reflection surfaces includes a shade, the left-right pair of entrance surfaces, the left-right pair of side surfaces, the left-right pair of second lower reflection surfaces, the left-right pair of intermediate emission surfaces, the intermediate entrance surface and the final emission surface constitute a left-right pair of second optical systems configured to form a second partial light distribution pattern which includes, on the upper edge thereof, the first cut-off line specified by the shades of the left-right pair of second lower reflection surfaces, when light partially shielded by the shades of the left-right pair of second lower reflection surfaces and light internally reflected by the left-right pair of second lower reflection surfaces, out of the light from the first light source which entered the first lens unit through the left-right pair of entrance surfaces and are internally reflected by the left-right pair of side surfaces, are emitted outside the first lens unit through the left-right pair of intermediate emission surfaces, enter the first lens unit through the intermediate entrance surface, are emitted from the final emission surface and are irradiated forward.

7. The lens body according to claim 6, wherein the rear end portion of the first lens unit includes an upper entrance surface disposed above the first entrance surface so as to surround a space between the first light source and the first entrance surface from above.

8. A vehicular lighting fixture comprising the lens body according to claim 7, the first light source, and the second light source.

9. A vehicular lighting fixture comprising the lens body according to claim 6, the first light source, and the second light source.

10. A vehicular lighting fixture comprising the lens body according to claim 1, the first light source, and the second light source.

11. A vehicular lighting fixture comprising the lens body according to claim 1.

12. A lens body disposed in front of a light source, including a rear end portion and a front end portion, and configured to form an Adaptive Driving Beam (ADB) light distribution pattern which includes a cut-off line when light from the light source which entered the lens body is emitted from the front end portion and is irradiated forward, lens body comprising:

an upper reflection surface and a vertical reflection surface disposed between the rear end portion and the front end portion of the lens body, wherein the rear portion includes an entrance portion through which the light from the light source enters the lens body, a tip portion of the upper reflection surface and a tip portion of the vertical reflection surface each include a shade, and the entrance portion, the upper reflection surface, the vertical reflection surface and the front end portion constitute an optical system configured to form the ADB light distribution pattern which includes, on the lower edge and on one side edge thereof, the cut-off line specified by the shade of the upper reflection surface and the shade of the vertical reflection surface, when light partially shielded by the shade of the upper reflection surface and the shade of the vertical reflection surface and light internally reflected by the upper reflection surface and the vertical reflection surface, out of the light from the light source which entered the lens body through the entrance surface, are emitted through the front end portions and are irradiated forward.

13. A vehicular lighting fixture comprising the lens body according to claim 12, and the light source.

14. A vehicular lighting fixture comprising the lens body according to claim 12.

* * * * *